US009177518B2

(12) United States Patent
Gondo

(10) Patent No.: US 9,177,518 B2
(45) Date of Patent: Nov. 3, 2015

(54) LIQUID CRYSTAL DISPLAY DEVICE, DRIVING DEVICE FOR LIQUID CRYSTAL DISPLAY PANEL, AND LIQUID CRYSTAL DISPLAY PANEL

(71) Applicant: KYOCERA DISPLAY CORPORATION, Yasu-shi (JP)

(72) Inventor: Kenji Gondo, Arakawa-ku (JP)

(73) Assignee: KYOCERA DISPLAY CORPORATION, Yasu-shi (JP)

( * ) Notice: Subject to any disclaimer, the term of this patent is extended or adjusted under 35 U.S.C. 154(b) by 0 days.

(21) Appl. No.: 14/454,387

(22) Filed: Aug. 7, 2014

(65) Prior Publication Data

US 2015/0035740 A1 Feb. 5, 2015

Related U.S. Application Data

(62) Division of application No. 12/903,569, filed on Oct. 13, 2010.

(30) Foreign Application Priority Data

Oct. 23, 2009 (JP) ..... 2009-244732
Jul. 7, 2010 (JP) ..... 2010-154897

(51) Int. Cl.
*G09G 3/36* (2006.01)

(52) U.S. Cl.
CPC ..... *G09G 3/3614* (2013.01); *G09G 3/3648* (2013.01); *G09G 3/3688* (2013.01); *G09G 2300/0426* (2013.01);
(Continued)

(58) Field of Classification Search
None
See application file for complete search history.

(56) References Cited

U.S. PATENT DOCUMENTS 5,796,379 A * 8/1998 Enomoto et al. ..... 345/89
2003/0197672 A1* 10/2003 Yun et al. ..... 345/99
(Continued)

FOREIGN PATENT DOCUMENTS

EP 1 962 270 A1 8/2008
GB 2 383 462 A 6/2003
(Continued)

OTHER PUBLICATIONS

Office Action issued Jul. 1, 2014 in Japanese Patent Application No. 2010-154897 (with English language translation).
(Continued)

*Primary Examiner* — Yong H Sim
(74) *Attorney, Agent, or Firm* — Oblon, McClelland, Maier & Neustadt, L.L.P.

(57) ABSTRACT

Pixel electrodes in odd-numbered rows and even-numbered rows of a liquid crystal display panel are connected to source lines arranged on the left side of the pixel electrodes and source lines on the right side of the pixel electrodes, respectively. A DA converter switches between whether a potential higher than a common electrode potential is output from an odd-numbered output terminal and a potential lower than the common electrode potential is output from an even-numbered potential output terminal, and whether a potential lower than the common electrode potential is output from the odd-numbered potential output terminal and a potential higher than the common electrode potential is output from the even-numbered potential output terminal. A switch mechanism switches between whether a pixel electrode potential is set using the source line on the left side or is set using the source line on the right side.

7 Claims, 51 Drawing Sheets

(52) U.S. Cl.
CPC ..... *G09G 2310/0286* (2013.01); *G09G 2310/0289* (2013.01); *G09G 2310/0291* (2013.01); *G09G 2310/0297* (2013.01); *G09G 2320/0219* (2013.01)

(56) References Cited

U.S. PATENT DOCUMENTS

| | | | |
|---|---|---|---|
| 2006/0232539 | A1 | 10/2006 | Hashimoto |
| 2007/0013639 | A1 | 1/2007 | Lin et al. |
| 2009/0195492 | A1 | 8/2009 | Takahashi |
| 2010/0164925 | A1 | 7/2010 | Weng |

FOREIGN PATENT DOCUMENTS

| | | | |
|---|---|---|---|
| JP | 2004-037905 | A | 2/2004 |
| JP | 2006-71891 | | 3/2006 |
| JP | 2007-272203 | A | 10/2007 |
| JP | 2008-292837 | A | 12/2008 |
| JP | 2009-044438 | A | 2/2009 |
| JP | 2009-181100 | | 8/2009 |
| JP | 2009-186911 | A | 8/2009 |

OTHER PUBLICATIONS

Extended European Search Report issued Sep. 5, 2012, in European Patent Application No. 10013857.7.

Extended European Search Report issued May 7, 2015 in Patent Application No. 13000960.8.

* cited by examiner

Fig. 11

| | | | | | | | |
|---|---|---|---|---|---|---|---|
| ODD-NUMBERED ROW | + | − | + | − | + | − | ··· |
| EVEN-NUMBERED ROW | − | + | − | + | − | + | ··· |

Fig. 15

| | | | | | | | |
|---|---|---|---|---|---|---|---|
| ODD-NUMBERED ROW | − | + | − | + | − | + | ··· |
| EVEN-NUMBERED ROW | + | − | + | − | + | − | ··· |

Fig. 19

| | | | | | | | |
|---|---|---|---|---|---|---|---|
| ODD-NUMBERED GROUP | + | − | + | − | + | − | ··· |
| | + | − | + | − | + | − | ··· |
| EVEN-NUMBERED GROUP | − | + | − | + | − | + | ··· |
| | − | + | − | + | − | + | ··· |

Fig. 21

| | | | | | | | |
|---|---|---|---|---|---|---|---|
| ODD-NUMBERED GROUP | − | + | − | + | − | + | ··· |
| | − | + | − | + | − | + | ··· |
| EVEN-NUMBERED GROUP | + | − | + | − | + | − | ··· |
| | + | − | + | − | + | − | ··· |

Fig. 26

(a)

| | | | | | | | | | | | |
|---|---|---|---|---|---|---|---|---|---|---|---|
| R | G | B | R | G | B | R | G | B | R | G | B |
| R | G | B | R | G | B | R | G | B | R | G | B |
| R | G | B | R | G | B | R | G | B | R | G | B |

(b)

| | | | |
|---|---|---|---|
| R | R | R | R |
| G | G | G | G |
| B | B | B | B |
| R | R | R | R |
| G | G | G | G |
| B | B | B | B |
| R | R | R | R |
| G | G | G | G |
| B | B | B | B |

FROM LEVEL SHIFTER 35, FIG.32A
36
D/A CONVERTER
37
VOLTAGE FOLLOWER
2b
V0~V8, V9~V17
POL1
G1
G2
G3
Gi
22
21

Fig. 41

ORDER OF INPUT OF DATA →

(a) $(R_1 \quad G_1 \quad B_1), (R_2 \quad G_2 \quad B_2), \cdots$ (b) $R_{1+} \quad G_{1-} \quad B_{1+} \quad R_{2-} \quad G_{2+} \quad B_{2-} \cdots$ (c) $R_{1+} \quad B_{1+} \quad G_{2+} \cdots$ (d) $G_{1-} \quad R_{2-} \quad B_{2-} \cdots$

LIQUID CRYSTAL DISPLAY DEVICE, DRIVING DEVICE FOR LIQUID CRYSTAL DISPLAY PANEL, AND LIQUID CRYSTAL DISPLAY PANEL

CROSS-REFERENCE TO RELATED APPLICATIONS

The present application is a divisional of U.S. application Ser. No. 12/903,569, filed on Oct. 13, 2010, and claims priority to JP 2009-244732 filed Oct. 23, 2009 and JP 2010-154897 filed Jul. 7, 2010, the entire contents of each of which are incorporated herein by reference.

TECHNICAL FIELD

The present invention relates to a liquid crystal display device, a driving device for a liquid crystal display panel and the liquid crystal display panel, and particularly to an active matrix liquid crystal display device, a driving device for a liquid crystal display panel and the liquid crystal display panel.

BACKGROUND ART

An active matrix liquid crystal display device is configured to sandwich liquid crystal between a common electrode and multiple pixel electrodes. Then, an active element such as a TFT (Thin Film Transistor) is provided for each pixel electrode, and use of the active element enables control of whether the voltage of source wiring should be set for the pixel electrode.

The common electrode is set to a predetermined potential, and each pixel electrode is set to a potential corresponding to each pixel value of an image to be displayed. Here, a state where the potential of the pixel electrode is higher than the potential of the common electrode is referred to as positive polarity. On the other hand, a state where the potential of the pixel electrode is lower than the potential of the common electrode is referred to as negative polarity.

FIG. 39 is an illustrative diagram showing an example of the potential of the common electrode and potentials for setting pixels to white or black at each polarity. Here, a description will be made by taking normally white mode as an example. The potential of the common electrode is denoted as $V_{COM}$. $V_{pb}$, $V_{pw}$, $V_{COM}$, $V_{nw}$ and $V_{nb}$ shown in FIG. 39 represent potentials, respectively, where $V_{nb}<V_{nw}<V_{COM}<V_{pw}<V_{pb}$. When pixels are to be displayed in black at the positive polarity, the potential of source lines connected to the pixels may be set to $V_{pb}$, while when the pixels are to be displayed in white at the positive polarity, the potential of the source lines connected to the pixels may be set to $V_{pw}$. Further, when the pixels to be displayed are set to gray scale display at the positive polarity, the potential of the source lines connected to the pixels may be set to a potential higher than $V_{pw}$ and lower than $V_{pb}$. On the other hand, when the pixels are to be displayed in black at the negative polarity, the potential of the source lines connected to the pixels may be set to $V_{nb}$, while when the pixels are to be displayed in white at the negative polarity, the potential of the source lines connected to the pixels may be set to $V_{nw}$. Further, when the pixels to be displayed is set to gray scale display at the negative polarity, the potential of the source lines connected to the pixels may be set to a potential lower than $V_{nw}$ and higher than $V_{nb}$.

In an active matrix liquid crystal display device, it is preferred to drive pixels in such a manner that few pixels having the same polarity will be disposed side by side in succession to prevent crosstalk. FIG. 40 is an illustrative diagram showing a typical liquid crystal display device. As shown in FIG. 40, pixel electrodes 50 are arranged in a matrix, and a TFT 51 is provided for each pixel electrode. In FIG. 40, pixels for red are denoted as "R," pixels for green are denoted as "G," and pixels for blue are denoted as "B."

As shown in FIG. 40, a source driver 60 is provided to set the potential of each of source lines $S_1$ to $S_n$, and each source line is connected to each of output terminals $D_1$ to $D_n$ of the source driver 60. In the example shown in FIG. 40, each TFT 51 is provided on the left side of the pixel electrode 50, and connected to the source line located on the left side of the pixel electrode 50. Further, gate lines $G_1$, $G_2$, $G_3$, . . . are provided for each row of pixels, and each gate line is connected to the TFT 51 of the pixel electrode in the row. The gate lines are selected sequentially and the TFTs 51 in the selected row put the pixel electrodes 50 and the source lines into a conductive state. As a result, the pixel electrodes 50 in the selected row are controlled to have potentials equal to the potentials of the source lines located on the left side of the pixel electrodes, respectively. On the other hand, the TFTs 51 in the unselected rows put the pixel electrodes 50 and the source lines into a non-conductive state. Thus, the gate lines are selected sequentially, and the source driver 60 sets the potential of each source line to a potential corresponding to the pixel value of each pixel in the selected row to display an image according to image data.

For example, in the typical liquid crystal display device shown in FIG. 40, the source driver 60 controls adjacent pixels to have different polarities as follows: Upon selection of gate lines in an odd-numbered row in certain one frame, the source driver 60 sets the potentials of source lines $S_1$, $S_3$, $S_5$, . . . in an odd-numbered column higher than the potential $V_{COM}$ of the common electrode (not shown), and sets the potentials of source lines $S_2$, $S_4$, $S_6$, . . . in even-numbered columns lower than $V_{COM}$. Upon selection of gate lines in an even-numbered row, the source driver 60 sets the potentials of source lines $S_1$, $S_3$, $S_5$, . . . in the odd-numbered columns lower than $V_{COM}$, and sets the potentials of source lines $S_2$, $S_4$, $S_6$, . . . in the even-numbered columns higher than $V_{COM}$. As a result, as shown in FIG. 40, adjacent pixels are controlled to alternate the positive polarity and the negative polarity. In FIG. 40, "+" represents the positive polarity and "−" represents the negative polarity.

Further, the source driver 60 changes the potentials of the source lines to reverse the polarity of each pixel each time the frame is switched. In other words, upon selection of gate lines in an odd-numbered row in the next frame that follows the above-mentioned frame, the source driver 60 sets the potentials of source lines in the odd-numbered columns lower than $V_{COM}$, and sets the potentials of source lines in the even-numbered columns higher than $V_{COM}$. On the other hand, upon selection of gate lines in an even-numbered row, the source driver 60 sets the potentials of source lines in the odd-numbered columns higher than $V_{COM}$, and sets the potentials of source lines in the even-numbered columns lower than $V_{COM}$. As a result, the polarity of each pixel becomes opposite to the polarity of each pixel shown in FIG. 40.

In this driving method, each time the selected row is switched to another, the potential of each source line is changed from a potential higher than $V_{COM}$ to a potential lower than $V_{COM}$, or from the potential lower than $V_{COM}$ to the potential higher than $V_{COM}$. This increases power requirements. Particularly, since the power consumption of a liquid crystal display panel is proportional to the square of a difference between the potentials of the source line upon switching between selected rows, the power consumption increases as the number of times of switching the potential of the source line increases.

There is proposed a liquid crystal display device capable of controlling adjacent pixels to have different polarities while reducing power consumption (see Paragraph Nos. 0008 to 0018 and FIGS. 1 to 6 in Japanese Patent Application Publication (JP-P2009-181100A)). In the liquid crystal display device described in JP-P2009-181100A, TFTs connected to gate lines in an odd-numbered row are formed on the left side of source lines, and TFTs connected to gate lines in an even-numbered row are formed on the right side of source lines. This structure can prevent a change in the potential of each source line from a potential higher than $V_{COM}$ to a potential lower than $V_{COM}$, or from a potential lower than $V_{COM}$ to a potential higher than $V_{COM}$ during each selection period.

The liquid crystal display device described in JP-P2009-181100A also includes a distribution transistor for switching the source lines to be connected to the TFTs to switch the output of a driver circuit among multiple source lines within one row selection period. For example, one of output terminals of the driver circuit is switched sequentially to the leftmost source line, the third source line from the left, the fifth source line from the left and so on within one row selection period. Similarly, another output terminal is switched sequentially to the second source line from the left, the fourth source line from the left, the sixth source line from the left, and so on within the selection period.

Further, a liquid crystal display device configured to switch between sampling timings of sampling and latching serially input image data per horizontal scanning period is described on the first page of Japanese Patent Application Publication (JP-P2006-71891A) and the like.

In the liquid crystal display device described in JP-P2009-181100A, one of the output terminals of the driver circuit is switched sequentially to the leftmost source line, the third source line from the left, the fifth source line from the left and so on within one row selection period. Similarly, another output terminal is also switched sequentially to the second source line from the left, the fourth source line from the left, the sixth source line from the left and so on within the selection period. Therefore, input data for respective pixels have to be output while changing the order of input of the data. FIG. 41 is an illustrative diagram showing switching between data sequences in a driving method for the liquid crystal display device described in JP-P2009-181100A. It is assumed here that pixels in each row are disposed in the following order: R, G, B, R, G, B, . . . .

For example, suppose that data on respective pixels are input as shown in FIG. 41(*a*) as data on respective pixels in the first row in the following order: ($R_1$, $G_1$, $B_1$), ($R_2$, $G_2$, $B_2$), . . . . Since potentials are so set that the polarities of adjacent pixels are switched alternately, it is assumed that output potentials $R_{1+}$, $G_{1-}$, $B_{1+}$, $R_{2-}$, $G_{2+}$, $B_{2-}$, . . . are defined in response to $R_1$, $G_1$, $B_1$, $R_2$, $G_2$, $B_2$, . . . (see FIG. 41(*b*)). Note that "+" represents a potential higher than $V_{COM}$ and "−" represents a potential lower than $V_{COM}$.

In the liquid crystal display device described in JP-P2009-181100A, one of the output terminals of the driver circuit first outputs $R_{1+}$ within the selection period of the first row, and the output terminal is connected to the leftmost source line at this time. Next, the output terminal outputs $B_{1+}$ within the selection period, and is connected to the third source line from the left. Further, the output terminal outputs $G_{2+}$ within the selection period, and is connected to the fifth source line from the left. Thus, this output terminal outputs data within one selection period as shown in FIG. 41 (*c*) in the following order: $R_{1+}$, $B_{1+}$, $G_{2+}$, . . . . Another output terminal first outputs $G_{1-}$ within the selection period of the first row, and the output terminal is connected to the second source line from the left at this time. Next, the output terminal outputs $R_{2-}$ within the selection period, and is connected to the fourth source line from the left. Further, the output terminal outputs $B_{2-}$ within the selection period, and is connected to the sixth source line from the left. Thus, this output terminal outputs data within one selection period as shown in FIG. 41 (*d*) in the following order: $G_{1-}$, $R_{2-}$, $B_{2-}$, . . . . Since the order of signal output does not correspond to the order of input as $R_1$, $G_1$, $B_1$, $R_2$, $G_2$, $B_2$, . . . , the order of output must be changed in the driver circuit, resulting in complicated data output control because of the need to change the order of data.

Further, since each output terminal has to set the potentials of multiple pixel electrodes within one selection period, there is a possibility that a medium- or large-sized liquid crystal display panel with a large number of pixels may not be able to set a potential necessary for each pixel electrode.

SUMMARY

It is a general object of the present invention to provide a liquid crystal display device capable of driving pixels in such a manner to reduce the number of pixels having the same polarity and appearing consecutively while reducing power consumption without the need to change the order of output of potentials corresponding to image data from the order of input of image data, and a driving device for a liquid crystal display panel employed in the liquid crystal display device and the liquid crystal display panel.

According to an exemplary aspect of the invention, a liquid crystal display device includes; an active matrix liquid crystal display panel; and a driving device (e.g., driving device 1) for driving the liquid crystal display panel, wherein the liquid crystal display panel includes: a common electrode; a plurality of pixel electrodes arranged in a matrix; and source lines provided on the left side of pixel electrodes in each column of pixel electrodes and on the right side of the rightmost column of pixel electrodes, wherein when every row or every two or more consecutive rows of pixel electrodes are set as one group, a pixel electrode in each row of an odd-numbered group is connected to a source line on a predetermined side (e.g., left side) among source lines existing on both sides of the pixel electrode, and a pixel electrode in each row of an even-numbered group is connected to a source line on the side (e.g., right side) opposite to the predetermined side among the source lines existing on both sides of the pixel electrode, and the driving device includes: potential output means (e.g., potential setting section 11) having a plurality of potential output terminals from each of which a potential corresponding to an input pixel value is output, and configured to output a potential from each potential output terminal in such a manner to output a potential higher than a common electrode potential and a potential lower than the common electrode potential alternately in order of arrangement of the potential output terminals; and switch means (e.g., switch section 12) having a plurality of input terminals and switch output terminals that is one more in number than the plurality of input terminals, wherein if the k-th input terminal from the left is denoted as $I_k$, the k-th and k+1-th switch output terminals from the left are denoted as $O_k$ and $O_{k+1}$, respectively, the number of input terminals is denoted as n, and k takes each value from 1 to n, the switch means connects the input terminal $I_k$ to either of the switch output terminals $O_k$ and $O_{k+1}$, wherein each source line of the liquid crystal display panel is connected to a corresponding switch output terminal of the switch means, the potential output means switches between output of a potential higher than the common electrode potential and output of a potential lower than the common electrode potential at each potential output terminal depending on a period for selecting each row in the odd-numbered group one by one or a period for selecting each row in the even-numbered group one by one, the switch means switches between the switch output terminals to be connected to each input terminal depending on the period for selecting each row in the odd-numbered group one by one or the period for selecting each row in the even-numbered group one by one, and the potential output means continues to output, from each potential output terminal, a potential specific to a pixel value corresponding to the potential output terminal, respectively, during a selection period of one row.

For example, the liquid crystal display device may also include control means (e.g., control section 3 or $\mathbf{3}_a$) for outputting a first control signal (e.g., $POL_1$) to control whether the potential of each potential output terminal of the potential output means is set higher or lower than the common electrode potential, and a second control signal (e.g., $POL_2$) to give an instruction to determine to which of the switch output terminals $O_k$ and $O_{k+1}$ the input terminal $I_k$ is to be connected, wherein depending on whether the first control signal is at high level or low level, the potential output means switches between whether a potential higher than the common electrode potential is output from an odd-numbered potential output terminal from the left and a potential lower than the common electrode potential is output from an even-numbered potential output terminal from the left, and whether a potential lower than the common electrode potential is output from the odd-numbered potential output terminal from the left and a potential higher than the common electrode potential is output from the even-numbered potential output terminal from the left, the switch means switches between the switch output terminals $O_k$ and $O_{k+1}$ to which the input terminal $I_k$ is to be connected, depending on whether the second control signal is at high level or low level, and the control means switches the levels of the first control signal and the second control signal between the period for selecting each row in the odd-numbered group one by one and the period for selecting each row in the even-numbered group one by one.

Further, for example, the control means may be configured to switch, on a frame-by-frame basis, between a mode of outputting the control signals, in which when the first control signal is set to high level, the second control signal is also set to high level, while when the first control signal is set to low level, the second control signal is also set to low level, and a mode of outputting the control signals, in which when the first control signal is set to low level, the second control signal is set to high level, while when the first control signal is set to high level, the second control signal is set to low level.

Further, for example, upon switching between selection periods, the control means may be configured to put output from a potential output terminal of the potential output means into a high impedance state, and switch the level of the second control signal while the output of the potential output terminal is in the high impedance state.

Further, for example, the liquid crystal display device may include control means for outputting a first control signal to control whether the potential of each potential output terminal of the potential output means is set higher or lower than the common electrode potential and notifying the potential output means of the start of a frame, wherein the potential output means outputs a second control signal to give an instruction to determine to which of the switch output terminals $O_k$ and $O_{k+1}$ the input terminal $I_k$ is to be connected, and depending on whether the first control signal is at high level or low level, the potential output means switches between whether a potential higher than the common electrode potential is output from an odd-numbered potential output terminal from the left and a potential lower than the common electrode potential is output from an even-numbered potential output terminal from the left, and whether a potential lower than the common electrode potential is output from the odd-numbered potential output terminal from the left and a potential higher than the common electrode potential is output from the even-numbered potential output terminal from the left, the switch means switches between the switch output terminals $O_k$ and $O_{k+1}$ to which the input terminal $I_k$ is to be connected, depending on whether the second control signal is at high level or low level, the control means switches the level of the first control signal between the period for selecting each row in the odd-numbered group one by one and the period for selecting each row in the even-numbered group one by one, and when notified of the start of a frame, the potential output means controls the second control signal to connect the input terminal $I_k$ to the switch output terminal $O_k$, and after that, switches the level of the second control signal between the period for selecting each row in the odd-numbered group one by one and the period for selecting each row in the even-numbered group one by one.

Further, for example, the control means may be configured to switch, on a frame-by-frame basis, between a mode of outputting the control signals, in which when the second control signal becomes high level, the first control signal is set to high level, while when the second control signal becomes low level, the first control signal is set to low level, and a mode of outputting the control signals, in which when the second control signal becomes high level, the first control signal is set to low level, while when the second control signal becomes low level, the first control signal is set to high level.

Further, for example, the control means may be such that upon switching between selection periods, the control means puts output from a potential output terminal of the potential output means into a high impedance state, and the potential output means switches the level of the second control signal while the output from the potential output terminal is in the high impedance state.

Further, for example, the liquid crystal display device may be such that every row of pixel electrodes is set as one group in such a manner that a pixel electrode in an odd-numbered row is connected to a source line on a predetermined side among source lines existing on both sides of the pixel electrode, and a pixel electrode in an even-numbered row is connected to a source line on the side opposite to the predetermined side among the source lines existing on both sides of the pixel electrode.

Further, for example, the liquid crystal display device may be such that two or more driving devices are provided, switch means of respective driving devices are placed side by side, and among adjacent two switch means, the rightmost switch output terminal of the left-hand switch means and the leftmost switch output terminal of the right-hand switch means are connected to a common source line (e.g., source line $S_{n+1}$ illustrated in FIG. 22).

Further, for example, the potential output means may be configured to set the output potential of each potential output terminal to a potential between the maximum potential and the minimum potential output from the potential output terminal during a vertical blanking interval.

For example, the potential output means may be configured to short-circuit between a pair of adjacent two potential output terminals during a vertical blanking interval.

Further, for example, the liquid crystal panel may be configured to arrange R, G and B pixels in the same sequence on a row-by-row basis.

Further, for example, the liquid crystal panel may be configured to arrange R, G and B pixels in different sequences among a predetermined number of consecutive rows and repeat the R, G and B arrangement pattern in the predetermined number of consecutive rows.

Further, for example, the liquid crystal panel may be configured to arrange only one kind of pixels among R, G and B in each row. Further, for example, the liquid crystal panel may have a sequence of RGBW pixels, rather than RGB pixels.

According another exemplary aspect of the invention, a liquid crystal display device includes: an active matrix liquid crystal display panel; and a driving device for driving the liquid crystal display panel, wherein the liquid crystal display panel includes: a common electrode; a plurality of pixel electrodes arranged in a matrix; and source lines provided on the left side of pixel electrodes in each column of pixel electrodes and on the right side of the rightmost column of pixel electrodes, wherein when every row or every two or more consecutive rows of pixel electrodes are set as one group, a pixel electrode in each row of an odd-numbered group is connected to a source line on a predetermined side among source lines existing on both sides of the pixel electrode, and a pixel electrode in each row of an even-numbered group is connected to a source line on the side opposite to the predetermined side among the source lines existing on both sides of the pixel electrode, and the driving device includes: a DA converter for inputting each data corresponding to each of pixel values for one row, converting the input data to an analog voltage, and outputting a potential after subjected to conversion, wherein depending on whether a first control signal (e.g., $POL_1$) input to the DA converter is at high level or low level, the DA converter switches between whether a potential higher than a common electrode potential is output from an odd-numbered potential output terminal from the left and a potential lower than the common electrode potential is output from an even-numbered potential output terminal from the left, and whether a potential lower than the common electrode potential is output from the odd-numbered potential output terminal from the left and a potential higher than the common electrode potential is output from the even-numbered potential output terminal from the left; and switch means for switching between whether the potential of a pixel electrode is set using the source line on the left side of the pixel electrode and whether the potential of the pixel electrode is set using the source line on the right side of the pixel electrode, wherein if the number of pixel columns to be driven is denoted as m, the switch means has input terminals and m+1 switch output terminals, and if the k-th input terminal from the left is denoted as $I_k$, the k-th and k+1-th switch output terminals from the left are denoted as $O_k$ and $O_{k+1}$, respectively, and k takes each value from 1 to m, the switch means switches, depending on whether a second control signal (e.g., $POL_2$) input to the switch means is at high level or low level, between whether the input terminal $I_k$ is connected to the switch output terminal $O_k$ and whether the input terminal $I_k$ is connected to the switch output terminal $O_{k+1}$.

Further, the driving device may also include a voltage follower, and depending on whether the second control signal is at high level or low level, output from the leftmost potential output terminal of the voltage follower is put into a high impedance state or output from the rightmost potential output terminal of the voltage follower is put into the high impedance state.

Further, the liquid crystal display device may be configured to include two or more driving devices, and among adjacent two driving devices, the rightmost potential output terminal of the left-hand driving device and the leftmost potential output terminal of the right-hand driving device are connected to a common source line.

Further, the liquid crystal display device may be configured further to include: first latch means (e.g., first latch sections 32 for R, G and B in a sixth embodiment) for reading and holding R, G and B pixel values each for one pixel simultaneously; a shift register (e.g., shift register 31 in the sixth embodiment) for outputting a data reading instruction signal sequentially to instruct the first latch means to read each of the R, G and B pixel values each for one pixel; second latch means (e.g., second latch sections 33 for R, G and B in the sixth embodiment) for reading pixel values of m pixels for one row collectively from the first latch means, and outputting data corresponding to each pixel value; level shifting means (e.g., level shifter 35) having m+1 data input terminals and m+1 data output terminals and configured to shift the levels of data input from the data input terminals and output the data from the data output terminals; and a voltage follower (e.g., voltage follower 37 in the sixth embodiment) having m+1 potential input terminals and m+1 potential output terminals, and configured to output, from the potential output terminals, potentials equal to potentials input from the potential input terminals, wherein the second latch means has m data output terminals for outputting data corresponding to the pixel values of m pixels for one row, the DA converter has m+1 data input terminals and m+1 potential output terminals, the data output terminals of the second latch means are connected to the input terminals of the switch means in a one-to-one relationship, the switch output terminals of the switch means are connected to the data input terminals of the level shifting means in a one-to-one relationship, the data output terminals of the level shifting means are connected to the data input terminals of the DA converter in a one-to-one relationship, the potential output terminals of the DA converter are connected to the potential input terminals of the voltage follower in a one-to-one relationship, the potential output terminals of the voltage follower are connected to the source lines of the liquid crystal display panel, the level of the first control signal is switched alternately on a frame-by-frame basis, and the level of the second control signal is switched alternately each time all rows belonging to a group are selected.

Further, the liquid crystal display device may be configured further to include: first latch means (e.g., first latch sections 32 for R, G and B in a seventh embodiment) for reading and holding R, G and B pixel values each for one pixel simultaneously; a shift register (e.g., shift register 31 in the seventh embodiment) for outputting a data reading instruction signal sequentially to instruct the first latch means to read each of the R, G and B pixel values each for one pixel; second latch means (e.g., second latch sections 33 for R, G and B in the seventh embodiment) for reading pixel values of m pixels for one row collectively from the first latch means, and outputting data corresponding to each pixel value; level shifting means (e.g., level shifter 45 in the seventh embodiment) having m data input terminals and m data output terminals and configured to shift the levels of data input from the data input terminals and output the data from the data output terminals; and a voltage follower (e.g., voltage follower 37 in the seventh embodiment) having m+1 potential input terminals and m+1 potential output terminals, and configured to output, from the potential output terminals, potentials equal to potentials input from the potential input terminals, wherein the second latch means has m data output terminals for outputting data corresponding to the pixel values of m pixels for one row, the DA converter has m+1 data input terminals and m+1 potential output terminals, the data output terminals of the second latch means are connected to the data input terminals of the level shifting means in a one-to-one relationship, the data output terminals of the level shifting means are connected to the input terminals of the switch means in a one-to-one relationship, the switch output terminals of the switch means are connected to the data input terminals of the DA converter in a one-to-one relationship, the potential output terminals of the DA converter are connected to the potential input terminals of the voltage follower, the potential output terminals of the voltage follower are connected to the source lines of the liquid crystal display panel, the level of the first control signal is switched alternately on a frame-by-frame basis, and the level of the second control signal is switched alternately each time all rows belonging to a group are selected.

Further, the liquid crystal display device may be configured further to include: first latch means (e.g., first latch sections 32 for R, G and B in an eighth embodiment) for reading and holding R, G and B pixel values each for one pixel simultaneously; a shift register (e.g., shift register 31 in the eighth embodiment) for outputting a data reading instruction signal sequentially to instruct the first latch means to read each of the R, G and B pixel values each for one pixel; second latch means (e.g., second latch sections 33 for R, G and B in the eighth embodiment) for reading pixel values of m pixels for one row collectively from the first latch means, and outputting data corresponding to each pixel value; level shifting means (e.g., level shifters 45 for R, G and B in the eighth embodiment) having m data input terminals and m data output terminals and configured to shift the levels of data input from the data input terminals and output the data from the data output terminals; and a voltage follower (e.g., voltage follower 37 in the eighth embodiment) having m+1 potential input terminals and m+1 potential output terminals, and configured to output, from the potential output terminals, potentials equal to potentials input from the potential input terminals, wherein the second latch means has m data output terminals for outputting data corresponding to the pixel values of m pixels for one row, the DA converter has m data input terminals and m potential output terminals, the data output terminals of the second latch means are connected to the data input terminals of the level shifting means in a one-to-one relationship, the data output terminals of the level shifting means are connected to the data input terminals of the DA converter in a one-to-one relationship, the potential output terminals of the DA converter are connected to the input terminals of the switch means in a one-to-one relationship, the switch output terminal of the switch means are connected to the potential input terminals of the voltage follower in a one-to-one relationship, the potential output terminals of the voltage follower are connected to the source lines of the liquid crystal display panel, the levels of the first control signal and the second control signal are switched alternately each time all rows belonging to a group are selected, and in one frame, when the second control signal is at high level, the first control signal also becomes high level, while when the second control signal is at low level, the first control signal also becomes high level, and in the next frame following the one frame, when the second control signal is at high level, the first control signal becomes low level, while when the second control signal is at low level, the first control signal becomes high level.

Further, the liquid crystal display device may be configured further to include: first latch means (e.g., first latch section 63 in a ninth embodiment) for reading and holding R, G and B pixel values each for one pixel simultaneously; a shift register (e.g., shift register 31 in the ninth embodiment) for outputting a data reading instruction signal sequentially to instruct the first latch means to read each of the R, G and B pixel values each for one pixel; second latch means (e.g., second latch section 43 in the ninth embodiment) for reading pixel values of m pixels for one row collectively from the first latch means, and outputting data corresponding to each pixel value; level shifting means (e.g., level shifter 35 in the ninth embodiment) having m+1 data input terminals and m+1 data output terminals and configured to shift the levels of data input from the data input terminals and output the data from the data output terminals; and a voltage follower (e.g., voltage follower 37 in the ninth embodiment) having m+1 potential input terminals and m+1 potential output terminals, and configured to output, from the potential output terminals, potentials equal to potentials input from the potential input terminals, wherein the first latch means has m pixel value output terminals for causing the second latch means to read the pixel values, the second latch means has m+1 data reading terminals for reading the pixel values from the first latch means, and m+1 data output terminals for outputting data corresponding to the pixel values of pixels for one row, the DA converter has m+1 data input terminals and m+1 potential output terminals, the pixel value output terminals of the first latch means are connected to the input terminals of the switch means in a one-to-one relationship, the switch output terminals of the switch means are connected to the data reading terminals of the second latch means in a one-to-one relationship, the data output terminals of the second latch means are connected to the data input terminals of the level shifting means in a one-to-one relationship, the data output terminals of the level shifting means are connected to the data input terminals of the DA converter in a one-to-one relationship, the potential output terminals of the DA converter are connected to the potential input terminals of the voltage follower in a one-to-one relationship, the potential output terminals of the voltage follower are connected to the source lines of the liquid crystal display panel, the level of the first control signal is switched alternately on a frame-by-frame basis, and the level of the second control signal is switched alternately each time all rows belonging to a group are selected.

Further, the liquid crystal display device may be configured such that the number of columns of pixels to be driven is a multiple of 3, and the liquid crystal display device further includes: first latch means (e.g., first latch section 66 in a tenth embodiment) in which m+1 latch circuits (e.g., latch circuits 61 in the tenth embodiment) are arranged, each latch circuit having an input terminal (e.g., LS) for a data reading instruction signal to give an instruction to read a pixel value, a pixel value reading terminal (e.g., D) for reading a pixel value for one pixel input when the data reading instruction signal is input to the input terminal, and an output terminal (Q) for the pixel value; a shift register (e.g., shift register 31 in the tenth embodiment) having signal output terminals for a m/3 piece of data reading instruction signal and configured to output the data reading instruction signal sequentially from each of the signal output terminals; output of shift register switching means (e.g., output of shift register switching section 65 in the tenth embodiment) which, if the i-th signal output terminal from the left in the shift register is denoted as $C_i$ and i takes each value from 1 to m/3, connects the signal output terminal $C_i$ with input terminals of the 3·i−2-th, 3·i−1-th and 3·i-th latch circuits of the first latch means when the second control signal is at high level, or connects the signal output terminal $C_i$ with input terminals of the 3·i−1-th, 3·i-th and 3·i+1-th latch circuits of the first latch means when the second control signal is at low level; second latch means (e.g., second latch section 43 in the tenth embodiment) for reading pixel values of m pixels for one row collectively from the first latch means, and outputting data corresponding to each pixel value; level shifting means (e.g., level shifter 35 in the tenth embodiment) having m+1 data input terminals and m+1 data output terminals and configured to shift the levels of data input from the data input terminals and output the data from the data output terminals; and a voltage follower (e.g., voltage follower 37 in the tenth embodiment) having m+1 potential input terminals and m+1 potential output terminals and configured to output, from the potential output terminals, potentials equal to potentials input from the potential input terminals, wherein the m input terminals of the switch means are connected to data wiring for transferring pixel values for R, data wiring for transferring pixel values for G and data wiring for transferring pixel values for B, the switch output terminals of the switch means are connected to the pixel value reading terminals of the respective latch circuits in the first latch means in a one-to-one relationship, the second latch means has m+1 data reading terminals for reading pixel values from the first latch means and m+1 data output terminals for outputting data corresponding to pixel values of pixels for one row, DA converter has m+1 data input terminals and m+1 potential output terminals, the output terminals of the respective latch circuits in the first latch means are connected to the data reading terminals of the second latch means in a one-to-one relationship, the data output terminals of the second latch means are connected to the data input terminals of the level shifting means in a one-to-one relationship, the data output terminals of the level shifting means are connected to the data input terminals of the DA converter in a one-to-one relationship, the potential output terminals of the DA converter are connected to the potential input terminals of the voltage follower in a one-to-one relationship, the potential output terminals of the voltage follower are connected to the source lines of the liquid crystal display panel, the level of the first control signal is switched alternately on a frame-by-frame basis, the level of the second control signal is switched alternately each time all rows belonging to a group are selected after the second control signal is set to high level upon starting a frame, and the output of shift register switching means and the switch means maintain a state equal to that when the second control signal is at high level until the second control signal is generated in a first frame after power-on.

Further, the liquid crystal display device may be configured further to include: first latch means (e.g., first latch section 66 in an eleventh embodiment) having m+1 input terminals for a data reading instruction signal to give an instruction to read a pixel value, and configured such that, when the data reading instruction signal is input, the first latch means reads and holds a pixel value for one pixel corresponding to an input terminal to which the data reading instruction signal is input; a shift register (e.g., shift register 81 in the eleventh embodiment) having m signal output terminals for the data reading instruction signal and configured to output the data reading instruction signal sequentially from each signal output terminal; second latch means (e.g., second latch section 43 in the eleventh embodiment) for reading pixel values of m pixels for one row collectively from the first latch means, and outputting data corresponding to each pixel value; level shifting means (e.g., level shifter 35 in the eleventh embodiment) having m+1 data input terminals and m+1 data output terminals and configured to shift the levels of data input from the data input terminals and outputting the data from the data output terminals; and a voltage follower (e.g., voltage follower 37 in the eleventh embodiment) having m+1 potential input terminals and m+1 potential output terminals and configured to output, from the potential output terminals, potentials equal to potentials input from the potential input terminals, wherein the first latch means has m+1 pixel value output terminals for causing the second latch means to read pixel values, the second latch means has m+1 data reading terminals for reading pixel values from the first latch means and m+1 data output terminals for outputting data corresponding to pixel values of pixels for one row, the DA converter has m+1 data input terminals and m+1 potential output terminals, the signal output terminals of the shift register are connected to the input terminals of the switch means in a one-to-one relationship, the switch output terminals of the switch means are connected to the input terminals of the first latch means in a one-to-one relationship, the pixel value output terminals of the first latch means are connected to the data reading terminals of the second latch means in a one-to-one relationship, the data output terminals of the second latch means are connected to the data input terminals of the level shifting means in a one-to-one relationship, the data output terminals of the level shifting means are connected to the data input terminals of the DA converter in a one-to-one relationship, the potential output terminals of the DA converter are connected to the potential input terminals of the voltage follower in a one-to-one relationship, the potential output terminals of the voltage follower are connected to the source lines of the liquid crystal display panel, the level of the first control signal is switched alternately on a frame-by-frame basis, the level of the second control signal is switched alternately each time all rows belonging to a group are selected after the second control signal is set to high level upon starting a frame, and the switch means maintains a state equal to that when the second control signal is at high level until the second control signal is generated in a first frame after power-on.

Further, the liquid crystal display device may be configured further to include: first latch means (e.g., first latch section 66 in a twelfth embodiment) for reading and holding a pixel value on a pixel-by-pixel basis; a shift register (e.g., shift register 81 in the twelfth embodiment) for outputting a data reading instruction signal sequentially to instruct the first latch means to read a pixel value for one pixel; second latch means (e.g., second latch section 43 in the twelfth embodiment) for reading pixel values of m pixels for one row collectively from the first latch means, and outputting data corresponding to each pixel value; level shifting means (e.g., level shifter 35 in the twelfth embodiment) having m+1 data input terminals and m+1 data output terminals and configured to shift the levels of data input from the data input terminals and output the data from the data output terminals; and a voltage follower (e.g., voltage follower 37 in the twelfth embodiment) having m+1 potential input terminals and m+1 potential output terminals and configured to output, from the potential output terminals, potentials equal to potentials input from the potential input terminals, wherein the first latch means has m pixel value output terminals for causing the second latch means to read pixel values, the second latch means has m+1 data reading terminals for reading pixel values from the first latch means, and m+1 data output terminals for outputting data corresponding to pixel values of pixels for one row, DA converter has m+1 data input terminals and m+1 potential output terminals, the pixel value output terminals of the first latch means are connected to the input terminals of the switch means in a one-to-one relationship, the switch output terminals of the switch means are connected to the data reading terminals of the second latch means in a one-to-one relationship, the data output terminals of the second latch means are connected to the data input terminals of the level shifting means in a one-to-one relationship, the data output terminals of the level shifting means are connected to the data input terminals of the DA converter in a one-to-one relationship, the potential output terminals of the DA converter are connected to the potential input terminal of the voltage follower in a one-to-one relationship, the potential output terminals of the voltage follower are connected to the source lines of the liquid crystal display panel, the level of the first control signal is switched alternately on a frame-by-frame basis, and the level of the second control signal is switched alternately each time all rows belonging to a group are selected.

Further, the liquid crystal display device may be configured further to include: first latch means (e.g., first latch section 66 in a thirteenth embodiment) for reading and holding a pixel value on a pixel-by-pixel basis; a shift register (e.g., shift register 81 in the thirteenth embodiment) for outputting a data reading instruction signal sequentially to instruct the first latch means to read a pixel value for one pixel; second latch means (e.g., second latch section 43 in the thirteenth embodiment) for reading pixel values of m pixels for one row collectively from the first latch means, and outputting data corresponding to each pixel value; level shifting means (e.g., level shifter 35 in the thirteenth embodiment) having m+1 data input terminals and m+1 data output terminals and configured to shift the levels of data input from the data input terminals and output the data from the data output terminals; and a voltage follower (e.g., voltage follower 37 in the thirteenth embodiment) having m+1 potential input terminals and m+1 potential output terminals and configured to output, from the potential output terminals, potentials equal to potentials input from the potential input terminals, wherein the second latch means has m data output terminals for outputting data corresponding to the pixel values of m pixels for one row, DA converter has m+1 data input terminals and m+1 potential output terminals, the data output terminals of the second latch means are connected to the input terminals of the switch means in a one-to-one relationship, the switch output terminals of the switch means are connected to the data input terminals of the level shifting means in a one-to-one relationship, the data output terminals of the level shifting means are connected to the data input terminals of the DA converter in a one-to-one relationship, the potential output terminals of the DA converter are connected to the potential input terminals of the voltage follower in a one-to-one relationship, the potential output terminals of the voltage follower are connected to the source lines of the liquid crystal display panel, the level of the first control signal is switched alternately on a frame-by-frame basis, and the level of the second control signal is switched alternately each time all rows belonging to a group are selected.

Further, the liquid crystal display device may be configured further to include: first latch means (e.g., first latch section 66 in a fourteenth embodiment) for reading and holding a pixel value on a pixel-by-pixel basis; a shift register (e.g., shift register 81 in the fourteenth embodiment) for outputting a data reading instruction signal sequentially to instruct the first latch means to read a pixel value for one pixel; second latch means (e.g., second latch section 43 in the fourteenth embodiment) for reading pixel values of m pixels for one row collectively from the first latch means, and outputting data corresponding to each pixel value; level shifting means (e.g., level shifter 35 in the fourteenth embodiment) having m data input terminals and m data output terminals and configured to shift the levels of data input from the data input terminals and output the data from the data output terminals; and a voltage follower (e.g., voltage follower 37 in the fourteenth embodiment) having m+1 potential input terminals and m+1 potential output terminals and configured to output, from the potential output terminals, potentials equal to potentials input from the potential input terminals, wherein the second latch means has m data output terminals for outputting data corresponding to pixel values of m pixels for one row, DA converter has m+1 data input terminals and m+1 potential output terminals, the data output terminals of the second latch means are connected to the data input terminals of the level shifting means in a one-to-one relationship, the data output terminals of the level shifting means are connected to the input terminals of the switch means in a one-to-one relationship, the switch output terminals of the switch means are connected to the data input terminals of the DA converter in a one-to-one relationship, the potential output terminals of the DA converter are connected to the potential input terminals of the voltage follower in a one-to-one relationship, the potential output terminals of the voltage follower are connected to the source lines of the liquid crystal display panel, the level of the first control signal is switched alternately on a frame-by-frame basis, and the level of the second control signal is switched alternately each time all rows belonging to a group are selected.

Further, the liquid crystal display device may be configured further to include: first latch means (e.g., first latch section 66 in a fifteenth embodiment) for reading and holding a pixel value on a pixel-by-pixel basis; a shift register (e.g., shift register 81 in the fifteenth embodiment) for outputting a data reading instruction signal sequentially to instruct the first latch means to read a pixel value for one pixel; second latch means (e.g., second latch section 43 in the fifteenth embodiment) for reading pixel values of m pixels for one row collectively from the first latch means, and outputting data corresponding to each pixel value; level shifting means (e.g., level shifter 35 in the fifteenth embodiment) having m data input terminals and m data output terminals and configured to shift the levels of data input from the data input terminals and output the data from the data output terminals; and a voltage follower (e.g., voltage follower 37 in the fifteenth embodiment) having m+1 potential input terminals and m+1 potential output terminals and configured to output, from the potential output terminals, potentials equal to potentials input from the potential input terminals, wherein the second latch means has m data output terminals for outputting data corresponding to the pixel values of m pixels for one row, the DA converter has m data input terminals and m potential output terminals, the data output terminals of the second latch means are connected to the data input terminals of the level shifting means in a one-to-one relationship, the data output terminals of the level shifting means are connected to the data input terminals of the DA converter in a one-to-one relationship, the potential output terminals of the DA converter are connected to the input terminals of the switch means in a one-to-one relationship, the switch output terminal of the switch means are connected to the potential input terminals of the voltage follower in a one-to-one relationship, the potential output terminals of the voltage follower are connected to the source lines of the liquid crystal display panel, the levels of the first control signal and the second control signal are switched alternately each time all rows belonging to a group are selected, and in one frame, when the second control signal is at high level, the first control signal also becomes high level, while when the second control signal is at low level, the first control signal also becomes high level, and in the next frame following the one frame, when the second control signal is at high level, the first control signal becomes low level, while when the second control signal is at low level, the first control signal becomes high level.

According to still another exemplary aspect of the invention, there is provided a driving device for a liquid crystal display panel including a common electrode, a plurality of pixel electrodes arranged in a matrix, and source lines provided on the left side of pixel electrodes in each column of pixel electrodes and on the right side of the rightmost column of pixel electrodes, wherein when every row or every two or more consecutive rows of pixel electrodes are set as one group, a pixel electrode in each row of an odd-numbered group is connected to a source line on a predetermined side (e.g., left side) among source lines existing on both sides of the pixel electrode, and a pixel electrode in each row of an even-numbered group is connected to a source line on the side (e.g., right side) opposite to the predetermined side among the source lines existing on both sides of the pixel electrode, the driving device including: potential output means (e.g., potential setting section 11) having a plurality of potential output terminals from each of which a potential corresponding to an input pixel value is output, and configured to output a potential from each potential output terminal in such a manner to output a potential higher than a common electrode potential and a potential lower than the common electrode potential alternately in order of arrangement of the potential output terminals; and switch means (e.g., switch section 12) having a plurality input terminals and switch output terminals that is one more in number than the plurality input terminals, wherein if the k-th input terminal from the left is denoted as $I_k$, the k-th and k+1-th switch output terminals from the left are denoted as $O_k$ and $O_{k+1}$, respectively, the number input terminals is denoted as n, and k takes each value from 1 to n, the switch means connects the input terminal $I_k$ to either of the switch output terminals $O_k$ and $O_{k+1}$, wherein the potential output means switches between output of a potential higher than the common electrode potential and output of a potential lower than the common electrode potential at each potential output terminal depending on a period for selecting each row in the odd-numbered group one by one or a period for selecting each row in the even-numbered group one by one, the switch means switches between the switch output terminals to be connected to each input terminal depending on the period for selecting each row in the odd-numbered group one by one or the period for selecting each row in the even-numbered group one by one, and the potential output means continues to output, from each potential output terminal, a potential specific to a pixel value corresponding to the potential output terminal, respectively, during a selection period of one row.

The driving device for a liquid crystal display panel according to the invention may be configured further to include control means (e.g., control section 3 or $\mathbf{3}_a$) for outputting a first control signal (e.g., $POL_1$) to control whether the potential of each potential output terminal of the potential output means is set higher or lower than the common electrode potential, and a second control signal (e.g., $POL_2$) to give an instruction to determine to which of the switch output terminals $O_k$ and $O_{k+1}$ the input terminal $I_k$ is to be connected, wherein depending on whether the first control signal is at high level or low level, the potential output means switches between whether a potential higher than the common electrode potential is output from an odd-numbered potential output terminal from the left and a potential lower than the common electrode potential is output from an even-numbered potential output terminal from the left, and whether a potential lower than the common electrode potential is output from the odd-numbered potential output terminal from the left and a potential higher than the common electrode potential is output from the even-numbered potential output terminal from the left, the switch means switches between the switch output terminals $O_k$ and $O_{k+1}$ to which the input terminal $I_k$ is to be connected, depending on whether the second control signal is at high level or low level, and the control means switches the levels of the first control signal and the second control signal between the period for selecting each row in the odd-numbered group one by one and the period for selecting each row in the even-numbered group one by one.

According to yet another exemplary aspect of the invention, there is provided a driving device for a liquid crystal display panel including a common electrode, a plurality of pixel electrodes arranged in a matrix, and source lines provided on the left side of pixel electrodes in each column of pixel electrodes and on the right side of the rightmost column of pixel electrodes, wherein when every row or every two or more consecutive rows of pixel electrodes are set as one group, a pixel electrode in each row of an odd-numbered group is connected to a source line on a predetermined side among source lines existing on both sides of the pixel electrode, and a pixel electrode in each row of an even-numbered group is connected to a source line on the side opposite to the predetermined side among the source lines existing on both sides of the pixel electrode, the driving device including: a DA converter for inputting each data corresponding to each of pixel values for one row, converting the input data to an analog voltage, and outputting a potential after subjected to conversion, wherein depending on whether a first control signal input to the DA converter is at high level or low level, the DA converter switches between whether a potential higher than a common electrode potential is output from an odd-numbered potential output terminal from the left and a potential lower than the common electrode potential is output from an even-numbered potential output terminal from the left, and whether a potential lower than the common electrode potential is output from the odd-numbered potential output terminal from the left and a potential higher than the common electrode potential is output from the even-numbered potential output terminal from the left; and switch means for switching between whether the potential of a pixel electrode is set using the source line on the left side of the pixel electrode and whether the potential of the pixel electrode is set using the source line on the right side of the pixel electrode, wherein if the number of pixel columns to be driven is denoted as m, the switch means has input terminals and m+1 switch output terminals, and if the k-th input terminal from the left is denoted as $I_k$, the k-th and k+l-th switch output terminals from the left are denoted as $O_k$ and $O_{k+1}$, respectively, and k takes each value from 1 to m, the switch means switches, depending on whether a second control signal input to the switch means is at high level or low level, between whether the input terminal $I_k$ is connected to the switch output terminal $O_k$ and whether the input terminal $I_k$ is connected to the switch output terminal $O_{k+1}$.

Further, the driving device for a liquid crystal display panel may be configured further to include a voltage follower, wherein depending on whether the second control signal is at high level or low level, output from the leftmost potential output terminal of the voltage follower is put into a high impedance state or output from the rightmost potential output terminal of the voltage follower is put into the high impedance state.

According to yet another aspect of the invention, there is provided a liquid crystal display panel including: a common electrode; a plurality of pixel electrodes arranged in a matrix;

source lines provided on the left side of pixel electrodes in each column of pixel electrodes and on the right side of the rightmost column of pixel electrodes; and switch means (e.g., switch section 12) having a plurality input terminals and switch output terminals that is one more in number than the plurality of input terminals, wherein if the k-th input terminal from the left is denoted as $I_k$, the k-th and k+1-th switch output terminals from the left are denoted as $O_k$ and $O_{k+1}$, respectively, the number input terminals is denoted as n, and k takes each value from 1 to n, the switch means connects the input terminal $I_k$ to either of the switch output terminals $O_k$ and $O_{k+1}$, wherein when every row or every two or more consecutive rows of pixel electrodes are set as one group, a pixel electrode in each row of an odd-numbered group is connected to a source line on a predetermined side (e.g., left side) among source lines existing on both sides of the pixel electrode, and a pixel electrode in each row of an even-numbered group is connected to a source line on the side (e.g., right side) opposite to the predetermined side among the source lines existing on both sides of the pixel electrode, each source line is connected to a corresponding switch output terminal of the switch means, and the switch means switches between the switch output terminals to be connected to each input terminal depending on the period for selecting each row in the odd-numbered group one by one or the period for selecting each row in the even-numbered group one by one.

According to yet another exemplary aspect of the invention, there is provided a liquid crystal display panel including: a common electrode; a plurality of pixel electrodes arranged in a matrix; and source lines provided on the left side of pixel electrodes in each column of pixel electrodes and on the right side of the rightmost column of pixel electrodes, wherein when every row or every two or more consecutive rows of pixel electrodes are set as one group, a pixel electrode in each row of an odd-numbered group is connected to a source line on a predetermined side among source lines existing on both sides of the pixel electrode, and a pixel electrode in each row of an even-numbered group is connected to a source line on the side opposite to the predetermined side among the source lines existing on both sides of the pixel electrode, and among the source lines, a specific odd-numbered source line has two branch portions to connect with different driving devices.

BRIEF DESCRIPTION OF THE DRAWINGS

FIG. 11 is an illustrative diagram showing an example of the polar state of each pixel.

FIG. 15 is an illustrative diagram showing an example of the polar state of each pixel.

FIG. 19 is an illustrative diagram showing an example of the polar state of each pixel in the second embodiment.

FIG. 21 is an illustrative diagram showing an example of the polar state of each pixel in the second embodiment.

FIG. 26 is an illustrative diagram showing an example of comparison between the fifth embodiment and the first embodiment in terms of the total number of source lines and gate lines.

FIG. 41 is an illustrative diagram showing switching between data sequences in a driving method for a liquid crystal display device described in JP-P2009-181100A.

DESCRIPTION OF EXEMPLARY EMBODIMENTS

Embodiments of the present invention will now be described with reference to the accompanying drawings.

First Embodiment

Figure 1:
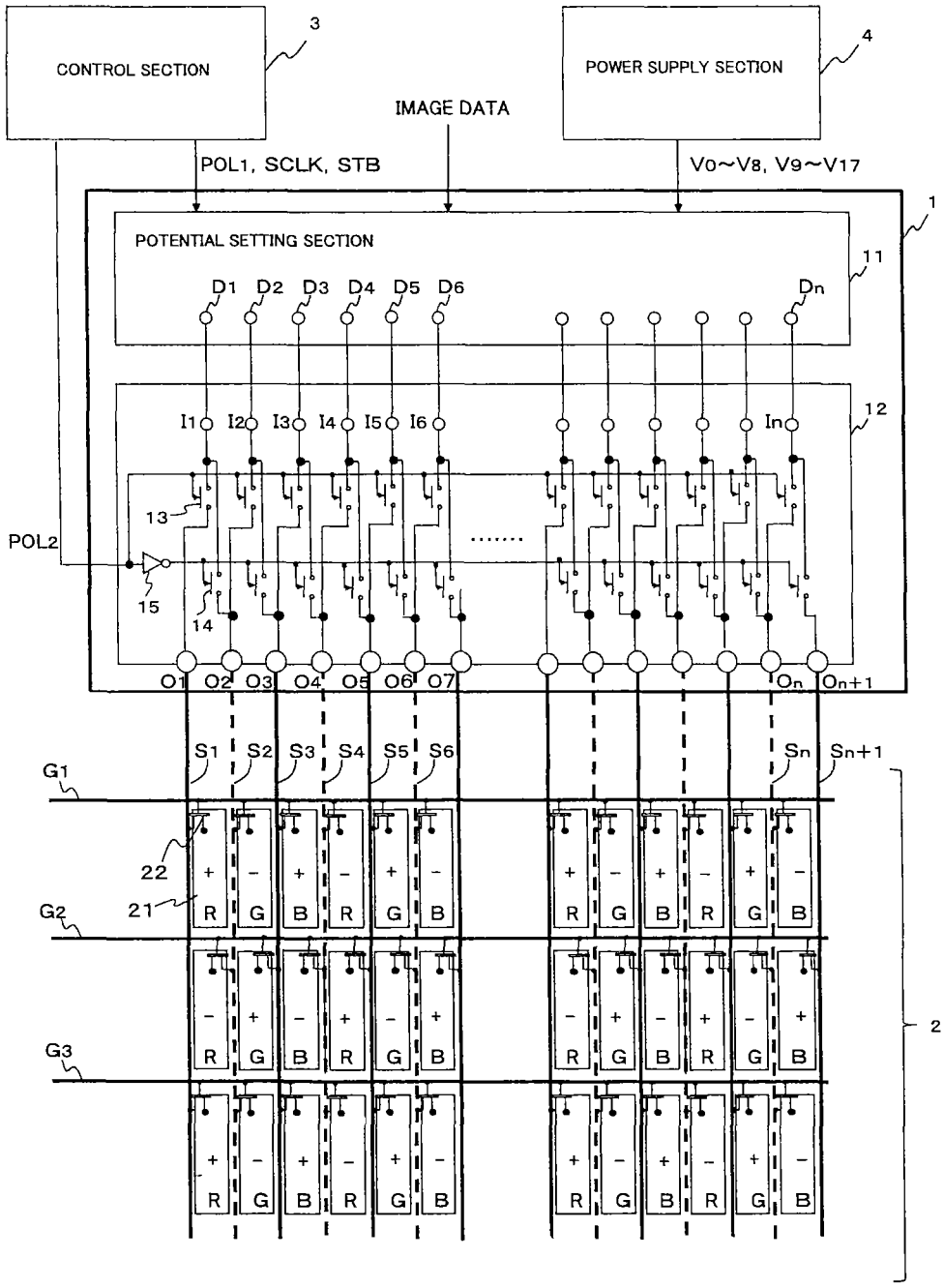
FIG. 1 is an illustrative diagram showing an example of a liquid crystal display device according to a first embodiment of the present invention.

FIG. 1 is an illustrative diagram showing an example of a liquid crystal display device according to a first embodiment of the present invention. The liquid crystal display device of the present invention includes a driving device 1, an active matrix liquid crystal display panel 2, a control section 3, and a power supply section 4.

The power supply section 4 supplies voltage $V_0$-$V_8$ and $V_9$-$V_{17}$ to the driving device 1 (potential setting section 11 to be specifically described later). $V_0$-$V_8$ are voltages higher than the potential $V_{COM}$ of a common electrode (not shown in FIG. 1), and $V_9$-$V_{17}$ are voltages lower than $V_{COM}$, where $V_{17}<V_{16}<\ldots<V_9<V_{COM}<V_8<V_7<\ldots<V_0$. In this example, a case where the power supply section 4 supplies $V_0$-$V_8$ as voltages for positive polarity display will be described as an example. The potential setting section 11 divides the voltages to provide, for example, 64 levels of halftone at the positive polarity. Similarly, a case where the power supply section 4 supplies $V_9$-$V_{17}$ as voltages for negative polarity display will be described as an example. The potential setting section 11 divides the voltages to provide 64 levels of halftone at the negative polarity, for example. Note that the kinds of voltage supplied for the positive polarity and the negative polarity from the power supply section 4 are not limited to nine kinds, respectively, and the number of levels of halftone is also not limited to 64 levels of halftone.

The driving device 1 controls the potentials of source lines $S_1$ to $S_{n+1}$ provided on the liquid crystal display panel 2. The driving device 1 includes the potential setting section 11 and a switch section 12.

The potential setting section 11 captures image data under the control of the control section 3, and outputs potentials corresponding to pixel values indicated by the image data. The number of potential output terminals of the potential setting section 11 is n, and this is denoted as $D_1$ to $D_n$.

Figure 2:
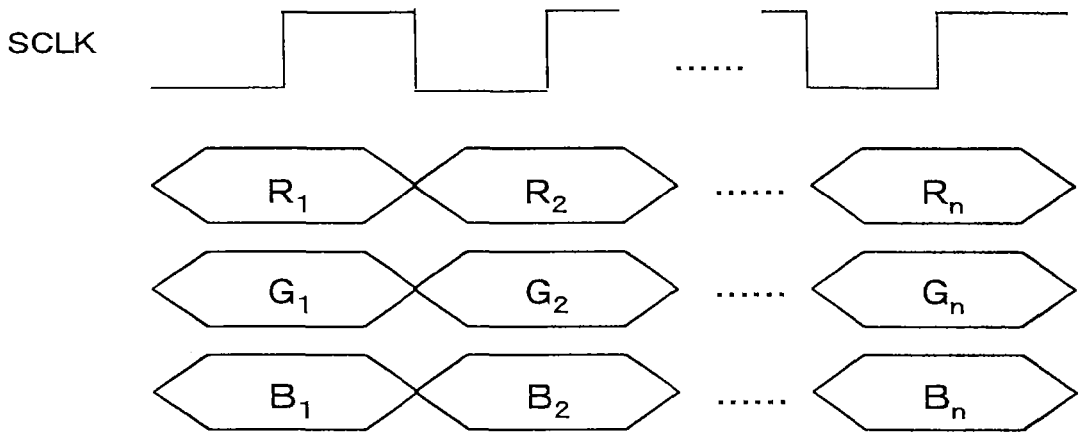
FIG. 2 is a timing chart showing timings at which a potential setting section captures data for one row in order.

In each row of the liquid crystal display panel 2, respective pixels are disposed in a repetitive pattern in order of R(red), G(green) and B(blue). Image data corresponding to pixels for one row are input into the potential setting section 11 in order from data (pixel value) corresponding to the leftmost pixel. FIG. 2 is a timing chart showing timings at which the potential setting section 11 captures data for one row in order. The potential setting section 11 captures the image data for one row in response to a control signal SCLK input from the control section 3 in order from data on the leftmost pixel. SCLK is a control signal to instruct the potential setting section 11 to capture an image. The potential setting section 11 captures image data for three pixels on the rising edge of SCLK. As shown in FIG. 2, the potential setting section 11 captures the leftmost pixel value $R_1$, the second pixel value $G_1$ from the left and the third pixel value $B_1$ from the left in the image data for one row on the first rising edge of SCLK, and stores them in a register (not shown) provided in the potential setting section 11. Then, the potential setting section 11 captures the fourth pixel value $R_2$ from the left, the fifth pixel value $G_2$ from the left and the sixth pixel value $B_2$ from the left on the next rising edge of SCLK, and stores them in the register in the same manner. The potential setting section 11 repeats the same operation and stores the image data for one row in the register. This SCLK is the control signal to instruct the potential setting section 11 to capture an image. Instead of the above-mentioned input mode in which data is input in parallel in order of RGB, the input mode may be such that RGB signals are input serially so that the potential setting section 11 will latch the data serially and store data for one row in response to the clock signal from the control section 3. The data for one row is stored in order of RGB without any interface, so-called RGB interface, RSDS interface, CPU interface or the like.

Figure 3:
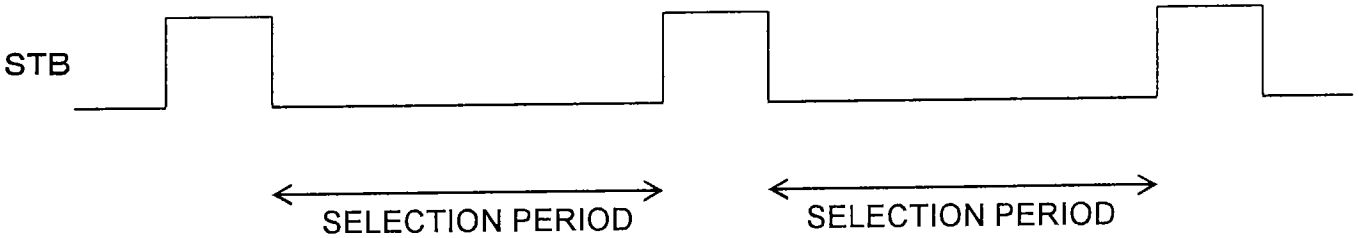
FIG. 3 is an illustrative diagram showing STB variations.

The potential setting section 11 captures this data for one row within one row selection period under the control of the control section 3, and outputs potentials corresponding to respective pieces of data for one row from the potential output terminals $D_1$ to $D_n$ during the next selection period. The potential setting section 11 outputs potentials in response to control signal STB input to the control section 3. STB is a control signal to specify a selection period of each row. FIG. 3 is an illustrative diagram showing STB variations. The selection period of one row on the liquid crystal display panel 2 corresponds to a period from the falling edge of STB to the rising edge thereof. The control section 3 outputs SCLK (see FIG. 2) to instruct potential setting section 11 to capture and store, in the register, image data for one row within this selection period. Then, the potential setting section 11 transfers, on the rising edge of STB, the data for one row stored in the register to a latch section (not shown) provided in the potential setting section 11. At this time, the potential setting section 11 transfers the data for one row to the latch section without changing the sequence of pixels in the data for one row. Therefore, the pixel value of the leftmost pixel is transferred to a portion of the latch section corresponding to the leftmost potential output terminal $D_1$. The same holds true for the other pixels. The potential setting section 11 outputs potentials from the potential output terminals $D_1$ to $D_n$ on the falling edge of STB according to the pixel values of respective pixels for one row stored in the latch section. Since the potential setting section 11 outputs, from one potential output terminal, only the potential corresponding to the pixel value stored in the portion of the latch section corresponding to the potential output terminal within one selection period, the output potential is never be switched to a potential corresponding to another pixel value within one selection period.

Thus, a potential corresponding to the pixel value of a corresponding pixel is output from each of the potential output terminals $D_1$ to $D_n$ according to the data sequence of pixels for one row sequentially input.

Further, the potential setting section 11 controls the potential output from each of the potential output terminals $D_1$ to $D_n$ to be a potential higher than $V_{COM}$ or a potential lower than $V_{COM}$ in response to control signal $POL_1$ input from the control section 3. $POL_1$ is a control signal to control whether the potential of each potential output terminal of the potential setting section 11 is set higher or lower than $V_{COM}$. The control section 3 alternates the level of $POL_1$ between high level and low level in one frame per selection period. Note that one frame means a period required to select lines sequentially from the first row to the last row (for sequential line scanning).

When $POL_1$ is at high level, the potential setting section 11 sets the potential of each of the odd-numbered potential output terminals $D_1, D_3, D_5, \ldots$ from the left to a potential higher than $V_{COM}$ ($V_0$-$V_8$ or a potential obtained by dividing the voltage based on $V_0$-$V_8$), and sets the potential of each of the even-numbered potential output terminals $D_2, D_4, D_6, \ldots$ from the left to a potential lower than $V_{COM}$ ($V_9$-$V_{17}$ or a potential obtained by dividing the voltage based on $V_9$-$V_{17}$). Hereinafter, $V_0$-$V_8$ or the potentials obtained by dividing the voltages based on $V_0$-$V_8$ are denoted as "$V_0$-$V_8$ or the like." Similarly, $V_9$-$V_{17}$ or the potentials obtained by dividing the voltages based on $V_9$-$V_{17}$ are denoted as "$V_9$-$V_{17}$ or the like." On the other hand, when $POL_1$ is at low level, the potential setting section 11 sets the potential of each of the odd-numbered potential output terminals $D_1, D_3, D_5, \ldots$ from the left to a potential lower than $V_{COM}$ ($V_9$-$V_{17}$ or the like), and sets the potential of each of the even-numbered potential output terminals $D_2, D_4, D_6, \ldots$ from the left to a potential higher than ($V_0$-$V_8$ or the like). Whether to output either of the potentials $V_0$-$V_8$ or the like and $V_9$-$V_{17}$ or the like is determined depending on the pixel value stored in the portion of the latch section corresponding to the potential output terminal.

The switch section 12 includes input terminals equal in number to the potential output terminals of the potential setting section 11, and switch output terminals that are one more in number than the number input terminals. In other words, the switch section 12 includes n input terminals $I_1$ to $I_n$ and n+1 switch output terminals $O_1$ to $O_{n+1}$. Hereinafter, the switch output terminal is simply referred to as the output terminal.

Each of the input terminals $I_1$ to $I_n$ has a one-to-one relationship with each of the potential output terminals $D_1$ to $D_n$ of the potential setting section 11, and is connected to a corresponding potential output terminal. For example, $I_1$ is connected to $D_1$. The same holds true for the other input terminals.

If any input terminal of the input terminals is denoted as $I_k$ (where $1 \le k \le n$), the input terminal $I_k$ outputs a potential input from the corresponding potential output terminal (denoted as $D_k$) from any one of the output terminals $O_k$ and $O_{k+1}$. Specifically, the input terminal $I_k$ is connected to a first terminal of a first transistor 13, and a second terminal of the first transistor 13 is connected to the output terminal $O_k$. Similarly, the input terminal $I_k$ is connected to a first terminal of a second transistor 14, and a second terminal of the second transistor 14 is connected to the output terminal $O_{k+1}$. Both the first transistor 13 and the second transistor 14 have a third terminal in addition to the first terminal and the second terminal. When a high-level signal (voltage) is input to the third terminal, electric conduction is created between the first terminal and the second terminal, while when a low-level signal (voltage) is input to the third terminal, electric conduction is blocked between the first terminal and the second terminal.

Further, a control signal $POL_2$ is input to the third terminal of each first transistor 13 from the control section 3. The switch section 12 has a signal inversion section 15. $POL_2$ is also input to the signal inversion section 15 from the control section 3. If input $POL_2$ is at high level, the signal inversion section 15 inverts $POL_2$ to low level, while if input $POL_2$ is at low level, it inverts $POL_2$ to high level. Then, the signal inversion section 15 inputs inverted $POL_2$ to the third terminal of each second transistor 14.

Thus, when $POL_2$ output from the control section 3 is at high level, high-level $POL_2$ is input to the third terminal of each first transistor 13, and low level $POL_2$ is input to the third terminal of each second transistor 14, causing each input terminal $I_k$ to be electrically conducted with the output terminal $O_k$, but not with the output terminal $O_{k+1}$. As a result, the potential output from the potential output terminal $D_k$ of the potential setting section 11 is output from the output terminal $O_k$ of the switch section 12.

On the other hand, when $POL_2$ output from the control section 3 is at low level, low-level $POL_2$ is input to the third terminal of each first transistor 13, and high-level $POL_2$ is input to the third terminal of each second transistor 14, causing each input terminal $I_k$ not to be electrically conducted with the output terminal $O_k$, but to be electrically conducted with the output terminal $O_{k+1}$. As a result, the potential output from the potential output terminal $D_k$ of the potential setting section 11 is output from the output terminal $O_{k+1}$ of the switch section 12.

In other words, $POL_2$ is a control signal for controlling to which of the output terminals $O_k$ and $O_{k+1}$ the input terminal $I_k$ is to be connected.

Figure 4:
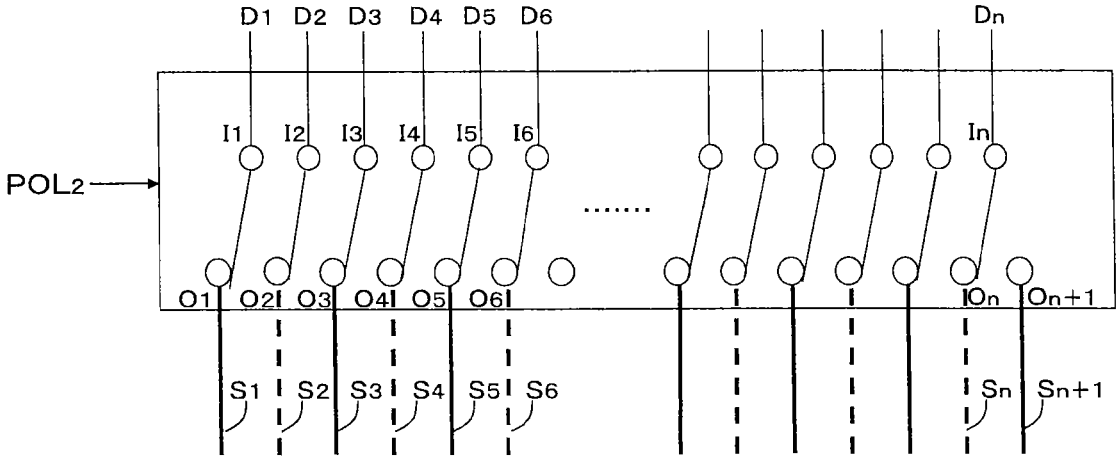
FIG. 4 is a schematic diagram showing a switch section.

The switch section 12 can also be schematically illustrated as in FIG. 4. Shown in FIG. 4 is a case where $POL_2$ output from the control section 3 is at high level and each input terminal $I_k$ is connected to the output terminal $O_k$. The following may schematically show the switch section 12 as illustrated in FIG. 4.

The liquid crystal display panel 2 shown in FIG. 1 is configured to sandwich liquid crystal (not shown) between multiple pixel electrodes 21 arranged in a matrix and the common electrode (not shown in FIG. 1) and change the liquid crystal to a state according to a difference in potential between the pixel electrodes 21 and the common electrode in order to display an image. The liquid crystal display panel 2 includes a pair of substrates (not shown), having the multiple pixel electrodes 21 arranged in a matrix on one substrate and the common electrode on the other substrate. The two substrates are so placed that the group of pixel electrodes 21 and the common electrode will face each other, and the liquid crystal is injected between the substrates.

As mentioned above, in each row of the liquid crystal display panel 2, respective pixels are disposed in a repetitive pattern in order of R(red), G(green) and B(blue). In FIG. 1, pixels for red are denoted as "R," pixels for green are denoted as "G," and pixels for blue are denoted as "B."

The liquid crystal display panel 2 includes not only source lines on the left side of the pixel electrodes in each column, but also a source line on the right side of the rightmost pixel column. In other words, the number of source lines is one more than the number of columns of the pixel electrodes. Further, pixel electrodes for one column are disposed between adjacent source lines. This example shows a case where the number of columns of the pixel electrodes is n columns, and the number of source lines is n+1. The source lines are denoted as $S_1$ to $S_{n+1}$.

Each source line corresponds to one output terminal of the switch section 12, respectively, and is connected to a corresponding output terminal of the switch section 12 according to the order of the sequence of source lines.

An active element 22 is provided for each pixel electrode 21. The following description will be made by taking, as an example, a case where the active element 22 is a TFT (Thin Film Transistor), but any active element other than TFT may be provided for each pixel electrode 21.

For each pixel electrode 21 in odd-numbered rows, the TFT 22 is provided on the left side of the pixel electrode 21, and is connected to the pixel electrode 21 and the source line on the left side thereof. On the other hand, for each pixel electrode 21 in even-numbered rows, the TFT 22 is provided on the right side of the pixel electrode 21, and is connected to the pixel electrode 21 and the source line on the right side thereof (see FIG. 1).

Here, the TFT in the odd-numbered row is provided on the left side of the pixel electrode and the TFT in the even-numbered row is provided on the right side of the pixel electrode for descriptive purposes, but the position of the TFT is optional as long as the pixel electrode in the odd-numbered row is connected to the left source line and the pixel electrode in the even-numbered row is connected to the right source line.

For example, each TFT 22 is connected to the pixel electrode 21 in such a manner that the source is connected to the source line and the drain is connected to the pixel electrode 21.

The liquid crystal display panel 2 also includes gate lines $G_1$, $G_2$, $G_3$, . . . for respective rows of the pixel electrodes arranged in a matrix. In FIG. 1, gate lines in the fourth row and beyond are omitted. Each gate line is connected to the gate of the TFT 22 provided for each pixel electrode 21 in the corresponding row. For example, gate line $G_1$ shown in FIG. 1 is connected to the gate of the TFT 22 of each pixel electrode in the first row.

Figure 5:
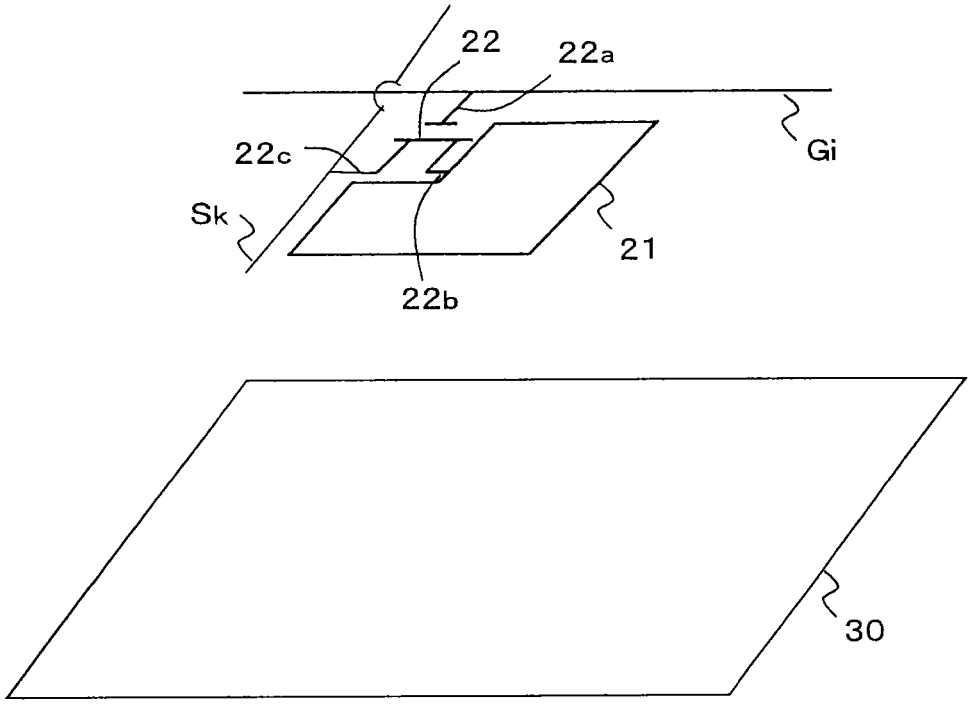
FIG. 5 is an illustrative diagram showing a connection example among a pixel electrode, a source line and a gate line.

FIG. 5 is an illustrative diagram showing a connection example among the pixel electrode, the source line and the gate line. In FIG. 5, a case is taken, as an example, where the pixel electrode 21 is connected to gate line Gi for the i-th row, and connected to source line Sk located on the left side of the pixel electrode 21. Gate $\mathbf{22}_a$ of the TFT 22 is connected to gate line Gi. The TFT 22 is also such that source $\mathbf{22}_c$ is connected to source line Sk, and drain $\mathbf{22}_b$ is connected to the pixel electrode 21. In FIG. 5, the pixel electrode 21 is connected to the left source line. However, if the pixel electrode 21 is to be connected to the right source line, the TFT 22 may be arranged on the right side of the pixel electrode 21 and connected in the manner as shown in FIG. 5.

The display device includes a gate driver (not shown) for setting the potential of each gate line. The gate driver selects gate lines sequentially line by line and sets a selected gate line to a potential upon selection and an unselected gate line to a potential upon non-selection. Thus, the rows are selected one by one. The driving device 1 may function as the gate driver.

Figure 6:
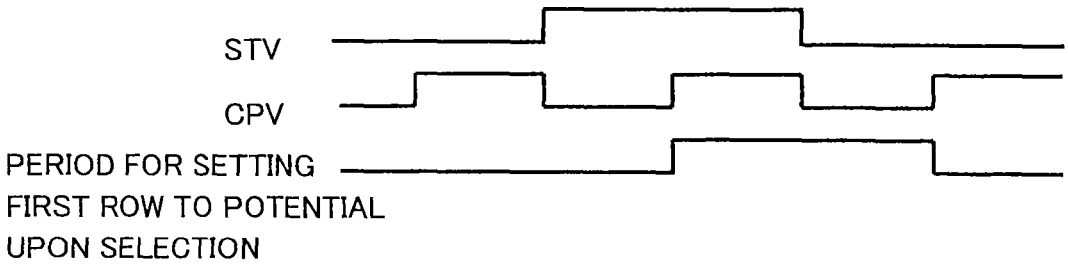
FIG. 6 is an illustrative diagram showing an example of STV and CPV.

The control section 3 inputs, to the gate driver, a control signal (hereinafter denoted as STV) to instruct it to start one frame, and a control signal (gate clock, hereinafter denoted as CPV) to instruct it to switch the selected row to another. FIG. 6 is an illustrative diagram showing an example of STV and CPV. A cycle of CPV is from the rising edge of CPV to the next rising edge of CPV, which is a period for setting a one gate line to a potential upon selection. The control section 3 sets STV to high level upon starting one frame and to low level during the other periods. In other words, the control section 3 sets STV to high level to notify the gate driver of the start of one frame. If the gate driver detects a rising edge of CPV while STV is at high level, the gate driver sets the gate line for the first row to the potential upon selection and sets the gate lines for the other rows to the potential upon non-selection. After that, the gate driver switches from one row to another in order for which the potential upon selection is set each time a rising edge of CPV is detected.

When the gate potential of each TFT 22 is set to the potential upon selection, current flows between the drain and the source, while when the gate potential is set to the potential upon non-selection, no current flows between the drain and the source. As a result, each pixel electrode in the selected row becomes equal in potential to the source line connected through the TFT. On the other hand, each pixel electrode in the unselected rows is electrically disconnected from the source line.

In the example shown in FIG. 5, when gate line Gi is selected to set the gate $\mathbf{22}_a$ to the potential upon selection, current flows between the drain $\mathbf{22}_b$ and the source $\mathbf{22}_c$, and the pixel electrode 21 becomes equal in potential to the source line Sk. Then, the state of liquid crystal between the pixel electrode 21 and the common electrode 30 is defined depending on the difference between the potential $V_{COM}$ of the common electrode 30 and the potentials of the pixel electrode 21, defining a display state of this pixel.

Amorphous silicon is used, for example, for each active element 22 provided on the liquid crystal display panel 2. Further, low-temperature polysilicon may be used, for example, for the driving device 1 including each active element 22.

The control section 3 inputs $POL_1$, SCLK and STB to the potential setting section 11 and $POL_2$ to the switch section 12 to control the driving device 1.

The control section 3 uses STB to define the selection period, and the potential setting section 11 uses SCLK to have the register capture data for one row. Then, the control section 3 causes STB to rise so that the potential setting section 11 will transfer the captured data for one row to the latch section (not shown). Further, the control section 3 causes STB to fall so that the potential setting section 11 will output, from each of the potential output terminals $D_1$ to $D_n$, each of potentials corresponding to the data for one row transferred to the latch section.

Further, the control section 3 switches the levels of $POL_1$ and $POL_2$ between high level and low level alternately per selection period.

Note that the control section 3 switches between the level of $POL_1$ upon selection of an odd-numbered row and the level of $POL_1$ upon selection of an even-numbered row alternately on a frame-by-frame basis. For example, suppose that the control section 3 sets $POL_1$ to high level upon selection of an odd-numbered row and to low level upon selection of an even-numbered row in a frame. In this case, in the next frame, the control section 3 sets $POL_1$ to low level upon selection of an odd-numbered row and to high level upon selection of an even-numbered row. Thus, the control section 3 switches the level of $POL_1$ on a frame-by-frame basis.

Further, the control section 3 sets the level of $POL_2$ to high level upon selection of an odd-numbered row and to low level upon selection of an even-numbered row regardless of the frame.

Figure 7:
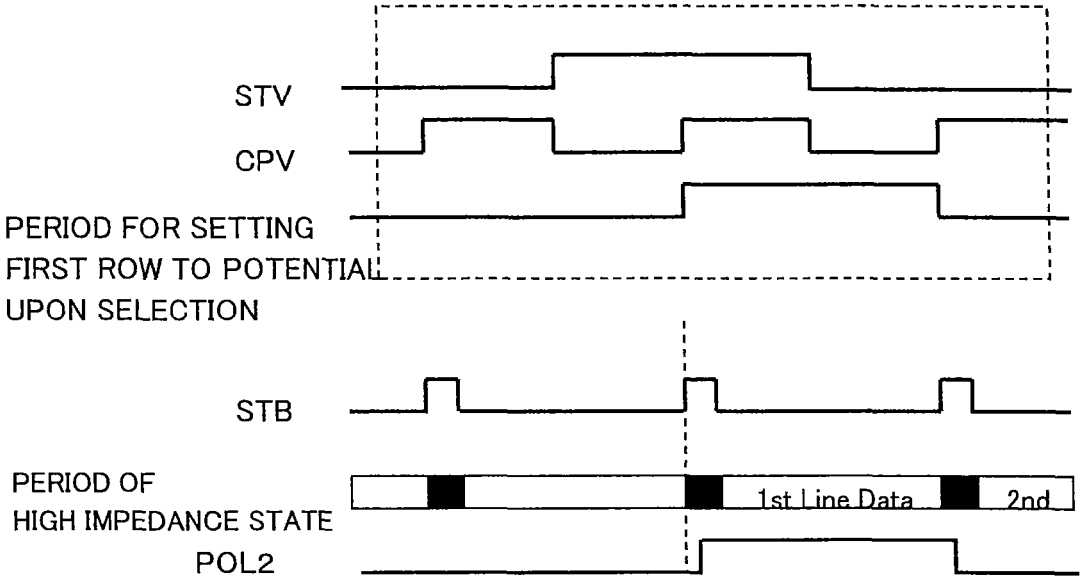
FIG. 7 is an illustrative diagram showing the timing setting of $POL_2$ upon starting a frame.

Upon starting a frame, since the first row as an odd-numbered row is selected, the control section 3 needs to set the level of $POL_2$ to high level upon starting the frame. The control section 3 has only to set the level of $POL_2$ to high level based on the rising edge of STB and the falling edge of STB within a period during which STV (see FIG. 6) to be input to the gate driver is kept at high level. FIG. 7 is an illustrative diagram showing the timing setting of $POL_2$ upon starting a frame. In FIG. 7, a portion indicated by the broken box is the same as that in FIG. 6. As will be described later, the control section 3 puts the output of the potential output terminals $D_1$ to $D_n$ of the potential setting section 11 into a high impedance state during a period in which STB is kept at high level. In FIG. 7, the periods during which the output of the potential output terminals $D_1$ to $D_n$ of the potential setting section 11 is in the high impedance state are blackened. If the control section 3 sets STB to high level in response to CPV while STV is kept at high level, the level of $POL_2$ is switched to low level while STB is kept at high level (see FIG. 7). After that, when each row of pixel electrodes is grouped, the control section 3 switches the level of $POL_2$ each time STB becomes high level.

Next, the operation will be described.

Figure 8:
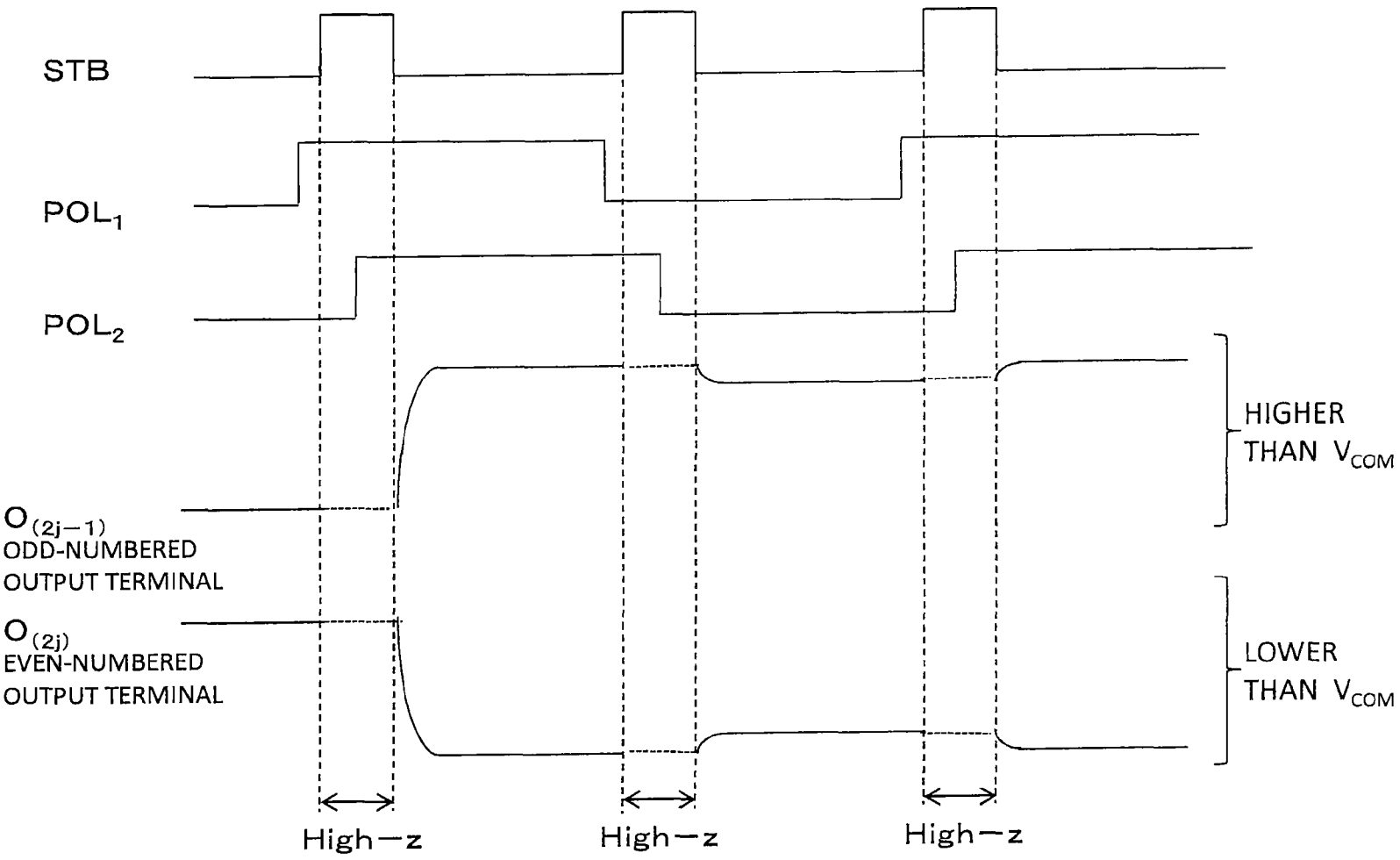
FIG. 8 is an illustrative diagram showing the relationships between STB, $POL_1$ and $POL_2$, and the potentials of output terminals of the switch section.

FIG. 8 is an illustrative diagram showing the relationships between the control signals STB, $POL_1$ and $POL_2$ output from the control section 3, and the potentials of the output terminals of the switch section 12. Here, a description will be made by taking, as an example, a frame in which the control section 3 sets $POL_1$ to high level upon selection of an odd-numbered row and to low level upon selection of an even-numbered row.

The control section 3 causes first STB to rise in the frame. The control section 3 also causes $POL_1$ and $POL_2$ to rise to high level in response to the rise of STB as control in the selection period of the first row (odd-numbered row). FIG. 8 illustrates a case where $POL_1$ is changed immediately before the rising edge of STB and $POL_2$ is changed between the rising edge and falling edge of STB. Note that the timing of changing $POL_1$ is not limited to the case shown in FIG. 8 as long as $POL_1$ and $POL_2$ are changed to respond to each selection period. As for $POL_2$, however, the output of the potential setting section sets a period (High-z) during which there is no polarity before and after the row to change $POL_2$ during this period. In other words, the control section 3 sets a period during which the output of the potential output terminals $D_1$ to $D_n$ in the potential setting section 11 becomes a high impedance state to switch the level of $POL_2$ during the period. For example, the control section 3 sets a period from the rising edge to the falling edge of STB as High-z (i.e., puts the output of the potential setting section into the high impedance state) to change $POL_2$ during this period. The same holds true for FIG. 12 to be described later.

Figure 9:
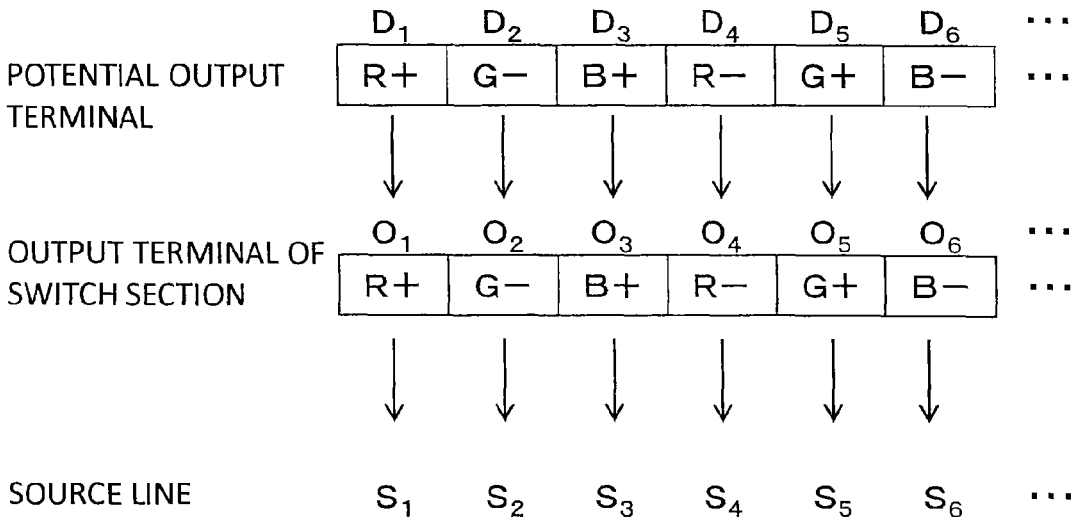
FIG. 9 is an illustrative diagram showing the correspondences among potential output terminals of the potential setting section, output terminals of the switch section and source lines.

FIG. 9 is an illustrative diagram showing the correspondences among the potential output terminals of the potential setting section 11, the output terminals of the switch section 12 and the source lines when $POL_1$ and $POL_2$ are at high level. In FIG. 9, "+" represents a potential higher than $V_{COM}$ and "−" represents a potential lower than $V_{COM}$. The same holds true for FIG. 10, FIG. 13 and FIG. 14 to be described later.

When STB rises, the potential setting section 11 transfers, to the latch section (not shown), the data for one row (data for the first row) stored in the register (not shown) at the time. The potential setting section 11 transfers the data to the latch section in order of data captured. In other words, the data on the leftmost pixel first input is transferred to a portion of the latch section corresponding to the leftmost potential output terminal $D_1$, and the data on the second pixel from the left is transferred to a portion of the latch section corresponding to the second potential output terminal $D_2$ from the left. The same holds true for the data on the other pixels.

When STB rises, the potential setting section 11 outputs a potential (any of $V_0$-$V_8$ or the like, or any of $V_9$-$V_{17}$ or the like) corresponding to the data on each pixel in the first row stored in the latch section to one of the potential output terminals $D_1$ to $D_n$ corresponding to each pixel. At this time, since $POL_1$ is at high level, the potential setting section 11 sets the output potential of each of the odd-numbered potential output terminals $D_1$, $D_3$, $D_5$, . . . from the left to a potential (any of $V_0$-$V_8$ or the like) higher than $V_{COM}$. Whether to output any of $V_0$-$V_8$ or the like may be determined according to the pixel value of each of the odd-numbered pixels from the left, respectively. Further, since $POL_1$ is at high level, the potential setting section 11 sets the output potential of each of the even-numbered each potential output terminals $D_2$, $D_4$, $D_6$, . . . from the left to a potential (any of $V_9$-$V_{17}$ or the like) lower than $V_{COM}$. Whether to output any of $V_9$-$V_{17}$ or the like may be determined according to the pixel value of each of the even-numbered pixels from the left, respectively.

Thus, since $POL_1$ is at high level, the output potentials of the odd-numbered potential output terminals $D_1$, $D_3$, $D_5$, . . . from the left become higher than $V_{COM}$ and the output potentials of the even-numbered potential output terminals $D_2$, $D_4$, $D_5$, . . . from the left become lower than $V_{COM}$.

Further, since the data stored in the latch section are sequenced in order of input of data for the first row, the potential output section 11 outputs the potentials corresponding to the data from the potential output terminals $D_1$ to $D_n$ without changing the order of the sequence of data.

$POL_2$ is also at high level at the rise time of STB. Therefore, the odd-number input terminals (noted as $I_{(2j-1)}$) from the left in the switch section 12 are electrically conducted with the odd-numbered output terminals (referred to as $O_{(2j-1)}$) from the left, respectively. As a result, the odd-numbered output terminals from the left in the switch section 12 output potentials equal to the potentials of the odd-numbered potential output terminals from the left in the potential setting section 11. Specifically, the output terminals $O_1$, $O_3$, $O_5$, . . . of the switch section 12 output potentials equal to the potentials of the potential output terminals $D_1$, $D_3$, $D_5$, . . . , respectively (see FIG. 9).

Thus, upon selection of the first row, each of the odd-numbered output terminals $O_{(2j-1)}$ from the left outputs the potential higher than $V_{COM}$ to make the potentials of the odd-numbered source lines $S_1$, $S_3$, $S_5$, . . . from the left higher than $V_{COM}$ (see FIG. 8 and FIG. 9).

Further, since $POL_2$ is at high level, the even-number input terminals (denoted as $I_{(2j)}$) from the left in the switch section 12 are electrically conducted with the even-numbered output terminals (referred to as $O_{(2j)}$) from the left, respectively. Therefore, the even-numbered output terminals from the left in the switch section 12 output potentials equal to the potentials of the even-numbered potential output terminals from the left in the potential setting section 11. Specifically, the output terminals $O_2$, $O_4$, $O_6$, . . . of the switch section 12 output potentials equal to the potentials of the potential output terminals $D_2$, $D_4$, $D_6$ . . . , respectively (see FIG. 9).

Thus, upon selection of the first row, each even-numbered output terminal $O_{(2j)}$ from the left outputs the potential lower than $V_{COM}$ to make the potentials of the even-numbered source lines $S_2$, $S_4$, $S_6$, . . . from the left lower than $V_{COM}$ (see FIG. 8 and FIG. 9).

As mentioned above, the potentials of the odd-numbered source lines from the left become higher than $V_{COM}$ and the potentials of the even-numbered source lines from the left become lower than $V_{COM}$ upon selection of the first row.

Each pixel electrode 21 in the first row (odd-numbered row) is connected to the source line located on the left side thereof. Therefore, each pixel electrode 21 in the first row becomes equal in potential to the left-hand source line. For example, the leftmost pixel electrode in the first row becomes equal in potential to the source line $S_1$.

The potential setting section 11 maintains the potential output state during the selection period without changing the output potential of each potential output terminal to a potential corresponding to data on another pixel.

Next, the control section 3 causes STB to rise again. The control section 3 also changes $POL_1$ and $POL_1$ from high level to low level in response to the rise of STB as control in the selection period of the second row (even-numbered row) (see FIG. 8).

Figure 10:
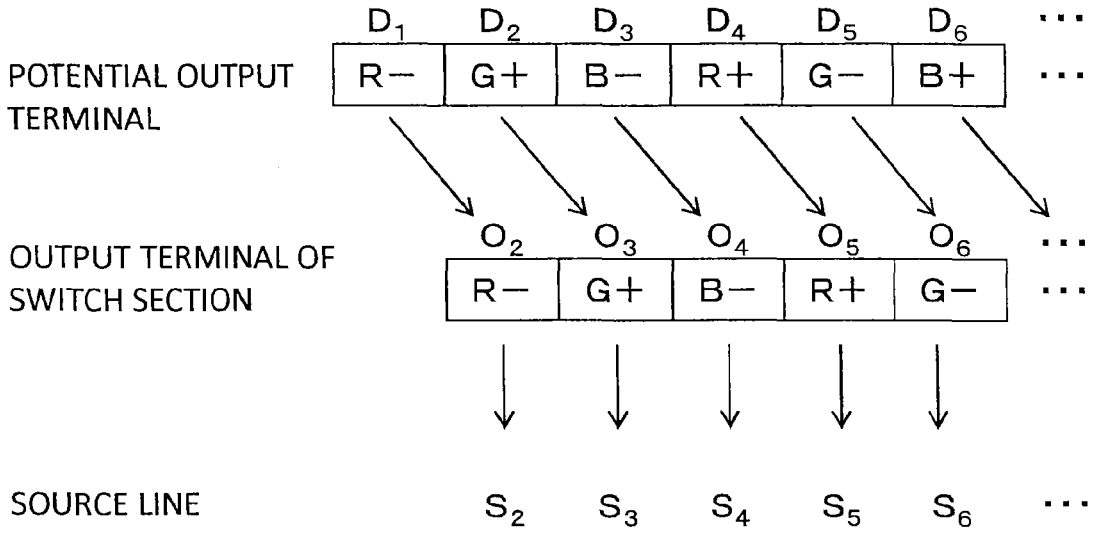
FIG. 10 is an illustrative diagram showing the correspondences among the potential output terminals of the potential setting section, the output terminals of the switch section and the source lines.

FIG. 10 is an illustrative diagram showing the correspondences among the potential output terminals of the potential setting section 11, the output terminals of the switch section 12 and the source lines when $POL_1$ and $POL_2$ are at low level.

When STB rises, the potential setting section 11 transfers, to the latch section (not shown), the data for one row (data for the second row) stored in the register (not shown) at the time. This operation is the same as that upon selection of the first row.

When STB rises, the potential setting section 11 outputs a potential (any of $V_0$-$V_8$ or the like, or any of $V_9$-$V_{17}$ or the like) corresponding to the data on each pixel in the second row stored in the latch section to one of the potential output terminals $D_1$ to $D_n$ corresponding to each pixel. At this time, since $POL_1$ is at low level, the potential setting section 11 sets the output potential of each of the odd-numbered potential output terminals $D_1$, $D_3$, $D_5$, . . . from the left to a potential (any of $V_9$-$V_{17}$ or the like) lower than $V_{COM}$. Whether to output any of $V_9$-$V_{17}$ or the like may be determined according to the pixel value of each of the odd-numbered pixels from the left, respectively. Further, since $POL_1$ is at low level, the potential setting section 11 sets the output potential of each of the even-numbered each potential output terminals $D_2$, $D_4$, $D_6$, . . . from the left to a potential (any of $V_0$-$V_8$ or the like) higher than $V_{COM}$. Whether to output any of $V_0$-$V_8$ or the like may be determined according to the pixel value of each of the even-numbered pixels from the left, respectively.

Thus, since $POL_1$ is at low level, the output potentials of the odd-numbered potential output terminals $D_1$, $D_3$, $D_5$, . . . from the left become lower than $V_{COM}$ and the output potentials of the even-numbered potential output terminals $D_2$, $D_4$, $D_6$, . . . from the left become higher than $V_{COM}$.

Further, since the data stored in the latch section are sequenced in order of input of data for the second row, the potential output section 11 outputs the potential corresponding to the data from each of the potential output terminals $D_1$ to $D_n$ without changing the order of the sequence of data.

$POL_2$ is at low level at the rise time of STB. Therefore, the odd-number input terminals $I_{(2j-1)}$ from the left in the switch section 12 are electrically conducted with the even-numbered output terminals $O_{(2j)}$ from the left, respectively. As a result, the even-numbered output terminals from the left in the switch section 12 output potentials equal to the potentials of the odd-numbered potential output terminals from the left in the potential setting section 11. Specifically, the output terminals $O_2$, $O_4$, $O_6$, . . . of the switch section 12 output potentials equal to the potentials of the potential output terminals $D_1$, $D_3$, $D_5$, . . . , respectively (see FIG. 10).

Thus, upon selection of the second row, each of the even-numbered output terminals $O_{(2j)}$ from the left outputs the potential lower than $V_{COM}$ to make the potentials of the even-numbered source lines $S_2$, $S_4$, $S_6$, . . . from the left lower than $V_{COM}$ (see FIG. 8 and FIG. 10).

Further, since $POL_2$ is at low level, the even-number input terminals $I_{(2j)}$ from the left in the switch section 12 are electrically conducted with the odd-numbered output terminals from the left, respectively. Therefore, the odd-numbered output terminals from the left in the switch section 12 output potentials equal to the potentials of the even-numbered potential output terminals from the left in the potential setting section 11. Specifically, the output terminals $O_3$, $O_5$, . . . of the switch section 12 outputs potentials equal to the potentials of the potential output terminals $D_2$, $D_4$, . . . , respectively (see FIG. 10).

Thus, upon selection of the second row, each of the odd-numbered each output terminals from the left in the switch section 12 outputs the potential higher than $V_{COM}$ to make the potentials of the odd-numbered source lines $S_3$, $S_5$, . . . from the left higher than $V_{COM}$ (see FIG. 8 and FIG. 10). Note that the source line $S_1$ is not used to set the potentials of the pixel electrodes because this is the time for selecting an even-numbered row.

As mentioned above, the potentials of the odd-numbered source lines from the left become higher than $V_{COM}$ and the potentials of the even-numbered source lines from the left become lower than $V_{COM}$ upon selection of the second row.

Each pixel electrode 21 in the second row (even-numbered row) is connected to the source line located on the right side thereof. Therefore, each pixel electrode 21 in the second row becomes equal in potential to the right-hand source line. For example, the leftmost pixel electrode in the second row becomes equal in potential to the source line $S_2$.

As will be appreciated from the foregoing, even if the selected row is changed, the odd-numbered source lines from the left are kept higher in potential than $V_{COM}$ and the even-numbered source lines from the left are kept lower in potential than $V_{COM}$.

After that, in this frame, the same operation as that upon selection of the first row is performed upon selection of an odd-numbered row, and the same operation as that upon selection of the second row is performed upon selection of an even-numbered row.

Therefore, in this frame, the odd-numbered source lines (source lines indicated by the solid line in FIG. 1) from the left are maintained at the potentials higher than $V_{COM}$. On the other hand, the even-numbered source lines (source lines indicated by the broken line in FIG. 1) from the left are maintained at the potentials lower than $V_{COM}$. Thus, the power consumption can be reduced.

As a result of the operation in this frame, the polarity of each pixel is as shown in FIG. 11. In other words, the pixels in the odd-numbered row have positive polarity, negative polarity, positive polarity, negative polarity, . . . , and the pixels in the even-numbered row have negative polarity, positive polarity, negative polarity, positive polarity, . . . . Thus, adjacent pixels are different in polarity from each other. Represented in FIG. 1 as "+" and "−" are polarities at this time.

Figure 12:
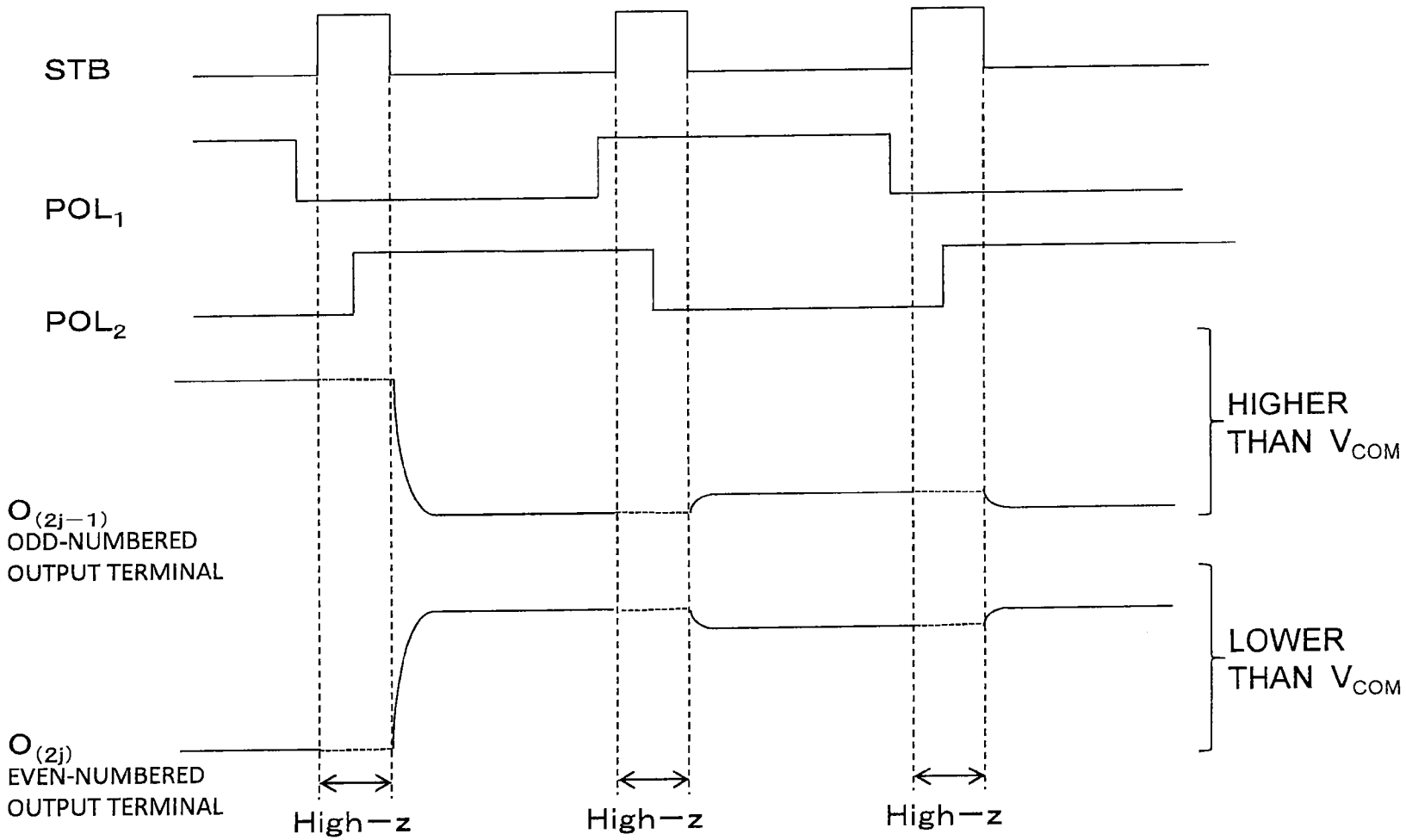
FIG. 12 is an illustrative diagram showing the relationships between STB, $POL_1$ and $POL_2$, and the potentials of the output terminals of the switch section.

In the next frame, the control section 3 sets $POL_1$ to low level upon the first selection period, and after that, the control section 3 switches the level of $POL_1$ per selection period. The others are the same as those in the above-mentioned frame. FIG. 12 is an illustrative diagram showing the relationships between the control signals STB, $POL_1$ and $POL_2$, and the potentials of the output terminals of the switch section 12 in this case.

The control section 3 causes first STB to rise in this frame. The control section 3 also sets $POL_1$ to low level in response to the rise of STB as control in the selection period of the first row (odd-numbered row). Like in the previous frame, the control section 3 causes $POL_2$ to rise to high level (see FIG. 12).

Figure 13:
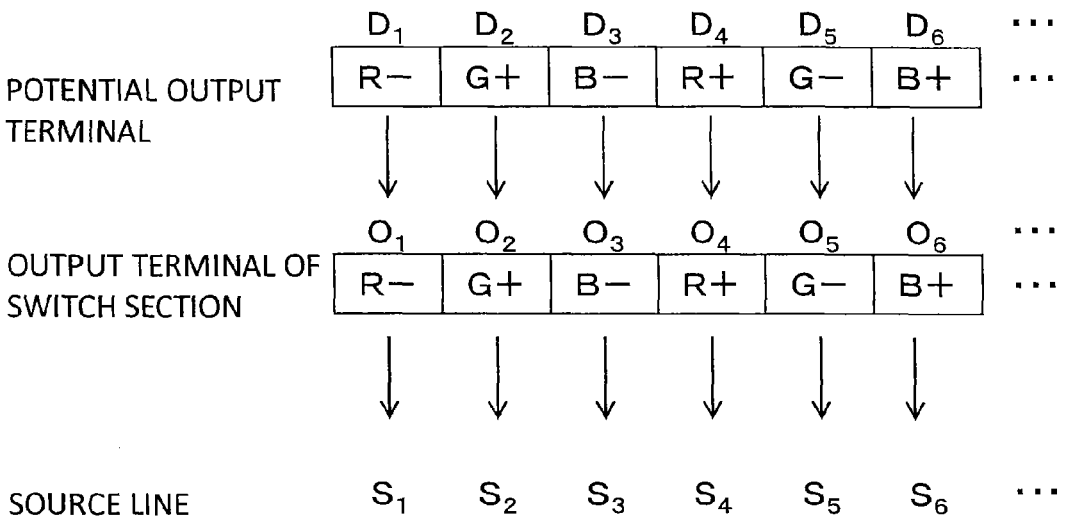
FIG. 13 is an illustrative diagram showing the correspondences among the potential output terminals of the potential setting section, the output terminals of the switch section and the source lines.

FIG. 13 is an illustrative diagram showing the correspondences among the potential output terminals of the potential setting section 11, the output terminals of the switch section 12 and the source lines when $POL_1$ is at low level and $POL_2$ is at high level.

When STB rises, the potential setting section 11 transfers, to the latch section (not shown), the data for one row (data for the first row) stored in the register (not shown) at the time. This operation is the same as that described with respect to the previous frame.

When STB rises, the potential setting section 11 outputs a potential corresponding to the data on each pixel in the first row stored in the latch section to one of the potential output terminals $D_1$ to $D_n$ corresponding to each pixel. At this time, since $POL_1$ is at low level, the potential setting section 11 sets the output potential of each of the odd-numbered potential output terminals $D_1$, $D_3$, $D_5$, . . . from the left to a potential (any of $V_9$-$V_{17}$ or the like) lower than $V_{COM}$. Whether to output any of $V_9$-$V_{17}$ or the like may be determined according to the pixel value of each of the odd-numbered pixels from the left, respectively. Further, since $POL_1$ is at low level, the potential setting section 11 sets the output potential of each of the even-numbered each potential output terminals $D_2$, $D_4$, $D_6$, . . . from the left to a potential (any of $V_0$-$V_8$ or the like) higher than $V_{COM}$. Whether to output any of $V_0$-$V_8$ or the like may be determined according to the pixel value of each of the even-numbered pixels from the left, respectively.

Thus, since $POL_1$ is at low level, the output potentials of the odd-numbered potential output terminals $D_1$, $D_3$, $D_5$, . . . from the left become lower than $V_{COM}$ and the output potentials of the even-numbered potential output terminals $D_2$, $D_4$, $D_6$, . . . from the left become higher than $V_{COM}$.

Further, since the data stored in the latch section are sequenced in order of input of data for the first row, the potential output section 11 outputs the potentials corresponding to the data from the potential output terminals $D_1$ to $D_n$ without changing the order of the sequence of data. This point is the same as that for the previous frame.

On the other hand, $POL_2$ is at high level at the rise time of STB. Therefore, the odd-number input terminals $I_{(2j-1)}$ from the left in the switch section 12 are electrically conducted with the odd-numbered output terminals $O_{(2j-1)}$ from the left, respectively. As a result, the odd-numbered output terminals from the left in the switch section 12 output potentials equal to the potentials of the odd-numbered potential output terminals from the left in the potential setting section 11. Specifically, the output terminals $O_1$, $O_3$, $O_5$, . . . of the switch section 12 output potentials equal to the potentials of the potential output terminals $D_1$, $D_3$, $D_5$, . . . , respectively (see FIG. 13).

Thus, upon selection of the first row, each of the odd-numbered output terminals $O_{(2j-1)}$ from the left outputs the potential lower than $V_{COM}$ to make the potentials of the odd-numbered source lines $S_1$, $S_3$, $S_5$, . . . from the left lower than $V_{COM}$ (see FIG. 12 and FIG. 13).

Further, since $POL_2$ is at high level, the even-number input terminals $I_{(2j)}$ from the left in the switch section 12 are electrically conducted with the even-numbered output terminals $O_{(2j)}$ from the left, respectively. Therefore, the even-numbered output terminals from the left in the switch section 12 output potentials equal to the potentials of the even-numbered potential output terminals from the left in the potential setting section 11. Specifically, the output terminals $O_2$, $O_4$, $O_6$, . . . of the switch section 12 output potentials equal to the potentials of the potential output terminals $D_2$, $D_4$, $D_6$, . . . , respectively (see FIG. 13).

Thus, upon selection of the first row, each of the even-numbered output terminals $O_{(2j)}$ from the left outputs the potential higher than $V_{COM}$ to make the potentials of the even-numbered source lines $S_2$, $S_4$, $S_6$, . . . from the left higher than $V_{COM}$ (see FIG. 12 and FIG. 13).

As mentioned above, the potentials of the odd-numbered source lines from the left become lower than $V_{COM}$ and the potentials of the even-numbered source lines from the left become higher than $V_{COM}$ upon selection of the first row.

Each pixel electrode 21 in the first row (odd-numbered row) is connected to the source line located on the left side thereof. Therefore, each pixel electrode 21 in the first row becomes equal in potential to the left-hand source line.

Next, the control section 3 causes STB to rise again. The control section 3 changes $POL_1$ from low level to high level in response to the rise of STB as control in the selection period of the second row (even-numbered row) (see FIG. 12).

Figure 14:
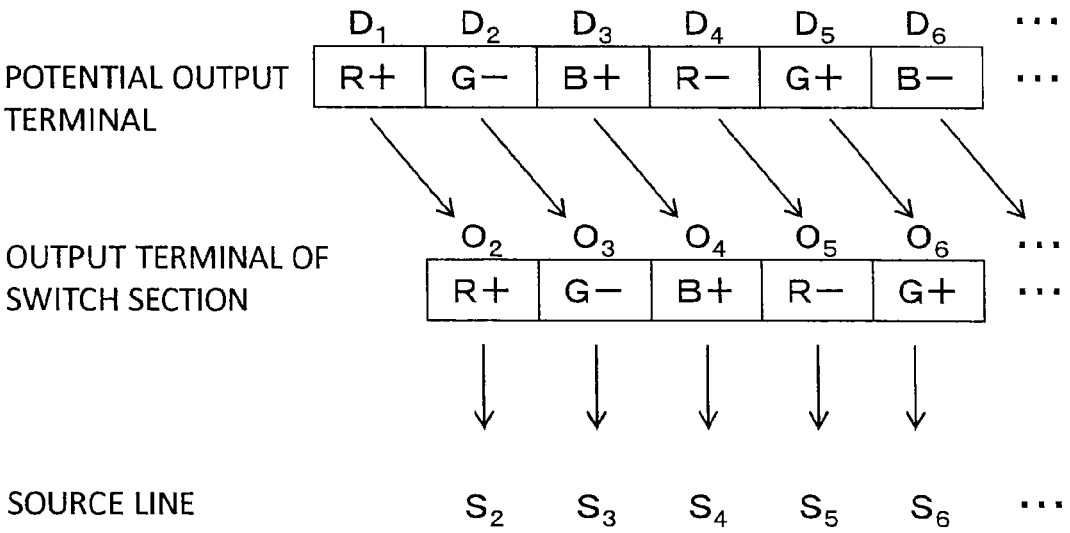
FIG. 14 is an illustrative diagram showing the correspondences among the potential output terminals of the potential setting section, the output terminals of the switch section and the source lines.

FIG. 14 is an illustrative diagram showing the correspondences among the potential output terminals of the potential setting section 11, the output terminals of the switch section 12 and the source lines when $POL_1$ is high level and $POL_2$ is low level.

When STB rises, the potential setting section 11 transfers, to the latch section (not shown), the data for one row (data for the second row) stored in the register (not shown) at the time.

When STB rises, the potential setting section 11 outputs a potential corresponding to the data on each pixel in the second row stored in the latch section to one of the potential output terminals $D_1$ to $D_n$ corresponding to each pixel. At this time, since $POL_1$ is at high level, the potential setting section 11 sets the output potential of each of the odd-numbered potential output terminals $D_1$, $D_3$, $D_5$, . . . from the left to a potential (any of $V_0$-$V_8$ or the like) higher than $V_{COM}$. Whether to output any of $V_0$-$V_8$ or the like may be determined according to the pixel value of each of the odd-numbered pixels from the left, respectively. Further, since $POL_1$ is at high level, the potential setting section 11 sets the output potential of each of the even-numbered each potential output terminals $D_2$, $D_4$, $D_6$, . . . from the left to a potential (any of $V_9$-$V_{17}$ or the like) lower than $V_{COM}$. Whether to output any of $V_9$-$V_{17}$ or the like may be determined according to the pixel value of each of the even-numbered each pixels from the left, respectively.

Thus, since $POL_1$ is at high level, the output potentials of the odd-numbered potential output terminals $D_1$, $D_3$, $D_5$, . . . from the left become higher than $V_{COM}$ and the output potentials of the even-numbered potential output terminals $D_2$, $D_4$, $D_6$, . . . from the left become lower than $V_{COM}$.

Further, since the data stored in the latch section are sequenced in order of input of data for the second row, the potential output section 11 outputs the potential corresponding to the data from each of the potential output terminals $D_1$ to $D_n$ without changing the order of the sequence of data.

On the other hand, $POL_2$ is at low level at the rise time of STB. Therefore, the odd-number input terminals $I_{(2j-1)}$ from the left in the switch section 12 are electrically conducted with the even-numbered output terminals $O_{(2j)}$ from the left, respectively. As a result, the even-numbered output terminals from the left in the switch section 12 output potentials equal to the potentials of the odd-numbered potential output terminals from the left in the potential setting section 11. Specifically, the output terminals $O_2$, $O_4$, $O_6$, . . . of the switch section 12 output potentials equal to the potentials of the potential output terminals $D_1$, $D_3$, $D_5$, . . . , respectively (see FIG. 14).

Thus, upon selection of the second row, each of the even-numbered output terminals $O_{(2j)}$ from the left outputs the potential higher than $V_{COM}$ to make the potentials of the even-numbered source lines $S_2$, $S_4$, $S_6$, . . . from the left higher than $V_{COM}$ (see FIG. 12 and FIG. 14).

Further, since $POL_2$ is at low level, the even-number input terminals $I_{(2j)}$ from the left in the switch section 12 are electrically conducted with the odd-numbered output terminals from the left, respectively. Therefore, the odd-numbered output terminals from the left in the switch section 12 output potentials equal to the potentials of the even-numbered potential output terminals from the left in the potential setting section 11. Specifically, the output terminals $O_3$, $O_5$, . . . of the switch section 12 outputs potentials equal to the potentials of the potential output terminals $D_2$, $D_4$, . . . , respectively (see FIG. 14).

Thus, upon selection of the second row, each of the odd-numbered each output terminals from the left in the switch section 12 outputs the potential lower than $V_{COM}$ to make the potentials of the odd-numbered source lines $S_3$, $S_5$, . . . from the left lower than $V_{COM}$ (see FIG. 12 and FIG. 14). Note that the source line $S_1$ is not used to set the potentials of the pixel electrodes because this is the time for selecting an even-numbered row.

As mentioned above, the potentials of the odd-numbered source lines from the left become lower than $V_{COM}$ and the potentials of the even-numbered source lines from the left become higher than $V_{COM}$ upon selection of the second row.

Each pixel electrode 21 in the second row (even-numbered row) is connected to the source line located on the right side thereof. Therefore, each pixel electrode 21 in the second row becomes equal in potential to the right-hand source line.

As will be appreciated from the foregoing, even if the selected row is changed in the frame, the odd-numbered source lines from the left are kept lower in potential than $V_{COM}$ and the even-numbered source lines from the left are kept higher in potential than $V_{COM}$.

After that, in this frame, the same operation as that upon selection of the first row is performed upon selection of an odd-numbered row, and the same operation as that upon selection of the second row is performed upon selection of an even-numbered row.

Therefore, in this frame, the odd-numbered source lines from the left are maintained at the potentials lower than $V_{COM}$. On the other hand, the even-numbered source lines from the left are maintained at the potentials higher than $V_{COM}$. Thus, the power consumption can be reduced.

As a result of the operations for this frame, the polarity of each pixel is as shown in FIG. 15. In other words, the pixels in the odd-numbered row have negative polarity, positive polarity, negative polarity, positive polarity, . . . and the pixels in the even-numbered row have positive polarity, negative polarity, positive polarity, negative polarity, . . . . Thus, adjacent pixels are different in polarity from each other.

After that, the frame operation illustrated in FIG. 8 and the frame operation illustrated in FIG. 12 is repeated alternately. A comparison between FIG. 11 and FIG. 15 shows that the polarity of the same pixel can be reversed on a frame-by-frame basis.

According to the first embodiment, the potential of each source line is maintained higher than $V_{COM}$ or lower than $V_{COM}$ in a frame. This can reduce the number of pixels having the same polarity and appearing consecutively (in the first embodiment, adjacent pixels are made to have different polarities) to drive the liquid crystal display panel while reducing power consumption.

Further, it is determined on a row-by-row basis to which source line, the left-hand source line or the right-hand source line, each pixel electrode is connected. Then, the switch section 12 connects the output terminals of the potential setting section 11 to the output terminals that reach the source lines connected to the pixel electrodes, respectively. In this case, no change in connecting condition on the output terminals of the potential setting section 11 is made during the selection period. Therefore, data on each pixel included in the input data for one row can be transferred to the latch section without changing the order of the sequence of data and output a potential corresponding to the data on each pixel.

Since the connecting condition on the output terminals of the potential setting section 11 is not changed during the selection period, sufficient time required to set desired potentials of the source lines can be secured within the selection period. This eliminates the problem that the source lines may not be able to be set to desired potentials depending on the number of gate lines (the size of the display panel).

Further, the power consumption can be reduced, and this can prevent the driving device 1 from generating heat. For example, even if the liquid crystal display panel 2 is driven at double speed or quad-speed, the heat generation can be prevented.

Figure 16:
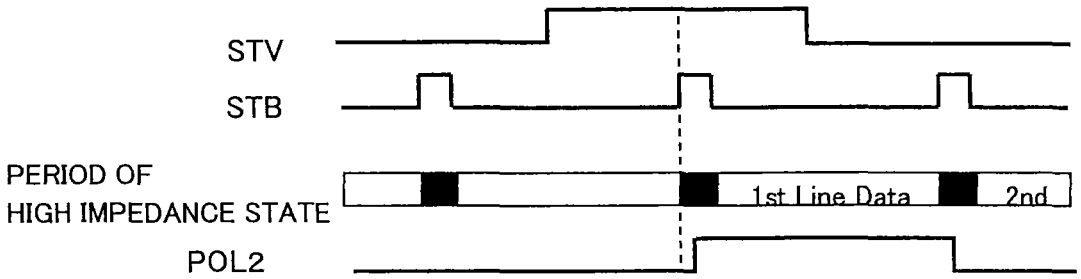
FIG. 16 is an illustrative diagram showing a mode in which the potential setting section generates $POL_2$.

The above has described the case where the control section 3 inputs $POL_2$ to the switch section 12 of the driving device 1. However, the potential setting section 11 may generate and input $POL_2$ to the switch section 12, rather than that the control section 3 generates $POL_2$. FIG. 16 is an illustrative diagram showing a mode in which the potential setting section 11 generates $POL_2$. In this case, the control section 3 inputs STV not only to the gate driver (not shown) but also to the potential setting section 11. This enables the potential setting section 11 to determine the start of a frame. The potential setting section 11 inputs generated $POL_2$ to the switch section 12. During a period in which STV input form the control section 3 is at high level, if STB input from the control section 3 becomes high level, the potential setting section 11 may switch the level of $POL_2$ from low level to high level during the period in which STB is maintained at high level (see FIG. 16). During the period in which STB is maintained at high level, the output of the potential output terminals $D_1$ to $D_n$ is in a high impedance state. After that, the potential setting section 11 switches the level of $POL_2$ alternately each time STB becomes high level. The operation is the same as that already described, except that $POL_2$ is generated by the potential setting section 11 and STV is input to the potential setting section 11. Even in this case, the control section 3 is also configured to switch, on a frame-by-frame basis, between the mode of control signal output to set $POL_1$ to high level when $POL_2$ becomes high level or set $POL_1$ to low level when $POL_2$ when $POL_2$ becomes low level, and the mode of control signal output to set $POL_1$ to low level when $POL_2$ becomes high level or set $POL_1$ to high level when $POL_2$ becomes low level.

Further, depending on the specifications of a driver IC that accepts a TAB substrate or COG (Chip on Glass), the number of outputs in one chip may be selectable in a setting mode. For example, some driver ICs with 480-pin output may be able to switch to 402-pin output in the setting mode. In this case, unused 78 pins are set up near the center of the driver IC.

Second Embodiment

In the first embodiment, pixel electrodes in odd-numbered rows are connected to left-hand source lines and pixel electrodes in even-numbered rows are connected to right-hand source lines. In a second embodiment, two or more consecutive rows are so set as one group that pixel electrodes in each row of an odd-numbered group are connected to left-hand source lines and pixel electrodes in each row of an even-numbered group are connected to right-hand source lines.

Figure 17:
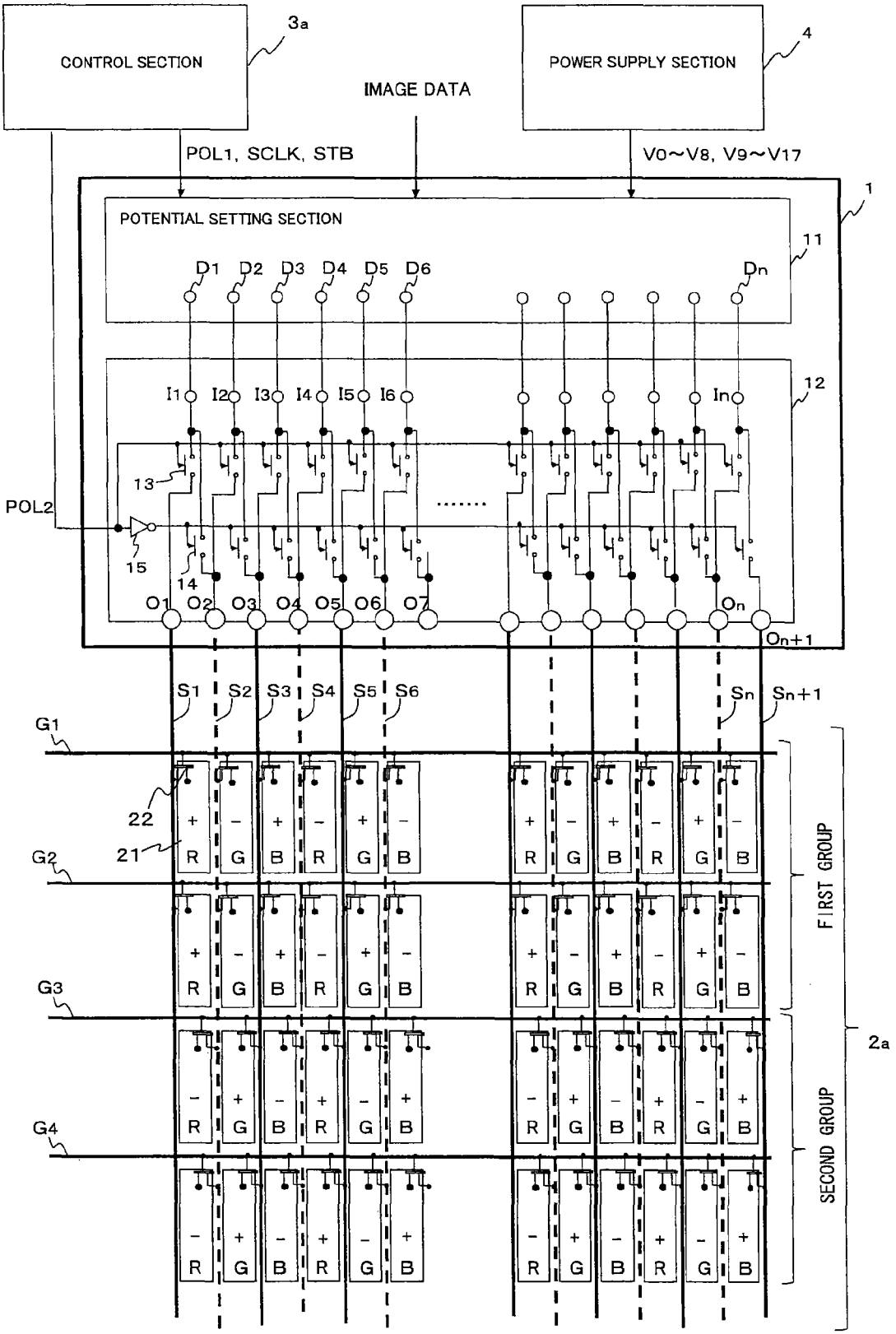
FIG. 17 is an illustrative diagram showing a liquid crystal display device according to a second embodiment of the present invention.

FIG. 17 is an illustrative diagram showing a liquid crystal display device according to the second embodiment of the present invention. The same components as those in the first embodiment will be given the same reference numerals as those in FIG. 1 to omit the detailed description thereof. The liquid crystal display device of the second embodiment includes the driving device 1, a liquid crystal display panel $\mathbf{2}_a$, a control section $\mathbf{3}_a$ and the power supply section 4.

The liquid crystal display panel $\mathbf{2}_a$ is configured to sandwich liquid crystal (not shown) between the multiple pixel electrodes 21 arranged in a matrix and the common electrode (not shown in FIG. 17). In each row of the liquid crystal display panel $\mathbf{2}_a$, respective pixels are disposed in a repetitive pattern in order of R(red), G(green) and B(blue).

The liquid crystal display panel $\mathbf{2}_a$ includes not only source lines on the left side of the pixel electrodes in each column, but also a source line on the right side of the rightmost pixel column. In other words, the number of source lines is one more than the number of columns of the pixel electrodes. Further, pixel electrodes for one column are disposed between adjacent source lines. Each of source lines $S_1$ to $S_{n+1}$ corresponds to one of output terminals of the switch section 12, respectively, and is connected to the corresponding output terminal of the switch section 12 according to the order of the sequence of source lines.

The active element 22 is provided for each pixel electrode 21, and each pixel electrode 21 is connected to a source line through the active element 22. The above configuration is the same as that of the liquid crystal display panel 2 according to the first embodiment. Like in the first embodiment, the following description will be made by taking, as an example, the case where the active element 22 is a TFT.

In the second embodiment, two or more consecutive rows of pixel electrodes 21 are combined into one group. In FIG. 17, a case where two consecutive rows are combined into one group is shown. Note that the number of rows combined into one group is not limited to two rows. For example, three consecutive rows or four consecutive rows may be combined into one group. If the number of rows of pixel electrodes 21 is N, the number of rows combined into one group may be N−1 or less.

The following description will be made by taking the case where two consecutive rows are combined into one group. In other words, the first row and second row of pixel electrodes 21 are grouped as the first group, and the third row and fourth row are grouped as the second group. The subsequent rows are also grouped in the same manner.

Then, each pixel electrode 21 in each row of an odd-numbered group is connected to a left-hand source line through each TFT 22. In odd-numbered groups, for example, the TFTs 22 are provided on the left side of the pixel electrodes 21, respectively. However, the position of the TFT 22 is not limited to this position, i.e., the position is optional.

Each pixel electrode 21 in each row of an even-numbered group is connected to a right-hand source line through each TFT 22. In even-numbered groups, for example, the TFTs 22 are provided on the right side of the pixel electrodes 21, respectively. However, the position of the TFT 22 is not limited to this position, i.e., the position is optional.

The operations of the power supply section 4 and the driving device 1 (the potential setting section 11 and the switch section 12) is the same as those in the first embodiment. Since the second embodiment is different from the first embodiment in the mode in which the control section $\mathbf{3}_a$ outputs $POL_1$ and $POL_2$, the potential setting section 11 and the switch section 12 operate in accordance with $POL_1$ and $POL_2$ input from the control section $\mathbf{3}_a$.

Like in the first embodiment, the liquid crystal display device of the second embodiment also includes the gate driver (not shown) for setting the potential of each gate line. The gate driver selects gate lines sequentially one by one and sets a selected gate line to a potential upon selection and an unselected gate line to a potential upon non-selection. Thus, the rows in each group are selected one by one. The driving device 1 may function as the gate driver.

The control section $\mathbf{3}_a$ outputs $POL_1$, $POL_2$, SCLK and STB to control the potential setting section 11 and the switch section 12.

The output mode of SCLK and STB is the same as that in the first embodiment. In other words, the control section $\mathbf{3}_a$ uses STB to set down the selection period, and uses SCLK to cause the potential setting section 11 to capture data for one row into the register. Then, the control section $\mathbf{3}_a$ causes STB to rise so that the potential setting section 11 will transfer the captured data for one row to the latch section (not shown). Further, the control section $\mathbf{3}_a$ causes STB to fall so that the potential setting section 11 will output, from each of the potential output terminals $D_1$ to $D_n$, each potential corresponding to the data for one row transferred to the latch section.

In the second embodiment, the control section $\mathbf{3}_a$ switches the levels of $POL_1$ and $POL_2$ between high level and low level alternately in one frame on a group-by-group basis.

In other words, the control section $\mathbf{3}_a$ switches between the level of $POL_1$ when each row in the odd-numbered group is selected one by one and the level of $POL_1$ when each row in the even-numbered group is selected one by one alternately on a frame-by-frame basis. For example, suppose that the control section $\mathbf{3}_a$ sets, in a frame, the level of $POL_1$ to high level when each row in the odd-numbered group is selected one by one and the level of $POL_1$ to low level when each row in the even-numbered group is selected one by one. In the next frame, the control section $\mathbf{3}_a$ sets the level of $POL_1$ to low level when each row in the odd-numbered group is selected one by one and the level of $POL_1$ to high level when each row in the even-numbered group is selected one by one.

Further, regardless of the frame, the control section $\mathbf{3}_a$ sets the level of $POL_2$ to high level when each row in the odd-numbered group is selected one by one and the level of $POL_2$ to low level when each row in the even-numbered group is selected one by one.

In the embodiment, if the control section 3 sets STB to high level in response to CPV while STV (see FIG. 6) is kept at high level, the level of $POL_2$ is switched from low level to high level while STB is kept at high level. After that, if the number of rows forming a group is denoted as g, the control section 3 has just to repeat switching of the level of $POL_2$ during a period in which STB becomes high level after g times.

Figure 18:
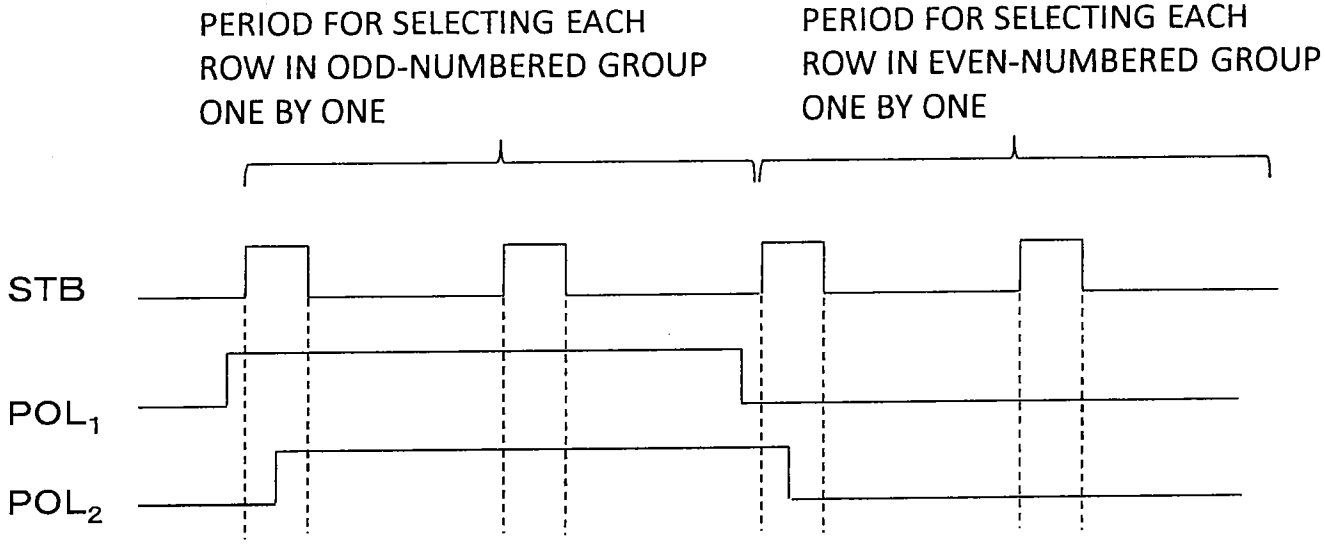
FIG. 18 is an illustrative diagram showing an example of outputting STB, $POL_1$ and $POL_2$ in the second embodiment.

Next, the operation will be described. First, a description will be made of a frame in which $POL_1$ is set to high level during a period for selecting each row in the odd-numbered group one by one (hereinafter referred to as the selection period of the odd-numbered group for descriptive purposes) and $POL_1$ is set to low level during a period for selecting each row in the even-numbered group one by one (hereinafter referred to as the selection period of the even-numbered group for descriptive purposes). FIG. 18 is an illustrative diagram showing an example of outputting STB, $POL_1$ and $POL_2$ in this frame.

Upon selection period of the odd-numbered group, the control section $\mathbf{3}_a$ sets $POL_1$ and $POL_2$ to high level, respectively (see FIG. 18). Thus, the operation when respective rows are selected sequentially during the selection period of the odd-numbered group is the same as the operation upon the selection period during which the control section 3 sets both $POL_1$ and $POL_2$ to high level in the first embodiment. Therefore, like in the case shown in FIG. 9, the potential setting section 11 outputs potentials higher than $V_{COM}$ from odd-numbered potential output terminals $D_1, D_3, D_5, \ldots$ from the left, and the switch section 12 outputs the potentials from odd-numbered output terminals, respectively. Further, the potential setting section 11 outputs potentials lower than $V_{COM}$ from even-numbered potential output terminals $D_2, D_4, D_6, \ldots$ from the left, and the switch section 12 outputs the potentials from even-numbered output terminals $O_2, O_4, O_6, \ldots$ from the left. Thus, odd-numbered source lines from the left become potentials higher than $V_{COM}$ and even-numbered source lines from the left become potentials lower than $V_{COM}$.

Further, upon selection period of the even-numbered group, the control section $\mathbf{3}_a$ sets $POL_1$ and $POL_2$ to low level, respectively (see FIG. 18). Thus, the operation when respective rows are selected sequentially during the even-numbered selection period is the same as the operation upon the selection period during which the control section 3 sets both $POL_1$ and $POL_2$ to low level in the first embodiment. Therefore, like in the case shown in FIG. 10, the potential setting section 11 outputs potentials lower than $V_{COM}$ from the odd-numbered potential output terminals $D_1, D_3, D_5, \ldots$ from the left, and the switch section 12 outputs the potentials from the even-numbered output terminals $O_2, O_4, O_6, \ldots$ from the left. Further, the potential setting section 11 outputs potentials higher than $V_{COM}$ from the even-numbered potential output terminals $D_2, D_4, \ldots$ from the left, and the switch section 12 outputs the potentials from the odd-numbered potential output terminals $D_3, D_5, \ldots$ from the left. Thus, the odd-numbered source lines from the left become potentials higher than $V_{COM}$ and the even-numbered source lines from the left become potentials lower than $V_{COM}$.

Thus, in this frame, each source line is maintained at a potential higher than $V_{COM}$ or a potential lower than $V_{COM}$.

As a result of the above frame operation, the polarity of each pixel is as shown in FIG. 19. In other words, the pixels in each row in the odd-numbered group have positive polarity, negative polarity, positive polarity, negative polarity, . . . , and the pixels in each row in the even-numbered group have negative polarity, positive polarity, negative polarity, positive polarity, . . . . Represented in FIG. 17 as "+" and "−" are polarities at this time.

Figure 20:
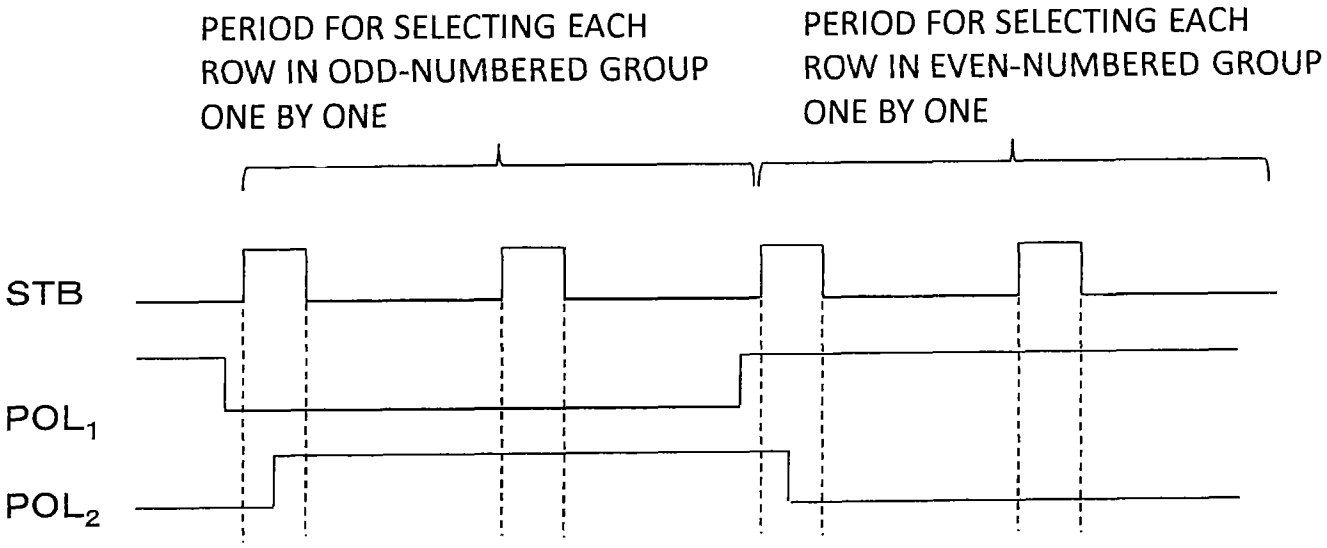
FIG. 20 is an illustrative diagram showing an example of outputting STB, $POL_1$ and $POL_2$ in the second embodiment.

Next, a description will be made of a frame in which $POL_1$ is set to low level upon selection period of the odd-numbered group and $POL_1$ is set to high level upon selection period of the even-numbered group. FIG. 20 is an illustrative diagram showing an example of outputting STB, $POL_1$ and $POL_2$ in this frame.

Upon selection period of the odd-numbered group, the control section $\mathbf{3}_a$ sets $POL_1$ to low level and $POL_2$ to high level (see FIG. 20). Thus, the operation when respective rows are selected sequentially during the selection period of the odd-numbered group is the same as the operation upon the selection period during which the control section 3 sets $POL_1$ to low level and $POL_2$ to high level in the first embodiment. Therefore, like in the case shown in FIG. 13, the potential setting section 11 outputs potentials lower than $V_{COM}$ from the odd-numbered potential output terminals $D_1, D_3, D_5, \ldots$ from the left, and the switch section 12 outputs the potentials from odd-numbered potential output terminals $D_1, D_3, D_5, \ldots$ from the left, and the switch section 12 outputs the potentials from the odd-numbered output terminals $O_1, O_3, O_5, \ldots$ from the left. Further, the potential setting section 11 outputs potentials higher than $V_{COM}$ from the even-numbered potential output terminal $D_2, D_4, D_6, \ldots$ from the left, and the switch section 12 outputs the potentials from the even-numbered output terminals $O_2, O_4, O_6, \ldots$ from the left. Thus, the odd-numbered source lines from the left become potentials lower than $V_{COM}$ and the even-numbered source lines from the left become potentials higher than $V_{COM}$.

Further, upon selection period of the even-numbered group, the control section $\mathbf{3}_a$ sets $POL_1$ to high level and $POL_2$ to low level (see FIG. 20). Thus, the operation when respective rows are selected sequentially during the selection period of the even-numbered selection period is the same as the operation upon the selection period during which the control section 3 sets $POL_1$ to high level and $POL_2$ to low level in the first embodiment. Therefore, like in the case shown in FIG. 14, the potential setting section 11 outputs potentials higher than $V_{COM}$ from the odd-numbered potential output terminals $D_1, D_3, D_5, \ldots$ from the left, and the switch section 12 outputs the potentials from the even-numbered output terminals $O_2, O_4, O_6, \ldots$ from the left. Further, the potential setting section 11 outputs potentials lower than $V_{COM}$ from the even-numbered potential output terminals $D_2, D_4, \ldots$ from the left, and the switch section 12 outputs the potentials lower than $V_{COM}$ from the odd-numbered potential output terminals $D_3, D_5, \ldots$ from the left. Thus, the odd-numbered source lines from the left become potentials lower than $V_{COM}$ and the even-numbered source lines from the left become potentials higher than $V_{COM}$.

Thus, in this frame, each source line is also maintained at a potential higher than $V_{COM}$ or a potential lower than $V_{COM}$.

As a result of the above frame operation, the polarity of each pixel is as shown in FIG. In other words, the pixels in each row in the odd-numbered group have negative polarity, positive polarity, negative polarity, positive polarity, . . . , and the pixels in each row in the even-numbered group have positive polarity, negative polarity, positive polarity, negative polarity, . . . . A comparison between FIG. 19 and FIG. 21 shows that the polarity of the same pixel can be reversed on a frame-by-frame basis.

The second embodiment is the same as the first embodiment, except in that consecutive rows are so grouped that longitudinal pixels belonging to the same group will be sequenced with the same polarity. Thus, the second embodiment also has effects similar to the first embodiment. However, the first embodiment is preferred in that all adjacent pixels are different in polarity from each other.

In the second embodiment, the liquid crystal display device may also be configured such that the potential setting section 11 generates and inputs $POL_2$ to the switch section 12, rather than that the control section $\mathbf{3}_a$ generates $POL_2$. In this case, as described in the first embodiment, the control section $\mathbf{3}_a$ outputs STV not only to the gate driver (not shown) but also to the potential setting section 11. During a period in which STV input from the control section $\mathbf{3}_a$ is at high level, if STB input from the control section 3 has become high level, the potential setting section 11 switches the level of $POL_2$ from low level to high level during the period in which STB is maintained at high level. After that, if the number of rows forming a group is denoted as g, the potential setting section 11 has just to repeat switching of the level of $POL_2$ during a period in which STB becomes high level after g times. The others are the same as those already described, except in that the potential setting section 11 generates $POL_2$ and STV is input to the potential setting section 11.

Note that the first embodiment corresponds to a case where the number of rows belonging to each group in the second embodiment is one. Therefore, it can be said that the first embodiment is another aspect of the second embodiment.

Further, in the second embodiment, the description is made of the case where each pixel in the odd-numbered group is connected to a left-hand source line and each pixel in the even-numbered group is connected to a right-hand source line, but the structure may be such that each pixel in the odd-numbered group is connected to a right-hand source line and each pixel in the even-numbered group is connected to a left-hand source line. In this case, the control section $3_a$ outputs $POL_1$ and $POL_2$ according to this structure.

Similarly, the structure in the first embodiment may be such that each pixel in odd-numbered rows is connected to a right-hand source line and each pixel in even-numbered rows is connected to a left-hand source line. In this case, the control section 3 outputs $POL_1$ and $POL_2$ according to this structure. The same holds true for each embodiment to be described below.

Third Embodiment

Figure 22:
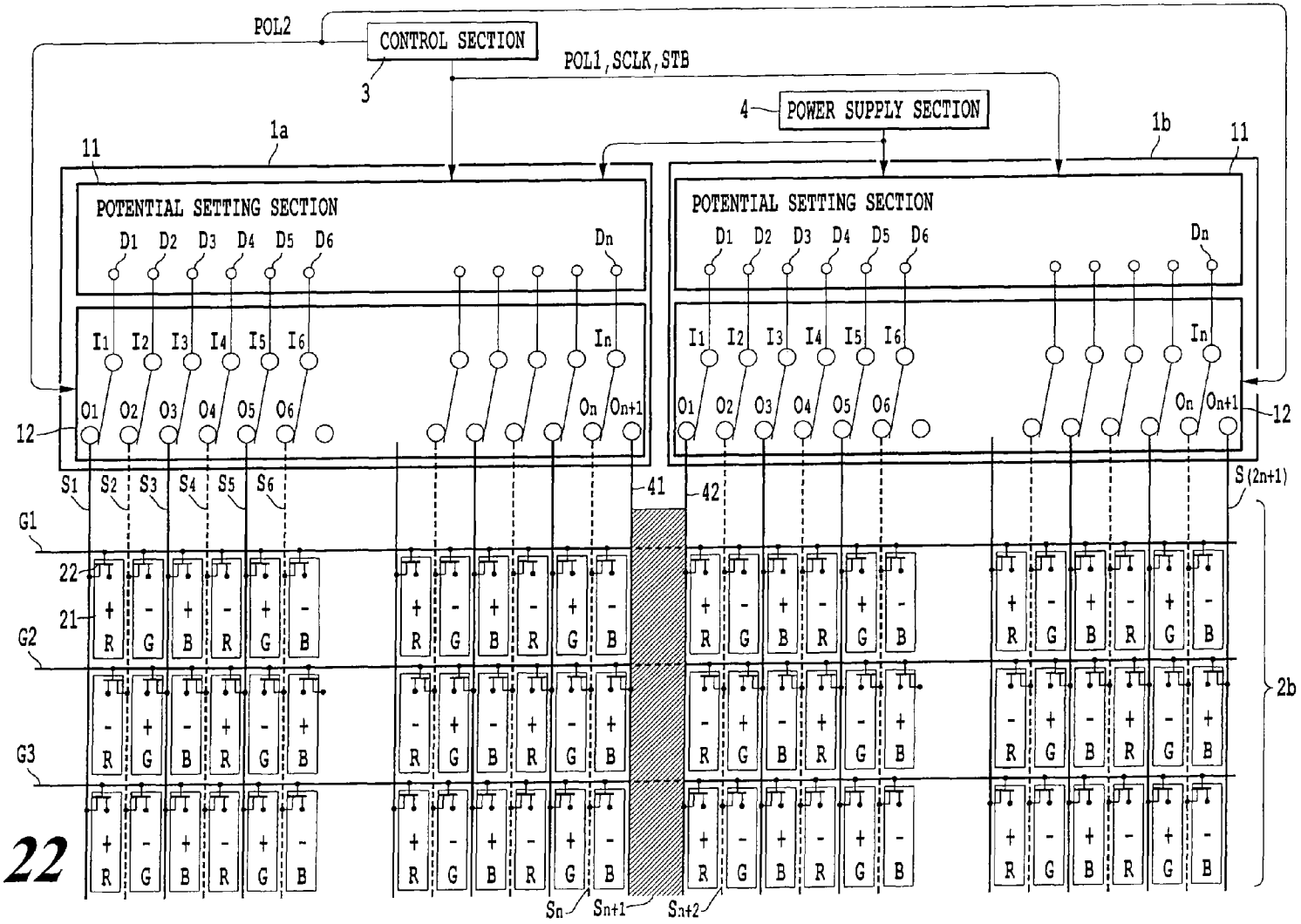
FIG. 22 is an illustrative diagram showing an example of a liquid crystal display device according to a third embodiment of the present invention.

FIG. 22 is an illustrative diagram showing an example of a liquid crystal display device according to a third embodiment of the present invention. The same components as those in the first embodiment will be given the same reference numerals as those in FIG. 1 to omit the detailed description thereof. This is applicable to a case where the first or last driving device does not use all the output pins of the driving device depending on the resolution. Further, depending on the specifications of a driver IC that accepts a TAB substrate or COG (Chip on Glass), the number of outputs in one chip may be selectable in a setting mode. For example, some driver ICs with 480-pin output may be able to switch to 402-pin output in the setting mode. In this case, unused 78 pins are set up near the center of the driver IC. In such a driver IC, the driving device can be handled as if two driving devices existed in one chip like in this embodiment.

The liquid crystal display device of the third embodiment includes two or more driving devices 1*a* and 1*b*, a liquid crystal display panel $2_b$, the control section 3 and the power supply section 4. Here, a case where two driving devices 1*a* and 1*b* are provided will be described, but three or more driving devices may be provided.

The driving devices 1*a* and 1*b* have the same structure as the driving device 1 in the first embodiment, including the potential setting section 11 and the switch section 12, respectively. Note that in FIG. 22 each switch section 12 is schematically shown like in the case illustrated in FIG. 4.

The potential setting section 11 provided in each of the driving devices 1*a* and 1*b* includes n potential output terminals $D_1$ to $D_n$, respectively. Then, like in the first embodiment, the potential setting section 11 outputs a potential higher than $V_{COM}$ and a potential lower than $V_{COM}$ alternately in response to $POL_1$ input to each potential output terminal. As for the potential of the rightmost potential output terminal $D_n$ of the potential setting section 11 in the left driving device 1*a* and the potential of the leftmost potential output terminal $D_1$ of the potential setting section 11 in the right driving device 1*b*, if one output potential is higher than $V_{COM}$, the other output potential is set lower than $V_{COM}$. To this end, the number, n, of potential output terminals of each potential setting section 11 is set to an even number. Further, in order to combine R, G and B into one set, the number of potential output terminals of each potential setting section 11 needs to be a multiple of 3. Therefore, in this embodiment, it is assumed that the number, n, of potential output terminals of each potential setting section 11 is a multiple of 6.

The operation of each potential setting section 11 performed in response to $POL_1$, SCLK and STB is the same as that in the first embodiment.

Further, the left the left driving device 1*a* takes charge of processing the first half of image data for one row, the right driving device 1*b* takes charge of processing the second half of the data for one row. In other words, the potential setting section 11 of the driving device 1*a* captures the first half of data for one row sequentially in response to SCLK. On the other hand, the potential setting section 11 of the driving device 1*b* captures the second half of data for one row sequentially in response to SCLK.

The switch section 12 provided in each of the driving devices 1*a* and 1*b* is the same as the switch section 12 in the first embodiment, including input terminals $I_1$ to $I_n$ and n+1 output terminals $O_1$ to $O_{n+1}$. The operation of each switch section 12 performed in response to $POL_2$ is the same as that in the first embodiment.

The liquid crystal display panel $2_b$ is configured to sandwich liquid crystal (not shown) between multiple pixel electrodes 21 arranged in a matrix, a common electrode (not shown in FIG. 22). In each row of the liquid crystal display panel $2_b$, respective pixels are disposed in a repetitive pattern in order of R(red), G(green) and B(blue).

The liquid crystal display panel $2_b$ includes not only source lines on the left side of the pixel electrodes in each column, but also a source line on the right side of the rightmost pixel column. In other words, the number of source lines is one more than the number of columns of the pixel electrodes. Further, pixel electrodes for one column are disposed between adjacent source lines. The above is the same as in the first embodiment.

In the embodiment, however, the number of columns of pixel electrodes is more than the number, n, of potential output terminals of one potential setting section 11. Here, a case where the number of columns of pixel electrodes is 2n is taken as an example. In this case, the number of source lines is 2n+1 and the source lines are denoted as $S_1$ to $S_{(2n+1)}$ from the left.

The first to n-th source lines $S_1$ to $S_n$ from the left correspond to the output terminals $O_1$ to $O_n$ of the switch section 12 of the left driving device 1*a*, respectively, and are connected to the output terminals $O_1$ to $O_n$ in order of the sequence of source lines. The n+1-th source line $S_{n+1}$ from the left is connected to the rightmost output terminal $O_{n+1}$ of the left switch section 12 and the leftmost output terminal $O_1$ of the right switch section. Specifically, as shown in FIG. 22, the n+1-th source line $S_{n+1}$ from the left has branch portions 41 and 42 from the left. The branch portion 41 is connected to the rightmost output terminal $O_{n+1}$ of the left switch section 12, and the branch portion 42 is connected to the leftmost output terminal $O_1$ of the right switch section.

The n+2-th and subsequent source lines $S_{n+2}$ to $S_{(2n+1)}$ from the left correspond to the output terminals $O_2$ to $O_{n+1}$ of the switch section 12 of the right driving device 1*b*, respectively, and are connected to the output terminal $O_2$ to $O_{n+1}$ in order of the sequence of source lines.

Thus, when two or more switch sections 12 exist side by side, the rightmost output terminal $O_{n+1}$ of the left switch section 12 and the leftmost output terminal $O_1$ of the right switch section 12 are connected to the same source line, and each of the other output terminals is connected to one source line in order of the sequence of source lines.

In FIG. 22, the source line $S_{n+1}$ connected to the two switch sections 12 are indicated by a line bolder than the other source lines for descriptive purposes, but the all the source lines $S_1$ to $S_{(2n+1)}$ have the same wire size.

Further, the active element 22 is provided for each pixel electrode 21, and each pixel electrode 21 is connected to a source line through the active element 22. The odd-numbered pixel electrodes 21 are connected to the left-hand source lines, and the even-numbered pixel electrodes 21 are connected to the right-hand source lines. In this point, the liquid crystal display panel $2_b$ is the same as that of the first embodiment. Further, like in the first embodiment, the case where the active element 22 is a TFT is taken as an example.

The control section 3 outputs control signals $POL_1$, SCLK and STB to each potential setting section 11. The output mode of $POL_1$, SCLK and STB is the same as in the first embodiment, except in that the control signals are output to the two or more potential setting sections 11 at the same time.

Further, the control section 3 outputs $POL_2$ to the respective switch section 12 at the same time. The output mode of $POL_2$ is also the same as in the first embodiment, except in that $POL_2$ is output to the two or more switch sections 12 at the same time.

Next, the operation will be described. First, a description will be made of a frame in which the control section 3 sets $POL_1$ to high level upon selection of an odd-numbered row and sets $POL_1$ to low level upon selection of an even-numbered row.

Upon selection of an odd-numbered row, the control section 3 sets $POL_1$ to be output to each potential setting section 11 to high level. Therefore, each potential setting section 11 outputs potentials higher than $V_{COM}$ from the odd-numbered potential output terminals $D_1$, $D_3$, $D_5$, . . . from the left, and potentials lower than $V_{COM}$ from the even-numbered potential output terminal $D_2$, $D_4$, $D_6$, . . . from the left. At this time, the control section 3 sets $POL_2$ to be output to each switch section 12 to high level. Thus, as shown in FIG. 22, the input terminals $I_1$ to $I_n$ of each switch section 12 are electrically conducted with the output terminals $O_1$ to $O_n$.

As a result, the odd-numbered source lines $S_1$, $S_3$, $S_5$ . . . from the left become potentials higher than $V_{COM}$, and the even-numbered source line $S_2$, $S_4$, $S_6$, . . . from the left become potentials lower than $V_{COM}$. Then, each pixel electrode 21 in the selected row (odd-numbered row) is set to a potential equal to the left-hand source line.

Figure 23:
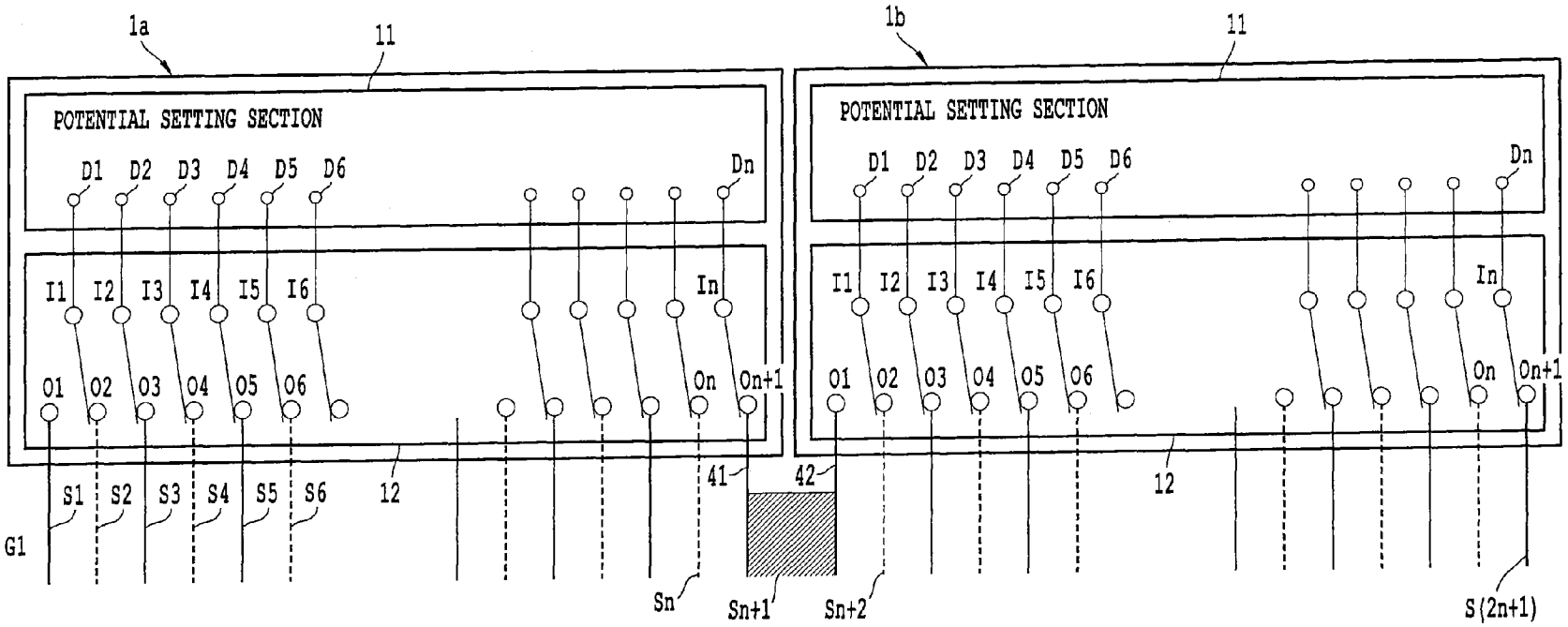
FIG. 23 is an illustrative diagram showing the state of a switch section in the third embodiment.

Upon selection of an even-numbered row, the control section 3 sets $POL_1$ to be output to each potential setting section 11 to low level. Therefore, each potential setting section 11 outputs potentials lower than $V_{COM}$ from the odd-numbered potential output terminals $D_1$, $D_3$, $D_5$, . . . from the left, and potentials higher than $V_{COM}$ from the even-numbered potential output terminal $D_2$, $D_4$, $D_6$, . . . from the left. At this time, the control section 3 sets $POL_2$ to be output to each switch section 12 to low level. The state of each switch section 12 at this time is shown in FIG. 23. Since $POL_2$ is at low level, the input terminals $I_1$ to $I_n$ of each switch section 12 are electrically conducted with the output terminals $O_2$ to $O_{n+1}$ as shown in FIG. 23.

As a result, the odd-numbered source lines $S_1$, $S_3$, $S_5$ . . . from the left become potentials higher than $V_{COM}$, and the even-numbered source line $S_2$, $S_4$, $S_6$, . . . from the left become potentials lower than $V_{COM}$. Then, each pixel electrode 21 in the selected row (even-numbered row) is set to a potential equal to the right-hand source line.

Thus, in this frame, the odd-numbered source lines from the left are maintained at potentials higher than $V_{COM}$, and the even-numbered source lines from the left are maintained at potentials lower than $V_{COM}$. The polarity of each pixel in this frame is the same as shown in FIG. 11.

Next, a description will be made of a frame in which the control section 3 sets $POL_1$ to low level upon selection of an odd-numbered row and sets $POL_1$ to high level upon selection of an even-numbered row.

Upon selection of an odd-numbered row, the control section 3 sets $POL_1$ to be output to each potential setting section 11 to low level. Therefore, each potential setting section 11 outputs potentials lower than $V_{COM}$ from the odd-numbered potential output terminals $D_1$, $D_3$, $D_5$, . . . from the left, and potentials higher than $V_{COM}$ from the even-numbered potential output terminal $D_2$, $D_4$, $D_6$, . . . from the left. At this time, the control section 3 sets $POL_2$ to be output to each switch section 12 to high level. Thus, as shown in FIG. 22, t input terminals $I_1$ to $I_n$ of each switch section 12 are electrically conducted with the output terminals $O_1$ to $O_n$.

As a result, the odd-numbered source lines $S_1$, $S_3$, $S_5$. . . from the left become potentials lower than $V_{COM}$, and the even-numbered source line $S_2$, $S_4$, $S_6$, . . . from the left become potentials higher than $V_{COM}$. Then, each pixel electrode 21 in the selected row (odd-numbered row) is set to a potential equal to the left-hand source line.

Upon selection of an even-numbered row, the control section 3 sets $POL_1$ to be output to each potential setting section 11 to high level. Therefore, each potential setting section 11 outputs potentials higher than $V_{COM}$ from the odd-numbered potential output terminals $D_1$, $D_3$, $D_5$, . . . from the left, and potentials lower than $V_{COM}$ from the even-numbered potential output terminal $D_2$, $D_4$, $D_6$, . . . from the left. At this time, the control section 3 sets $POL_2$ to be output to each switch section 12 to low level. Since $POL_2$ is at low level, the input terminals $I_1$ to $I_n$ of each switch section 12 are electrically conducted with the output terminals $O_2$ to $O_{n+1}$ as shown in FIG. 23.

As a result, the odd-numbered source lines $S_3$, $S_5$, . . . from the left become potentials lower than $V_{COM}$, and the even-numbered source line $S_2$, $S_4$, $S_6$, . . . from the left become potentials higher than $V_{COM}$. Then, each pixel electrode 21 in the selected row (even-numbered row) is set to a potential equal to the right-hand source line.

Thus, in this frame, the odd-numbered source lines from the left are maintained at potentials lower than $V_{COM}$, and the even-numbered source lines from the left are maintained at potentials higher than $V_{COM}$. The polarity of each pixel in this frame is the same as shown in FIG. 15.

In the third embodiment, the operation of each of the driving devices 1*a* and 1*b* is the same as that in the first embodiment, and each source line can be maintained at a potential higher than $V_{COM}$ or a potential lower than $V_{COM}$ in a frame. Thus, the third embodiment has effects similar to the first embodiment.

The second embodiment may be applied to the third embodiment. In other words, it may be configured such that consecutive rows of pixel electrodes 21 are so grouped that the pixel electrodes in each row of an odd-numbered group are connected to the left-hand source lines and the pixel electrodes in each row of an even-numbered group are connected to right-hand source lines. In this case, the control section 3 may output $POL_1$ and $POL_2$ in the same manner as in the second embodiment.

Fourth Embodiment

Figure 24:
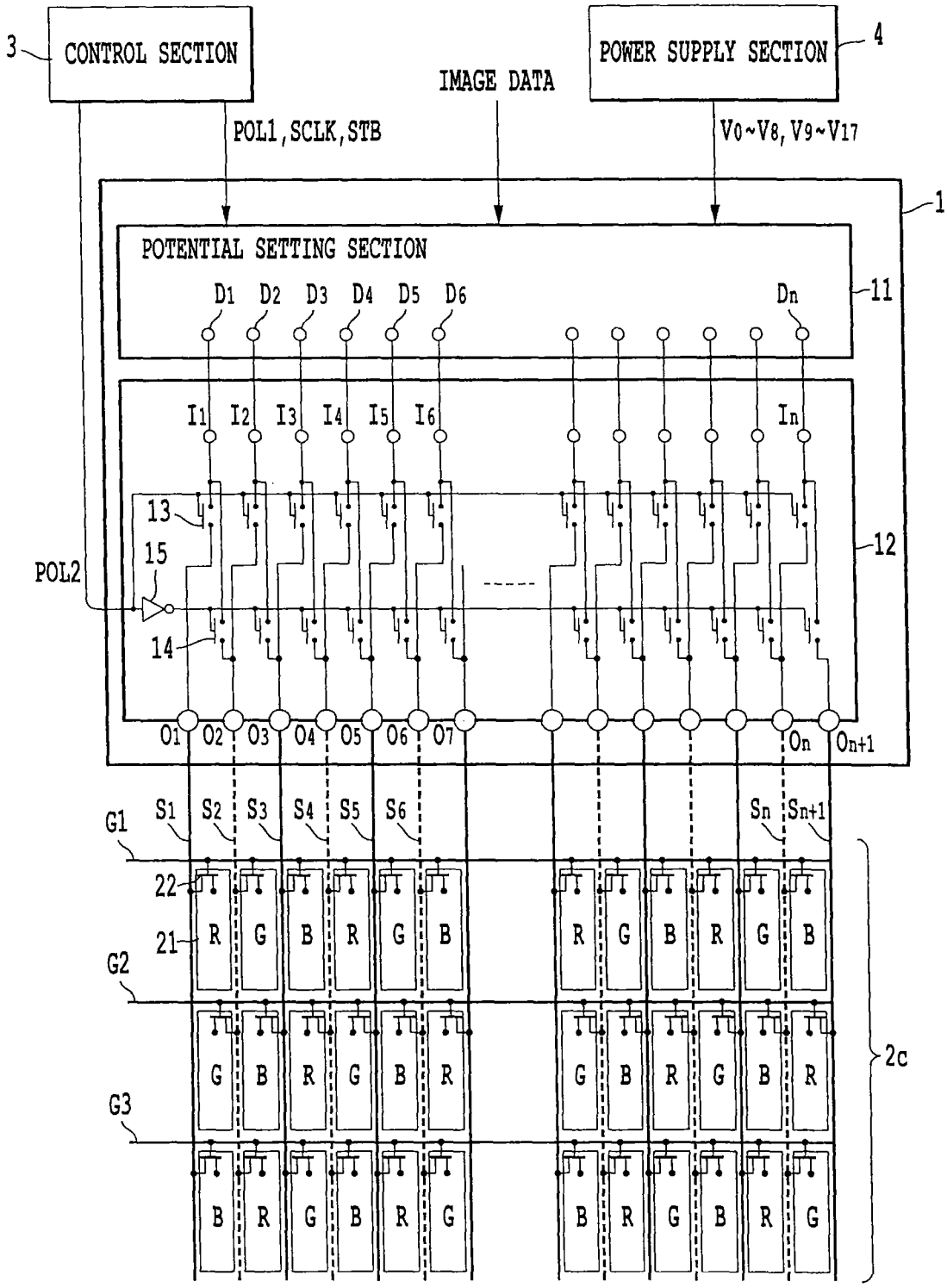
FIG. 24 is an illustrative diagram showing an example of a liquid crystal display device according to a fourth embodiment of the present invention.

FIG. 24 is an illustrative diagram showing a liquid crystal display device according to a fourth embodiment of the present invention. The same components as those in the first embodiment will be given the same reference numerals as those in FIG. 1 to omit the detailed description thereof.

The liquid crystal display device of the fourth embodiment includes the driving device 1, a liquid crystal display panel $\mathbf{2}_c$, the control section 3 and the power supply section 4. The driving device 1 includes the potential setting section 11 and the switch section 12. The operation of the control section 3, the power supply section 4 and the driving device 1 (the potential setting section 11 and the switch section 12) is the same as in the first embodiment.

The liquid crystal display panel $\mathbf{2}_c$ has the same structure as that of the liquid crystal display panel 2 in the first embodiment, but the arrangement of red pixel (R), green pixel (G) and blue pixel (B) is different from the first embodiment.

Compared to the first embodiment, the liquid crystal display panel 2 in the first embodiment is such that the way of placing R, G, B is the same in any row and, if focusing on each column of pixels, the same color pixels are arrayed in units of columns (see FIG. 1).

On the other hand, in the fourth embodiment, the arrangement of R, G, B is different among consecutive three rows. In the example of FIG. 24, pixels are placed in order of R, G, B, R, G, B, . . . from the left in the 3k+1-th row. In the 3k+2-th row, pixels are placed in order of G, B, R, G, B, R, . . . from the left. Then, in the 3k-th row, pixels are placed in order of B, R, G, B, R, G, . . . from the left. Here, k is an integer equal to or greater than zero. As a result, pixels R, G and B exist in each column, respectively. In the other points, the liquid crystal display panel $\mathbf{2}_c$ is the same as the liquid crystal display panel 2 of the first embodiment.

When image data is input to the potential setting section 11 of the driving device 1, the image data may be input according to the arrangement of RGB on the liquid crystal display panel $\mathbf{2}_c$. For example, data for one row may be input as data in the first row in order from data on the leftmost R pixel to data on the second G pixel from the left, data on the third B pixel from the left, . . . . As data for the second row, data for one row may be input in order from data on the leftmost G pixel to data on the second B pixel from the left, data on the third R pixel from the left, . . . . Further, as data for the third row, data for one row may be input in order from data on the leftmost B pixel to data on the second R pixel from the left, data on the third G pixel, . . . .

Note that the operation of the potential setting section 11 to capture the data for one row to be input is the same as in the first embodiment. In other words, image data corresponding to the arrangement of the liquid crystal display panel $\mathbf{2}_c$ has only to be prepared and input to the driving device 1. The operations of the control section 3, the driving device 1 and the power supply section 4 are the same as in the first embodiment.

Since the fourth embodiment is different from the first embodiment only in the arrangement of RGB on the liquid crystal display panel, the fourth embodiment also has effects similar to the first embodiment. Note that the arrangement of R, G and B on the liquid crystal display panel $\mathbf{2}_c$, is not limited to the arrangement shown in FIG. 24, and any other arrangement may be adopted.

Fifth Embodiment

Figure 25:
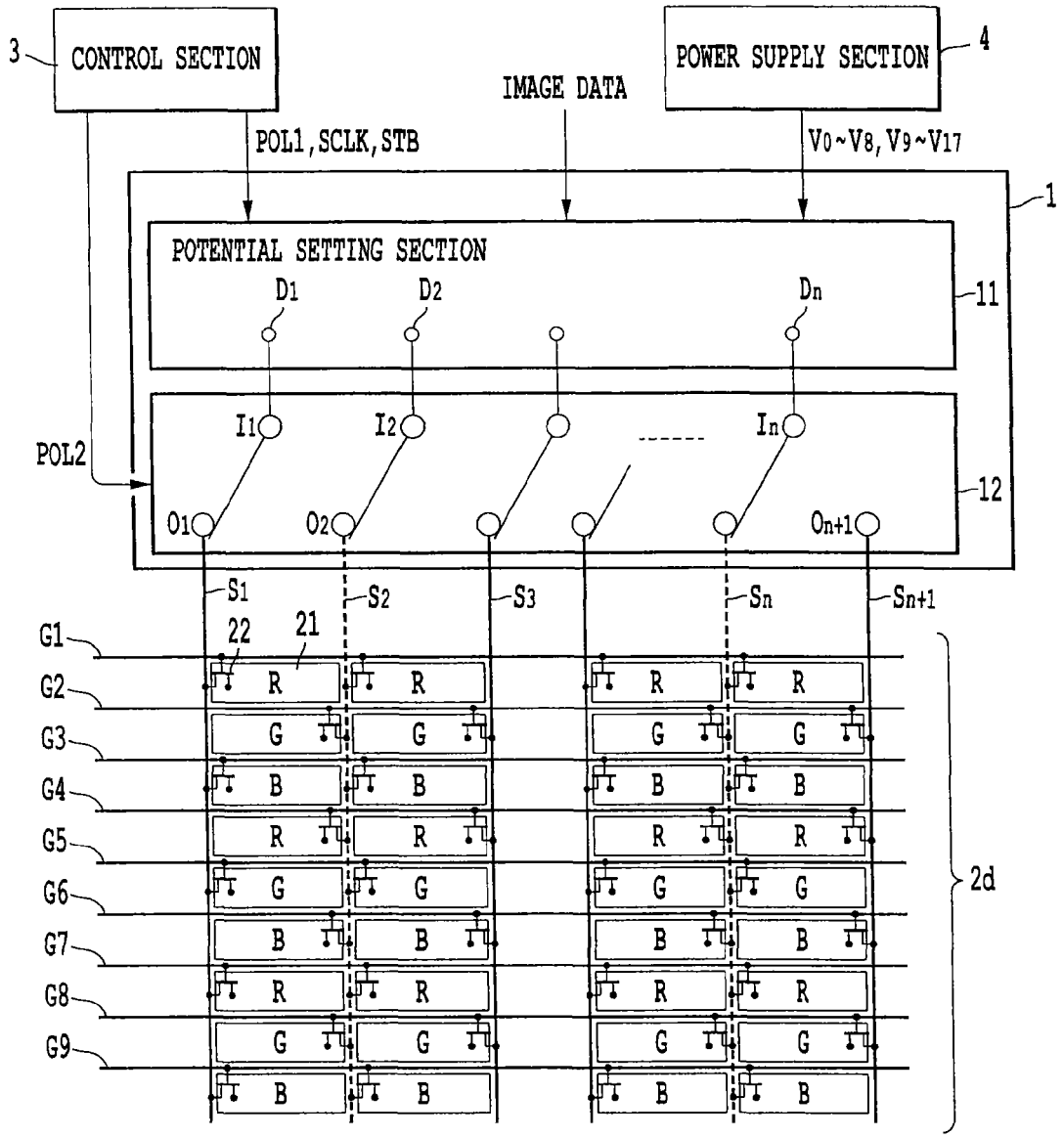
FIG. 25 is an illustrative diagram showing an example of a liquid crystal display device according to a fifth embodiment of the present invention.

FIG. 25 is an illustrative diagram showing an example of a liquid crystal display device according to a fifth embodiment of the present invention. The same components as those in the first embodiment will be given the same reference numerals as those in FIG. 1 to omit the detailed description thereof.

The liquid crystal display device of the fifth embodiment includes the driving device 1, a liquid crystal display panel $\mathbf{2}_d$, the control section 3 and the power supply section 4. The driving device 1 includes the potential setting section 11 and the switch section 12. The operations of the control section 3, the power supply section 4 and the driving device 1 (the potential setting section 11 and the switch section 12) are the same as in the first embodiment.

The liquid crystal display panel $\mathbf{2}_d$ has the same structure as that of the liquid crystal display panel 2 in the first embodiment, but the arrangement of red pixel (R), green pixel (G) and blue pixel (B) is different from the first embodiment.

The liquid crystal display panel $\mathbf{2}_d$ of the fifth embodiment is such that pixels in one row are of the same color. In the example shown in FIG. 25, R pixels line up in the 3k+1-th row. In the 3k+2-th row, G pixels line up. Then, in the 3k+3-th row, B pixels line up. Here, k is an integer equal to or greater than zero. In the other points, the liquid crystal display panel $\mathbf{2}_d$ is the same as the liquid crystal display panel 2 in the first embodiment.

When image data is input to the potential setting section 11 of the driving device 1, the image data may be input according to the arrangement of RGB on the liquid crystal display panel $\mathbf{2}_d$. For example, data for one row may be input as data in the first row in order from data on the leftmost R pixel to data on the second R pixel from the left, . . . . As data for the second row, data for one row may be input in order from data on the leftmost G pixel to data on the second G pixel, . . . . Further, as data for the third row, data for one row may be input in order from data on the leftmost B pixel to data on the second B pixel from the left, . . . .

Note that the operation of the potential setting section 11 to capture the data for one row to be input is the same as in the first embodiment. In other words, image data corresponding to the arrangement of the liquid crystal display panel $\mathbf{2}_d$ has only to be prepared and input to the driving device 1. The operation of the control section 3, the driving device 1 and the power supply section 4 itself is the same as in the first embodiment.

Since the fifth embodiment is different from the first embodiment only in the arrangement of RGB on the liquid crystal display panel, the fifth embodiment has effects similar to the first embodiment. Note that the arrangement of R, G and B on the liquid crystal display panel $\mathbf{2}_d$ is not limited to the arrangement shown in FIG. 25, and any other arrangement may be adopted.

Further, in the fifth embodiment, if the number of R, G and B pixels is set equal to that in the first embodiment, the total number of source lines and gate lines can be reduced. FIG. 26 is an illustrative diagram showing an example of comparison between the fifth embodiment and the first embodiment in terms of the total number of source lines and gate lines. FIG. 26(*a*) illustrates an example of RGB arrangement shown in the first embodiment, and FIG. 26(*b*) illustrates an example of RGB arrangement shown in the fifth embodiment. In both cases, the number of R, G and B pixels is the same, but the total number of source lines and gate lines in the case sown in FIG. 26(*b*) is smaller than the other. Thus, the fifth embodiment has the advantage of being able to reduce the number of lines.

Further, the second embodiment or the third embodiment may be applied to the fourth embodiment and the fifth embodiment.

In each of the aforementioned first to fifth embodiments, the description has been made of the case where the potential setting section 11 captures image data for one row in response to SCLK in order from data on the leftmost pixel, the order of capturing pixel data is not limited to this order. In each embodiment, the potential setting section 11 may capture image data for one row in order from data on the rightmost pixel. Even this case has effects similar to each embodiment.

Further, in each of the aforementioned embodiments, it is preferred that output of potentials in the next frame be started after the potential setting section 11 once sets the output potential of each of the potential output terminals $D_1$ to $D_n$ to a potential between the maximum potential ($V_0$ in the above example) and the minimum potential ($V_{17}$ in the above example) during a vertical blanking interval. It is particularly preferred that the potential setting section 11 should set the potential of each of the potential output terminals $D_1$ to $D_n$ to $V_{COM}(=(V_0+V_{17})/2)$ during the vertical blanking interval.

Thus, if the potentials are set during the vertical blanking interval, the load on the power supply section 4 can be reduced.

In order to set the output potential of each of the potential output terminals $D_i$ to $D_n$ once to a potential between the maximum potential and the minimum potential, the potential setting section 11 may, for example, short-circuit between a pair of adjacent two potential output terminals. For example, potential output terminals in each pair, such as a pair of $D_1$ and $D_2$, a pair of $D_3$ and $D_4$, may be short-circuited.

Note that the vertical blanking interval is a period from when the selection of the last row is completed until the selection of the first row is started next, i.e., an interval from frame to frame.

Further, in each of the aforementioned embodiments, the case where the liquid crystal display panel is provided with R, G and B pixels to provide color display is shown, but the liquid crystal display panel may be a black-and-white liquid crystal display panel provided with black-and-white pixels, rather than R, G and B pixels.

In each of the aforementioned embodiments, a driving device for a liquid crystal display panel including the potential setting section 11 and the switch section 12 is disclosed.

In each of the aforementioned embodiments, the control section 3 or the control section $\mathbf{3}_a$ may be provided in the driving device 1. In other words, the driving device 1 may include the control section 3 or the control section $\mathbf{3}_a$.

In each of the aforementioned embodiments, the switch section 12 may be provided on the liquid crystal display panel 2, $\mathbf{2}_a$, $\mathbf{2}_b$, $\mathbf{2}_c$, or $\mathbf{2}_d$, rather than being provided in the driving device 1. In this case, the driving device 1 has only to include the potential setting section 11. Further, in each of the aforementioned embodiments, the potential setting section 11 or the control section 3 may be a TAB substrate or COG (Chip on Glass), or be formed from polysilicon or the like.

Sixth Embodiment

Figure 27A:
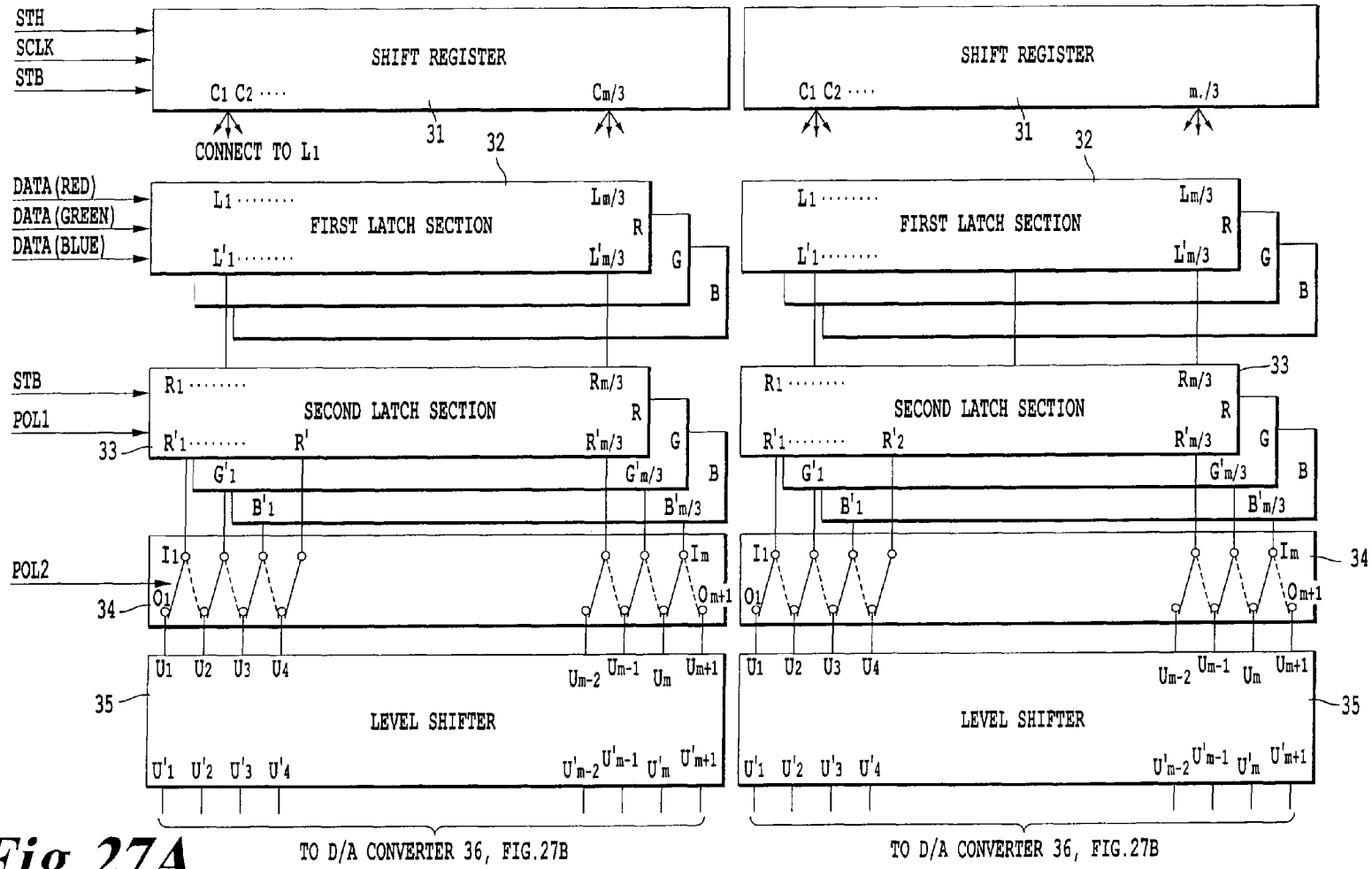
FIGS. 27A, 27B are illustrative diagrams showing an example of a liquid crystal display device according to a sixth embodiment of the present invention.
Figure 27B:
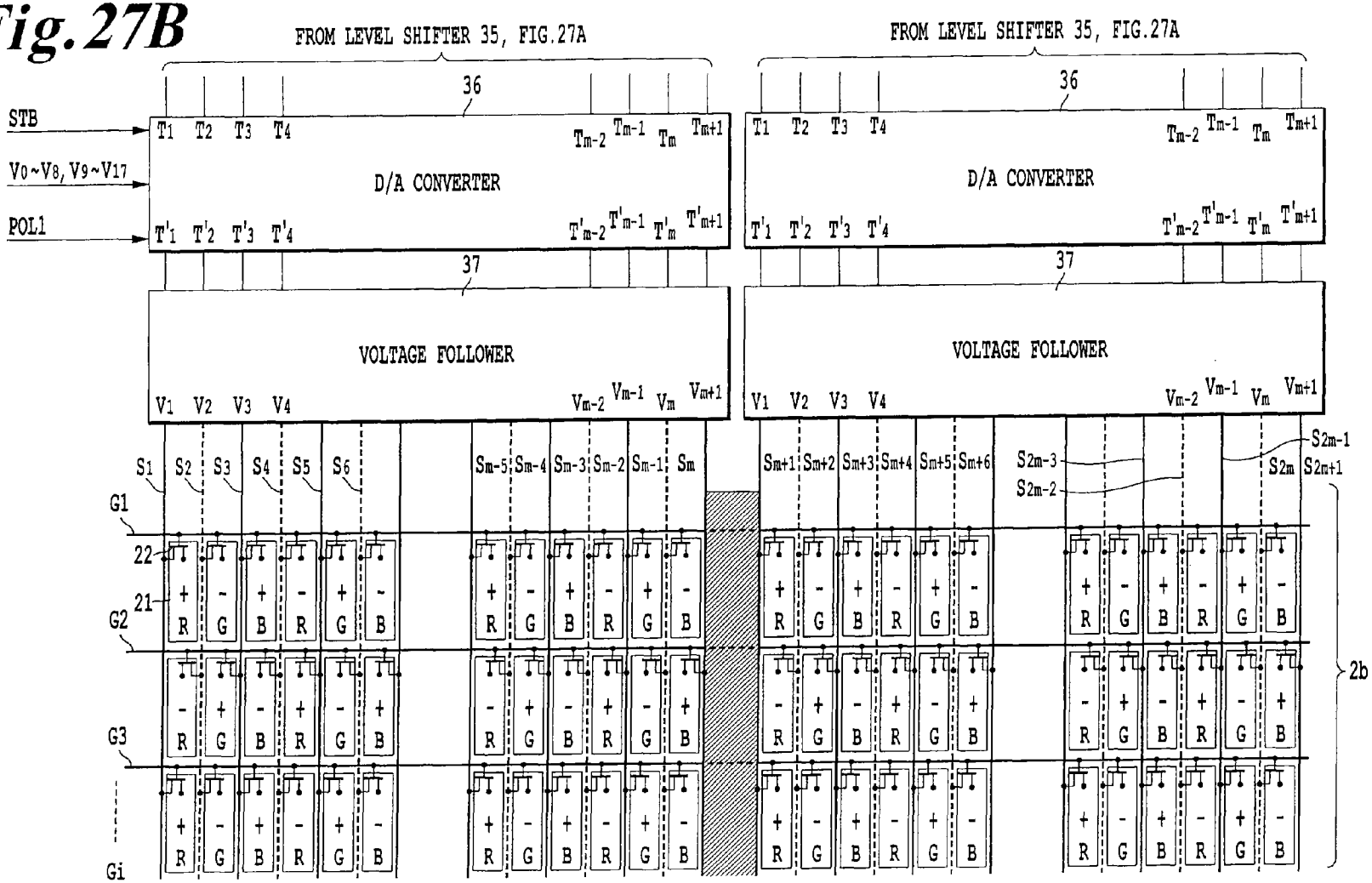

In each of the following embodiments, a description will be made of a case where switches are included in the potential setting section. FIGS. 27A, 27B are illustrative diagrams showing an example of a liquid crystal display device according to a sixth embodiment of the present invention. In the example shown in FIGS. 27A, 27B, the structure of the liquid crystal display panel is the same as that of the liquid crystal display panel $\mathbf{2}_b$ in the third embodiment, and two driving devices are connected to the liquid crystal display panel $\mathbf{2}_b$. Each driving device includes a shift register 31, a first latch section 32, a second latch section 33, a switch section 34, a level shifter 35, a DA converter 36 and a voltage follower 37. The combination of these components 31 to 37 functions as the potential setting section.

The liquid crystal display device also includes the same gate driver (not shown) as that in the first embodiment. Since the input mode of control signals to the gate driver and the operation of the gate driver are the same as in the first embodiment, the redundant description thereof will be omitted. This holds true for the following seventh and subsequent embodiments.

The liquid crystal display panel $\mathbf{2}_b$ includes 2m columns of pixel electrodes, and among the columns, the left-hand m columns are driven by a first driving device and the right-hand m columns are driven by a second driving device. It is assumed that m is a multiple of 3. Like in the third embodiment, the liquid crystal display panel $\mathbf{2}_b$ includes source lines $S_1$ to $S_{2m+1}$ that is one more in number than the number of columns of pixel electrodes. The mode of connection of the m+1-th source line $S_{m+1}$ from the left with two voltage followers shown in FIGS. 27A, 27B is the same as the mode of connection of the central source line with two switches in the third embodiment (see FIG. 23). In other words, the Line $S_{m+1}$ has two branch portions, and the left branch portion is connected to the rightmost potential output terminal $V_{m+1}$ of the left voltage follower 37. The right branch portion is connected to the leftmost potential output terminal $V_1$ of the right voltage follower 37. It is assumed that the $m_{+1}$-th source line $S_{m+1}$ from the left is an odd-numbered source line, i.e., m+1 is an odd number.

SCLK, STH and STB are input to the shift register 31 from the control section (not shown in FIGS. 27A, 27B). The shift register 31 includes m/3 signal output terminals $C_1$ to $C_{m/3}$. The shift register 31 outputs a data reading instruction signal from one signal output terminal to a signal input terminal of the first latch section 32 each time SCLK is input. The shift register 31 outputs the data reading instruction signal in order of signal output terminals $C_1, C_2, \ldots, C_{m/3}$. The control signal STH is a signal to instruct the shift register 31 to start capturing data for one line. For example, when instructing the shift register 31 to start output from the signal output terminal $C_1$, the control section sets STH to high level, and during the other periods, the control section sets STH to low level. When SCLK is input while STH is at high level, the shift register 31 outputs the data reading instruction signal from the signal output terminal $C_1$. After that, the shift register 31 may switch to the next signal output terminal sequentially each time SCLK is input.

The first driving device includes first latch sections 32 for R, G, and B, respectively, as the first latch section 32. Each of the first latch sections 32 for R, G and B has signal input terminals $L_1$ to $L_{m/3}$ corresponding to the signal output terminals $C_1$ to $C_{m/3}$, respectively. Any signal output terminal $C_i$ of the shift register 31 is connected to a signal input terminal $L_i$ in each of the first latch sections 32 for R, G and B. Thus, the shift register 31 outputs the data reading instruction signal from the signal output terminal $C_i$ to the signal input terminals $L_i$ of the first latch sections 32 for R, G and B at the same time, respectively.

When the data reading instruction signal is input from the signal input terminal $L_i$, the first latch section 32 for R captures the i-th R data in one line. Similarly, when the data reading instruction signal is input from the signal input terminal $L_i$, the first latch section 32 for G captures the i-th G data in one line. When the data reading instruction signal is input from the signal input terminal $L_i$, the first latch section 32 for B captures the i-th B data in one line. As mentioned above, since the data reading instruction signal is input to the signal input terminals $L_i$ of the first latch sections 32 for R, G and B, respectively, at the same time, each of R, G and B data is read into the first latch sections 32 in parallel. Each first latch section 32 holds the read data in order, respectively. These pieces of data are pixel values each representing the level of halftone of each pixel in one line.

The first latch sections 32 for R, G and B may be made up in an integrated fashion to capture data along the sequence of respective R, G and B data for one line.

Further, SCLK is input from the control section to the shift register 31 to provide signal output from the signal output terminals $C_1$ to $C_{m/3}$ within one cycle of STB. Thus, during one cycle of STB, R data, G data and B data for one line are held in the first latch sections 32, respectively. These pieces of R data, G data and B data for one line are read into the second latch section 33 collectively.

Each of the above R data, G data and B data for one line is m/3 piece of data, respectively. Each first latch section 32 has m/3 output terminals $L'_1$ to $L'_{m/3}$ as terminals used for output of this m/3 piece of data.

Further, one driving device includes second latch sections 33 for R, G and B as the second latch section 33. Each of the second latch sections 33R, G and B includes data reading terminals corresponding to the output terminals $L'_1$ to $L'_{m/3}$ of the first latch section 32, respectively. Hereinafter, the data reading terminals of the second latch section 33 for R are denoted as $R_1$ to $R_{m/3}$. Similarly, the data reading terminals for G and B are denoted as $G_1$ to $G_{m/3}$ and $B_1$ to $B_{m/3}$, respectively.

Further, the second latch section 33 for R includes data output terminals $R'_1$ to $R'_{m/3}$ corresponding to the data reading terminals $R_1$ to $R_{m/3}$. The second latch section 33 for R outputs, from data output terminal $R'_i$, data read from any data reading terminal $R_i$. The same holds true for the second latch sections 33 for G and B.

The timing at which each second latch section 33 reads data from the first latch section 32 and outputs the data is determined by STB. For example, the second latch section 33 for R may read R data for one line (m/3 piece of data) collectively at predetermined timing (e.g., on the falling edge of STB or the like) in each cycle of STB, and output the data from each of the data output terminals $R_1$ to $R_{m/3}$. The same holds true for the second latch sections 33 for G and B. The control section outputs STB to the shift register 31, each second latch section 33 and the DA converter 36.

The second latch sections 33 for R, G and B may be made up in an integrated fashion to capture data along the sequence of respective R, G and B data for one line.

The switch section 34 has the same structure as the switch 12 in the first embodiment. In the example of FIGS. 27A, 27B, the switch section 34 includes input terminals $I_1$ to $I_m$ and m+1 output terminals $O_1$ to $O_{m+1}$. $POL_2$ is input to the switch section 34. Since the operation of the switch section 34 according to the level of input $POL_2$ (high level or low level) is the same as that of the switch 12 in the first embodiment, the redundant description thereof will be omitted.

$POL_2$ may be generated by the control section and input to the switch section 34. Alternatively, as described as the modification of the first embodiment, the potential setting section of the driving device may generate $POL_2$. For example, means for generating $POL_2$ may be provided in the potential setting section. In this case, the control section outputs STV to notify the driving device of the start time of a frame. In either case, $POL_2$ is generated to become high level during the selection period of the first row in each frame.

The i-th data output terminal $R_i$ of the second latch section 33 for R is connected to the input terminal $I_{3\cdot i-2}$ of the switch section 34. The i-th data output terminal $G_i$ of the second latch section 33 for G is connected to the input terminal $I_{3\cdot i-1}$ of the switch section 34. The data output terminal $B_i$ of the second latch section 33 for B is connected to the input terminal $I_{3\cdot i}$ of the switch section 34. Thus, when $POL_2$ is at high level, the switch section 34 outputs respective data from the output terminals $O_1$ to $O_m$ in the following order: R, G, B, R, G, B, . . . . On the other hand, when $POL_1$ is at low level, the switch section 34 outputs respective data from the output terminals $O_2$ to $O_{m+1}$ in the following order: R, G, B, R, G, B, . . . .

The level shifter 35 has m+1 data input terminals $U_1$ to $U_{m+1}$ and m+1 data output terminals $U'_1$ to $U'_{m+1}$. Each of the data input terminals $U_1$ to $U_{m+1}$ is connected to each of the output terminals $O_1$ to $O_{m+1}$ of the switch section 34 in a one-to-one relationship. The level shifter 35 shifts the level of data input to each of the data input terminals $U_1$ to $U_{m+1}$, and outputs data after subjected to level shifting from $U'_1$ to $U'_{m+1}$. For example, when the output data of the second latch section 33 is in a low voltage system (e.g., 3V system), the level shifter 35 shifts the level of the data input through the switch section 34 to a high voltage system (e.g., 15V system), and outputs the data from the data output terminals, respectively.

The DA converter 36 has m+1 data input terminals $T_1$ to $T_{m+1}$ and m+1 potential output terminals $T'_1$ to $T'_{m+1}$. Each of the data input terminals $T_1$ to $T_{m+1}$ is connected to the data output terminals $U'_1$ to $U'_{m+1}$ of the level shifter 35 in a one-to-one relationship. The DA converter 36 coverts data input from each of the data input terminals $T_1$ to $T_{m+1}$ to an analog voltage, and outputs the analog voltage from each of the potential output terminals $T'_1$ to $T'_{m+1}$. Further, each voltage of $V_0$-$V_8$ and $V_9$-$V_{17}$ is supplied from a power supply (not shown in FIGS. 27A, 27B) to the DA converter 36, and the DA converter 36 divides the voltage to generate a potential with one of 64 levels of halftone. The DA converter 36 outputs a potential corresponding to the data after subjected to voltage division as the potential after subjected to analog conversion. In other words, the DA converter 36 converts data, output from the each second latch 33 and subjected to level shifting according to the value of each of R, G and B data, into any one of potentials with 64 levels of halftone, and outputs the converted potential. Here, the case where the image gradation is 64 levels is taken as an example, but the kinds of voltage supplied to the DA converter 36 are not limited to $V_0$ to $V_{17}$, and the image gradation is not limited to 64 levels. The same holds true for the other embodiments.

$POL_1$ is input from the control section to the DA converter 36. The DA converter 36 switches the output potential of each of the potential output terminals $T'_1$ to $T'_{m+1}$ between a potential higher than $V_{COM}$ and a potential lower than $V_{COM}$ depending on whether $POL_1$ is at high level or low level. Specifically, when $POL_1$ is at high level, the DA converter 36 sets the output potentials of the odd-numbered potential output terminals $T'_1$, $T'_3$, . . . from the left to potentials higher than $V_{COM}$, and the output potentials of the even-numbered potential output terminals $T'_2$, $T'_4$, . . . from the left to potentials lower than $V_{COM}$. On the other hand, when $POL_1$ is at low level, the DA converter 36 sets the output potentials of the odd-numbered potential output terminals $T'_1$, $T'_3$, . . . from the left to potentials lower than $V_{COM}$, and the output potentials of the even-numbered potential output terminals $T'_2$, $T'_4$, . . . from the left to potentials higher than $V_{COM}$.

In other words, when $POL_1$ is at high level, any one of potentials $V_0$-$V_8$ or the like is output from each of the odd-numbered potential output terminals $T'_1$, $T'_3$, . . . , and any one of potentials $V_9$-$V_{17}$ or the like is output from the even-numbered potential output terminals $T'_2$, $T'_4$, . . . . On the other hand, when $POL_1$ is at low level, any one of potentials $V_9$-$V_{17}$ or the like is output from each of the odd-numbered potential output terminals $T'_1$, $T'_3$, . . . , and any one of potentials $V_0$-$V_8$ or the like is output from the even-numbered potential output terminals $T'_2$, $T'_4$, . . . .

In the embodiment, the control section switches $POL_1$ between high level and low level alternately on a frame-by-frame basis. As a result, the output potential from each of the potential output terminals in the DA converter 36 is maintained at a potential higher than $V_{COM}$ or a potential lower than $V_{COM}$ during one frame. Therefore, the potential of each source line is also maintained at a potential higher than $V_{COM}$ or a potential lower than $V_{COM}$ during one frame.

Note that $POL_1$ may be input to the second latch section 33. In such a case, however, the operation of the second latch section 33 is not affected by $POL_1$.

The voltage follower 37 has potential input terminals (not shown in FIGS. 27A, 27B) corresponding to the potential output terminals $T'_1$ to $T'_{m+1}$ of the DA converter 36, and potential output terminals $V_1$ to $V_{m+1}$ each outputting a potential equal to the potential input to each of the potential input terminals of the voltage follower 37. The odd-numbered potential output terminals $V_1, V_3, \ldots$ from the left are connected to the odd-numbered source lines $S_1, S_3, \ldots$ from the left. The even-numbered potential output terminals $V_2, V_4, \ldots$ from the left are connected to the even-numbered source lines $S_2, S_4, \ldots$ from the left. Note that the source line $S_{m+1}$ having branch portions is an odd-numbered source line.

Next, the operation will be described.

Figure 28:
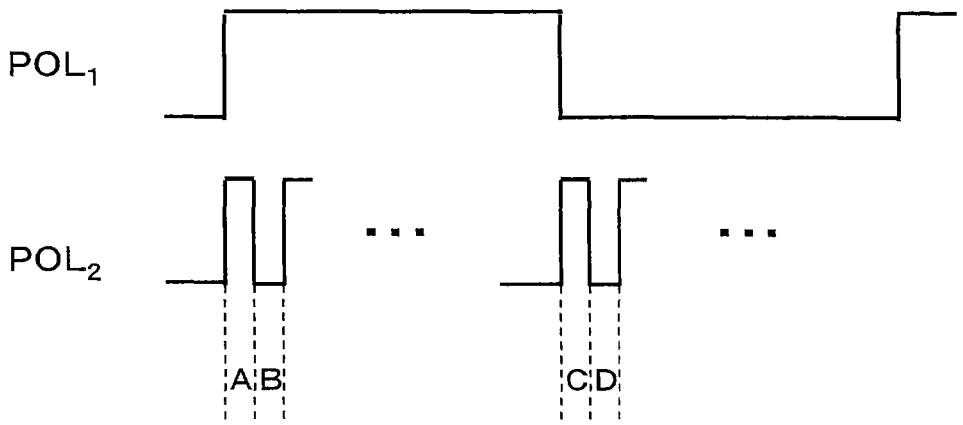
FIG. 28 is an illustrative diagram showing an example of the variations of $POL_1$ and $POL_2$ in the sixth embodiment.

FIG. 28 is an illustrative diagram showing an example of the variations of $POL_1$ and $POL_2$ in the sixth embodiment. The level of $POL_1$ is switched alternately on a frame-by-frame basis. Further, $POL_2$ is at high level upon starting a frame, and after that, it is switched per cycle of STB (i.e., per selection period of each row). Hereinafter, a period where both $POL_1$ and $POL_2$ are at high level is denoted as "A." A period where $POL_1$ is at high level and $POL_2$ is at low level is denoted as "B." A period where $POL_1$ is at low level and $POL_2$ is at high level is denoted as "C." A period where both $POL_1$ and $POL_2$ are at low level is denoted as "D."

First, a frame in which $POL_1$ is at high level will be described. In this frame, any input terminal $I_i$ of the switch section 34 is connected to the output terminal $O_i$ during period A where $POL_2$ is at high level (e.g., during the selection period of the first row). Therefore, the switch section 34 outputs each data from the output terminals $O_1$ to $O_m$ in the following order: R, G, B, R, G, B, . . . . The data is data output from each second latch section 33 according to the R data, G data and B data for one line, respectively. The following takes the selection period of the first row by way of example to describe the operation during period A.

The level shifter 35 receives, at the data input terminals $U_1$ to $U_m$, each data output from the output terminal $O_1$ to $O_m$ of the switch section 34. Then, the level shifter 35 shifts the level of each data received at the data input terminals $U_1$ to $U_m$, respectively, and inputs the data to the data input terminals $T_1$ to $T_m$ of the DA converter 36.

Since $POL_1$ is at high level, the DA converter 36 converts the data input to each of the odd-numbered potential output terminals $T_1, T_3, \ldots$ from the left into an analog voltage ($V_0$-$V_8$ or the like) higher than $V_{COM}$, respectively, and outputs the analog voltage from each of the potential output terminals $T'_1, T'_3, \ldots$ from the left. Further, the DA converter 36 converts the data input to each of the even-numbered data input terminals $T_2, T_4, \ldots$ from the left into an analog voltage ($V_9$-$V_{17}$ or the like) lower than $V_{COM}$, respectively, and outputs the analog voltage from each of the potential output terminals $T'_2, T'_4, \ldots$ from the left. The voltage follower 37 outputs the potentials output from $T'_1$ to $T'_m$ from the potential output terminals $V_1$ to $V_m$, respectively.

Since the output terminal $O_{m+1}$ is not connected to the input terminal $I_m$ in the switch section 34, there is no significant output from $V_{m+1}$ in each voltage follower 37.

Each pixel electrode in the first row is set to a potential equal to the source line arranged on the left side of the pixel electrode during the selection period of the first row. As a result, the polarity of each pixel in the first row is positive, negative, positive, negative, . . . in this order from the left as shown in FIGS. 27A, 27B.

Further, during period B where $POL_2$ becomes low level in the frame in which $POL_1$ is at high level (e.g., the selection period of the second row), any input terminal $I_i$ of the switch section 34 is connected to the output terminal $O_{i+1}$. Therefore, the switch section 34 outputs each data from the output terminals $O_2$ to $O_{m+1}$ in the following order: R, G, B, R, G, B, . . . . This data is data output from each second latch section 33 according to the R data, G data and B data for one line, respectively. The following takes the selection period of the second row by way of example to describe the operation during period B.

The level shifter 35 receives, at the data input terminals $U_2$ to $U_{m+1}$ each of data output from the output terminals $O_2$ to $O_{m+1}$ of the switch section 34. Then, the level shifter 35 shifts the level of each data received at the data input terminals $U_2$ to $U_{m+1}$, respectively, and inputs the data to the data input terminals $T_2$ to $T_{m+1}$ of the DA converter 36.

Since $POL_1$ is at high level, the DA converter 36 converts the data input to each of the even-numbered data input terminals $T_2, T_4, \ldots$ from the left into an analog voltage ($V_9$-$V_{17}$ or the like) lower than $V_{COM}$, respectively, and outputs the analog voltage from each of the potential output terminals $T'_2, T'_4, \ldots$ from the left. Further, the DA converter 36 converts the data input to each of the odd-numbered potential output terminals $T_1, T_3, \ldots$ from the left into an analog voltage ($V_0$-$V_8$ or the like) higher than $V_{COM}$, respectively, and outputs the analog voltage from each of the potential output terminals $T'_1, T'_3, \ldots$ from the left. The voltage follower 37 outputs the potentials output from $T'_2$ to $T'_{m+1}$ from the potential output terminals $V_2$ to $V_{m+1}$, respectively.

Since the output terminal $O_1$ is not connected to the input terminal $I_1$, there is no significant output from $V_1$ in each voltage follower 37.

Each pixel electrode in the second row is set to a potential equal to the source line arranged on the right side of the pixel electrode during the selection period of the second row. As a result, the polarity of each pixel in the second row is negative, positive, negative, positive, . . . in this order from the left as shown in FIGS. 27A, 27B.

After that, the operations for periods A and B are repeated in this frame. As a result, the polar state of each pixel in this frame is as shown in FIG. 11.

Next, a frame in which $POL_1$ is at low level will be described. In this frame, the operation of the switch section 34 and the level shifter 35 during period C where $POL_2$ becomes high level (e.g., during the selection period of the first row) is the same as that that for period A. The following takes the selection period of the first row by way of example to describe the operation during period C.

Since $POL_1$ is at low level during period C, the DA converter 36 converts the data input to each of the odd-numbered data input terminals $T_1, T_3, \ldots$ from the left into an analog voltage ($V_9$-$V_{17}$ or the like) lower than $V_{COM}$, respectively, and outputs the analog voltage from each of the potential output terminals $T'_1, T'_3, \ldots$ from the left. Further, the DA converter 36 converts the data input to each of the even-numbered data input terminals $T_2, T_4, \ldots$ from the left into an analog voltage ($V_0$-$V_8$ or the like) higher than $V_{COM}$, respectively, and outputs the analog voltage from each of the potential output terminals $T'_2, T'_4, \ldots$ from the left. The voltage follower 37 outputs the potentials output from $T'_1$ to $T'_m$ from the potential output terminals $V_1$ to $V_m$, respectively. Note that there is no significant output from $V_{m+1}$ in the each voltage follower 37 during period C. This is the same as period A. Here, High-z may be set as the insignificant output.

Each pixel electrode in the first row is set to a potential equal to the source line arranged on the left side of the pixel electrode during the selection period of the first row. As a result, the polarity of each pixel in the first row is negative, positive, negative, positive, . . . in this order from the left.

Further, during period D where $POL_1$ becomes low level in the frame in which $POL_1$ is at low level (e.g., the selection period of the second row), the operation of the switch section 34 and the level shifter 35 is the same as that for period B. The following takes the selection period of the second row by way of example to describe period D.

Since $POL_1$ is at low level during period D, the DA converter 36 converts the data input to each of the even-numbered data input terminals $T_2$, $T_4$, . . . from the left into an analog voltage ($V_0$-$V_8$ or the like) higher than $V_{COM}$, respectively, and outputs the analog voltage from each of the potential output terminals $T'_2$, $T'_4$, from the left. Further, the DA converter 36 converts the data input to each of the odd-numbered potential output terminals $T_3$, $T_5$, . . . from the left into an analog voltage ($V_9$-$V_{17}$ or the like) lower than $V_{COM}$, respectively, and outputs the analog voltage from each of the potential output terminals $T'_3$, $T'_5$, . . . . The voltage follower 37 outputs the potentials output from $T'_2$ to $T'_{m+1}$ from the potential output terminals $V_2$ to $V_{m+1}$, respectively. Note that there is no significant output from $V_1$ in each voltage follower 37 during period D. This is the same as period B. Here, High-z may be set as the insignificant output.

Each pixel electrode in the second row is set to a potential equal to the source line arranged on the right side of the pixel electrode during the selection period of the second row. As a result, the polarity of each pixel in the second row is positive, negative, positive, negative, . . . from the left.

After that, the operations for periods C and D are repeated in this frame. As a result, the polar state of each pixel in this frame is as shown in FIG. 15.

In the sixth embodiment, a potential corresponding to data on each pixel can also be output to each source line without changing the sequence of R, G and B data for one row input in parallel. In the other points, the sixth embodiment has effects similar to the first embodiment, the third embodiment, and so on.

In the embodiment, since the switch section 34 is provided on the upstream side of the voltage follower 36, there is no limitation that the level of $POL_2$ must be switched while the output of the potential setting section is in the high impedance state. This point holds true for the seventh and subsequent embodiments. The following gives a brief description of the mode of connection between the first driving device and the second driving device. When $POL_2$ is at high level relative to the switch section 34, the switches are thrown to the left (indicated by the solid line in FIGS. 27A, 27B) so the switches are connected to the output terminals $O_1$ to $O_m$ with no connection to $O_{m+1}$. However, the rightmost potential output terminal $V_{m+1}$ of the voltage follower 37 of the first driving device is short-circuited with the leftmost potential output terminal $V_1$ of the voltage follower 37 of the second driving device. In order to resolve the competition for potential between $V_{m+1}$ and $V_1$ at this time, $V_{m+1}$ or $V_1$ is bring into the high impedance state in synchronization with a change in polarity of $POL_2$. For example, when $POL_2$ is at high level, $V_{m+1}$ is set as High-z, while when $POL_2$ is at low level, $V_1$ is set as High-z. This holds true for seventh to tenth embodiments.

Next, a modification of the sixth embodiment will be described.

Like in the third embodiment, FIGS. 27A, 27B illustrate the case where two or more driving devices are connected to the liquid crystal display panel $\mathbf{2}_b$, but the number of driving devices connected to the liquid crystal panel may be one. In this case, the structure of the liquid crystal display panel may be similar to the structure of the liquid crystal display panel 2 in the first embodiment (see FIG. 1). Then, the mode of connection between the liquid crystal display panel and the voltage follower 37 may be set similar to the mode of connection between the liquid crystal display panel 2 and the switch 12 in the first embodiment (see FIG. 1).

Further, like in the second embodiment, two or more consecutive gate lines may be grouped. In this case, the structure of the liquid crystal panel may be made similar to the structure of the liquid crystal panel $\mathbf{2}_a$ in the second embodiment (see FIG. 17). In this case, the control section (or the potential setting section) may set $POL_2$ to high level during the period for selecting each row in the odd-numbered group one by one, and set $POL_2$ to low level during the period for selecting each row in the even-numbered group one by one. In this case, periods A, B, C and D shown in FIG. 28 become selection periods of two or more rows, respectively, but the operation for each period A, B, C or D is the same as the operation mentioned above.

Seventh Embodiment

Figure 29A:
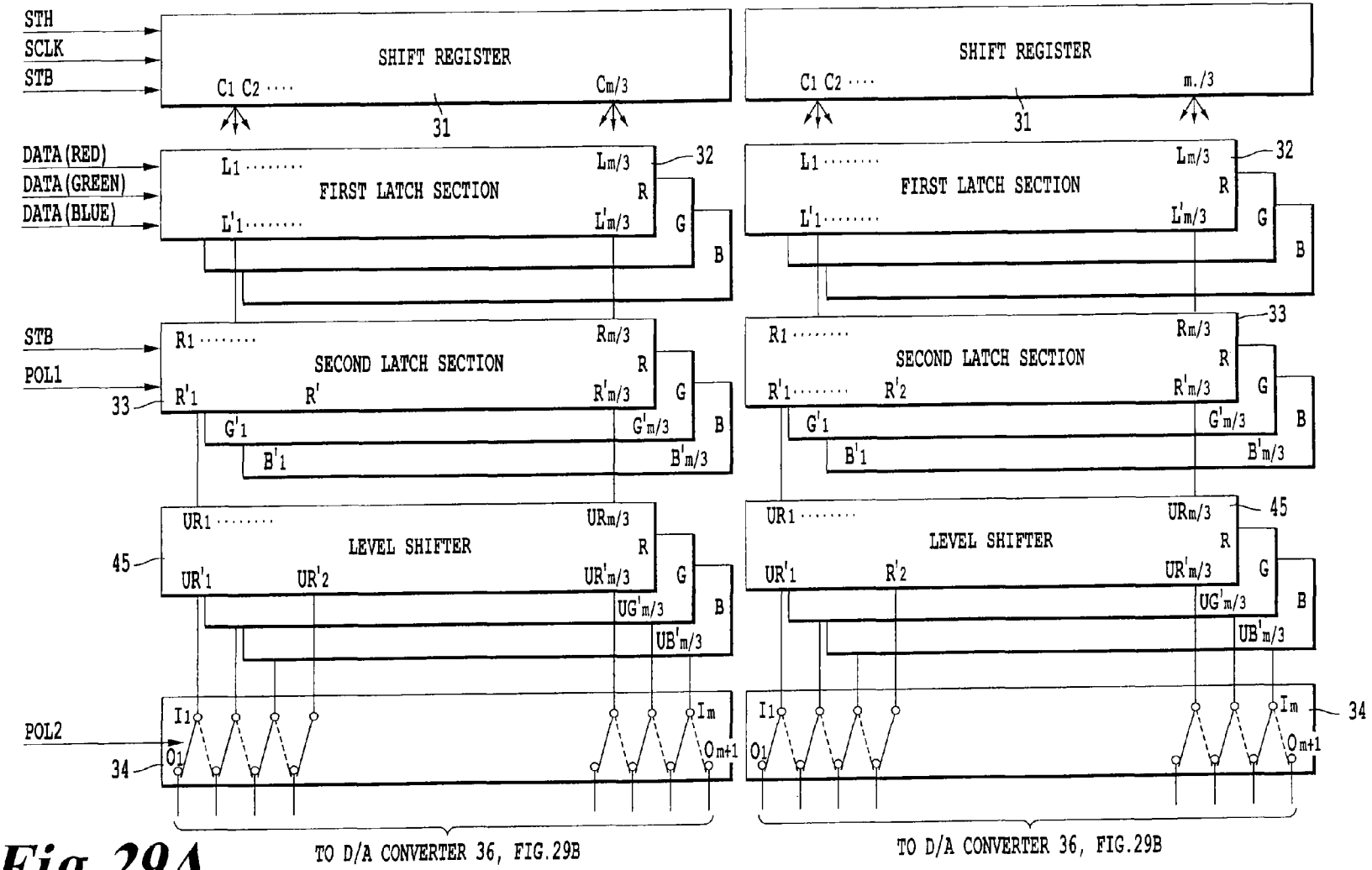
FIGS. 29A, 29B are illustrative diagrams showing an example of a liquid crystal display device according to a seventh embodiment of the present invention.
Figure 29B:
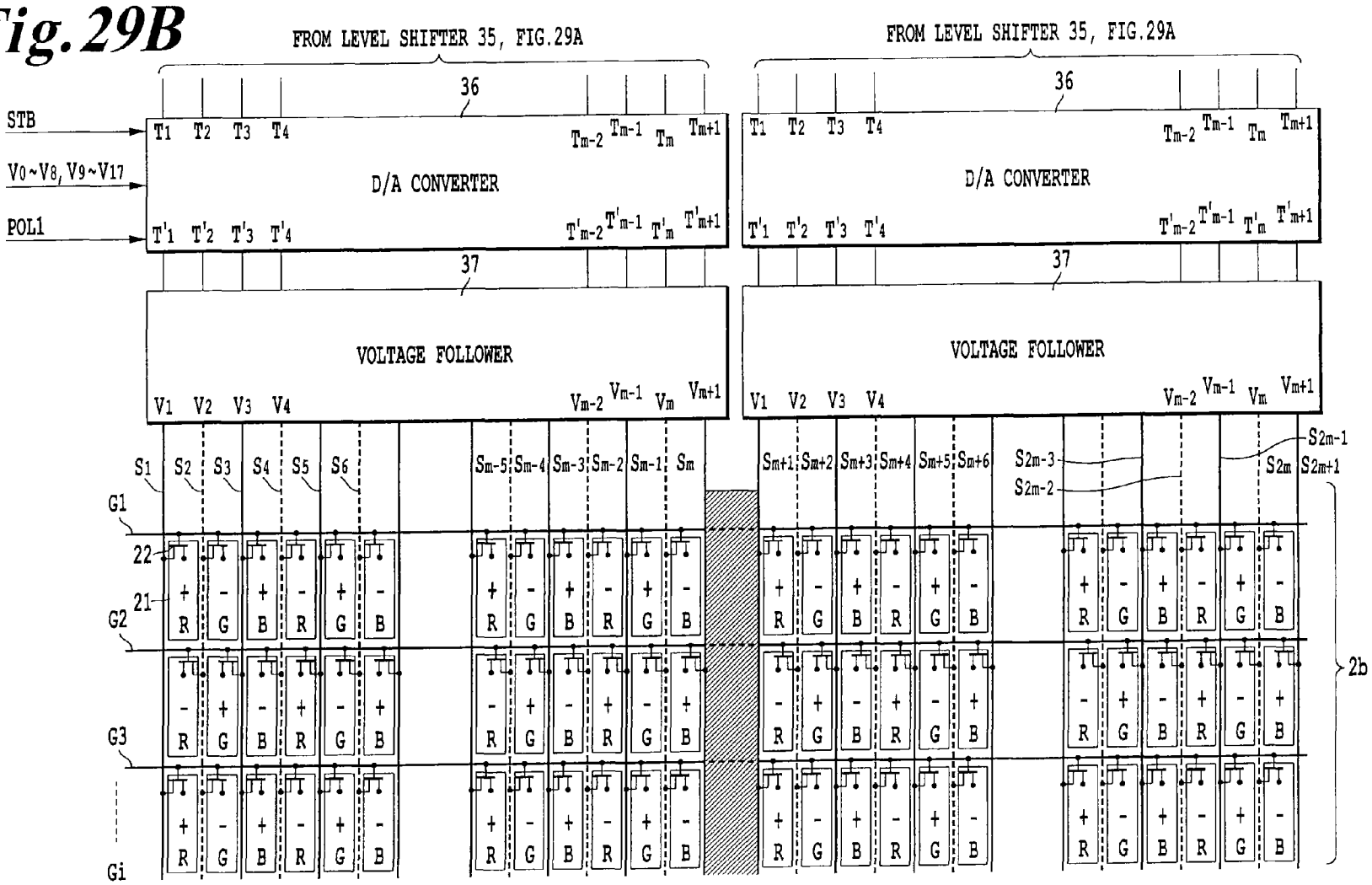

FIGS. 29A, 29B are illustrative diagrams showing an example of a liquid crystal display device according to a seventh embodiment of the present invention. The same components as those in the sixth embodiment will be given the same reference numerals as those in FIGS. 27A, 27B to omit the detailed description thereof. Also illustrated in FIGS. 29A, 29B is the case where the structure of the liquid crystal display panel is similar to the liquid crystal display panel $\mathbf{2}_b$ in the third embodiment. Then, the case where two driving devices are connected to the liquid crystal display panel $\mathbf{2}_b$ is illustrated. Each driving device includes the shift register 31, the first latch section 32, the second latch section 33, a level shifter 45, the switch section 34, the DA converter 36 and the voltage follower 37. The combination of these components 31, 32, 33, 45, 34, 36 and 37 functions as the potential setting section.

The liquid crystal panel $\mathbf{2}_b$ is the same as that in the sixth embodiment.

The shift register 31, the first latch section 32 and the second latch section 33 are also the same as those in the sixth embodiment, except in that the second latch section 33 is connected to the level shifter 45.

In the embodiment, one driving device includes level shifters 45 for R, G and B as the level shifter 45. Each of the level shifters 45 for R, G and B has m/3 data input terminals and data output terminals, respectively. The data input terminals contained in the level shifter 45 for R are denoted as $UR_1$ to $UR_{m/3}$. The data output terminals contained in the level shifter 45 for R are denoted as $UR'_1$ to $UR'_{m/3}$. Similarly, the data input terminals contained in the level shifter 45 for G are denoted as $UG_1$ to $UG_{m/3}$. Then, the data output terminals contained in the level shifter 45 for G are denoted as $UG'_1$ to $UG'_{m/3}$. Further, the data input terminals contained in the level shifter 45 for B are denoted as $UB_1$ to $UB_{m/3}$. The data output terminals contained in the level shifter 45 for B are denoted as $UB'_1$ to $UB'_{m/3}$.

Each of the data input terminal $UR_1$ to $UR_{m/3}$ of the level shifter 45 for R is connected to each of the data output terminal $R'_1$ to $R'_{m/3}$ of the second latch section 33 for R. Then, the level shifter 45 for R shifts the level of data input to each of the data input terminals $UR_1$ to $UR_{m/3}$ and outputs the data after subjected to level shifting from each of the data output terminals $UR'_1$ to $UR'_{m/3}$.

Each of the data input terminals $UG_1$ to $UG_{m/3}$ of the level shifter 45 for G is connected to each of the data output terminals $G'_1$ to $G'_{m/3}$ of the second latch section 33 for G. Each of the data input terminal $UB_1$ to $UB_{m/3}$ of the level shifter 45 for B is connected to each of the data output terminals $B'_1$ to $B'_{m/3}$ of the second latch section 33 for B. Like the level shifter 45 for R, each of the level shifters 45 for G and B shift the level of input data and outputs the data after subjected to level shifting from each of the data output terminals.

The level shifters 45 for R, G and B may be made up in an integrated fashion so that each data will be input along the sequence of respective R, G and B data for one row.

The structure of the switch section 34 is the same as the switch section 34 in the sixth embodiment, except in the following points: The i-th data output terminal $UR'_i$ in the level shifter 45 for R in the seventh embodiment is connected to the input terminal $I_{3\cdot i-2}$ of the switch section 34. The i-th data output terminal $UG'_i$ in the level shifter 45 for G is connected to the input terminal $I_{3\cdot i-1}$ of the switch section 34. The i-th data output terminal $UB'_i$ in the level shifter 45 for B is connected to the input terminal $I_{3\cdot i}$ of the switch section 34. Thus, when $POL_2$ is at high level, the switch section 34 outputs respective data (data after subjected to level shifting) from the output terminals $O_1$ to $O_m$ in the following order: R, G, B, R, G, B, . . . . On the other hand, when $POL_2$ is at low level, the switch section 34 outputs respective data (data after subjected to level shifting) from the output terminals $O_2$ to $O_{m+1}$ in the following order: R, G, B, R, G, B, . . . .

The DA converter 36 and the voltage follower 37 are the same as in the sixth embodiment, except in that each of the data input terminals $T_1$ to $T_{m+1}$ of the DA converter 36 is connected to each of the output terminals $O_1$ to $O_{m+1}$ of the switch section 34 in a one-to-one relationship.

Further, like in the sixth embodiment, the control section (not shown in FIGS. 29A, 29B) switches $POL_1$ between high level and low level alternatively on a frame-by-frame basis.

As for $POL_2$, like in the sixth embodiment, the control section may generate and input $POL_2$ to the switch section 34, or $POL_2$ may be generated inside the driving device. In either case, $POL_2$ is generated to become high level during the selection period of the first row in each frame. This is also the same as in the sixth embodiment.

The other control signals generated by the control section are the same as those in the sixth embodiment.

A comparison of the structure in the seventh embodiment with that in the sixth embodiment shows that in the seventh embodiment, the level shifter 45 is provided upstream of the switch section 34, and the level shifters 45 for R, G and B are provided. The mode of connection between each level shifter 45 and each input terminal of the switch is as already described above.

According to such a structure, data input to the DA converter 36 is the same as in the sixth embodiment. In other words, when $POL_2$ is at high level, R data, G data and B data for one line after subjected to level shifting are input to the data input terminals $T_1$ to $T_m$ of the DA converter 36. On the other hand, when $POL_2$ is at low level, R data, G data and B data for one line after subjected to level shifting are input to the data input terminals $T_2$ to $T_{m+1}$.

The variations in $POL_2$ input to the switch section 34 and variations in $POL_1$ input to the DA converter 36 are the same as in the sixth embodiment (see FIG. 28). Further, the state of polarity of each pixel during each of periods A to D shown in FIG. 28 is also the same as in the sixth embodiment.

This embodiment also has effects similar to the sixth embodiment.

The modification of the sixth embodiment can also be applied to the seventh embodiment. In other words, the case where the two or more driving devices are connected to the liquid crystal display panel $\mathbf{2}_b$ like in the third embodiment is illustrated in FIGS. 29A, 29B, but the number of driving devices connected to the liquid crystal panel may be one.

Further, like in the second embodiment, two or more consecutive gate lines may be grouped. In this case, the structure of the liquid crystal panel may be made similar to the structure of the liquid crystal panel $\mathbf{2}_a$ in the second embodiment (see FIG. 17). In this case, the control section (or the potential setting section) may set $POL_2$ to high level during the period for selecting each row in the odd-numbered group one by one, and set $POL_2$ to low level during the period for selecting each row in the even-numbered group one by one. These points are the same as in the modification of the sixth embodiment.

Eighth Embodiment

Figure 30A:
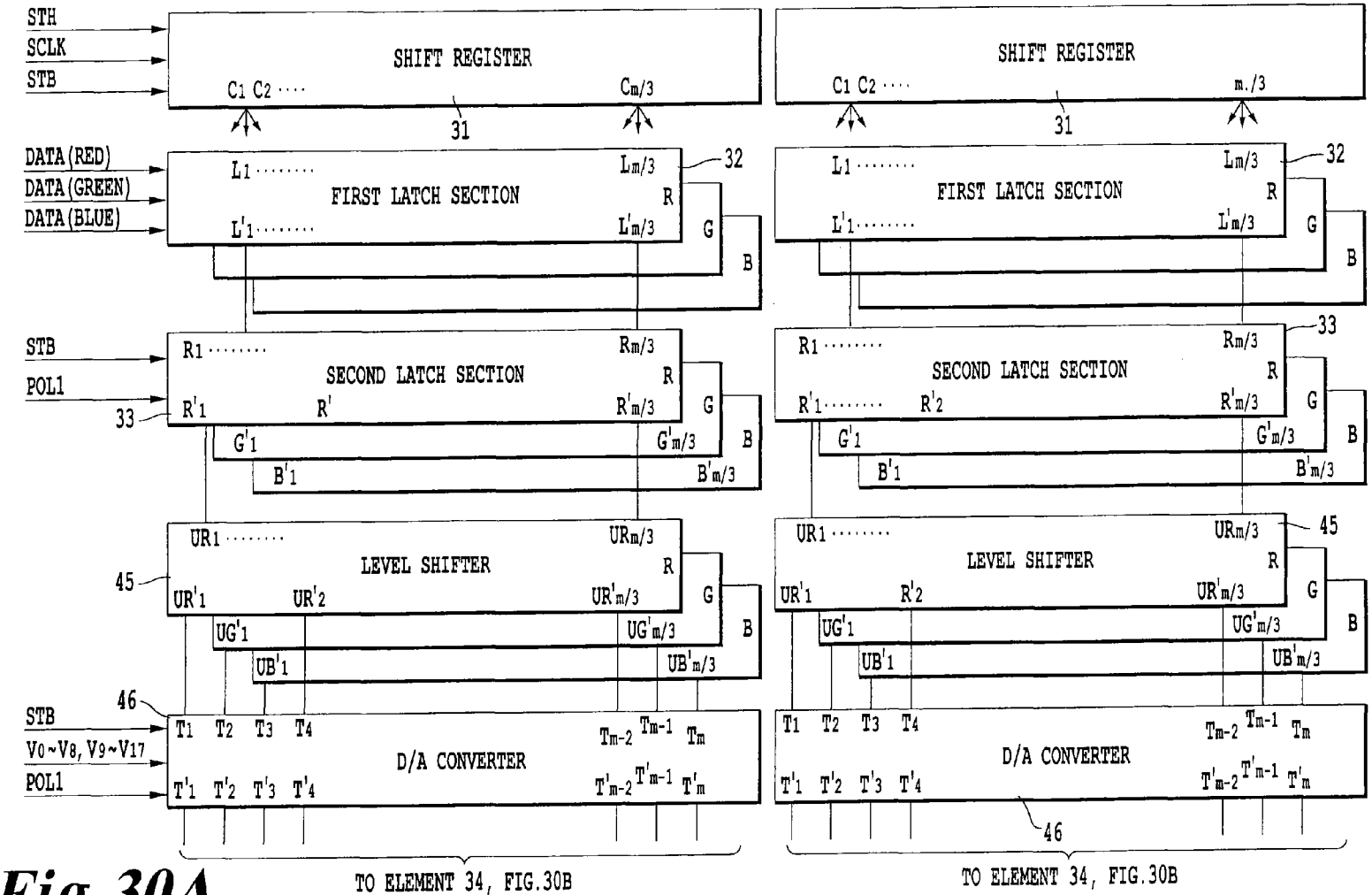
FIGS. 30A, 30B are illustrative diagrams showing an example of a liquid crystal display device according to an eighth embodiment of the present invention.
Figure 30B:
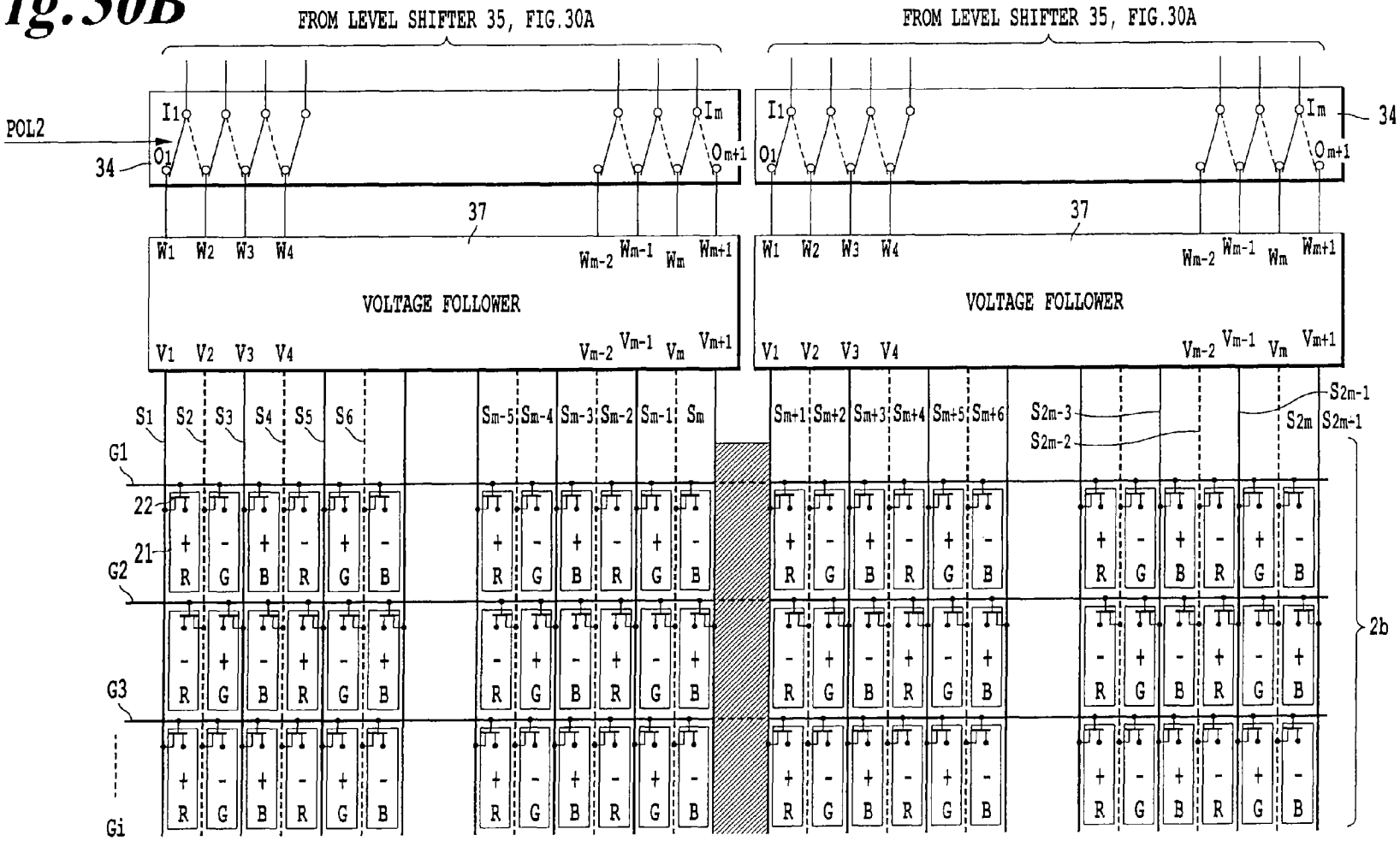

FIGS. 30A, 30B are illustrative diagrams showing an example of a liquid crystal display device according to an eighth embodiment of the present invention. The same components as those in the sixth and seventh embodiments will be given the same reference numerals as those in FIGS. 27A, 27B or FIGS. 29A, 29B to omit the detailed description thereof. Also illustrated in FIGS. 30A, 30B is the case where the liquid crystal display panel has the same structure as the liquid crystal display panel $\mathbf{2}_b$ in the third embodiment. Then, the case where two driving devices are connected to the liquid crystal display panel $\mathbf{2}_b$ is illustrated. Each driving device includes the shift register 31, the first latch section 32, the second latch section 33, the level shifter 45, a DA converter 46, the switch section 34 and the voltage follower 37. The combination of these components 31, 32, 33, 45, 46, 34 and 37 function as the potential setting section.

The liquid crystal panel $\mathbf{2}_b$ has the same structure as that in the sixth embodiment.

The shift register 31, the first latch section 32 and the second latch section 33 are also the same as those in the sixth embodiment. Further, the level shifter 45 is the same as in the seventh embodiment, and the mode of connections between the second latch sections 33 and the level shifters 45, both of which are for R, G and B, respectively, is the same as in the seventh embodiment, except in that the level shifter 45 is connected to the DA converter 46 in the eighth embodiment.

The DA converter 46 is the same as that in the sixth and seventh embodiments, except in that the number of data input terminals and the number of potential output terminals are m, respectively. The DA converter 46 converts data input from each of the level shifter 45 to the data input terminals $T_1$ to $T_m$ into an analog voltage, and outputs the analog voltage from each of the potential output terminals $T'_1$ to $T'_m$.

When input $POL_1$ is at high level, the DA converter 46 sets the output potentials of the odd-numbered potential output terminals $T'_1$, $T'_3$, . . . from the left to potentials higher than $V_{COM}$, and sets the output potentials of the even-numbered potential output terminals $T'_2$, $T'_4$, . . . from the left to potentials lower than $V_{COM}$. On the other hand, when $POL_1$ is at low level, the DA converter 36 sets the output potentials of the odd-numbered potential output terminal $T'_1$, $T'_3$, . . . from the left to potentials lower than $V_{COM}$, and sets the output potentials of the even-numbered potential output terminals $T'_2$, $T'_4$, . . . from the left to potentials higher than $V_{COM}$.

Here, $POL_1$ input to the DA converter 36 will be described. In the sixth and seventh embodiments, the level of $POL_1$ is switched on a frame-by-frame basis. On the other hand, in this embodiment, the control section (not shown in FIGS. 30A, 30B) switches the level of $POL_1$ for each selection period. Then, the control section switches, on a frame-by-frame basis, between an output mode of $POL_1$ and $POL_2$ in which when $POL_2$ becomes low level, $POL_1$ is also set to low level, and an output mode of $POL_1$ and $POL_2$ in which when $POL_2$ becomes low level, $POL_1$ is set to high level.

In this embodiment, the i-th data output terminal $UR'_i$ in the level shifter 45 for R is connected to the data input terminal $T_{3\cdot i-2}$ of the DA converter 46. The i-th data output terminal $UG'_i$ in the level shifter 45 for G is connected to the data input terminal $T_{3\cdot i-1}$ of the DA converter 46. The i-th data output terminal $UB'_i$ in the level shifter 45 for B is connected to the data input terminal $T_{3\cdot i}$ of the DA converter 46.

The structure of the switch section 34 is the same as the switch section 34 in the sixth and seventh embodiments, except in that in this embodiment, the switch section 34 is provided downstream of the DA converter 46, and each of the input terminals $I_1$ to $I_m$ of the switch section 34 is connected to each of the potential output terminals $T'_1$ to $T'_m$ of the DA converter 46 in a one-to-one relationship.

Therefore, when $POL_2$ is at high level, the switch section 34 outputs, from each of the output terminals $O_1$ to $O_m$ of the switch section 34, the potential output from each of the potential output terminals $T'_1$ to $T'_m$ of the DA converter. On the other hand, when $POL_2$ is at low level, the switch section 34 outputs, from each of the output terminals $O_2$ to $O_{m+1}$, the potential output from each of the potential output terminal $T'_1$ to $T'_m$ of the DA converter.

As for $POL_2$, like in the sixth and seventh embodiments, the control section may generate and input $POL_2$ to the switch section 34, or $POL_2$ may be generated inside the driving device. In either case, $POL_2$ is generated to become high level during the selection period of the first row in each frame. This is also the same as in the sixth and seventh embodiments.

Output is taken from each of the output terminals $O_1$ to $O_{m+1}$ of the switch section 34 to each of m+1 potential input terminals (denoted as $W_1$ to $W_{m+1}$) of the voltage follower 37 in one-to-one relationship. The voltage follower 37 is the same as that in the sixth and seventh embodiments, and outputs, from each of the potential output terminal $V_1$ to $V_{m+1}$, a potential equal to the potential input to each of the potential input terminals $W_1$ to $W_{m+1}$, respectively.

Next, the operation will be described.

Figure 31:
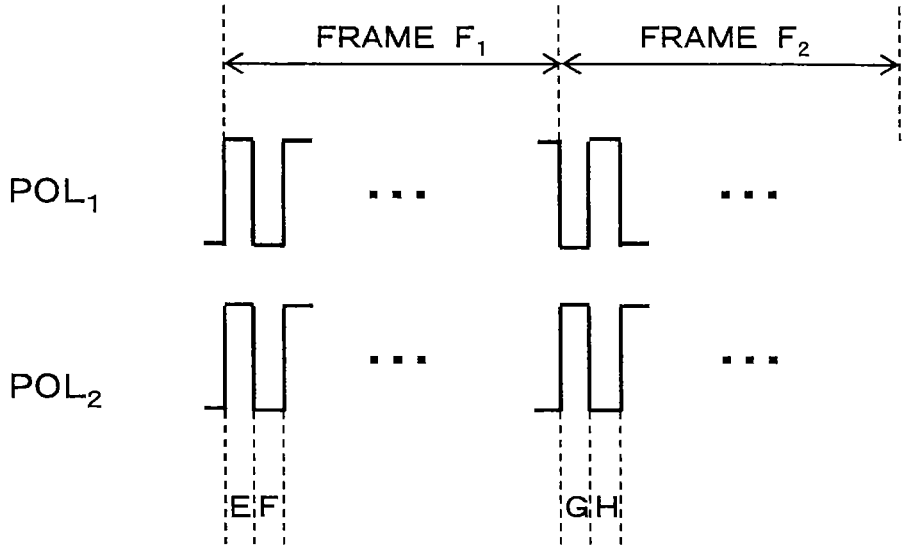
FIG. 31 is an illustrative diagram showing an example of the variations of $POL_1$ and $POL_2$ in the eighth embodiment.

FIG. 31 is an illustrative diagram showing an example of the variations of $POL_1$ and $POL_2$ in the eighth embodiment. $POL_2$ is at high level upon starting a frame, and after that, it is switched per cycle of STB (i.e., per selection period of each row). This point is the same as in the sixth embodiment. Further, in this embodiment, $POL_1$ is switched per cycle of STB. Then, in a frame, when $POL_2$ becomes high level, the control section also sets $POL_1$ to high level, while when $POL_2$ becomes low level, the control section also sets $POL_1$ to low level (see frame $F_1$ shown in FIG. 31). Then, in the next frame, when $POL_2$ becomes high level, $POL_1$ is set to low level, while when $POL_2$ becomes low level, $POL_1$ is set to high level (see frame $F_2$ shown in FIG. 31). Then, the output mode of $POL_1$ and $POL_2$ in frame $F_1$ and the output mode of $POL_1$ and $POL_2$ in frame $F_2$ are repeated alternately on a frame-by-frame basis.

In the eighth embodiment, a period where both $POL_1$ and $POL_2$ are at high level is denoted as "E." A period where both $POL_1$ and $POL_2$ are at low level is denoted as "F." A period where $POL_1$ is at low level and $POL_2$ is at high level is denoted as "G." A period where $POL_1$ is at high level and $POL_2$ is at low level is denoted as "H."

First, frame $F_1$ in which periods E and F alternate will be described. The following takes the selection period of the first row by way of example to describe period E. During period E, the second latch section 33 for R reads R data for one row from the first latch section 32 for R, and inputs each data to the level shifter 45 for R, respectively. The second latch sections 33 for G and B operate the same way.

The level shifter 45 for R shifts the level of input data, and inputs each data after subjected to level shifting to each of the data input terminals $T_1, T_4, \ldots, T_{m-2}$ of the DA converter 46. The level shifter 45 for G also shifts the level of input data, and inputs each data after subjected to level shifting to each of the data input terminals $T_2, T_5, \ldots, T_{m-1}$ of the DA converter 46. The level shifter 45 for B also shifts the level of input data, and inputs each data after subjected to level shifting to each of the data input terminals $T_3, T_6, \ldots, T_m$ of the DA converter 46. As a result, each data (data after subjected to level shifting) for one row is input from the left-hand data input terminals to the DA converter 46 in the following order: R, G, B, R, G, B, . . . . The DA converter 46 converts this data to an analog voltage $V_0$-$V_8$ or the like, or $V_9$-$V_{17}$ or the like, and outputs the analog voltage from each of the potential output terminals $T'_1$ to $T'_m$.

Since $POL_1$ is at high level during period E, the DA converter 46 outputs a potential ($V_0$-$V_8$ or the like) higher than $V_{COM}$ from each of the odd-numbered potential output terminals $T'_1, T'_3, \ldots$ from the left, and outputs a potential ($V_9$-$V_{17}$ or the like) lower than $V_{COM}$ from each of the even-numbered potential output terminal $T'_2, T'_4, \ldots$ from the left.

Since $POL_2$ is at high level, the input terminal $I_i$ of the switch section 34 is connected to the output terminal $O_i$. Therefore, the potentials output from the potential output terminals $T'_1$ to $T'_m$ of the DA converter 46 are output from the output terminals $O_1$ to $O_m$ of the switch section 34, and further output from the potential output terminals $V_1$ to $V_m$ of the voltage follower 37.

As a result, in each voltage follower 37, potentials higher than $V_{COM}$ are output from the odd-numbered potential output terminals $V_1, V_3, \ldots$ from the left and potentials lower than $V_{COM}$ are output from the even-numbered potential output terminals $V_2, V_4, \ldots$ from the left. Then, the odd-numbered source lines $S_1, S_3, \ldots$ from the left are set to potentials higher than $V_{COM}$, and the even-numbered source lines $S_2, S_4, \ldots$ from the left are set to potentials lower than $V_{COM}$. Since the output terminal $O_{m+1}$ is not connected to the input terminal $I_m$ in the switch section 34, there is no output from $V_{m+1}$ in each voltage follower 37.

Each pixel electrode in the first row is set to a potential equal to the source line arranged on the left side of the pixel electrode during the selection period of the first row. As a result, the polarity of each pixel in the first row is positive, negative, positive, negative, . . . in this order from the left.

Next, the selection period of the second row is taken by way of example to describe period F. During period F, the operation until data for one row (data after subjected to level shifting) are input to the DA converter 46 is the same as that for period E.

Since $POL_1$ is at low level during period F, the DA converter 46 outputs a potential ($V_9$-$V_{17}$ or the like) lower than $V_{COM}$ from each of the odd-numbered potential output terminals $T'_1, T'_3$, from the left, and outputs a potential ($V_0$-$V_8$ or the like) higher than $V_{COM}$ from each of the even-numbered potential output terminals $T'_2, T'_4, \ldots$ from the left.

Further, since $POL_1$ is at low level, the input terminal $I_i$ of the switch section 34 is connected to the output terminal $O_{i+1}$. Therefore, the potentials output from the potential output terminals $T'_1$ to $T'_m$ of the DA converter 46 are output from the output terminals $O_2$ to $O_{m+1}$ of the switch section 34, and further output from the potential output terminal $V_2$ to $V_{m+1}$ of the voltage follower 37.

As a result, in each voltage follower 37, potentials lower than $V_{COM}$ are output from the even-numbered potential output terminals $V_2, V_4, \ldots$ from the left and potentials higher than $V_{COM}$ are output from the odd-numbered potential output terminals $V_3, V_5, \ldots$ from the left. Then, the even-numbered source lines $S_2, S_4, \ldots$ from the left are set to potentials lower than $V_{COM}$, and the odd-numbered source lines $S_3, S_5, \ldots$ from the left are set to potentials higher than $V_{COM}$. Since the output terminal $O_1$ is not connected to the input terminal $I_1$ in the switch section 34, there is no input from $V_1$ in each voltage follower 37.

Each pixel electrode in the second row is set to a potential equal to the potential of the source line arranged on the right side of the pixel electrode during the selection period of the second row. As a result, the polarity of each pixel in the second row is negative, positive, negative, positive, . . . in this order from the left as shown in FIGS. 30A, 30B.

After that, in this frame $F_1$, the operations for periods E and F are repeated. As a result, the polar state of each pixel in this frame $F_1$ becomes the same as shown in FIG. 11.

Next, frame $F_2$ in which periods G and H alternate will be described. The following takes the selection period of the first row by way of example to describe period G. The operation until data for one row (data after subjected to level shifting) are input to the DA converter 46 is the same as that for periods E and F mentioned above.

Since $POL_1$ is at low level during period G, the DA converter 46 outputs a potential lower than $V_{COM}$ from each of the odd-numbered potential output terminals $T'_1$, $T'_3$, . . . from the left, and outputs a potential higher than $V_{COM}$ from each of the even-numbered potential output terminal $T'_2$, $T'_4$, . . . from the left.

Further, since $POL_2$ is at high level, the input terminal $I_i$ of the switch section 34 is connected to the output terminal $O_i$. Therefore, the potentials output from the potential output terminals $T'_1$ to $T'_m$ of the DA converter 46 are output from the output terminals $O_1$ to $O_m$ of the switch section 34, and further output from the potential output terminals $V_1$ to $V_m$ of the voltage follower 37.

As a result, in each voltage follower 37, potentials lower than $V_{COM}$ are output from the odd-numbered potential output terminals $V_1$, $V_3$, . . . from the left and potentials higher than $V_{COM}$ are output from the even-numbered potential output terminals $V_2$, $V_4$, . . . from the left. Then, the odd-numbered source lines $S_1$, $S_3$, . . . from the left are set to potentials lower than $V_{COM}$, and the even-numbered source lines $S_2$, $S_4$, . . . from the left are set to potentials higher than $V_{COM}$. Since the output terminal $O_{m+1}$ is not connected to the input terminal $I_m$ in the switch section 34, there is no output from the potential output terminal $V_{m+1}$ in each voltage follower 37.

Then, each pixel electrode in the first row is set to a potential equal to the source line arranged on the left side of the pixel electrode. As a result, the polarity of each pixel in the first row is negative, positive, negative, positive, . . . in this order from the left.

Next, the selection period of the second row is taken by way of example to describe period H. The operation until data for one row (data after subjected to level shifting) are input to the DA converter 46 is the same as that for periods E, F and G.

Since $POL_L$ is at high level during period H, the DA converter 46 outputs a potential higher than $V_{COM}$ from each of the odd-numbered potential output terminals $T'_1$, $T'_3$, . . . from the left, and outputs a potential lower than $V_{COM}$ from each of the even-numbered potential output terminals $T'_2$, $T'_4$, . . . from the left.

Further, since $POL_2$ is at low level, the input terminal $I_i$ of the switch section 34 is connected to the output terminal $O_{i+1}$. Therefore, the potentials output from the potential output terminals $T'_1$ to $T'_m$ of the DA converter 46 are output from the output terminals $O_2$ to $O_{m+1}$ of the switch section 34, and further output from the potential output terminal $V_2$ to $V_{m+1}$ of the voltage follower 37.

As a result, in each voltage follower 37, potentials higher than $V_{COM}$ are output from the even-numbered potential output terminals $V_2$, $V_4$, . . . from the left and potentials lower than $V_{COM}$ are output from the odd-numbered potential output terminals $V_3$, $V_5$, . . . from the left. Then, the even-numbered source lines $S_2$, $S_4$, . . . from the left are set to potentials higher than $V_{COM}$, and the odd-numbered source lines $S_3$, $S_5$, . . . from the left are set to potentials lower than $V_{COM}$. Since the output terminal $O_1$ is not connected to the input terminal $I_1$ in the switch section 34, there is no input from the potential output terminal $V_1$ in each voltage follower 37.

Then, each pixel electrode in the second row is set to a potential equal to the potential of the source line arranged on the right side of the pixel electrode. As a result, the polarity of each pixel in the second row is positive, negative, positive, negative, . . . in this order from the left.

After that, in this frame $F_2$, the operations for periods G and H are repeated. As a result, the polar state of each pixel in this frame $F_2$ becomes the same as shown in FIG. 15.

This embodiment also has effects similar to the sixth embodiment.

The modification of the sixth embodiment can also be applied to the eighth embodiment. When two or more consecutive gate lines are grouped, the structure of the liquid crystal panel may be made similar to the structure of the liquid crystal panel $\mathbf{2}_a$ (see FIG. 17) in the second embodiment. In this case, the control section (or the potential setting section) may set $POL_2$ to high level during the period for selecting each row in the odd-numbered group one by one, and set $POL_2$ to low level during the period for selecting each row in the even-numbered group one by one. Then, the cycle of switching the level of $POL_1$ may be matched to the cycle of switching the level of $POL_2$.

Ninth Embodiment

Figure 32A:
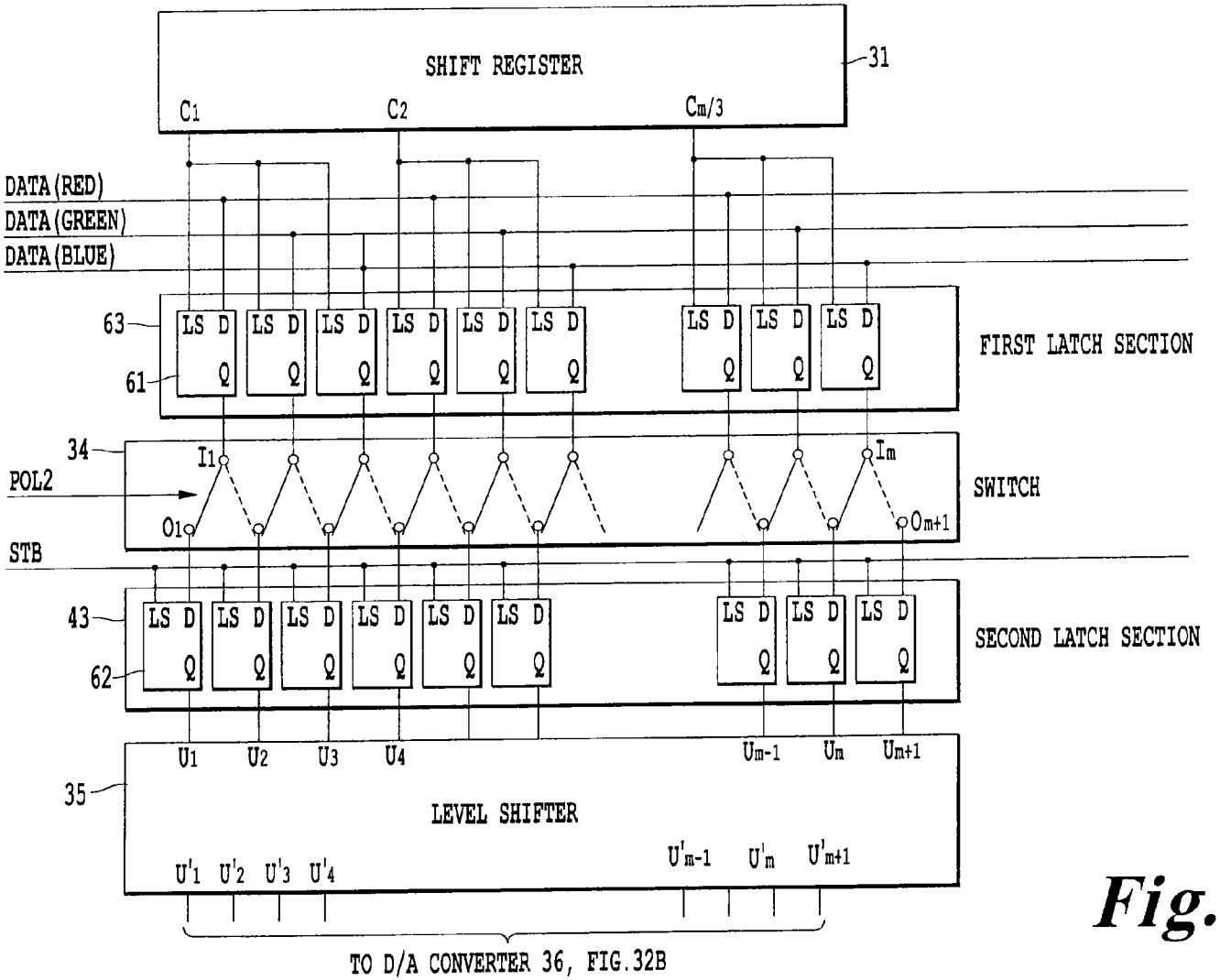
FIGS. 32A, 32B are illustrative diagrams showing an example of a liquid crystal display device according to a ninth embodiment of the present invention.
Figure 32B:
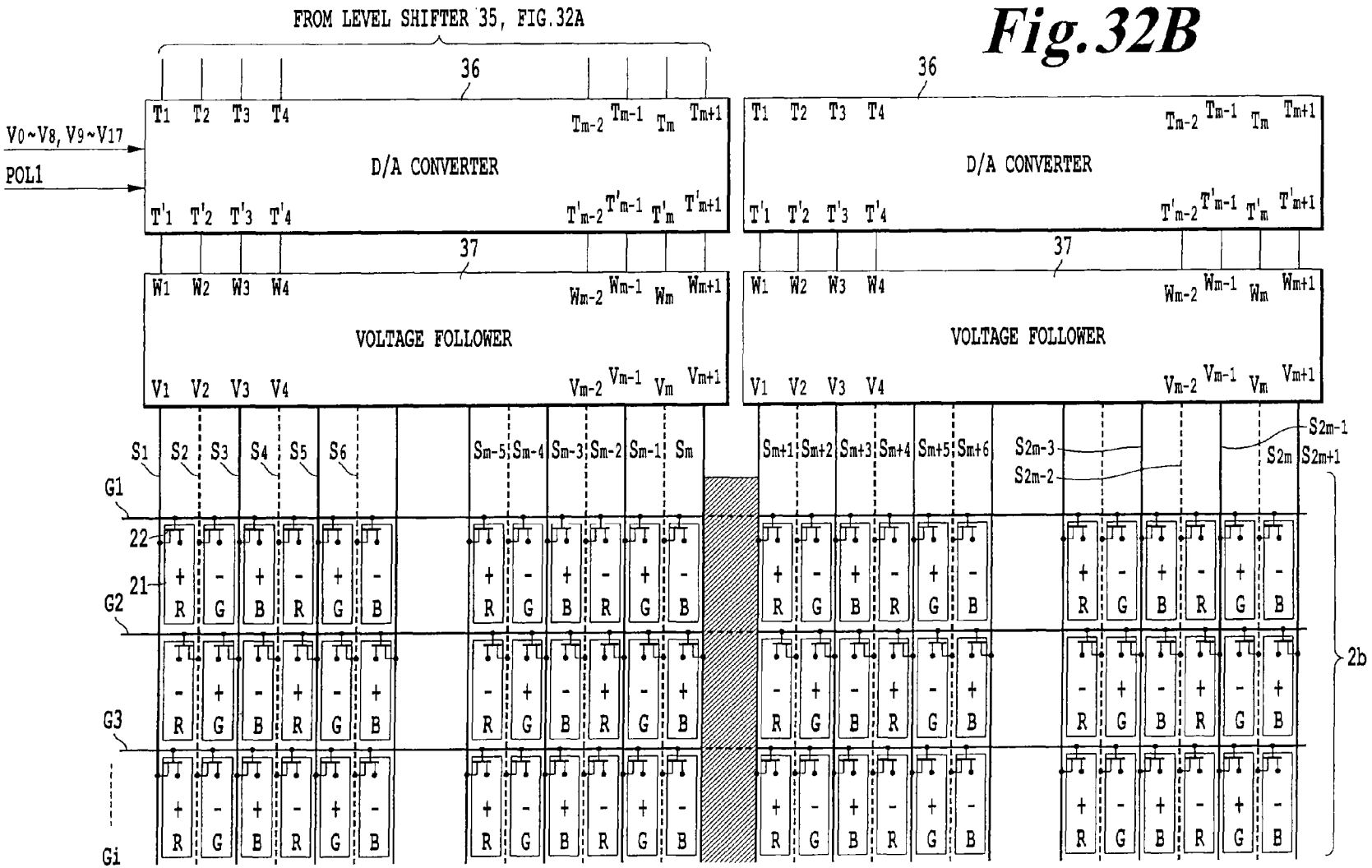

FIGS. 32A, 32B are illustrative diagrams showing an example of a liquid crystal display device according to a ninth embodiment of the present invention. The same components as those in the sixth embodiment will be given the same reference numerals as those in FIGS. 27A, 27B to omit the detailed description thereof. In the ninth embodiment, each driving device includes the shift register 31, a first latch section 63, the switch section 34, a second latch section 43, the level shifter 35, the DA converter 36 and the voltage follower 37. In FIGS. 32A, 32B, among two driving devices connected to the liquid crystal display panel $\mathbf{2}_b$, only the DA converter 36 and the voltage follower 37 in the right driving device are shown without showing the other components.

The first latch section 63 has a structure in which the first latch sections 32 for R, G and B in the sixth embodiment and the like are integrated. The first latch section 63 captures each data along the sequence of R, G and B data for one row.

Specifically, the first latch section 63 has m latch circuits 61 each of which captures data for one pixel. The 3·i−2-th latch circuit 61 from the left captures R data. The 3·i−1-th latch circuit 61 from the left captures G data. The 3·i-th latch circuit 61 from the left captures B data.

Each latch circuit 61 includes a signal input terminal LS to which the data reading instruction signal is input from the shift register 31, a terminal D for reading data, and a terminal Q used by the second latch section 43 to read data. When the data reading instruction signal is input to the terminal LS, each latch circuit 61 reads data for one pixel from the terminal D.

The shift register 31 is the same as the shift register in the sixth embodiment. In other words, the shift register 31 outputs the data reading instruction signal from the signal output terminals $C_1$, $C_2$, . . . , $C_{m/3}$ in this order each time SCLK is input. In this embodiment, any signal output terminal $C_i$ is connected to the 3·i−2 th, 3·i−1-th and 3·i-th latch circuits 61 in the first latch section 63. Therefore, when the shift register 31 outputs the data reading instruction signal from one signal output terminal, R, G and B data are read into three latch circuits in parallel, respectively. For example, the signal output terminal $C_1$ is connected to each of the first to third latch circuit 61 from the left, respectively. Thus, when the signal is output to the signal output terminal $C_1$, the first to third latch circuits 61 from the left read R, G and B data, each for one pixel, respectively.

The second latch section 43 captures data for one row collectively along the sequence of R, G and B data for one row. The second latch section 43 includes latch circuits 62, each of which captures and outputs data for one pixel. Note that the second latch section 43 has the latch circuits 62 that is one more in number than the number of columns, m, of pixels to be driven by the driving device. Each of the latch circuits 62 of the second latch section 43 has a terminal LS to which STB is input from the control section (not shown in FIGS. 32A, 32B), a terminal D for reading data from each latch circuit 61 of the first latch section 63 through the switch section 34, and a terminal Q for outputting the read data. For example, each latch circuit 62 captures data at predetermined timing (e.g., on the falling edge of STB or the like) in the cycle of STB so that the second latch section 43 will capture R, G and B data for one row collectively.

The switch section 34 is the same as the switch section 34 in the sixth embodiment. Any input terminal $I_i$ of the switch section 34 is connected to the terminal Q of the i-th latch circuit 61 from the left in the first latch section 63. Further, any output terminal $O_i$ of the switch section 34 is connected to the terminal D of the i-th latch circuit 62 from the left in the first latch section 43.

Thus, when $POL_2$ input to the switch section 34 is at high level, the m latch circuits 62 numbered from the first to m-th latch circuit from the left in the second latch section 43 captures data for one row from the first latch section 63 through the switch section 34, and outputs the captured data from the terminals Q, respectively. On the other hand, when $POL_2$ is at low level, the m latch circuits 62 numbered from the second to m+1-th latch circuit from the left in the second latch section 43 capture data for one row from the first latch section 63 through the switch section 34, and output the captured data from the terminals Q.

The level shifter 35, the DA converter 36, the voltage follower 37 and the liquid crystal display panel $\mathbf{2}_b$ are the same as those in the sixth embodiment. The mode of connections of these components 35, 36, 37 and $\mathbf{2}_b$ is also the same as in the sixth embodiment.

However, note that any data input terminal $U_i$ of the level shifter 35 is connected to the terminal Q of the i-th latch circuit 62 from the left in the second latch section 43.

Further, the mode of outputting the control signals from the control section (not shown in FIGS. 32A, 32B) in the ninth embodiment is the same as in the sixth embodiment. Therefore, the level of $POL_1$ is switched alternately on a frame-by-frame basis, and the level of $POL_2$ is switched alternately per cycle of STB (per selection period) (see FIG. 28).

Next, the operation will be described.

First, a frame in which periods A and B (see FIG. 28) alternate will be described. Since $POL_2$ is at high level during period A, any input terminal $I_i$ of the switch section 34 is connected to the output terminal $O_1$. Therefore, the m latch circuits 62 numbered from the first to m-th latch circuit from the left in the second latch section 43 read data for one row from the first latch section 63 through the switch section 34, and output respective data.

Since $POL_2$ is at high level and there is no output from the output terminal $O_{m+1}$ of the switch section 34, there is no input and output to and from the m+1 terminals in the level shifter 35, the DA converter 36 and the voltage follower 37.

The data output from the m latch circuits 62 numbered from the first to m-th latch circuit from the left in the second latch section 43 are input to the data input terminals $U_1$ to $U_m$ of the level shifter 35, respectively. Further, $POL_1$ input to the DA converter 36 during period A is at high level. Thus, the operation of the level shifter 35, the DA converter 36 and the voltage follower 37 is the same as the operation for period A described in the sixth embodiment. As a result, the polarity of each pixel during period A in this embodiment is the same as that during period A in the sixth embodiment.

Further, since $POL_2$ becomes low level during period B, any input terminal $I_i$ of the switch section 34 is connected to the output terminal $O_{i+1}$. Therefore, the m latch circuits 62 numbered from the second to m+1-th latch circuit from the left in the second latch section 43 read data for one row from the first latch section 63 through the switch section 34, and output respective data. In this case, there is no input and output to and from the leftmost terminal in the level shifter 35, DA converter 36 and voltage follower 37, respectively.

The data output from the m latch circuits 62 numbered from the second to m+1-th latch circuit from the left in the second latch section 43 are input to the data input terminals $U_2$ to $U_{m+1}$ in the level shifter 35. Further, $POL_1$ input to the DA converter 36 during period B is at high level. Thus, the operation of the level shifter 35, the DA converter 36 and the voltage follower 37 is the same as the operation for period B described in the sixth embodiment. As a result, the polarity of each pixel during period B in this embodiment is the same as that during period A in the sixth embodiment.

After that, the operations for periods A and B are repeated in this frame.

Next, a frame in which period C and D (see FIG. 28) alternate will be described. Since $POL_2$ is at high level during period C, the state of the switch section 34 and the mode of outputting data from the second latch section 43 are the same as those for period A mentioned above. Therefore, the data output from the second latch section 43 are input to the data input terminals $U_1$ to $U_m$ in the level shifter 35. Further, $POL_1$ input to the DA converter 36 during period C is at low level. Thus, the operation of the level shifter 35, the DA converter 36 and the voltage follower 37 is the same as the operation for period C described in the sixth embodiment. As a result, the polarity of each pixel during period C in this embodiment is the same as that during period C in the sixth embodiment.

Further, since $POL_2$ is at low level during period D, the state of the switch section 34 and the mode of outputting data from the second latch section 43 are the same as those for period B mentioned above. Therefore, the data output from the second latch section 43 are input to the data input terminals $U_2$ to $U_{m+1}$ in the level shifter 35. Further, $POL_1$ input to the DA converter 36 during period D is at low level. Thus, the operation of the level shifter 35, the DA converter 36 and the voltage follower 37 is the same as the operation for period D described in the sixth embodiment. As a result, the polarity of each pixel during period D in this embodiment is the same as that during period D in the sixth embodiment.

After that, the operations for periods C and D are repeated in this frame.

The above operation allows even this embodiment to have effects similar to the sixth embodiment.

Further, each modification of the sixth embodiment can also be applied to the ninth embodiment.

Tenth Embodiment

Figure 33A:
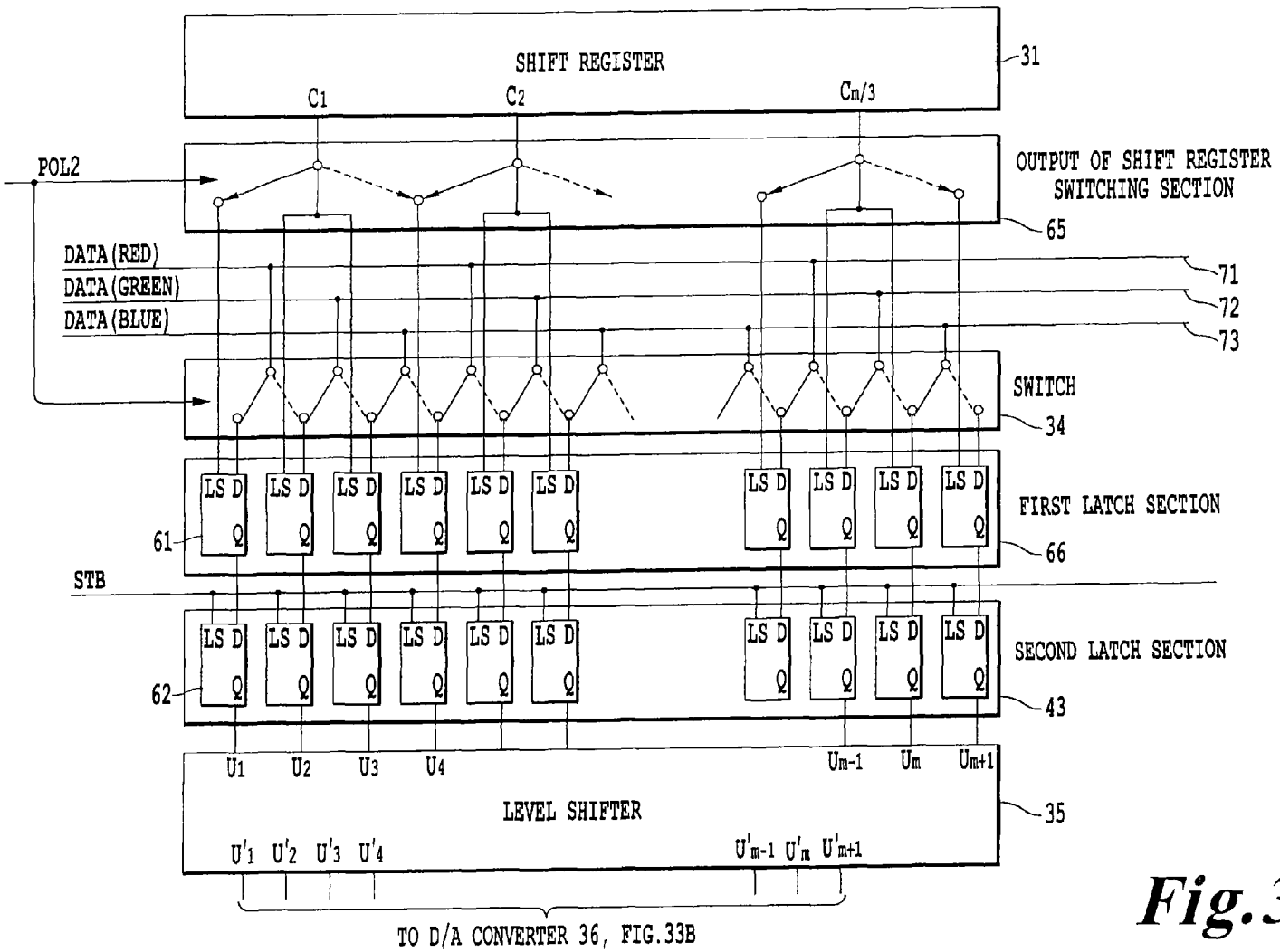
FIGS. 33A, 33B are illustrative diagrams showing an example of a liquid crystal display device according to a tenth embodiment of the present invention.
Figure 33B:
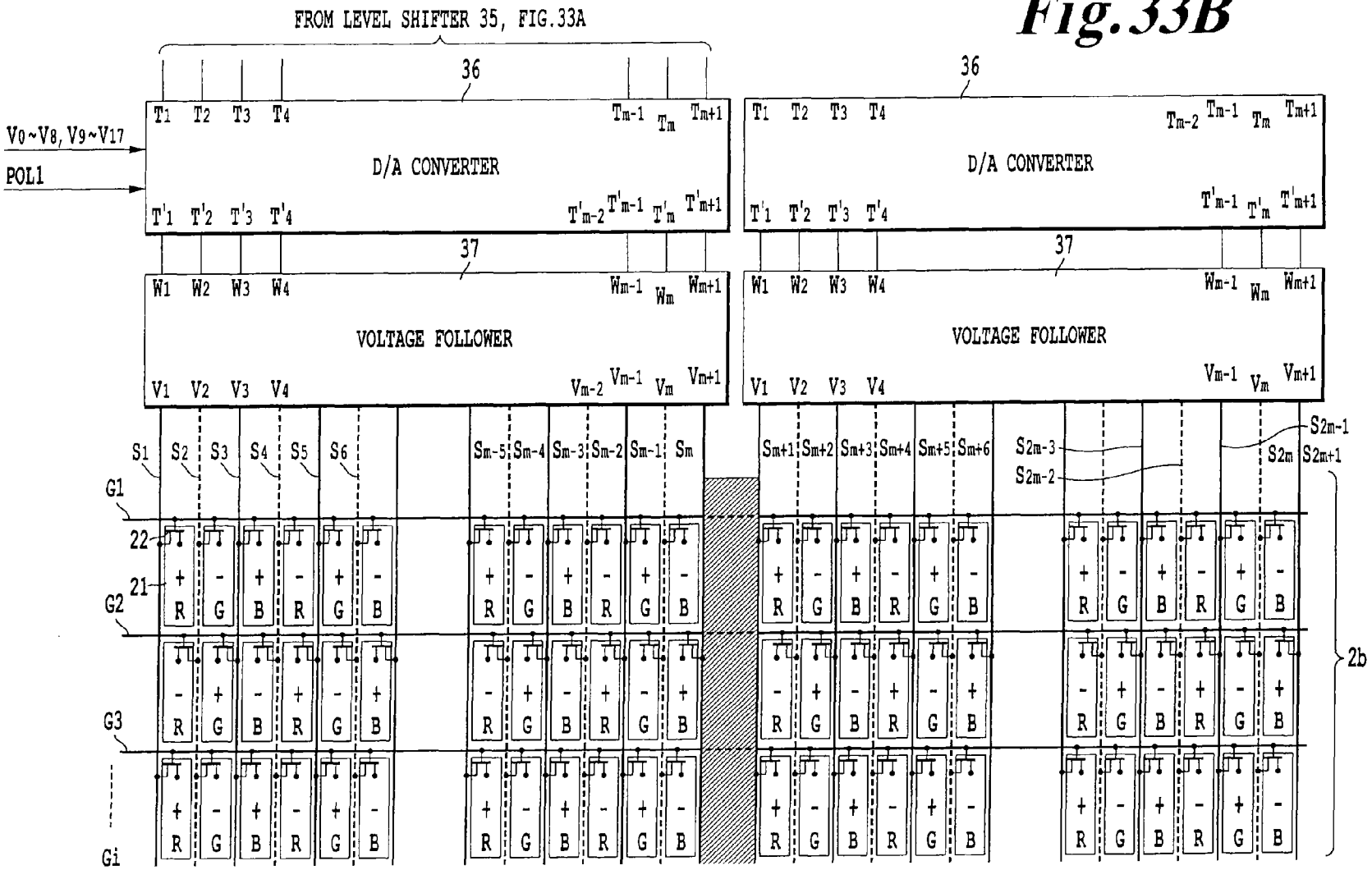

FIGS. 33A, 33B are illustrative diagrams showing an example of a liquid crystal display device according to a tenth embodiment of the present invention. The same components as those in the ninth embodiment will be given the same reference numerals as those in FIGS. 32A, 32B to omit the detailed description thereof. In the tenth embodiment, each driving device includes the shift register 31, an output of shift register switching section 65, the switch section 34, a first latch section 66, the second latch section 43, the level shifter 35, the DA converter 36 and the voltage follower 37. Like in FIGS. 32A, 32B, the components of the right driving device other than the DA converter 36 and the voltage follower 37 are not shown in FIGS. 33A, 33B as well.

The first latch section 66 has m+1 latch circuits 61, each of which captures data for one pixel. The first latch section 66 is the same as the first latch section 63 (see FIGS. 32A, 32B) in the ninth embodiment, except in that the number of latch circuits is m+1.

The second latch section 43 is the same as the second latch section 43 (see FIGS. 32A, 32B) in the ninth embodiment. In this embodiment, however, each of the terminals D of the m+1 latch circuits in the second latch section 43 is connected to each of the terminals Q of the latch circuits 61 of the first latch section 66 in a one-to-one relationship, respectively.

The output of shift register switching section 65 connects each signal output terminal $C_i$ of the shift register with each of the terminals LS of the latch circuits 61 in the first latch section 66. Note that $POL_2$ is input to the output of shift register switching section 65. Then, the output of shift register switching section 65 switches the connection sate depending on whether $POL_2$ is at high level or low level.

In the first latch section 66, the terminal LS of the j-th latch circuit 61 from the left is denoted as $LS_j$. The output of shift register switching section 65 always connects the signal output terminal $C_i$ of the shift register 31 to the terminals $LS_{3\cdot i-1}$ and $LS_{3\cdot i}$. Then, when $POL_2$ is at high level, it connects the signal output terminal $C_i$ to the terminal $LS_{3\cdot i-2}$, while when $POL_2$ is at low level, it connects the signal output terminal $C_i$ to $LS_{3\cdot i+1}$. In other words, when $POL_2$ is at high level, the signal output terminal $C_i$ of the shift register 31 is connected to three terminals $LS_{3\cdot i-2}$, $LS_{3\cdot i-1}$ and $LS_{3\cdot i}$. On the other hand, when $POL_2$ is at low level, the signal output terminal $C_i$ is connected to three terminals $LS_{3\cdot i-1}$, $LS_{3\cdot i}$ and $LS_{3\cdot i+1}$.

For example, if $POL_2$ is at high level, the signal output terminal $C_1$ of the shift register 31 is connected to three terminals $LS_1$, $LS_2$ and $LS_3$, while if $POL_2$ is at low level, it is connected to three terminals $LS_2$, $LS_3$ and $LS_4$. The same holds true for the other signal output terminals of the shift register 31.

It is assumed that each signal output terminal $C_i$ of the shift register 31 is connected to three terminals $LS_{3\cdot i-2}$, $LS_{3\cdot i-1}$ and $LS_{3\cdot 1}$ until $POL_2$ is input after the liquid crystal display device is turned on. After that, when $POL_2$ is input, the output of shift register switching section 65 operates in accordance with $POL_2$.

The switch section 34 is the same as the switch section 34 in the sixth embodiment, having m input terminals $I_1$ to $I_m$ and m+1 output terminals $O_1$ to $O_{m+1}$. Among input terminals, the terminals $I_{3\cdot i-2}$ (specifically, $I_1$, $I_4$, $I_7$ . . . ) are connected to data wiring 71 for R used to transfer R data. Similarly, among the input terminals, the terminals $I_{3\cdot i-1}$ (specifically, $I_2$, $I_5$, $I_8$ . . . ) are connected to data wiring 72 for G used to transfer G data. Further, among the input terminals, $I_{3\cdot i}$ (specifically, $I_3$, $I_6$, $I_9$ . . . ) B are connected to data wiring 73 for B used to transfer B data.

Further, each of the output terminals $O_1$ to $O_{m+1}$ of the switch section 34 is connected to each terminal D of the m+1 latch circuits in the first latch section 66 in a one-to-one relationship.

In the tenth embodiment, it is assumed that the switch section 34 continues to connect the input terminal $I_i$ to the output terminal $O_i$ until $POL_2$ is input after the liquid crystal display device is turned on. After that, when $POL_2$ is input, the switch section 34 operates in accordance with $POL_2$.

The level shifter 35, the DA converter 36, the voltage follower 37 and the liquid crystal display panel $\mathbf{2}_b$ are the same as those in the sixth and ninth embodiments. The mode of connections of these components 35, 36, 37 and $\mathbf{2}_b$ is also the same as in the sixth and ninth embodiments. Further, the mode of connection between the second latch section 43 and the level shifter 35 is the same as that in the ninth embodiment.

The control section (not shown in FIGS. 33A, 33B) in the tenth embodiment switches the level of $POL_1$ on a frame-by-frame basis. As for $POL_2$, like in the other embodiments, the control section may generate $POL_2$ or the driving device may generate $POL_2$. In this embodiment, as mentioned above, the state of the output of shift register switching section 65 and the switch section 34 are defined even in a state where $POL_2$ is not input immediately after the liquid crystal display device is turned on. This state is the same state as when $POL_2$ is at high level. In this state, the first frame is started and each of R, G and data in the first row is captured. Then, upon the start of output of STB, $POL_2$ or the like, $POL_2$ is generated to switch the state of the output of shift register switching section 65 and the switch section 34, and after that, the level of $POL_2$ is switched alternately per cycle of STB (i.e., per selection period) in the first frame.

Further, in each of the second and subsequent frames, the control section (or the driving device) sets $POL_2$ to high level upon the first selection period, and switched the level of $POL_2$ alternately per cycle of STB in the frame. In each of the second and subsequent frames, $POL_2$ is set to high level at the time of starting the frame regardless of whether $POL_2$ before the start of the frame is at high level or low level, and after that, the level of $POL_2$ is switched per cycle of STB.

Next, the operation will be described.

First, the operation at power-on will be described. After power-on, the output of shift register switching section 65 continues to connect the each signal output terminal $C_i$ of the shift register 31 to the terminals $LS_{3\cdot i-2}$, $LS_{3\cdot i-1}$ and $LS_{3\cdot i}$. Further, the switch section 34 continues to connect each input terminal $I_i$ to each output terminal $O_i$. In this sate, when a frame is started, the shift register 31 outputs the data reading instruction signal in response to SCLK from the signal output terminals $C_1$, $C_2$, . . . in this order. Since the output of shift register switching section 65 and the switch section 34 are in the above-mentioned state, the first latch section 66 reads R, G and B data in parallel sequentially for each of the three latch circuits from the left. At this time, the m+1-th latch circuit 61 of the first latch section 66 reads no data.

After that, when the generation of STB is started, the first to m-th latch circuits 62 from the left in the second latch section 43 reads data for one row collectively from the first latch section 66, and inputs each data to the data input terminal $U_1$ to $U_m$ of the level shifter 35. After that, the operation of the level shifter 35, the DA converter 36 and the voltage follower 37 is the same as that in the sixth and ninth embodiments. The operation of the DA converter 36 depends on the level of $POL_1$ input. The above operation is referred to as the first operation.

It is assumed that $POL_2$ is also generated together with the generation of STB, and low-level $POL_2$ is input to the output of shift register switching section 65 and the switch section 34. As a result, the output of shift register switching section 65 switches to a state in which each signal output terminal $C_i$ of the shift register 31 is connected to the terminals $LS_{3\cdot i-1}$, $LS_{3\cdot i}$ and $LS_{3\cdot i+1}$. Further, the switch section 34 switches to a state in which each input terminal $I_i$ is connected to the output terminal $O_{i+1}$.

The shift register 31 outputs the data reading instruction signal in response to SCLK from the signal output terminals $C_1$, $C_2$, . . . in this order. Since the output of shift register switching section 65 and the switch section 34 are in the above-mentioned state, the first latch circuit 61 from the left in the first latch section 66 reads no data. Then, the second to m+1-th latch circuits 61 from the left in the first latch section 66 read R, G and B data sequentially three at a time in parallel. The output of the data reading instruction signal from each of the signal output terminals $C_1$, $C_2$, . . . is completed during the cycle of STB.

After that, the second to m+1-th latch circuits from the left in the second latch section 43 reads data for one row collectively from the first latch section 66, and inputs each data to the data input terminal $U_2$ to $U_{m+1}$ of the level shifter 35. After that, the operation of the level shifter 35, the DA converter 36 and the voltage follower 37 is the same as that in the sixth and ninth embodiments. The operation of the DA converter 36 depends on the level of $POL_1$ input. The above operation is referred to as the second operation.

After that, $POL_2$ is switched between high level and low level alternately per cycle of STB. As a result, the first operation and the second operation are repeated alternately.

In each of the second and subsequent frames, $POL_2$ is set to high level at the time of starting the frame. Since $POL_2$ is at high level, the output of shift register switching section 65 continues to connect each signal output terminal $C_i$ of the shift register 31 with the terminals $LS_{3\cdot i-2}$, $LS_{3\cdot i-1}$ and $LS_{3\cdot i}$. Further, the switch section 34 continues to connect each input terminal $I_i$ to the output terminal $O_i$. As a result, the driving device performs the same operation as the first operation mentioned above.

Further, when $POL_2$ becomes low level, the output of shift register switching section 65 switches to a state in which each signal output terminal $C_i$ of the shift register 31 is connected to the terminals $LS_{3\cdot i-1}$, $LS_{3\cdot i}$ and $LS_{3\cdot i+1}$. Further, the switch section 34 switches to a state in which each input terminal $I_i$ is connected to the output terminal $O_{i+1}$. As a result, the driving device performs the same operation as the second operation mentioned above.

In each of the second and subsequent frames, since $POL_2$ is also switched between high level and low level alternately per cycle of STB, the first operation and the second operation are performed alternately.

As a result of the above operations, the polarities of pixels adjacent to each other in the longitudinal direction and the lateral direction become opposite to each other. Further, since $POL_1$ is switched on a frame-by-frame basis, the polar state shown in FIG. 11 and polar state shown in FIG. 15 are switched alternately.

This embodiment also has effects similar to the sixth embodiment.

Further, each modification of the sixth embodiment can also be applied to the tenth embodiment.

Eleventh Embodiment

Figure 34A:
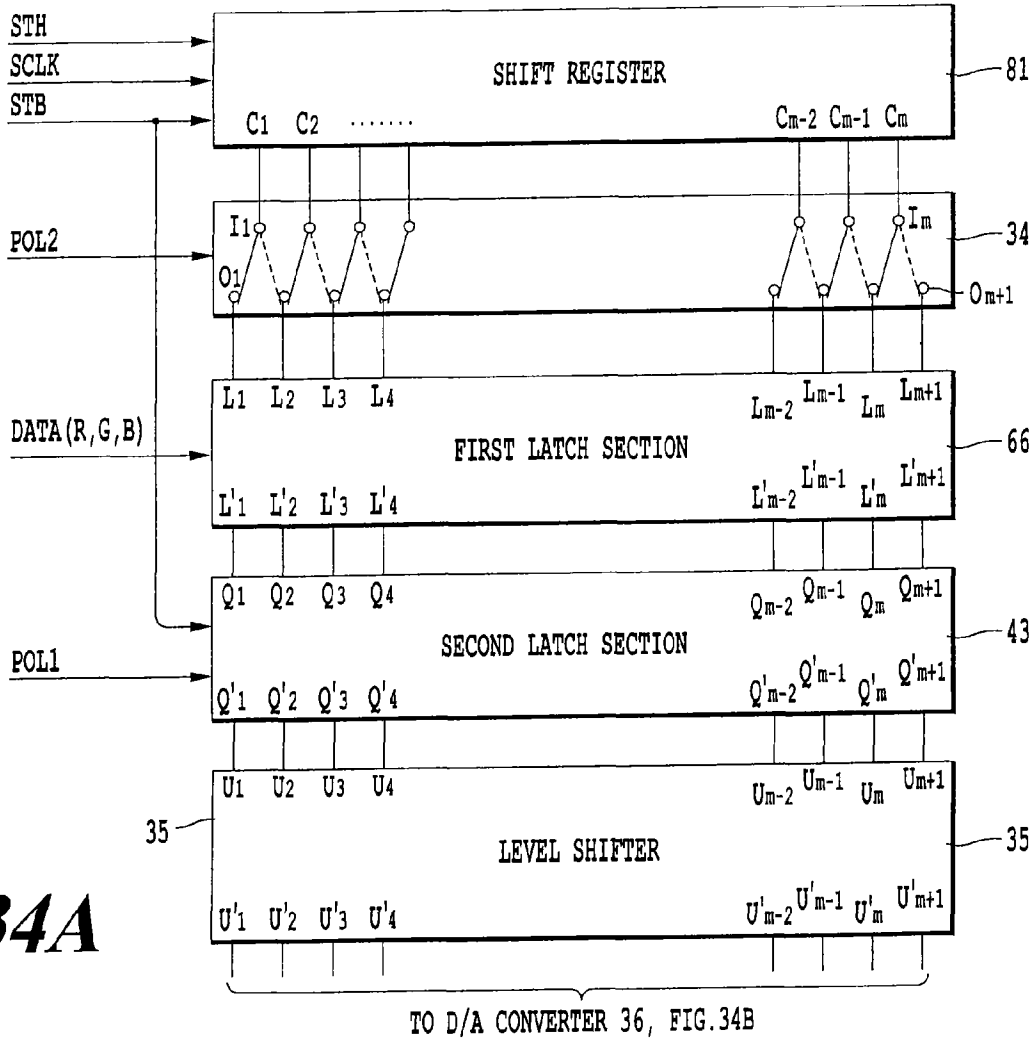
FIGS. 34A, 34B are illustrative diagrams showing an example of a liquid crystal display device according to an eleventh embodiment of the present invention.
Figure 34B:
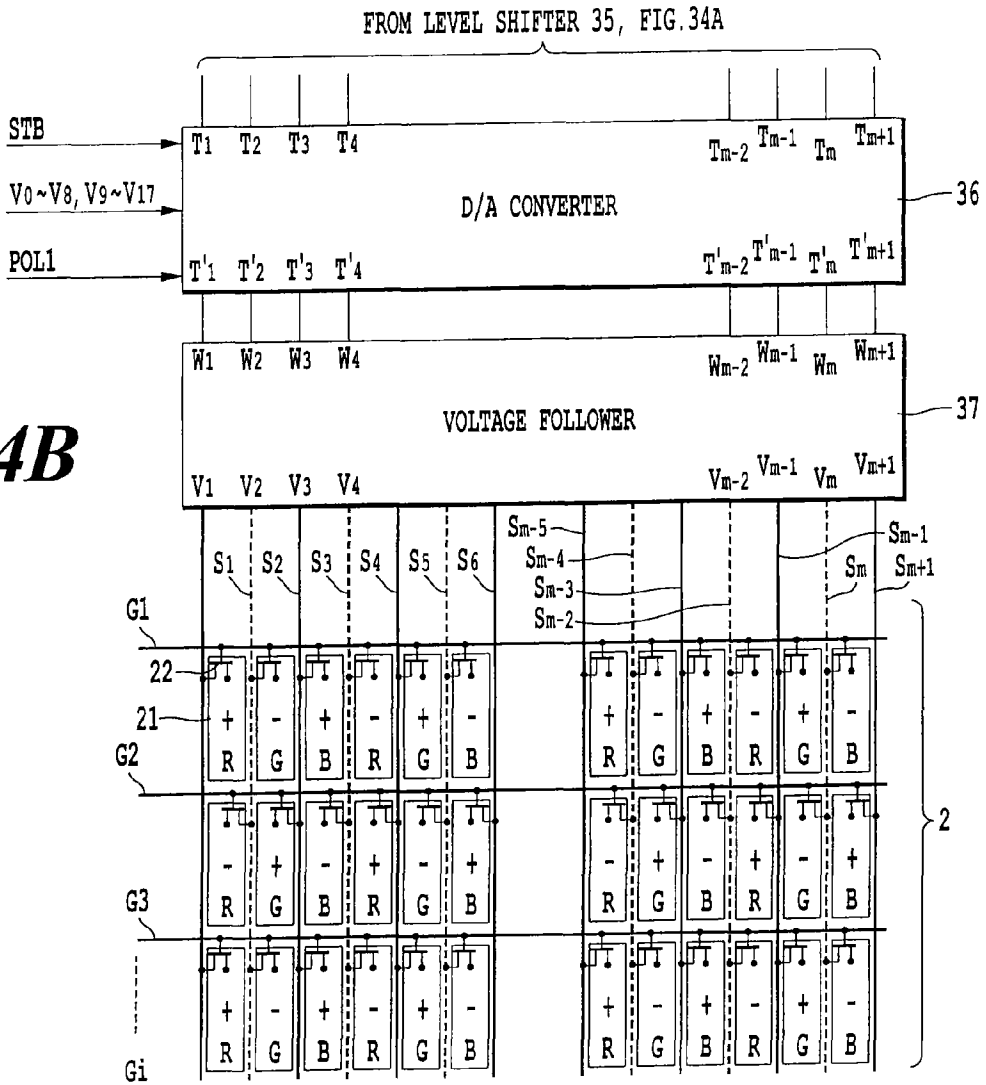

FIGS. 34A, 34B are illustrative diagrams showing an example of a liquid crystal display device according to an eleventh embodiment of the present invention. The detailed description of the same components as those in the sixth and tenth embodiment and the like will be omitted. In the eleventh embodiment, the driving device includes a shift register 81, the switch section 34, the first latch section 66, the second latch section 43, the level shifter 35, the DA converter 36 and the voltage follower 37.

The liquid crystal display panel 2 is the same as that in the first embodiment. In the example shown in FIGS. 34A, 34B, the liquid crystal display panel 2 includes m columns of pixel electrodes and source lines $S_1$ to $S_{m+1}$ that is one more in number than the number of columns of pixel electrodes.

The operation of the shift register 81 is the same as the shift register 31 in the sixth and tenth embodiments and the like, except in that the shift register 81 has m signal output terminal $C_1$ to $C_m$ as many as the number of columns of pixels (dots) on the liquid crystal display panel 2. Since the shift register 81 is the same as the shift register already described except for the number of signal output terminals, the detailed description thereof will be omitted.

The switch section 34 is the same as the switch section 34 in the sixth embodiment, having m input terminals $I_1$ to $I_m$ and m+1 output terminals $O_1$ to $O_{m+1}$. Each of the input terminals $I_1$ to $I_m$ is connected to each of the signal output terminal $C_1$ to $C_m$ of the shift register 81 in a one-to-one relationship. In the eleventh embodiment, it is assumed that the switch section 34 continues to connect the input terminal $I_i$ to the output terminal $O_i$ until $POL_2$ is input after the liquid crystal display device is turned on. After that, when $POL_2$ is input, the switch section 34 operates in accordance with $POL_2$.

The first latch section 66 has sign input terminals $L_1$ to $L_{m+1}$, and the sign input terminals $L_1$ to $L_{m+1}$ are connected to the output terminal $O_1$ to $O_{m+1}$ of the switch section 34 in a one-to-one relationship. When the data reading instruction signal is input from the signal input terminal $L_i$, the first latch section 66 captures the i-th data in one line. In the eleventh and subsequent embodiments, it is assumed that each pixel data is transferred as data for one line sequentially in the following order: R, G, B, R, G, B . . . . Therefore, the first latch section 66 reads data for one line serially in response to the data reading instruction signal input in series from the shift register 81 through the switch section 34. In other words, the first latch section 66 reads data in order one pixel (dot) by one pixel (dot). The first latch section 66 has m+1 output terminals $L'_1$ to as terminals used to read data (m data) for one line. For example, the first latch section 66 may have the same structure as the first latch section 66 (see FIGS. 33A, 33B) in the tenth embodiment.

Further, the liquid crystal display panel 2 may be a black-and-white liquid crystal display panel provided with black-and-white pixels. In this case, data transferred to the first latch section 66 may be data according to a black-and-white image. This point holds true for the twelfth and subsequent embodiments.

The second latch section 43 has data reading terminals $Q_1$ to $Q_{m+1}$ for reading data for one line, and the data reading terminals $Q_1$ to $Q_{m+1}$ are connected to the output terminals $L'_1$ to $L'_{m+1}$ of the first latch section 66 in a one-to-one relationship. The second latch section 43 reads m data for one line collectively from the first latch section 66 at predetermined timing (e.g., on the falling edge of STB or the like) in each cycle of STB, and outputs each data from the data output terminals $Q'_1$ to $Q'_{m+1}$, respectively. The data output terminals $Q'_1$ to $Q'_{m+1}$ contained in the second latch section 43 are connected to the data input terminals $U_1$ to $U_{m+1}$ of the level shifter 35 in a one-to-one relationship. For example, the second latch section 43 may have the same structure as the second latch section 43 in the tenth embodiment.

The level shifter 35, the DA converter 36 and the voltage follower 37 are the same as those in the sixth and tenth embodiments. The mode of connections among these components 35 to 37 is also the same as in the sixth and tenth embodiments. Each of the potential output terminals $V_1$ to $V_{m+1}$ of the voltage follower 37 are connected to each of the source lines $S_1$ to $S_{m+1}$ of the liquid crystal display panel 2 in a one-to-one relationship.

In the eleventh embodiment, the control section (not shown in FIGS. 34A, 34B) also switches the level of $POL_1$ on a frame-by-frame basis. As for $POL_2$, like in the other embodiments, the control section may generate $POL_2$ or the driving device may generate $POL_2$. In the eleventh embodiment, the state of the switch section 34 is defined even in a state where $POL_2$ is not input immediately after the liquid crystal display device is turned on. This state is the same state as when $POL_2$ is at high level. In this state, the first frame is started and data in the first row is captured. Then, upon the start of generation of STB, $POL_2$ or the like, $POL_2$ is generated to switch the state of the switch section 34, and after that, the level of $POL_2$ is switched alternately during the cycle of STB in the first frame. This point is the same as that of the tenth embodiment.

In each of the second and subsequent frames, the control section (or the driving device) sets $POL_2$ to high level upon the first selection period, and after that, the level of $POL_2$ is switched alternately per cycle of STB in the frame. In each of the second and subsequent frames, $POL_2$ is set to high level at the time of starting the frame regardless of whether $POL_2$ before the start of the frame is at high level or low level, and after that, the level of $POL_2$ is switched per cycle of STB. This point also the same as that in the tenth embodiment.

Next, the operation at power-on will be described. After power-on, the switch section 34 continues to connect each input terminal $I_i$ to the output terminal $O_i$. In this state, when the frame is started, the shift register 81 outputs the data reading instruction signal from the signal output terminals $C_1$, $C_2$, . . . in this order in response to SCLK, and the first latch section 66 reads data for one line serially one pixel by one pixel. At this time, since the switch section 34 is in the above-mentioned state, the output terminal $O_{m+1}$ of the switch section 34 is not connected to the input terminal $I_m$. Therefore, since there is no signal input to the signal input terminal $L_{m+1}$ of the first latch section 66, the data output terminal $L'_{m+1}$ is not used.

After that, when the generation of STB is started, the data reading terminals $Q_1$ to $Q_m$ of the second latch section 43 reads data for one row collectively from the first latch section 66, and inputs each data to the data input terminals $U_1$ to $U_m$ of the level shifter 35. After that, the operation of the level shifter 35, the DA converter 36 and the voltage follower 37 is the same as that in the sixth, ninth and tenth embodiments and the like. Note that the operation of the DA converter 36 depends on the level of $POL_1$ input. As described in the tenth embodiment, this operation is referred to as the first operation.

It is assumed that $POL_2$ is also generated together with STB, and low-level $POL_2$ is input to the switch section 34. As a result, the switch section 34 switches to a state in which each input terminal $I_i$ is connected to the output terminal $O_{i+1}$.

The shift register 81 outputs the data reading instruction signal from the signal output terminals $C_1$, $C_2$, . . . in this order in response to SCLK, and the first latch section 66 reads data for one line serially one pixel (dot) by one pixel (dot). Since each input terminal $I_i$ of the switch section 34 is connected to the output terminal $O_{i+1}$, there is no signal input to the signal input terminal $L_1$ of the first latch section 66, and data output terminal $L'_1$ is not used.

After that, the data reading terminals $Q_2$ to $Q_{m+1}$ of the second latch section 43 reads data for one row collectively from the first latch section 66, and inputs each data to the data input terminals $U_2$ to $U_{m+1}$ of the level shifter 35. After that, the operation of the level shifter 35, the DA converter 36 and the voltage follower 37 is the same as in the sixth, ninth and tenth embodiments and the like. Note that the operation of the DA converter 36 depends on the level of $POL_1$ input. As described in the tenth embodiment, this operation is referred to as the second operation.

After that, $POL_2$ is switched between high level and low level alternately per cycle of STB. As a result, the first operation and the second operation are repeated alternately.

In each of the second and subsequent frames, $POL_2$ is set to high level at the time of starting the frame. Since $POL_2$ is at high level, the switch section 34 is in the state where each input terminal $I_i$ is connected to the output terminal Oi. As a result, the driving device performs the same operation as the first operation mentioned above.

Further, when $POL_2$ becomes low level, the switch section 34 switches to a state in which each input terminal $I_i$ is connected to the output terminal $O_{i+1}$. As a result, the driving device performs the same operation as the second operation mentioned above.

In each of the second and subsequent frames, since $POL_2$ is switched between high level and low level alternately per cycle of STB, the first operation and the second operation are performed alternately.

As a result of the above-mentioned operations, the polar state of each pixel in each frame becomes the same as that in the sixth embodiment and the like.

This embodiment also has effects similar to the sixth embodiment.

Next, a modification of the eleventh embodiment will be described.

Like in the first embodiment, FIGS. 34A, 34B show the case where one driving device is connected to the liquid crystal display panel, but two or more driving devices may be connected to the liquid crystal panel like in the sixth embodiment and the like. In this case, the structure of the liquid crystal display panel may be the same structure of the liquid crystal display panel $\mathbf{2}_b$ (see FIGS. 27A, 27B or the like in the third and sixth embodiments. Then, like in the sixth embodiment, the liquid crystal display panel $\mathbf{2}_b$ may be connected to the voltage follower 37 of each driving device.

Further, like in the second embodiment, two or more consecutive gate lines may be grouped. In this case, the liquid crystal panel has the same structure as the liquid crystal panel $\mathbf{2}_a$ (see FIG. 17) in the second embodiment. In this case, the control section (or the potential setting section) may set $POL_2$ to high level during a period for selecting each row in the odd-numbered group one by one, and sets $POL_2$ to low level during a period for selecting each row in the even-numbered group one by one.

Twelfth Embodiment

Figure 35A:
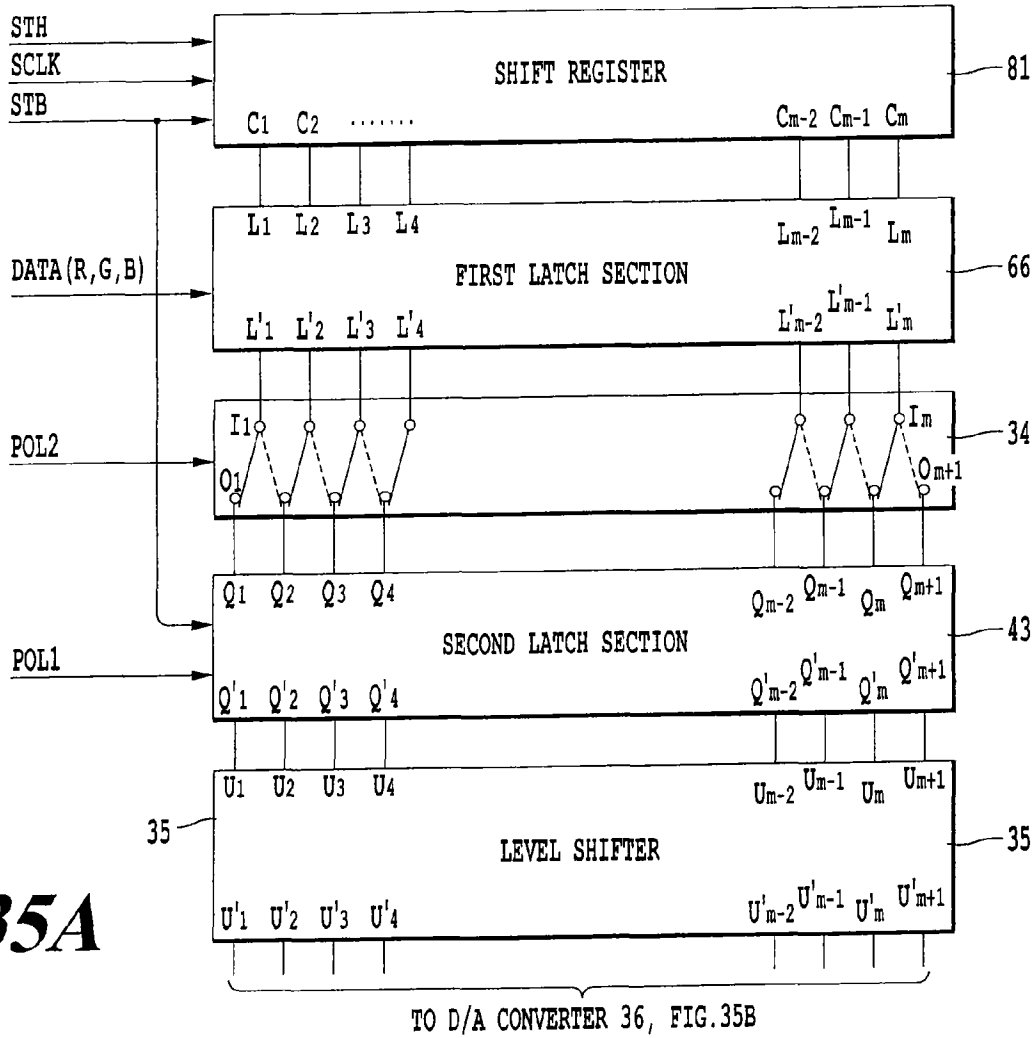
FIGS. 35A, 35B are illustrative diagrams showing an example of a liquid crystal display device according to a twelfth embodiment of the present invention.
Figure 35B:
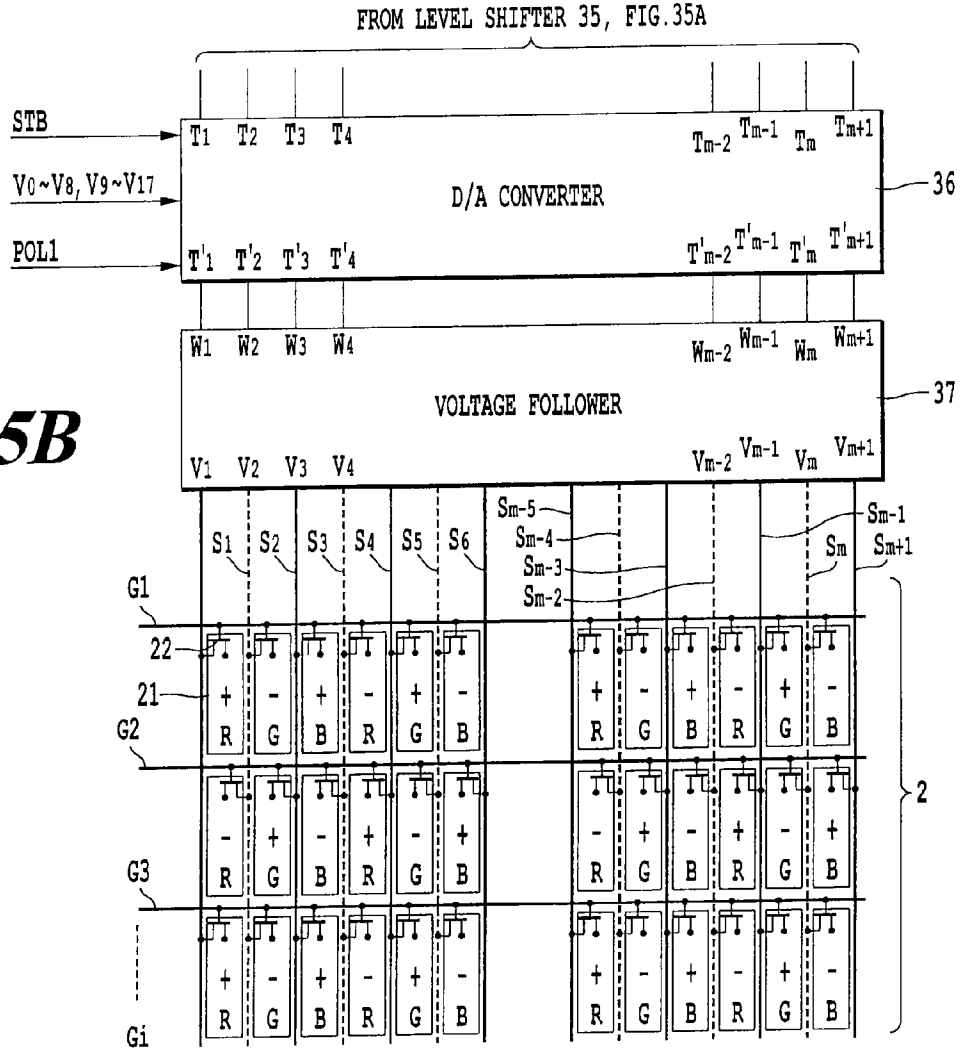

FIGS. 35A, 35B are illustrative diagrams showing an example of a liquid crystal display device according to a twelfth embodiment of the present invention. The description of the same components as those in the eleventh embodiment will be omitted. In the twelfth embodiment, the driving device includes the shift register 81, the first latch section 66, the switch section 34, the second latch section 43, the level shifter 35, the DA converter 36 and the voltage follower 37.

In the structure of the twelfth embodiment is different from that of the eleventh embodiment in that the switch section 34 is arranged between the first latch section 66 and the second latch section 43. Because of this arrangement, the first latch section 66 has m signal input terminals $L_1$ to $L_m$ and m output terminals $L'_1$ to $L'_m$ in the twelfth embodiment. The sign input terminals $L_1$ to $L_m$ of the first latch section 66 are connected to the signal output terminal $C_1$ to $C_m$ of the shift register 81 in a one-to-one relationship. Further, the output terminals $L'_1$ to $L'_m$ of the first latch section 66 are connected to the input terminals $I_1$ to $I_m$ of the switch section 34 in a one-to-one relationship.

The structure of the switch section 34 is that same as that in the sixth and other embodiments. In this embodiment, the output terminals $O_1$ to $O_{m+1}$ of the switch section 34 are connected to the data reading terminals $Q_1$ to $Q_{m+1}$ of the second latch section 43 in a one-to-one relationship.

The second latch section 43, the level shifter 35, the DA converter 36, the voltage follower 37 and the liquid crystal display panel 2 are the same as those in the eleventh embodiment. Further, the mode of connections among these components 43, 35, 36, 37 and 2 is also the same as that in the eleventh embodiment.

The output mode of control signals from the control section (not shown in FIGS. 35A, 35B) in the twelfth embodiment is the same as in the sixth embodiment. Therefore, the level variations of $POL_1$ and $POL_2$ are the same as the case shown in FIG. 28. In other words, the level of $POL_1$ switched alternately on a frame-by-frame basis, and the level of $POL_2$ is switched alternately per cycle of STB. Like in the other embodiments, $POL_2$ may be generated on the driving device side. These points hold true for thirteenth and fourteenth embodiments to be described later.

A frame in which periods A and B (see FIG. 28) alternate will be described. Since $POL_2$ is at high level during period A, any input terminal $I_i$ of the switch section 34 is connected to the output terminal $O_i$. The second latch section 43 reads data for one row from the first latch section 63 through the switch section 34 by means of the m data reading terminals $Q_1$ to $Q_m$. Then, the second latch section 43 outputs each data from the data output terminals $Q'_1$ to $Q'_m$. At this time, since there is no output from the output terminal $O_{m+1}$ of the switch section 34, there is no input and output to and from the m+1-th terminal from the left in the second latch section 43, the level shifter 35, the DA converter 36 and the voltage follower 37.

The data output from the data output terminals $Q'_1$ to $Q'_m$ of the second latch section 43 are input to the data input terminal $U_1$ to $U_m$ of the level shifter 35. Further, $POL_1$ is at high level during period A. Therefore, the operation of the level shifter 35, the DA converter 36 and the voltage follower 37 is the same as that for period A described in the sixth embodiment.

Since $POL_2$ becomes low level during period B (see FIG. 28), any input terminal $I_i$ of the switch section 34 is connected to the output terminal $O_{i+1}$. Therefore, the second latch section 43 reads data for one row from the first latch section 63 through the switch section 34 by means of the m data reading terminals $Q_2$ to $Q_{m+1}$. Then, the second latch section 43 outputs each data from the data output terminals $Q'_2$ to $Q'_{m+1}$. At this time, since there is not output from the output terminal $O_1$ of the switch section 34, there is no input output to and from the leftmost terminal in the second latch section 43, the level shifter 35, the DA converter 36 and the voltage follower 37.

The data output from the data output terminals $Q'_2$ to $Q'_{m+1}$ of the second latch section 43 are input to the data input terminals $U_2$ to $U_{m+i}$ of the level shifter 35. Further, $POL_1$ is at high level during period B. Therefore, the operation of the level shifter 35, the DA converter 36 and the voltage follower 37 is the same as that for period B described in the sixth embodiment.

After that, the operations for periods A and B are repeated alternately.

Next, a frame in which periods C and D (see FIG. 28) alternate will be described. Since $POL_2$ becomes high level during period C, the second latch section 43 reads data for one row from the data reading terminal $Q_1$ to $Q_m$ through the switch section 34, and outputs each data from the data output terminal $Q'_1$ to $Q'_m$. At this time, $POL_1$ is at low level. Therefore, the operation of the level shifter 35, the DA converter 36 and the voltage follower 37 is the same as that for period C described in the sixth embodiment.

Since $POL_2$ becomes low level during period D, the second latch section 43 reads data for one row from the data reading terminals $Q_2$ to $Q_{m+1}$ through the switch section 34, and outputs each data from the data output terminals $Q'_2$ to $Q'_{m+1}$. At this time, $POL_1$ is at low level. Therefore, the operation of the level shifter 35, the DA converter 36 and the voltage follower 37 is the same as that for period D described in the sixth embodiment.

After that, the operations for periods C and D are repeated alternately in this frame.

As a result of the above-mentioned operations, the polar state of each pixel in each frame becomes the same as that in the sixth embodiment and the like.

This embodiment also has effects similar to the sixth embodiment.

Further, each modification of the eleventh embodiment can also be applied to the twelfth embodiment.

Thirteenth Embodiment

Figure 36A:
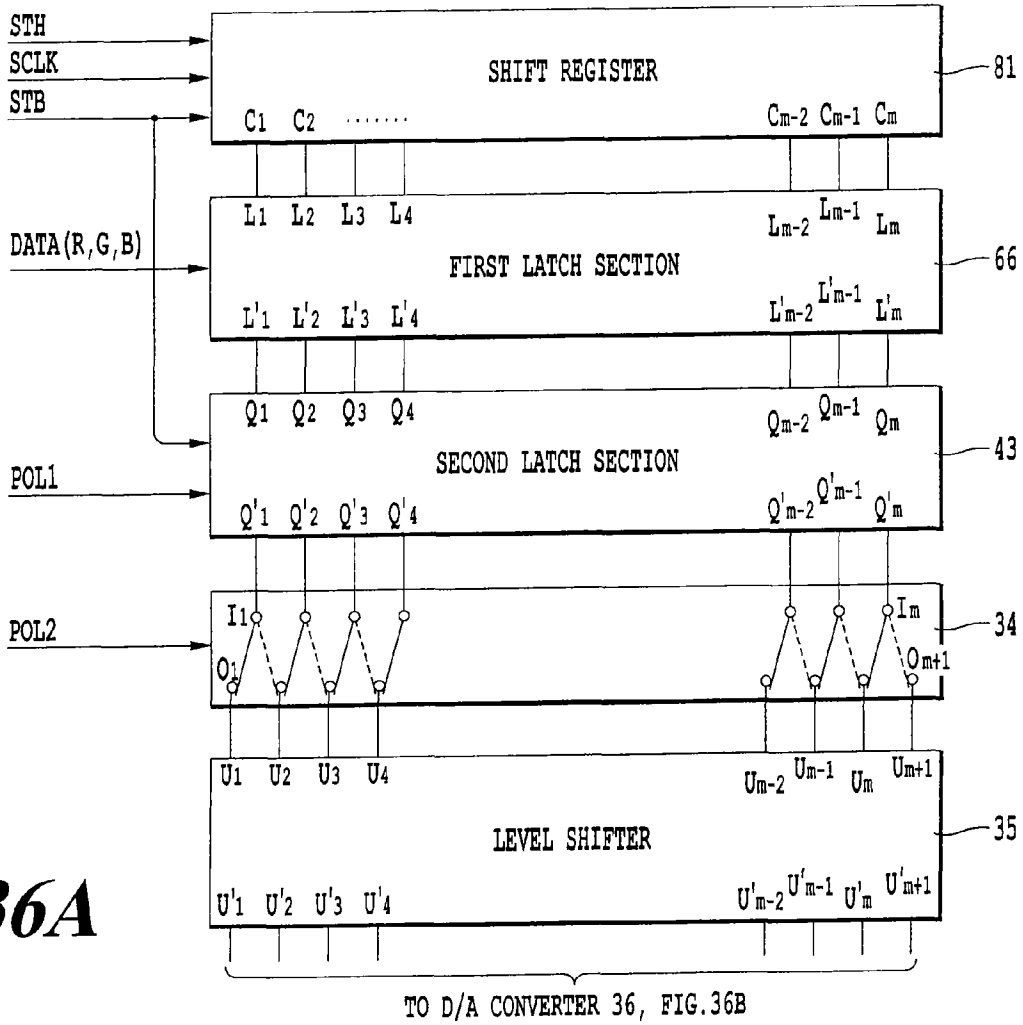
FIGS. 36A, 36B are illustrative diagrams showing an example of a liquid crystal display device according to a thirteenth embodiment of the present invention.
Figure 36B:
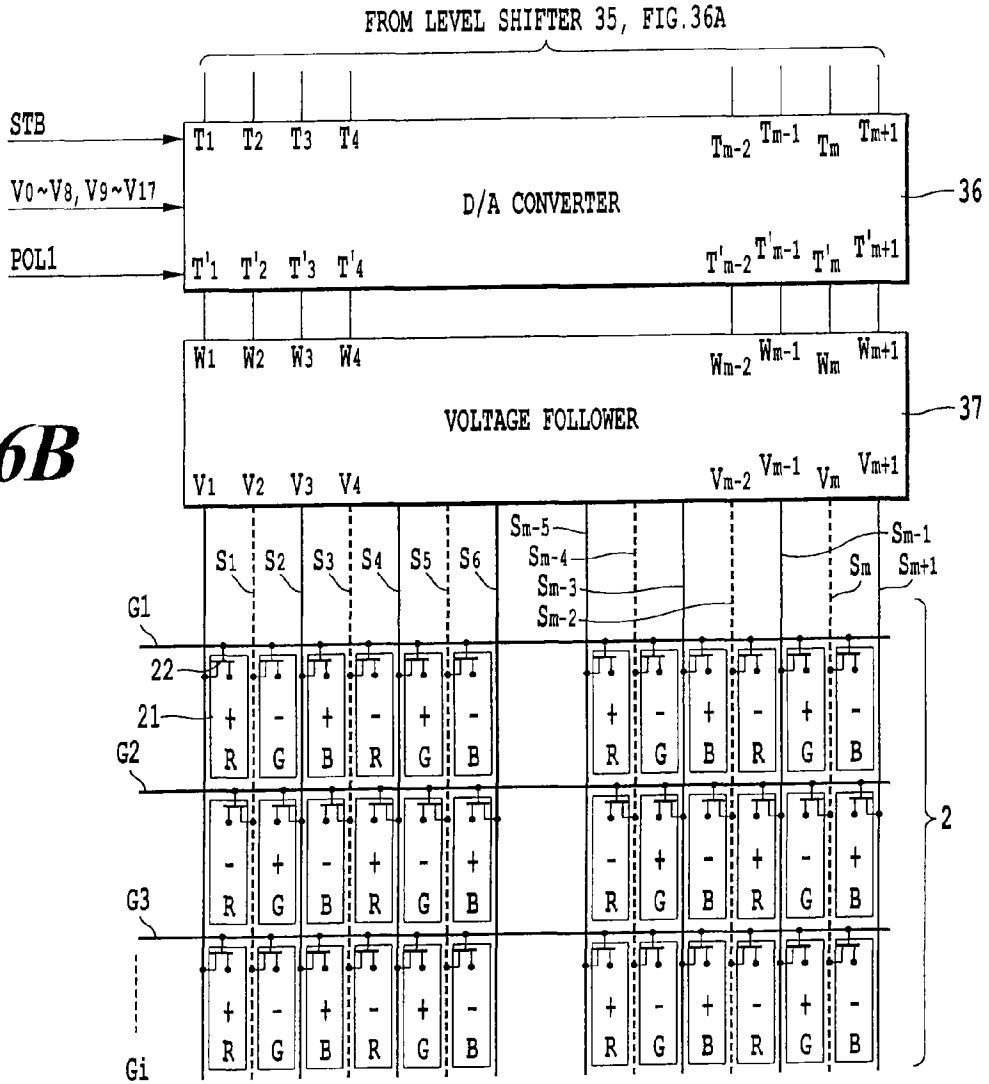

FIGS. 36A, 36B are illustrative diagrams showing an example of a liquid crystal display device according to a thirteenth embodiment of the present invention. The detailed description of the same components as those in the twelfth embodiment will be omitted. In the thirteenth embodiment, the driving device includes the shift register 81, the first latch section 66, the second latch section 43, the switch section 34, the level shifter 35, the DA converter 36 and the voltage follower 37.

The mode of connection between the shift register 81 and the first latch section 66 is the same as that in the twelfth embodiment.

The structure of the thirteenth embodiment is different from that of the twelfth embodiment in that the switch section 34 is arranged between the second latch section 43 and the level shifter 35. Because of this arrangement, the second latch section 43 has m data reading terminals $Q_1$ to $Q_m$ and m data output terminals $Q'_1$ to $Q'_m$ in the thirteenth embodiment. The data reading terminals $Q_1$ to $Q_m$ of the second latch section 43 are connected to the output terminals $L'_1$ to $L'_m$ of the first latch section 66 in a one-to-one relationship. Further, the data output terminals $Q'_1$ to $Q'_m$ of the second latch section 43 are connected to the input terminal $I_1$ to $I_m$ of the switch section 34 in a one-to-one relationship.

The structure of the switch section 34 is that same as that in the sixth and other embodiments. In this embodiment, the output terminals $O_1$ to $O_{m+1}$ of the switch section 34 are connected to the data input terminal $U_1$ to $U_{m+1}$ of the level shifter 35 in a one-to-one relationship.

The level shifter 35, the DA converter 36, the voltage follower 37 and the liquid crystal display panel 2 are the same as those in the eleventh and twelfth embodiments. The mode of connections among these components is also the same as that in the eleventh and twelfth embodiments.

As already described, the level variations of $POL_1$ and $POL_2$ in the thirteenth embodiment are also the same as the case shown in FIG. 28. A frame in which periods A and B (see FIG. 28) alternate will be described. Since $POL_2$ becomes high level during period A, any input terminal $I_i$ of the switch section 34 is connected to the output terminal $O_i$. Therefore, the second latch section 43 captures data for one row from the data reading terminals $Q_1$ to $Q_m$, and outputs each data from the data output terminals $Q'_1$ to $Q'_m$. Since the switch section 34 is in the above-mentioned state, the data output from the data output terminals $Q'_1$ to $Q'_m$ are input to the data input terminal $U_1$ to $U_m$ of the level shifter 35. Further, $POL_1$ is high level during period A. Therefore, the operation of the level shifter 35, the DA converter 36 and the voltage follower 37 is the same as the operation for period A described in the sixth embodiment. Note that there is no input and output to and from the m+1-th terminal from the left in the level shifter 35, the DA converter 36 and the voltage follower 37.

Since $POL_2$ becomes low level during period B, any input terminal $I_i$ of the switch section 34 is connected to the output terminal $O_{i+1}$. Further, the second latch section 43 captures data for one row from the data reading terminals $Q_1$ to $Q_m$, and outputs each data from the data output terminals $Q'_1$ to $Q'_m$. Since the switch section 34 is in the above-mentioned state, the data output from the data output terminals $Q'_1$ to $Q'_m$ are input to the data input terminals $U_2$ to $U_{m+1}$ of the level shifter 35. Further, $POL_1$ is at high level during period B. Therefore, the operation of the level shifter 35, the DA converter 36 and the voltage follower 37 is the same as the operation for period B described in the sixth embodiment. Note that there is no input and output to and from the leftmost terminal in the level shifter 35, the DA converter 36 and the voltage follower 37.

After that, the operations for periods A and B are repeated alternately in this frame.

Next, a frame in which periods C and D (see FIG. 28) alternate will be described. Since $POL_2$ becomes high level during period C, any input terminal $I_i$ of the switch section 34 is connected to the output terminal $O_i$. Therefore, the data output from the data output terminals $Q'_1$ to $Q'_m$ of the second latch section 43 are input to the data input terminals $U_1$ to $U_m$ of the level shifter 35. Further, $POL_1$ is at low level during period C. Therefore, the operation of the level shifter 35, the DA converter 36 and the voltage follower 37 is the same as the operation for period C described in the sixth embodiment. Note that there is no input and output to and from the m+1-th terminal in the level shifter 35, the DA converter 36 and the voltage follower 37.

Since $POL_2$ becomes low level during period D, any input terminal $I_i$ of the switch section 34 is connected to the output terminal $O_{1+1}$. Therefore, the data output from the data output terminals $Q'_1$ to $Q'_m$ of the second latch section 43 are input to the data input terminal $U_2$ to $U_{m+1}$ of the level shifter 35. Further, $POL_1$ is at low level during period D. Therefore, the operation of the level shifter 35, the DA converter 36 and the voltage follower 37 is the same as the operation for period D described in the sixth embodiment. Note that there is no input and output to and from the leftmost terminal in the level shifter 35, the DA converter 36 and the voltage follower 37.

After that, the operations for periods C and D are repeated alternately.

As a result of the above-mentioned operations, the polar state of each pixel in each frame becomes the same as that in the sixth embodiment and the like.

This embodiment also has effects similar to the sixth embodiment.

Further, each modification of the eleventh embodiment can also be applied to the thirteenth embodiment.

Fourteenth Embodiment

Figure 37A:
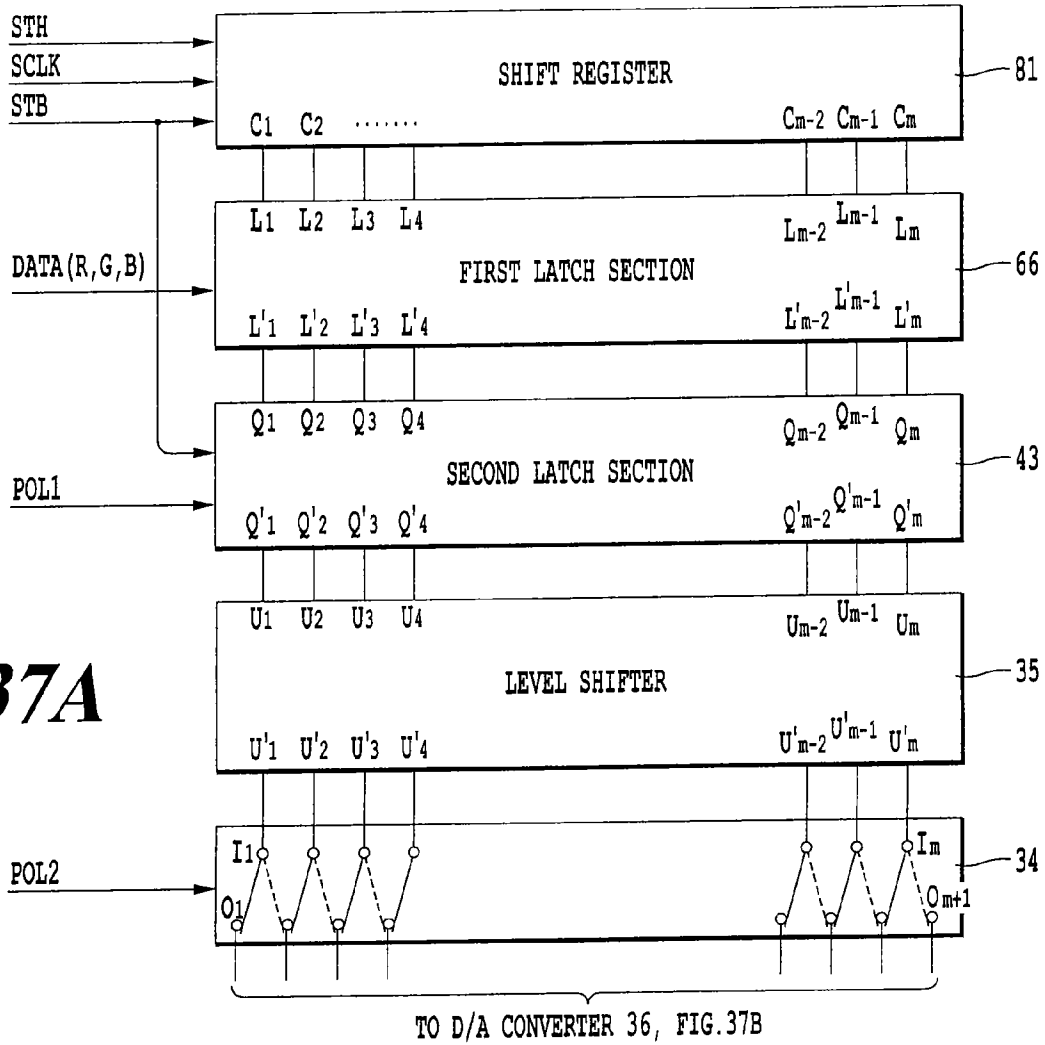
FIGS. 37A, 37B are illustrative diagrams showing an example of a liquid crystal display device according to a fourteenth embodiment of the present invention.
Figure 37B:
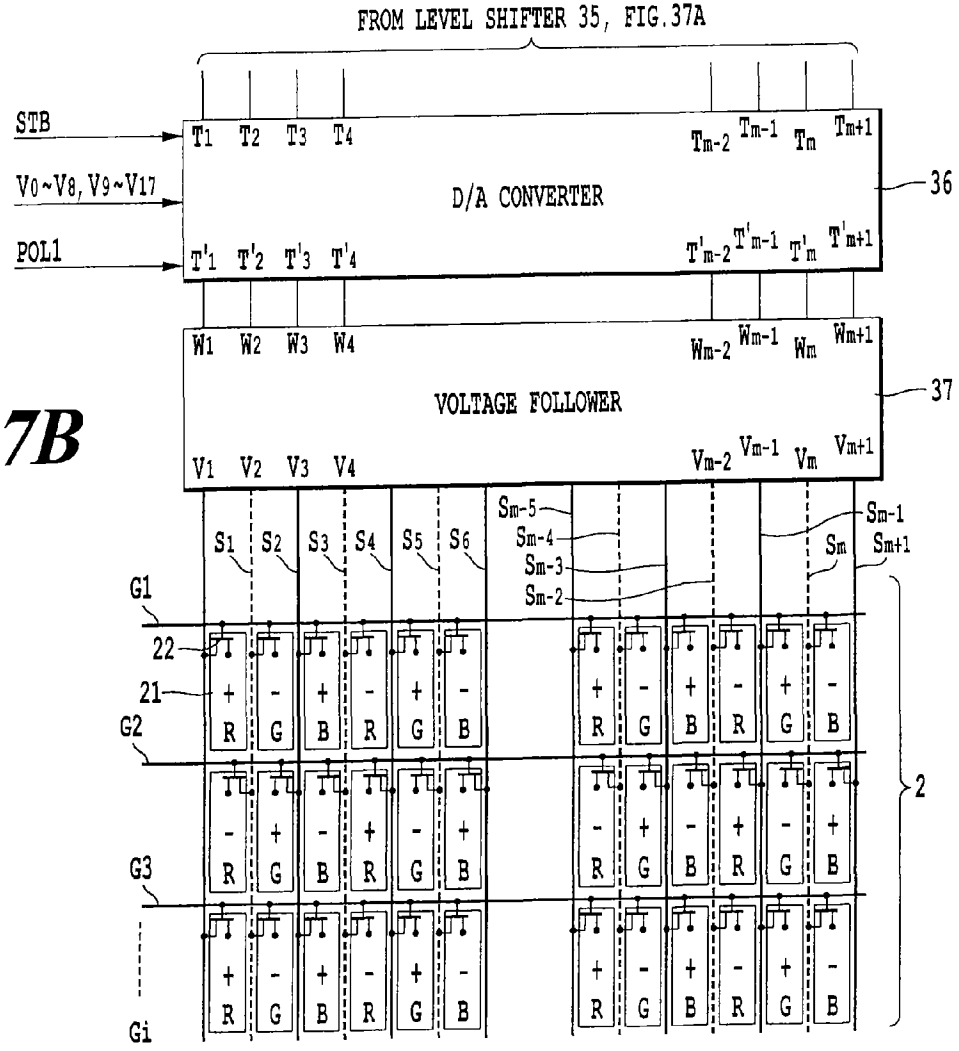

FIGS. 37A, 37B are illustrative diagrams showing an example of a liquid crystal display device according to a fourteenth embodiment of the present invention. The detailed description of the same components as those in the thirteenth embodiment will be omitted. In the fourteenth embodiment, the driving device includes the shift register 81, the first latch section 66, the second latch section 43, the level shifter 35, the switch section 34, the DA converter 36 and the voltage follower 37.

The shift register 81, the first latch section 66 and second latch section 43, and the mode of connections among them are the same as in the thirteenth embodiment.

The structure of the fourteenth embodiment is different from the thirteenth embodiment in that the switch section 34 is arranged between the level shifter 35 and the DA converter 36. Because of this arrangement, the level shifter 35 has m data input terminals $U_1$ to $U_m$ and m data output terminals $U'_1$ to $U'_m$ in the fourteenth embodiment. The data input terminals $U_1$ to $U_m$ of the level shifter 35 are connected to the data output terminals $Q'_1$ to $Q'_m$ of the second latch section 43 in a one-to-one relationship. Further, the data output terminals $U'_1$ to $U'_m$ of the level shifter 35 are connected to the input terminals $I_1$ to $I_m$ of the switch section 34 in a one-to-one relationship.

The structure of the switch section 34 is that same as that in the sixth and other embodiments. In this embodiment, the output terminals $O_1$ to $O_{m+1}$ of the switch section 34 are connected to the data input terminals $T_1$ to $T_{m+1}$ of the DA converter 36 in a one-to-one relationship.

The DA converter 36, the voltage follower 37 and the liquid crystal display panel 2, and the mode of connections among them are the same as in the eleventh embodiment and the like.

As already described, the level variations of $POL_1$ and $POL_2$ in the fourteenth embodiment are also the same as the case shown in FIG. 28. A frame in which periods A and B (see FIG. 28) alternate will be described. Since $POL_2$ becomes high level during period A, any input terminal $I_i$ of the switch section 34 is connected to the output terminal $O_i$. The second latch section 43 captures data for one row from the data reading terminals $Q_1$ to $Q_m$, and inputs each data to the data input terminals $U_1$ to $U_m$ of the level shifter 35. The level shifter 35 shifts the level of input data and outputs the data from the data output terminals $U'_1$ to $U'_m$. Since the switch section 34 is in the above-mentioned state, the data output from the data output terminals $U'_1$ to $U'_m$ are input to the data input terminals $T_1$ to $T_m$ of the DA converter. $POL_1$ is at high level during period A. Therefore, the operation of the DA converter 36 and the voltage follower 37 is the same as the operation for period A described in the sixth embodiment. Note that there is no input and output to and from the m+1-th terminal from the left in the DA converter 36 and the voltage follower 37.

Since $POL_2$ becomes low level during period B, any input terminal $I_i$ of the switch section 34 is connected to the output terminal $O_{i+1}$. The second latch section 43 inputs data for one row to the data input terminals $U_1$ to $U_m$ of the level shifter 35. The level shifter 35 shifts the level of input data and outputs the data from the data output terminals $U'_1$ to $U'_m$. Since the switch section 34 is in the above-mentioned state, the data output from the data input terminals $U_1$ to $U_m$ are input to the data input terminals $T_2$ to $T_{m+1}$ of the DA converter. $POL_1$ is at high level during period B. Therefore, the operation of the DA converter 36 and the voltage follower 37 is the same as the operation for period B described in the sixth embodiment. Note that there is no input and output to and from the leftmost terminal in the DA converter 36 and the voltage follower 37.

After that, the operations for periods A and B are repeated alternately in this frame.

Next, a frame in which periods C and D (see FIG. 28) alternate will be described. Since $POL_2$ becomes high level during period C, any input terminal $I_i$ of the switch section 34 is connected to the output terminal $O_i$. The second latch section 43 inputs data for one row to the data input terminals $U_1$ to $U_m$ of the level shifter 35. The level shifter 35 shifts the level of input data and outputs the data from the data output terminals $U'_1$ to $U'_m$. Since the switch section 34 is in the above-mentioned state, the data output from the data output terminals $U'_1$ to $U'_m$ are input to the data input terminals $T_1$ to $T_m$ of the DA converter. $POL_1$ is at low level during period C. Therefore, the operation of the DA converter 36 and the voltage follower 37 is the same as the operation for period C described in the sixth embodiment. Note that there is no input and output to and from the m+1-th terminal from the left in the DA converter 36 and the voltage follower 37.

Since $POL_2$ becomes low level during period D, any input terminal $I_i$ of the switch section 34 is connected to the output terminal $O_{i+1}$. The second latch section 43 inputs data for one row to the data input terminals $U_1$ to $U_m$ of the level shifter 35. The level shifter 35 shifts the level of input data and outputs the data from the data output terminals $U'_1$ to $U'_m$. Since the switch section 34 is in the above-mentioned state, the data output from the data input terminals $U_1$ to $U_m$ are input to the data input terminals $T_2$ to $T_{m+1}$ of the DA converter. $POL_1$ is at low level during period D. Therefore, the operation of the DA converter 36 and the voltage follower 37 is the same as the operation for period D described in the sixth embodiment. Note that there is no input and output to and from the leftmost terminal in the DA converter 36 and the voltage follower 37.

After that, the operations for periods C and D are repeated alternately.

As a result of the above-mentioned operations, the polar state of each pixel in each frame becomes the same as that in the sixth embodiment.

This embodiment also has effects similar to the sixth embodiment.

Further, each modification of the eleventh embodiment can also be applied to the fourteenth embodiment.

Fifteenth Embodiment

Figure 38A:
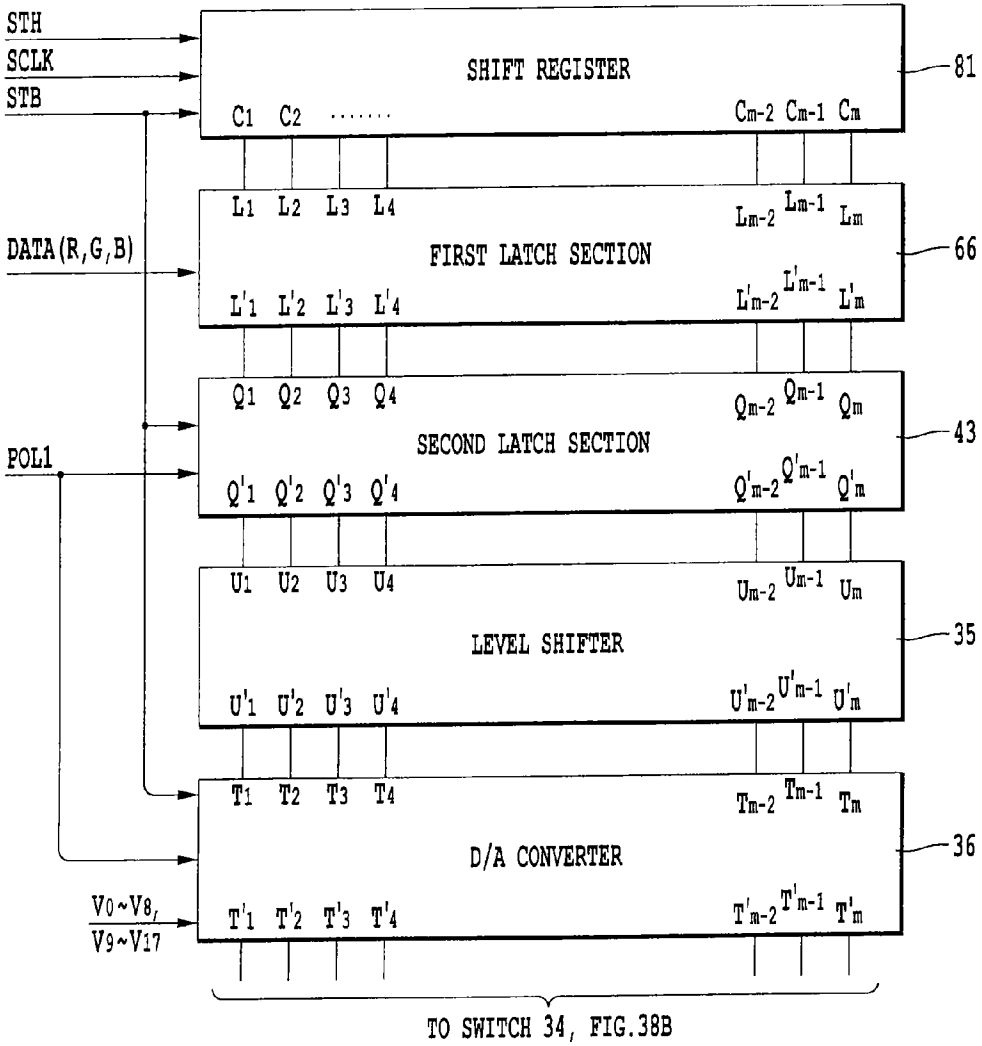
FIGS. 38A, 38B are illustrative diagrams showing an example of a liquid crystal display device according to a fifteenth embodiment of the present invention.
Figure 38B:
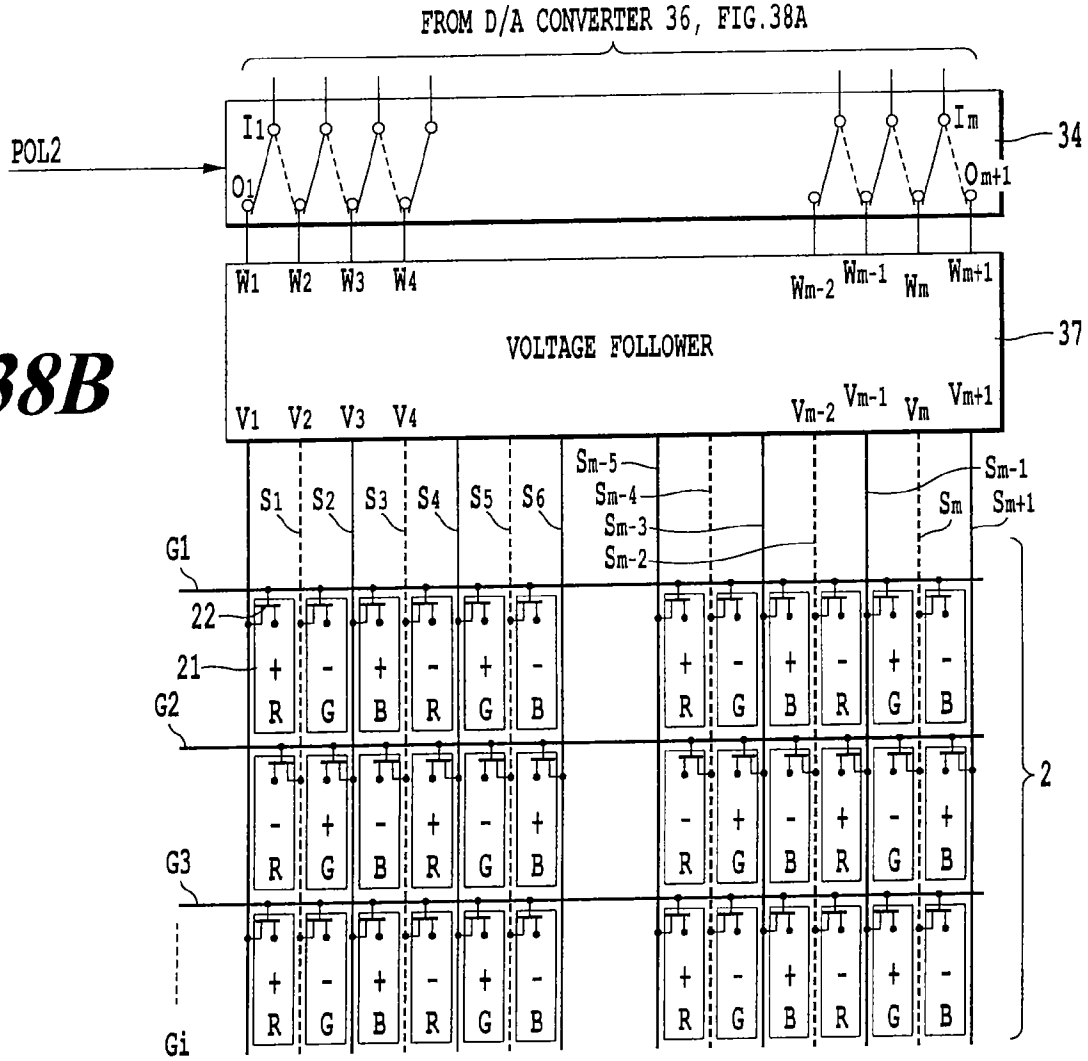
Figure 39:
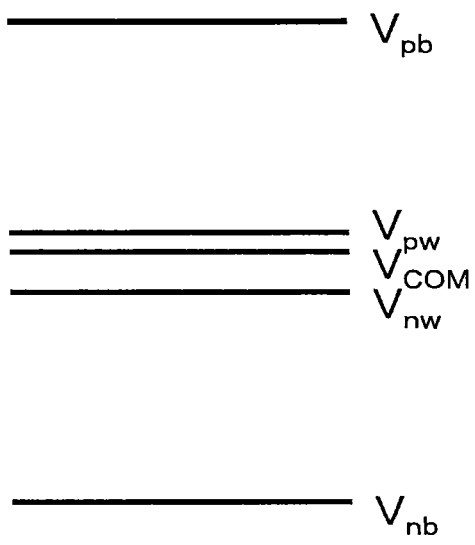
FIG. 39 is an illustrative diagram showing an example of the potential of a common electrode and the potentials for setting pixels to white or black at each polarity.
Figure 40:
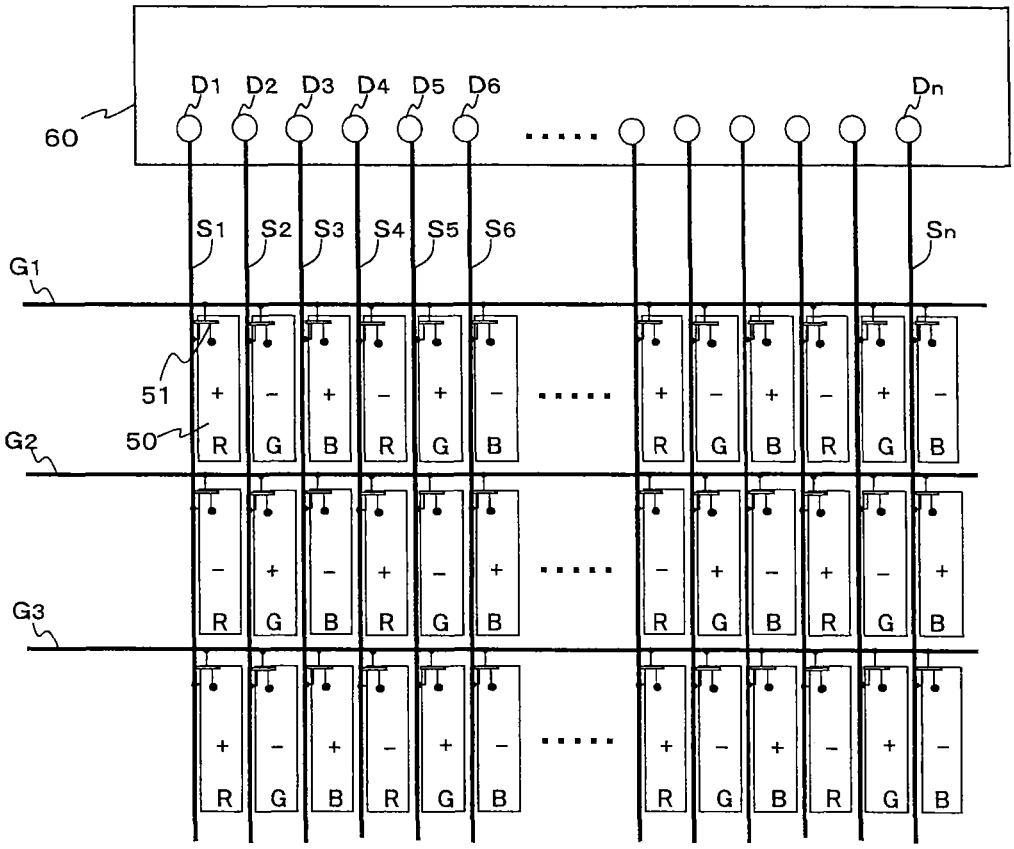
FIG. 40 is an illustrative diagram showing a typical liquid crystal display device.

FIGS. 38A, 38B are illustrative diagrams showing an example of a liquid crystal display device according to a fifteenth embodiment of the present invention. The detailed description of the same components as those in the fourteenth embodiment will be omitted. In the fifteenth embodiment, the driving device includes the shift register 81, the first latch section 66, the second latch section 43, the level shifter 35, the DA converter 36, the switch section 34 and the voltage follower 37.

The shift register 81, the first latch section 66 and second latch section 43, and the mode of connection among them are the same as in the fourteenth embodiment.

The structure of the fifteenth embodiment is different from the fourteenth embodiment in that the switch section 34 is arranged between the DA converter 36 and the voltage follower 37. Because of this arrangement, the DA converter 36 has m data input terminals $T_1$ to $T_m$ and m potential output terminals $T'_1$ to $T'_m$ in the fifteenth embodiment. The DA converter 36 is the same as that in the fourteenth and other embodiments, except in that the data input terminals and the potential output terminals are one less in number, respectively. The data input terminals $T_1$ to $T_m$ of the DA converter 36 are connected to the data output terminals $U'_1$ to $U'_m$ of the level shifter 35 in a one-to-one relationship. Further, the potential output terminals $T'_1$ to $T'_m$ of the DA converter 36 are connected to the input terminals $I_1$ to $I_m$ of the switch section 34 in a one-to-one relationship.

The structure of the switch section 34 is that same as that in the sixth and other embodiments. In this embodiment, the output terminals $O_1$ to $O_{m+1}$ of the switch section 34 are connected to the potential input terminals $W_1$ to $W_{m+1}$ of the voltage follower in a one-to-one relationship.

The voltage follower 37 and the liquid crystal display panel 2, and the mode of connection therebetween are the same as in the eleventh embodiment and the like.

The output mode of control signals from the control section (not shown in FIGS. 38A, 38B) in the fifteenth embodiment is the same as in the eighth embodiment. Therefore, the level variations of $POL_1$ and $POL_2$ are the same as the case shown in FIG. 31. In other words, the level of $POL_2$ is set to high level at the time of starting the frame, and after that, switched alternately per cycle of STB (i.e., per row selection period). Further, $POL_1$ is switched per cycle of STB. Then, frame $F_1$ (see FIG. 31) in which when $POL_2$ becomes high level, $POL_1$ is also set to high level, while when $POL_2$ becomes low level, $POL_1$ is also set to low level, and frame $F_2$ (see FIG. 31) in which when $POL_2$ becomes high level, $POL_1$ is set to low level, while when $POL_2$ becomes low level, $POL_1$ is set to high level are repeated alternately. Like in the other embodiments, $POL_2$ may be generated on the driving device side.

The following describes frame $F_1$ in which periods E and F (see FIG. 31) alternate. First, period E will be described. The second latch section 43 reads data for one row from the first latch section 66, and input each data to the level shifter 35. The level shifter 35 shifts the level of the input data, and input each data after subjected to level shifting to the data input terminals $T_1$ to $T_m$ of the DA converter 46. In addition to period E, this operation is the same as those for periods F, G and H. The DA converter 46 converts the input data into an analog voltage and outputs the analog voltage. Since $POL_1$ is at high level during period E, the DA converter 46 outputs a potential ($V_0$-$V_8$ or the like) higher than $V_{COM}$ from each of the odd-numbered potential output terminals $T'_1$, $T'_3$, . . . from the left, and outputs a potential ($V_9$-$V_{17}$ or the like) lower than $V_{COM}$ from each of the even-numbered potential output terminals $T'_2$, $T'_4$, . . . from the left. Since $POL_2$ becomes high level during period E, any input terminal $I_i$ of the switch section 34 is connected to the output terminal $O_i$. Therefore, the potentials output from the potential output terminals $T'_1$ to $T'_m$ of the DA converter 46 are output from the output terminals $O_1$ to $O_m$ of the switch section 34, and further output from the potential output terminals $V_1$ to $V_m$ of the voltage follower 37. Note that there is no output from the potential output terminal $V_{m+1}$.

Since $POL_1$ is at low level during period F, the DA converter 46 outputs a potential ($V_9$-$V_{17}$ or the like) lower than $V_{COM}$ from each of the odd-numbered potential output terminals $T'_1$, $T'_3$, . . . from the left, and outputs a potential ($V_0$-$V_8$ or the like) higher than $V_{COM}$ from each of the even-numbered potential output terminals $T'_2$, $T'_4$, . . . from the left. Since $POL_2$ becomes low level during period F, any input terminal $I_i$ of the switch section 34 is connected to the output terminal $O_{i+1}$. Therefore, the potentials output from the potential output terminals $T'_1$ to $T'_m$ of the DA converter 46 are output from the output terminals $O_2$ to $O_{m+1}$ of the switch section 34, and further output from the potential output terminals $V_2$ to $V_{m+1}$ of the voltage follower 37. Note that there is no output from the potential output terminal $V_1$.

After that, the operations for periods E and F are repeated alternately in frame $F_1$.

Next, frame $F_2$ in which periods G and H (see FIG. 31) are alternate will be described. Since $POL_1$ is at low level during period G, the DA converter 46 outputs a potential ($V_9$-$V_{17}$ or the like) lower than $V_{COM}$ from each of the odd-numbered potential output terminals $T'_1$, $T'_3$, . . . from the left, and outputs a potential ($V_0$-$V_8$ or the like) higher than $V_{COM}$ from each of the even-numbered potential output terminals $T'_2$, $T'_4$, . . . from the left. Further, since $POL_2$ becomes high level during period G, any input terminal $I_i$ of the switch section 34 is connected to the output terminal $O_i$. Therefore, the potentials output from the potential output terminals $T'_1$ to $T'_m$ of the DA converter 46 are output from the output terminals $O_1$ to $O_m$ of the switch section 34, and further output from the potential output terminals $V_1$ to $V_m$ of the voltage follower 37. Note that there is no output from the potential output terminal $V_{m+1}$.

Since $POL_1$ is at high level during period H, the DA converter 46 outputs a potential ($V_0$-$V_8$ or the like) higher than $V_{COM}$ from each of the odd-numbered potential output terminals $T'_1$, $T'_3$, . . . from the left, and outputs a potential ($V_9$-$V_{17}$ or the like) lower than $V_{COM}$ from each of the even-numbered potential output terminals $T'_2$, $T'_4$, . . . from the left. Further, since $POL_2$ becomes low level during period H, any input terminal $I_i$ of the switch section 34 is connected to the output terminal $O_{i+1}$. Therefore, the potentials output from the potential output terminals $T'_1$ to $T'_m$ of the DA converter 46 are output from the output terminals $O_2$ to $O_{m+1}$, and further output from the potential output terminals $V_2$ to $V_{m+1}$ of the voltage follower 37. Note that there is no output from the potential output terminal $V_1$.

After that, the operations for periods G and H are repeated alternately in frame $F_2$.

As a result of the above-mentioned operations, the polar state of each pixel in each frame becomes the same as that in the sixth embodiment and the like.

This embodiment also has effects similar to the sixth embodiment.

Further, each modification of the eleventh embodiment can also be applied to the fifteenth embodiment. When two or more consecutive gate lines are grouped, the control section (or the potential setting section) may set $POL_2$ to high level during a period for selecting each row in the odd-numbered group one by one, and set $POL_2$ to low level during a period for selecting each row in the even-numbered group one by one. Then, the cycle of switching the level of $POL_1$ may be matched to the cycle of switching the level of $POL_2$.

Further, in each of the sixth and subsequent embodiments, it is preferred that output of potentials in the next frame be started after the DA converter 36 once sets the output potential of each potential output terminal $T'_i$ to a potential between the maximum potential ($V_0$ in the above example) and the minimum potential ($V_{17}$ in the above example) during a vertical blanking interval. It is particularly preferred that the DA converter 36 should set the output potential of each potential output terminal $T'_i$ to $V_{COM}$(=($V_0$+$V_{17}$)/2) during the vertical blanking interval. This setting can reduce the load on the power supply (not shown in FIGS. 27A, 27B and the like) supplying $V_0$ to $V_{17}$.

In order to set the output potential of each potential output terminal of the DA converter 36 once to a potential between the maximum potential and the minimum potential, DA converter 36 may, for example, short-circuit between pair of adjacent two potential output terminals.

The present invention can be applied to both normally white and normally black.

According to the present invention, the liquid crystal display panel can be so driven that the number of consecutive pixels having the same polarity will be reduced while reducing power consumption, and the liquid crystal display panel can be driven without changing the order of output of potentials corresponding to image data from the order of input of image data.

The aforementioned embodiments disclose the characteristic structures of the present invention as follows:

(Note 1) A liquid crystal display device comprising: an active matrix liquid crystal display panel; and a driving device for driving the liquid crystal display panel, wherein the liquid crystal display panel comprises: a common electrode; a plurality of pixel electrodes arranged in a matrix; and source lines provided on the left side of pixel electrodes in each column of pixel electrodes and on the right side of the rightmost column of pixel electrodes, wherein when every row or every two or more consecutive rows of pixel electrodes are set as one group, a pixel electrode in each row of an odd-numbered group is connected to a source line on a predetermined side among source lines existing on both sides of the pixel electrode, and a pixel electrode in each row of an even-numbered group is connected to a source line on the side opposite to the predetermined side among the source lines existing on both sides of the pixel electrode, and the driving device comprises: potential output means having a plurality of potential output terminals from each of which a potential corresponding to an input pixel value is output, and configured to output a potential from each potential output terminal in such a manner to output a potential higher than a common electrode potential and a potential lower than the common electrode potential alternately in order of arrangement of the potential output terminals; and switch means having a plurality of input terminals and switch output terminals that is one more in number than the plurality of input terminals, wherein if the k-th input terminal from the left is denoted as $I_k$, the k-th and k+1-th switch output terminals from the left are denoted as $O_k$ and $O_{k+1}$, respectively, the number of input terminals is denoted as n, and k takes each value from 1 to n, the switch means connects the input terminal $I_k$ to either of the switch output terminals $O_k$ and $O_{k+1}$, wherein each source line of the liquid crystal display panel is connected to a corresponding switch output terminal of the switch means, the potential output means switches between output of a potential higher than the common electrode potential and output of a potential lower than the common electrode potential at each potential output terminal depending on a period for selecting each row in the odd-numbered group one by one or a period for selecting each row in the even-numbered group one by one, the switch means switches between the switch output terminals to be connected to each input terminal depending on the period for selecting each row in the odd-numbered group one by one or the period for selecting each row in the even-numbered group one by one, and the potential output means continues to output, from each potential output terminal, a potential specific to a pixel value corresponding to the potential output terminal, respectively, during a selection period of one row.

(Note 2) The liquid crystal display device according to Note 1, further comprising control means for outputting a first control signal to control whether the potential of each potential output terminal of the potential output means is set higher or lower than the common electrode potential, and a second control signal to give an instruction to determine to which of the switch output terminals $O_k$ and $O_{k+1}$ the input terminal $I_k$ is to be connected, wherein depending on whether the first control signal is at high level or low level, the potential output means switches between whether a potential higher than the common electrode potential is output from an odd-numbered potential output terminal from the left and a potential lower than the common electrode potential is output from an even-numbered potential output terminal from the left, and whether a potential lower than the common electrode potential is output from the odd-numbered potential output terminal from the left and a potential higher than the common electrode potential is output from the even-numbered potential output terminal from the left, the switch means switches between the switch output terminals $O_k$ and $O_{k+1}$ to which the input terminal $I_k$ is to be connected, depending on whether the second control signal is at high level or low level, and the control means switches the levels of the first control signal and the second control signal between the period for selecting each row in the odd-numbered group one by one and the period for selecting each row in the even-numbered group one by one.

(Note 3) The liquid crystal display device according to Note 2, wherein the control means switches, on a frame-by-frame basis, between a mode of outputting the control signals, in which when the first control signal is set to high level, the second control signal is also set to high level, while when the first control signal is set to low level, the second control signal is also set to low level, and a mode of outputting the control signals, in which when the first control signal is set to low level, the second control signal is set to high level, while when the first control signal is set to high level, the second control signal is set to low level.

(Note 4) The liquid crystal display device according to Note 2 or 3, wherein upon switching between selection periods, the control means puts output from a potential output terminal of the potential output means into a high impedance state, and switches the level of the second control signal while the output of the potential output terminal is in the high impedance state.

(Note 5) The liquid crystal display device according to Note 1, further comprising control means for outputting a first control signal to control whether the potential of each potential output terminal of the potential output means is set higher or lower than the common electrode potential and notifying the potential output means of the start of a frame, wherein the potential output means outputs a second control signal to give an instruction to determine to which of the switch output terminals $O_k$ and $O_{k+1}$ the input terminal $I_k$ is to be connected, and depending on whether the first control signal is at high level or low level, the potential output means switches between whether a potential higher than the common electrode potential is output from an odd-numbered potential output terminal from the left and a potential lower than the common electrode potential is output from an even-numbered potential output terminal from the left, and whether a potential lower than the common electrode potential is output from the odd-numbered potential output terminal from the left and a potential higher than the common electrode potential is output from the even-numbered potential output terminal from the left, the switch means switches between the switch output terminals $O_k$ and $O_{k+1}$ to which the input terminal $I_k$ is to be connected, depending on whether the second control signal is at high level or low level, the control means switches the level of the first control signal between the period for selecting each row in the odd-numbered group one by one and the period for selecting each row in the even-numbered group one by one, and when notified of the start of a frame, the potential output means controls the second control signal to connect the input terminal $I_k$ to the switch output terminal $O_k$, and after that, switches the level of the second control signal between the period for selecting each row in the odd-numbered group one by one and the period for selecting each row in the even-numbered group one by one.

(Note 6) The liquid crystal display device according to Note 5, wherein the control means switches, on a frame-by-frame basis, between a mode of outputting the control signals, in which when the second control signal becomes high level, the first control signal is set to high level, while when the second control signal becomes low level, the first control signal is set to low level, and a mode of outputting the control signals, in which when the second control signal becomes high level, the first control signal is set to low level, while when the second control signal becomes low level, the first control signal is set to high level.

(Note 7) The liquid crystal display device according to Note 5 or 6, wherein upon switching between selection periods, the control means puts output from a potential output terminal of the potential output means into a high impedance state, and the potential output means switches the level of the second control signal while the output from the potential output terminal is in the high impedance state.

(Note 8) The liquid crystal display device according to any one of Notes 1 to 7, wherein every row of pixel electrodes is set as one group in such a manner that a pixel electrode in an odd-numbered row is connected to a source line on a predetermined side among source lines existing on both sides of the pixel electrode, and a pixel electrode in an even-numbered row is connected to a source line on the side opposite to the predetermined side among the source lines existing on both sides of the pixel electrode.

(Note 9) The liquid crystal display device according to any one of Notes 1 to 8, wherein two or more driving devices are provided, switch means of respective driving devices are placed side by side, and among adjacent two switch means, the rightmost switch output terminal of the left-hand switch means and the leftmost switch output terminal of the right-hand switch means are connected to a common source line.

(Note 10) The liquid crystal display device according to any one of Notes 1 to 9, wherein the potential output means sets the output potential of each potential output terminal to a potential between the maximum potential and the minimum potential output from the potential output terminal during a vertical blanking interval.

(Note 11) The liquid crystal display device according to any one of Notes 1 to 10, wherein the potential output means short-circuits between a pair of adjacent two potential output terminals during a vertical blanking interval.

(Note 12) The liquid crystal display device according to any one of Notes 1 to 11, wherein R, G and B pixels are arranged on the liquid crystal panel in the same sequence on a row-by-row basis.

(Note 13) The liquid crystal display device according to any one of Notes 1 to 11, wherein R, G and B pixels are arranged on the liquid crystal panel in different sequences among a predetermined number of consecutive rows, and the R, G and B arrangement pattern in the predetermined number of consecutive rows is repeated.

(Note 14) The liquid crystal display device according to any one of Notes 1 to 11, wherein only one kind of pixels among R, G and B are arranged in each row on the liquid crystal panel.

(Note 15) A liquid crystal display device comprising: an active matrix liquid crystal display panel; and a driving device for driving the liquid crystal display panel, wherein the liquid crystal display panel comprises: a common electrode; a plurality of pixel electrodes arranged in a matrix; and source lines provided on the left side of pixel electrodes in each column of pixel electrodes and on the right side of the rightmost column of pixel electrodes, wherein when every row or every two or more consecutive rows of pixel electrodes are set as one group, a pixel electrode in each row of an odd-numbered group is connected to a source line on a predetermined side among source lines existing on both sides of the pixel electrode, and a pixel electrode in each row of an even-numbered group is connected to a source line on the side opposite to the predetermined side among the source lines existing on both sides of the pixel electrode, and the driving device comprises: a DA converter for inputting each data corresponding to each of pixel values for one row, converting the input data to an analog voltage, and outputting a potential after subjected to conversion, wherein depending on whether a first control signal input to the DA converter is at high level or low level, the DA converter switches between whether a potential higher than a common electrode potential is output from an odd-numbered potential output terminal from the left and a potential lower than the common electrode potential is output from an even-numbered potential output terminal from the left, and whether a potential lower than the common electrode potential is output from the odd-numbered potential output terminal from the left and a potential higher than the common electrode potential is output from the even-numbered potential output terminal from the left; and switch means for switching between whether the potential of a pixel electrode is set using the source line on the left side of the pixel electrode and whether the potential of the pixel electrode is set using the source line on the right side of the pixel electrode, wherein if the number of pixel columns to be driven is denoted as m, the switch means has m input terminals and m+1 switch output terminals, and if the k-th input terminal from the left is denoted as $I_k$, the k-th and k+l-th switch output terminals from the left are denoted as $O_k$ and $O_{k+1}$, respectively, and k takes each value from 1 to m, the switch means switches, depending on whether a second control signal input to the switch means is at high level or low level, between whether the input terminal $I_k$ is connected to the switch output terminal $O_k$ and whether the input terminal $I_k$ is connected to the switch output terminal $O_{k+1}$.

(Note 16) The liquid crystal display device according to Note 15, wherein the driving device further comprises a voltage follower, and depending on whether the second control signal is at high level or low level, output from the leftmost potential output terminal of the voltage follower is put into a high impedance state or output from the rightmost potential output terminal of the voltage follower is put into the high impedance state.

(Note 17) The liquid crystal display device according to Note 15, wherein two or more driving devices are provided, and among adjacent two driving devices, the rightmost potential output terminal of the left-hand driving device and the leftmost potential output terminal of the right-hand driving device are connected to a common source line.

(Note 18) The liquid crystal display device according to Note 15, further comprising: first latch means for reading and holding R, G and B pixel values each for one pixel simultaneously; a shift register for outputting a data reading instruction signal sequentially to instruct the first latch means to read each of the R, G and B pixel values each for one pixel; second latch means for reading pixel values of m pixels for one row collectively from the first latch means, and outputting data corresponding to each pixel value; level shifting means having m+1 data input terminals and m+1 data output terminals and configured to shift the levels of data input from the data input terminals and output the data from the data output terminals; and a voltage follower having m+1 potential input terminals and m+1 potential output terminals, and configured to output, from the potential output terminals, potentials equal to potentials input from the potential input terminals, wherein the second latch means has m data output terminals for outputting data corresponding to the pixel values of m pixels for one row, the DA converter has m+1 data input terminals and m+1 potential output terminals, the data output terminals of the second latch means are connected to the input terminals of the switch means in a one-to-one relationship, the switch output terminals of the switch means are connected to the data input terminals of the level shifting means in a one-to-one relationship, the data output terminals of the level shifting means are connected to the data input terminals of the DA converter in a one-to-one relationship, the potential output terminals of the DA converter are connected to the potential input terminals of the voltage follower in a one-to-one relationship, the potential output terminals of the voltage follower are connected to the source lines of the liquid crystal display panel, the level of the first control signal is switched alternately on a frame-by-frame basis, and the level of the second control signal is switched alternately each time all rows belonging to a group are selected.

(Note 19) The liquid crystal display device according to Note 15, further comprising: first latch means for reading and holding R, G and B pixel values each for one pixel simultaneously; a shift register for outputting a data reading instruction signal sequentially to instruct the first latch means to read each of the R, G and B pixel values each for one pixel; second latch means for reading pixel values of m pixels for one row collectively from the first latch means, and outputting data corresponding to each pixel value; level shifting means having m data input terminals and m data output terminals and configured to shift the levels of data input from the data input terminals and output the data from the data output terminals; and a voltage follower having m+1 potential input terminals and m+1 potential output terminals, and configured to output, from the potential output terminals, potentials equal to potentials input from the potential input terminals, wherein the second latch means has m data output terminals for outputting data corresponding to the pixel values of m pixels for one row, the DA converter has m+1 data input terminals and m+1 potential output terminals, the data output terminals of the second latch means are connected to the data input terminals of the level shifting means in a one-to-one relationship, the data output terminals of the level shifting means are connected to the input terminals of the switch means in a one-to-one relationship, the switch output terminals of the switch means are connected to the data input terminals of the DA converter in a one-to-one relationship, the potential output terminals of the DA converter are connected to the potential input terminals of the voltage follower, the potential output terminals of the voltage follower are connected to the source lines of the liquid crystal display panel, the level of the first control signal is switched alternately on a frame-by-frame basis, and the level of the second control signal is switched alternately each time all rows belonging to a group are selected.

(Note 20) The liquid crystal display device according to Note 15, further comprising: first latch means for reading and holding R, G and B pixel values each for one pixel simultaneously; a shift register for outputting a data reading instruction signal sequentially to instruct the first latch means to read each of the R, G and B pixel values each for one pixel; second latch means for reading pixel values of m pixels for one row collectively from the first latch means, and outputting data corresponding to each pixel value; level shifting means having m data input terminals and m data output terminals and configured to shift the levels of data input from the data input terminals and output the data from the data output terminals; and a voltage follower having m+1 potential input terminals and m+1 potential output terminals, and configured to output, from the potential output terminals, potentials equal to potentials input from the potential input terminals, wherein the second latch means has m data output terminals for outputting data corresponding to the pixel values of m pixels for one row, the DA converter has m data input terminals and m potential output terminals, the data output terminals of the second latch means are connected to the data input terminals of the level shifting means in a one-to-one relationship, the data output terminals of the level shifting means are connected to the data input terminals of the DA converter in a one-to-one relationship, the potential output terminals of the DA converter are connected to the input terminals of the switch means in a one-to-one relationship, the switch output terminal of the switch means are connected to the potential input terminals of the voltage follower in a one-to-one relationship, the potential output terminals of the voltage follower are connected to the source lines of the liquid crystal display panel, the levels of the first control signal and the second control signal are switched alternately each time all rows belonging to a group are selected, and in one frame, when the second control signal is at high level, the first control signal also becomes high level, while when the second control signal is at low level, the first control signal also becomes high level, and in the next frame following the one frame, when the second control signal is at high level, the first control signal becomes low level, while when the second control signal is at low level, the first control signal becomes high level.

(Note 21) The liquid crystal display device according to Note 15, further comprising: first latch means for reading and holding R, G and B pixel values each for one pixel simultaneously; a shift register for outputting a data reading instruction signal sequentially to instruct the first latch means to read each of the R, G and B pixel values each for one pixel; second latch means for reading pixel values of m pixels for one row collectively from the first latch means, and outputting data corresponding to each pixel value; level shifting means having m+1 data input terminals and m+1 data output terminals and configured to shift the levels of data input from the data input terminals and output the data from the data output terminals; and a voltage follower having m+1 potential input terminals and m+1 potential output terminals, and configured to output, from the potential output terminals, potentials equal to potentials input from the potential input terminals, wherein the first latch means has m pixel value output terminals for causing the second latch means to read the pixel values, the second latch means has m+1 data reading terminals for reading the pixel values from the first latch means, and m+1 data output terminals for outputting data corresponding to the pixel values of pixels for one row, the DA converter has m+1 data input terminals and m+1 potential output terminals, the pixel value output terminals of the first latch means are connected to the input terminals of the switch means in a one-to-one relationship, the switch output terminals of the switch means are connected to the data reading terminals of the second latch means in a one-to-one relationship, the data output terminals of the second latch means are connected to the data input terminals of the level shifting means in a one-to-one relationship, the data output terminals of the level shifting means are connected to the data input terminals of the DA converter in a one-to-one relationship, the potential output terminals of the DA converter are connected to the potential input terminals of the voltage follower in a one-to-one relationship, the potential output terminals of the voltage follower are connected to the source lines of the liquid crystal display panel, the level of the first control signal is switched alternately on a frame-by-frame basis, and the level of the second control signal is switched alternately each time all rows belonging to a group are selected.

(Note 22) The liquid crystal display device according to Note 15, wherein the number of columns of pixels to be driven is a multiple of 3, and the liquid crystal display device further comprises: first latch means in which m+1 latch circuits are arranged, each latch circuit having an input terminal for a data reading instruction signal to give an instruction to read a pixel value, a pixel value reading terminal for reading a pixel value for one pixel input when the data reading instruction signal is input to the input terminal, and an output terminal for the pixel value; a shift register having signal output terminals for a m/3 piece of data reading instruction signal and configured to output the data reading instruction signal sequentially from each of the signal output terminals; output of shift register switching means which, if the i-th signal output terminal from the left in the shift register is denoted as $C_i$ and i takes each value from 1 to m/3, connects the signal output terminal $C_i$ with input terminals of the 3·i−2-th, 3·i−1-th and 3·i-th latch circuits of the first latch means when the second control signal is at high level, or connects the signal output terminal $C_i$ with input terminals of the 3·i−1-th, 3·i-th and 3·i+1-th latch circuits of the first latch means when the second control signal is at low level; second latch means for reading pixel values of m pixels for one row collectively from the first latch means, and outputting data corresponding to each pixel value; level shifting means having m+1 data input terminals and m+1 data output terminals and configured to shift the levels of data input from the data input terminals and output the data from the data output terminals; and a voltage follower having m+1 potential input terminals and m+1 potential output terminals and configured to output, from the potential output terminals, potentials equal to potentials input from the potential input terminals, wherein the input terminals of the switch means are connected to data wiring for transferring pixel values for R, data wiring for transferring pixel values for G and data wiring for transferring pixel values for B, the switch output terminals of the switch means are connected to the pixel value reading terminals of the respective latch circuits in the first latch means in a one-to-one relationship, the second latch means has m+1 data reading terminals for reading pixel values from the first latch means and m+1 data output terminals for outputting data corresponding to pixel values of pixels for one row, DA converter has m+1 data input terminals and m+1 potential output terminals, the output terminals of the respective latch circuits in the first latch means are connected to the data reading terminals of the second latch means in a one-to-one relationship, the data output terminals of the second latch means are connected to the data input terminals of the level shifting means in a one-to-one relationship, the data output terminals of the level shifting means are connected to the data input terminals of the DA converter in a one-to-one relationship, the potential output terminals of the DA converter are connected to the potential input terminals of the voltage follower in a one-to-one relationship, the potential output terminals of the voltage follower are connected to the source lines of the liquid crystal display panel, the level of the first control signal is switched alternately on a frame-by-frame basis, the level of the second control signal is switched alternately each time all rows belonging to a group are selected after the second control signal is set to high level upon starting a frame, and the output of shift register switching means and the switch means maintain a state equal to that when the second control signal is at high level until the second control signal is generated in a first frame after power-on.

(Note 23) The liquid crystal display device according to Note 15, further comprising: first latch means having m+1 input terminals for a data reading instruction signal to give an instruction to read a pixel value, and configured such that, when the data reading instruction signal is input, the first latch means reads and holds a pixel value for one pixel corresponding to an input terminal to which the data reading instruction signal is input; a shift register having m signal output terminals for the data reading instruction signal and configured to output the data reading instruction signal sequentially from each signal output terminal; second latch means for reading pixel values of m pixels for one row collectively from the first latch means, and outputting data corresponding to each pixel value; level shifting means having m+1 data input terminals and m+1 data output terminals and configured to shift the levels of data input from the data input terminals and outputting the data from the data output terminals; and a voltage follower having m+1 potential input terminals and m+1 potential output terminals and configured to output, from the potential output terminals, potentials equal to potentials input from the potential input terminals, wherein the first latch means has m+1 pixel value output terminals for causing the second latch means to read pixel values, the second latch means has m+1 data reading terminals for reading pixel values from the first latch means and m+1 data output terminals for outputting data corresponding to pixel values of pixels for one row, the DA converter has m+1 data input terminals and m+1 potential output terminals, the signal output terminals of the shift register are connected to the input terminals of the switch means in a one-to-one relationship, the switch output terminals of the switch means are connected to the input terminals of the first latch means in a one-to-one relationship, the pixel value output terminals of the first latch means are connected to the data reading terminals of the second latch means in a one-to-one relationship, the data output terminals of the second latch means are connected to the data input terminals of the level shifting means in a one-to-one relationship, the data output terminals of the level shifting means are connected to the data input terminals of the DA converter in a one-to-one relationship, the potential output terminals of the DA converter are connected to the potential input terminals of the voltage follower in a one-to-one relationship, the potential output terminals of the voltage follower are connected to the source lines of the liquid crystal display panel, the level of the first control signal is switched alternately on a frame-by-frame basis, the level of the second control signal is switched alternately each time all rows belonging to a group are selected after the second control signal is set to high level upon starting a frame, and the switch means maintains a state equal to that when the second control signal is at high level until the second control signal is generated in a first frame after power-on.

(Note 24) The liquid crystal display device according to Note 15, further comprising: first latch means for reading and holding a pixel value on a pixel-by-pixel basis; a shift register for outputting a data reading instruction signal sequentially to instruct the first latch means to read a pixel value for one pixel; second latch means for reading pixel values of m pixels for one row collectively from the first latch means, and outputting data corresponding to each pixel value; level shifting means having m+1 data input terminals and m+1 data output terminals and configured to shift the levels of data input from the data input terminals and output the data from the data output terminals; and a voltage follower having m+1 potential input terminals and m+1 potential output terminals and configured to output, from the potential output terminals, potentials equal to potentials input from the potential input terminals, wherein the first latch means has m pixel value output terminals for causing the second latch means to read pixel values, the second latch means has m+1 data reading terminals for reading pixel values from the first latch means, and m+1 data output terminals for outputting data corresponding to pixel values of pixels for one row, DA converter has m+1 data input terminals and m+1 potential output terminals, the pixel value output terminals of the first latch means are connected to the input terminals of the switch means in a one-to-one relationship, the switch output terminals of the switch means are connected to the data reading terminals of the second latch means in a one-to-one relationship, the data output terminals of the second latch means are connected to the data input terminals of the level shifting means in a one-to-one relationship, the data output terminals of the level shifting means are connected to the data input terminals of the DA converter in a one-to-one relationship, the potential output terminals of the DA converter are connected to the potential input terminal of the voltage follower in a one-to-one relationship, the potential output terminals of the voltage follower are connected to the source lines of the liquid crystal display panel, the level of the first control signal is switched alternately on a frame-by-frame basis, and the level of the second control signal is switched alternately each time all rows belonging to a group are selected.

(Note 25) The liquid crystal display device according to Note 15, further comprising: first latch means for reading and holding a pixel value on a pixel-by-pixel basis; a shift register for outputting a data reading instruction signal sequentially to instruct the first latch means to read a pixel value for one pixel; second latch means for reading pixel values of m pixels for one row collectively from the first latch means, and outputting data corresponding to each pixel value; level shifting means having m+1 data input terminals and m+1 data output terminals and configured to shift the levels of data input from the data input terminals and output the data from the data output terminals; and a voltage follower having m+1 potential input terminals and m+1 potential output terminals and configured to output, from the potential output terminals, potentials equal to potentials input from the potential input terminals, wherein the second latch means has m data output terminals for outputting data corresponding to the pixel values of m pixels for one row, DA converter has m+1 data input terminals and m+1 potential output terminals, the data output terminals of the second latch means are connected to the input terminals of the switch means in a one-to-one relationship, the switch output terminals of the switch means are connected to the data input terminals of the level shifting means in a one-to-one relationship, the data output terminals of the level shifting means are connected to the data input terminals of the DA converter in a one-to-one relationship, the potential output terminals of the DA converter are connected to the potential input terminals of the voltage follower in a one-to-one relationship, the potential output terminals of the voltage follower are connected to the source lines of the liquid crystal display panel, the level of the first control signal is switched alternately on a frame-by-frame basis, and the level of the second control signal is switched alternately each time all rows belonging to a group are selected.

(Note 26) The liquid crystal display device according to Note 15, further comprising: first latch means for reading and holding a pixel value on a pixel-by-pixel basis; a shift register for outputting a data reading instruction signal sequentially to instruct the first latch means to read a pixel value for one pixel; second latch means for reading pixel values of m pixels for one row collectively from the first latch means, and outputting data corresponding to each pixel value; level shifting means having m data input terminals and m data output terminals and configured to shift the levels of data input from the data input terminals and output the data from the data output terminals; and a voltage follower having m+1 potential input terminals and m+1 potential output terminals and configured to output, from the potential output terminals, potentials equal to potentials input from the potential input terminals, wherein the second latch means has m data output terminals for outputting data corresponding to pixel values of m pixels for one row, DA converter has m+1 data input terminals and m+1 potential output terminals, the data output terminals of the second latch means are connected to the data input terminals of the level shifting means in a one-to-one relationship, the data output terminals of the level shifting means are connected to the input terminals of the switch means in a one-to-one relationship, the switch output terminals of the switch means are connected to the data input terminals of the DA converter in a one-to-one relationship, the potential output terminals of the DA converter are connected to the potential input terminals of the voltage follower in a one-to-one relationship, the potential output terminals of the voltage follower are connected to the source lines of the liquid crystal display panel, the level of the first control signal is switched alternately on a frame-by-frame basis, and the level of the second control signal is switched alternately each time all rows belonging to a group are selected.

(Note 27) The liquid crystal display device according to Note 15, further comprising: first latch means for reading and holding a pixel value on a pixel-by-pixel basis; a shift register for outputting a data reading instruction signal sequentially to instruct the first latch means to read a pixel value for one pixel; second latch means for reading pixel values of m pixels for one row collectively from the first latch means, and outputting data corresponding to each pixel value; level shifting means having m data input terminals and m data output terminals and configured to shift the levels of data input from the data input terminals and output the data from the data output terminals; and a voltage follower having m+1 potential input terminals and m+1 potential output terminals and configured to output, from the potential output terminals, potentials equal to potentials input from the potential input terminals, wherein the second latch means has m data output terminals for outputting data corresponding to the pixel values of m pixels for one row, the DA converter has m data input terminals and m potential output terminals, the data output terminals of the second latch means are connected to the data input terminals of the level shifting means in a one-to-one relationship, the data output terminals of the level shifting means are connected to the data input terminals of the DA converter in a one-to-one relationship, the potential output terminals of the DA converter are connected to the input terminals of the switch means in a one-to-one relationship, the switch output terminal of the switch means are connected to the potential input terminals of the voltage follower in a one-to-one relationship, the potential output terminals of the voltage follower are connected to the source lines of the liquid crystal display panel, the levels of the first control signal and the second control signal are switched alternately each time all rows belonging to a group are selected, and in one frame, when the second control signal is at high level, the first control signal also becomes high level, while when the second control signal is at low level, the first control signal also becomes high level, and in the next frame following the one frame, when the second control signal is at high level, the first control signal becomes low level, while when the second control signal is at low level, the first control signal becomes high level.

(Note 28) A driving device for a liquid crystal display panel including a common electrode, a plurality of pixel electrodes arranged in a matrix, and source lines provided on the left side of pixel electrodes in each column of pixel electrodes and on the right side of the rightmost column of pixel electrodes, wherein when every row or every two or more consecutive rows of pixel electrodes are set as one group, a pixel electrode in each row of an odd-numbered group is connected to a source line on a predetermined side among source lines existing on both sides of the pixel electrode, and a pixel electrode in each row of an even-numbered group is connected to a source line on the side opposite to the predetermined side among the source lines existing on both sides of the pixel electrode, the driving device comprising: potential output means having a plurality of potential output terminals from each of which a potential corresponding to an input pixel value is output, and configured to output a potential from each potential output terminal in such a manner to output a potential higher than a common electrode potential and a potential lower than the common electrode potential alternately in order of arrangement of the potential output terminals; and switch means having a plurality input terminals and switch output terminals that is one more in number than the plurality input terminals, wherein if the k-th input terminal from the left is denoted as $I_k$, the k-th and k+1-th switch output terminals from the left are denoted as $O_k$ and $O_{k+1}$, respectively, the number input terminals is denoted as n, and k takes each value from 1 to n, the switch means connects the input terminal $I_k$ to either of the switch output terminals $O_k$ and $O_{k+1}$, wherein the potential output means switches between output of a potential higher than the common electrode potential and output of a potential lower than the common electrode potential at each potential output terminal depending on a period for selecting each row in the odd-numbered group one by one or a period for selecting each row in the even-numbered group one by one, the switch means switches between the switch output terminals to be connected to each input terminal depending on the period for selecting each row in the odd-numbered group one by one or the period for selecting each row in the even-numbered group one by one, and the potential output means continues to output, from each potential output terminal, a potential specific to a pixel value corresponding to the potential output terminal, respectively, during a selection period of one row.

(Note 29) The driving device for a liquid crystal display panel according to Note 28, further comprising control means for outputting a first control signal to control whether the potential of each potential output terminal of the potential output means is set higher or lower than the common electrode potential, and a second control signal to give an instruction to determine to which of the switch output terminals $O_k$ and $O_{k+1}$ the input terminal $I_k$ is to be connected, wherein depending on whether the first control signal is at high level or low level, the potential output means switches between whether a potential higher than the common electrode potential is output from an odd-numbered potential output terminal from the left and a potential lower than the common electrode potential is output from an even-numbered potential output terminal from the left, and whether a potential lower than the common electrode potential is output from the odd-numbered potential output terminal from the left and a potential higher than the common electrode potential is output from the even-numbered potential output terminal from the left, the switch means switches between the switch output terminals $O_k$ and $O_{k+1}$ to which the input terminal $I_k$ is to be connected, depending on whether the second control signal is at high level or low level, and the control means switches the levels of the first control signal and the second control signal between the period for selecting each row in the odd-numbered group one by one and the period for selecting each row in the even-numbered group one by one.

(Note 30) A driving device for a liquid crystal display panel including a common electrode, a plurality of pixel electrodes arranged in a matrix, and source lines provided on the left side of pixel electrodes in each column of pixel electrodes and on the right side of the rightmost column of pixel electrodes, wherein when every row or every two or more consecutive rows of pixel electrodes are set as one group, a pixel electrode in each row of an odd-numbered group is connected to a source line on a predetermined side among source lines existing on both sides of the pixel electrode, and a pixel electrode in each row of an even-numbered group is connected to a source line on the side opposite to the predetermined side among the source lines existing on both sides of the pixel electrode, the driving device comprising: a DA converter for inputting each data corresponding to each of pixel values for one row, converting the input data to an analog voltage, and outputting a potential after subjected to conversion, wherein depending on whether a first control signal input to the DA converter is at high level or low level, the DA converter switches between whether a potential higher than a common electrode potential is output from an odd-numbered potential output terminal from the left and a potential lower than the common electrode potential is output from an even-numbered potential output terminal from the left, and whether a potential lower than the common electrode potential is output from the odd-numbered potential output terminal from the left and a potential higher than the common electrode potential is output from the even-numbered potential output terminal from the left; and switch means for switching between whether the potential of a pixel electrode is set using the source line on the left side of the pixel electrode and whether the potential of the pixel electrode is set using the source line on the right side of the pixel electrode, wherein if the number of pixel columns to be driven is denoted as m, the switch means has m input terminals and m+1 switch output terminals, and if the k-th input terminal from the left is denoted as $I_k$, the k-th and k+l-th switch output terminals from the left are denoted as $O_k$ and $O_{k+1}$, respectively, and k takes each value from 1 to m, the switch means switches, depending on whether a second control signal input to the switch means is at high level or low level, between whether the input terminal $I_k$ is connected to the switch output terminal $O_k$ and whether the input terminal $I_k$ is connected to the switch output terminal $O_{k+1}$.

(Note 31) The driving device for a liquid crystal display panel according to Note 30, further comprising a voltage follower, wherein depending on whether the second control signal is at high level or low level, output from the leftmost potential output terminal of the voltage follower is put into a high impedance state or output from the rightmost potential output terminal of the voltage follower is put into the high impedance state.

(Note 32) A liquid crystal display panel comprising: a common electrode; a plurality of pixel electrodes arranged in a matrix; source lines provided on the left side of pixel electrodes in each column of pixel electrodes and on the right side of the rightmost column of pixel electrodes; and switch means having a plurality input terminals and switch output terminals that is one more in number than the plurality input terminals, wherein if the k-th input terminal from the left is denoted as $I_k$, the k-th and k+1-th switch output terminals from the left are denoted as $O_k$ and $O_{k+1}$, respectively, the number input terminals is denoted as n, and k takes each value from 1 to n, the switch means connects the input terminal $I_k$ to either of the switch output terminals $O_k$ and $O_{k+1}$, wherein when every row or every two or more consecutive rows of pixel electrodes are set as one group, a pixel electrode in each row of an odd-numbered group is connected to a source line on a predetermined side among source lines existing on both sides of the pixel electrode, and a pixel electrode in each row of an even-numbered group is connected to a source line on the side opposite to the predetermined side among the source lines existing on both sides of the pixel electrode, each source line is connected to a corresponding switch output terminal of the switch means, and the switch means switches between the switch output terminals to be connected to each input terminal depending on the period for selecting each row in the odd-numbered group one by one or the period for selecting each row in the even-numbered group one by one.

(Note 33) A liquid crystal display panel comprising: a common electrode; a plurality of pixel electrodes arranged in a matrix; and source lines provided on the left side of pixel electrodes in each column of pixel electrodes and on the right side of the rightmost column of pixel electrodes, wherein when every row or every two or more consecutive rows of pixel electrodes are set as one group, a pixel electrode in each row of an odd-numbered group is connected to a source line on a predetermined side among source lines existing on both sides of the pixel electrode, and a pixel electrode in each row of an even-numbered group is connected to a source line on the side opposite to the predetermined side among the source lines existing on both sides of the pixel electrode, and among the source lines, a specific odd-numbered source line has two branch portions to connect with different driving devices.

While the present invention has been described with reference to each of the aforementioned embodiments and modifications, the present invention is not intended to be limited to each of the aforementioned embodiments and modifications. Any change that those skilled in the art can contemplate may be added to each of the aforementioned embodiments and modifications within the scope of the present invention.

The present invention is preferably applied to active matrix liquid crystal display devices. For example, the present invention is applicable to TFT liquid crystal display devices, electronic paper using a TFT liquid crystal display device, and handheld liquid crystal display devices. Note that these are just illustrative examples, and the present invention may also be applied to medium- and large-sized liquid crystal display devices.

The invention claimed is:

1. A liquid crystal display device comprising:

an active matrix liquid crystal display panel; and a driving device for driving the liquid crystal display panel, wherein the liquid crystal display panel comprises:

a common electrode;

a plurality of pixel electrodes arranged in a matrix; and source lines provided on a left side of pixel electrodes in each column of pixel electrodes and on a right side of a rightmost column of pixel electrodes, wherein when every row or every two or more consecutive rows of pixel electrodes are set as one group, a pixel electrode in each row of an odd-numbered group is connected to a source line on a predetermined side among source lines existing on both sides of the pixel electrode, and a pixel electrode in each row of an even-numbered group is connected to a source line on a side opposite to the predetermined side among the source lines existing on both sides of the pixel electrode;

the driving device comprises:

a DA converter for inputting each data corresponding to each of pixel values for one row, converting the input data to an analog voltage, and outputting a potential after subjected to conversion, wherein depending on whether a first control signal input to the DA converter is at high level or low level, the DA converter switches between whether a potential higher than a common electrode potential is output from an odd-numbered potential output terminal from the left and a potential lower than the common electrode potential is output from an even-numbered potential output terminal from the left, and whether a potential lower than the common electrode potential is output from the odd-numbered potential output terminal from the left and a potential higher than the common electrode potential is output from the even-numbered potential output terminal from the left; and switch means for switching between whether a potential of a pixel electrode is set using the source line on the left side of the pixel electrode and whether the potential of the pixel electrode is set using the source line on the right side of the pixel electrode, wherein if the number of pixel columns to be driven is denoted as m, the switch means has m input terminals and m+1 switch output terminals, and if a k-th input terminal from the left is denoted as $I_k$, k-th and k+1-th switch output terminals from the left are denoted as $O_k$ and $O_{k+1}$, respectively, and k takes each value from 1 to m, the switch means switches, depending on whether a second control signal input to the switch means is at high level or low level, between whether the input terminal $I_k$ is connected to the switch output terminal $O_k$ and whether the input terminal $I_k$ is connected to the switch output terminal $O_{k+1}$:

wherein the driving device further comprises a voltage follower, and depending on whether the second control signal is at high level or low level, output from a leftmost potential output terminal of the voltage follower is put into a high impedance state or output from a rightmost potential output terminal of the voltage follower is put into the high impedance state.

2. A liquid crystal display device comprising:

an active matrix liquid crystal display panel; and a driving device for driving the liquid crystal display panel, wherein the liquid crystal display panel comprises:

a common electrode;

a plurality of pixel electrodes arranged in a matrix; and source lines provided on a left side of pixel electrodes in each column of pixel electrodes and on a right side of a rightmost column of pixel electrodes, wherein when every row or every two or more consecutive rows of pixel electrodes are set as one group, a pixel electrode in each row of an odd-numbered group is connected to a source line on a predetermined side among source lines existing on both sides of the pixel electrode, and a pixel electrode in each row of an even-numbered group is connected to a source line on a side opposite to the predetermined side among the source lines existing on both sides of the pixel electrode;

the driving device comprises:

a DA converter for inputting each data corresponding to each of pixel values for one row, converting the input data to an analog voltage, and outputting a potential after subjected to conversion, wherein depending on whether a first control signal input to the DA converter is at high level or low level, the DA converter switches between whether a potential higher than a common electrode potential is output from an odd-numbered potential output terminal from the left and a potential lower than the common electrode potential is output from an even-numbered potential output terminal from the left, and whether a potential lower than the common electrode potential is output from the odd-numbered potential output terminal from the left and a potential higher than the common electrode potential is output from the even-numbered potential output terminal from the left; and switch means for switching between whether a potential of a pixel electrode is set using the source line on the left side of the pixel electrode and whether the potential of the pixel electrode is set using the source line on the right side of the pixel electrode, wherein if the number of pixel columns to be driven is denoted as m, the switch means has m input terminals and m+1 switch output terminals, and if a k-th input terminal from the left is denoted as $I_k$, k-th and k+1-th switch output terminals from the left are denoted as $O_k$ and $O_{k+1}$, respectively, and k takes each value from 1to m, the switch means switches, depending on whether a second control signal input to the switch means is at high level or low level, between whether the input terminal $I_k$ is connected to the switch output terminal $O_k$ and whether the input terminal $I_k$ is connected to the switch output terminal $O_{k+1}$;

wherein two or more driving devices are provided, and among adjacent two driving devices, a rightmost potential output terminal of a left-hand driving device and a leftmost potential output terminal of a right-hand driving device are connected to a common source line.

3. A liquid crystal display device comprising an active matrix liquid crystal display panel; and a driving device for driving the liquid crystal display panel, wherein the liquid crystal display panel comprises:

a common electrode;

a plurality of pixel electrodes arranged in a matrix; and source lines provided on a left side of pixel electrodes in each column of pixel electrodes and on a right side of a rightmost column of pixel electrodes, wherein when every row or every two or more consecutive rows of pixel electrodes are set as one group, a pixel electrode in each row of an odd-numbered group is connected to a source line on a predetermined side among source lines existing on both sides of the pixel electrode, and a pixel electrode in each row of an even-numbered group is connected to a source line on a side opposite to the predetermined side among the source lines existing on both sides of the pixel electrode;

the driving device comprises:

a DA converter for inputting each data corresponding to each of pixel values for one row, converting the input data to an analog voltage, and outputting a potential after subjected to conversion, wherein depending on whether a first control signal input to the DA converter is at high level or low level, the DA converter switches between whether a potential higher than a common electrode potential is output from an odd-numbered potential output terminal from the left and a potential lower than the common electrode potential is output from an even-numbered potential output terminal from the left, and whether a potential lower than the common electrode potential is output from the odd-numbered potential output terminal from the left and a potential higher than the common electrode potential is output from the even-numbered potential output terminal from the left; and switch means for switching between whether a potential of a pixel electrode is set using the source line on the left side of the pixel electrode and whether the potential of the pixel electrode is set using the source line on the right side of the pixel electrode, wherein if the number of pixel columns to be driven is denoted as m, the switch means has m input terminals and m+1 switch output terminals, and if a k-th input terminal from the left is denoted as $I_k$, k-th and k+1-th switch output terminals from the left are denoted as $O_k$ and $O_{k+1}$, respectively, and k takes each value from 1 to m, the switch means switches, depending on whether a second control signal input to the switch means is at high level or low level, between whether the input terminal $I_k$ is connected to the switch output terminal $O_k$ and whether the input terminal $I_k$ is connected to the switch output terminal $O_{k+1}$; further comprising:

first latch means for reading and holding R, G and B pixel values each for one pixel simultaneously;

a shift register for outputting a data reading instruction signal sequentially to instruct the first latch means to read each of the R, G and B pixel values each for one pixel;

second latch means for reading pixel values of m pixels for one row collectively from the first latch means, and outputting data corresponding to each pixel value;

level shifting means having m+1 data input terminals and m+1 data output terminals and configured to shift levels of data input from the data input terminals and output the data from the data output terminals; and a voltage follower having m+1 potential input terminals and m+1 potential output terminals, and configured to output, from the potential output terminals, potentials equal to potentials input from the potential input terminals, wherein the second latch means has m data output terminals for outputting data corresponding to the pixel values of m pixels for one row, the DA converter has m+1 data input terminals and m+1 potential output terminals, the data output terminals of the second latch means are connected to the input terminals of the switch means in a one-to-one relationship, the switch output terminals of the switch means are connected to the data input terminals of the level shifting means in a one-to-one relationship, the data output terminals of the level shifting means are connected to the data input terminals of the DA converter in a one-to-one relationship, the potential output terminals of the DA converter are connected to the potential input terminals of the voltage follower in a one-to-one relationship, the potential output terminals of the voltage follower are connected to the source lines of the liquid crystal display panel, the level of the first control signal is switched alternately on a frame-by-frame basis, and the level of the second control signal is switched alternately each time all rows belonging to a group are selected.

4. A liquid crystal display device comprising:

an active matrix liquid crystal display panel; and a driving device for driving the liquid crystal display panel, wherein the liquid crystal display panel comprises:

a common electrode;

a plurality of pixel electrodes arranged in a matrix; and source lines provided on a left side of pixel electrodes in each column of pixel electrodes and on a right side of a rightmost column of pixel electrodes, wherein when every row or every two or more consecutive rows of pixel electrodes are set as one group, a pixel electrode in each row of an odd-numbered group is connected to a source line on a predetermined side among source lines existing on both sides of the pixel electrode, and a pixel electrode in each row of an even-numbered group is connected to a source line on a side opposite to the predetermined side among the source lines existing on both sides of the pixel electrode;

the driving device comprises:

a DA converter for inputting each data corresponding to each of pixel values for one row, converting the input data to an analog voltage, and outputting a potential after subjected to conversion, wherein depending on whether a first control signal input to the DA converter is at high level or low level, the DA converter switches between whether a potential higher than a common electrode potential is output from an odd-numbered potential output terminal from the left and a potential lower than the common electrode potential is output from an even-numbered potential output terminal from the left, and whether a potential lower than the common electrode potential is output from the odd-numbered potential output terminal from the left and a potential higher than the common electrode potential is output from the even-numbered potential output terminal from the left; and switch means for switching between whether a potential of a pixel electrode is set using the source line on the left side of the pixel electrode and whether the potential of the pixel electrode is set using the source line on the right side of the pixel electrode, wherein if the number of pixel columns to be driven is denoted as m, the switch means has m input terminals and m+1 switch output terminals, and if a k-th input terminal from the left is denoted as $I_k$, k-th and k+1-th switch output terminals from the left are denoted as $O_k$ and $O_{k+1}$, respectively, and k takes each value from 1 to m, the switch means switches, depending on whether a second control signal input to the switch means is at high level or low level, between whether the input terminal $I_k$ is connected to the switch output terminal $O_k$ and whether the input terminal $I_k$ is connected to the switch output terminal $O_{k+1}$;

the liquid crystal display device further comprising:

first latch means for reading and holding R, G and B pixel values each for one pixel simultaneously;

a shift register for outputting a data reading instruction signal sequentially to instruct the first latch means to read each of the R, G and B pixel values each for one pixel;

second latch means for reading pixel values of m pixels for one row collectively from the first latch means, and outputting data corresponding to each pixel value;

level shifting means having m+1 data input terminals and m+1 data output terminals and configured to shift levels of data input from the data input terminals and output the data from the data output terminals; and a voltage follower having m+1 potential input terminals and m+1 potential output terminals, and configured to output, from the potential output terminals, potentials equal to potentials input from the potential input terminals, wherein the first latch means has m pixel value output terminals for causing the second latch means to read the pixel values, the second latch means has m+1 data reading terminals for reading the pixel values from the first latch means, and m+1 data output terminals for outputting data corresponding to the pixel values of pixels for one row, the DA converter has m+1 data input terminals and m+1 potential output terminals, the pixel value output terminals of the first latch means are connected to the input terminals of the switch means in a one-to-one relationship, the switch output terminals of the switch means are connected to the data reading terminals of the second latch means in a one-to-one relationship, the data output terminals of the second latch means are connected to the data input terminals of the level shifting means in a one-to-one relationship, the data output terminals of the level shifting means are connected to the data input terminals of the DA converter in a one-to-one relationship, the potential output terminals of the DA converter are connected to the potential input terminals of the voltage follower in a one-to-one relationship, the potential output terminals of the voltage follower are connected to the source lines of the liquid crystal display panel, the level of the first control signal is switched alternately on a frame-by-frame basis, and the level of the second control signal is switched alternately each time all rows belonging to a group are selected.

5. A liquid crystal display device comprising:

an active matrix liquid crystal display panel; and a driving device for driving the liquid crystal display panel, wherein the liquid crystal display panel comprises:

a common electrode;

a plurality of pixel electrodes arranged in a matrix; and source lines provided on a left side of pixel electrodes in each column of pixel electrodes and on a right side of a rightmost column of pixel electrodes, wherein when every row or every two or more consecutive rows of pixel electrodes are set as one group, a pixel electrode in each row of an odd-numbered group is connected to a source line on a predetermined side among source lines existing on both sides of the pixel electrode, and a pixel electrode in each row of an even-numbered group is connected to a source line on a side opposite to the predetermined side among the source lines existing on both sides of the pixel electrode;

the driving device comprises:

a DA converter for inputting each data corresponding to each of pixel values for one row, converting the input data to an analog voltage, and outputting a potential after subjected to conversion, wherein depending on whether a first control signal input to the DA converter is at high level or low level, the DA converter switches between whether a potential higher than a common electrode potential is output from an odd-numbered potential output terminal from the left and a potential lower than the common electrode potential is output from an even-numbered potential output terminal from the left, and whether a potential lower than the common electrode potential is output from the odd-numbered potential output terminal from the left and a potential higher than the common electrode potential is output from the even-numbered potential output terminal from the left; and switch means for switching between whether a potential of a pixel electrode is set using the source line on the left side of the pixel electrode and whether the potential of the pixel electrode is set using the source line on the right side of the pixel electrode, wherein if the number of pixel columns to be driven is denoted as m, the switch means has m input terminals and m+1 switch output terminals, and if a k-th input terminal from the left is denoted as $I_k$, k-th and k+1-th switch output terminals from the left are denoted as $O_k$ and $O_{k+1}$, respectively, and k takes each value from 1 to m, the switch means switches, depending on whether a second control signal input to the switch means is at high level or low level, between whether the input terminal $I_k$ is connected to the switch output terminal $O_k$ and whether the input terminal $I_k$ is connected to the switch output terminal $O_{k+1}$;

wherein the number of columns of pixels to be driven is a multiple of 3, and the liquid crystal display device further comprises:

first latch means in which m+1 latch circuits are arranged, each latch circuit having an input terminal for a data reading instruction signal to give an instruction to read a pixel value, a pixel value reading terminal for reading a pixel value for one pixel input when the data reading instruction signal is input to the input terminal, and an output terminal for the pixel value;

a shift register having signal output terminals for a m/3 piece of data reading instruction signal and configured to output the data reading instruction signal sequentially from each of the signal output terminals;

output of shift register switching means which, if an i-th signal output terminal from the left in the shift register is denoted as $C_i$ and i takes each value from 1 to m/3, connects the signal output terminal $C_i$ with input terminals of 3·i−2-th, 3·i−1-th and 3·i-th latch circuits of the first latch means when the second control signal is at high level, or connects the signal output terminal $C_i$ with input terminals of 3·i−1-th, 3·i-th and 3·i+1-th latch circuits of the first latch means when the second control signal is at low level;

second latch means for reading pixel values of m pixels for one row collectively from the first latch means, and outputting data corresponding to each pixel value;

level shifting means having m+1 data input terminals and m+1 data output terminals and configured to shift levels of data input from the data input terminals and output the data from the data output terminals; and a voltage follower having m+1 potential input terminals and m+1 potential output terminals and configured to output, from the potential output terminals, potentials equal to potentials input from the potential input terminals, wherein the m input terminals of the switch means are connected to data wiring for transferring pixel values for R, data wiring for transferring pixel values for G and data wiring for transferring pixel values for B, the switch output terminals of the switch means are connected to the pixel value reading terminals of the respective latch circuits in the first latch means in a one-to-one relationship, the second latch means has m+1 data reading terminals for reading pixel values from the first latch means and m+1 data output terminals for outputting data corresponding to pixel values of pixels for one row, DA converter has m+1 data input terminals and m+1 potential output terminals, the output terminals of the respective latch circuits in the first latch means are connected to the data reading terminals of the second latch means in a one-to-one relationship, the data output terminals of the second latch means are connected to the data input terminals of the level shifting means in a one-to-one relationship, the data output terminals of the level shifting means are connected to the data input terminals of the DA converter in a one-to-one relationship, the potential output terminals of the DA converter are connected to the potential input terminals of the voltage follower in a one-to-one relationship, the potential output terminals of the voltage follower are connected to the source lines of the liquid crystal display panel, the level of the first control signal is switched alternately on a frame-by-frame basis, the level of the second control signal is switched alternately each time all rows belonging to a group are selected after the second control signal is set to high level upon starting a frame, and the output of shift register switching means and the switch means maintain a state equal to that when the second control signal is at high level until the second control signal is generated in a first frame after power-on.

6. A liquid crystal display device comprising:

an active matrix liquid crystal display panel; and a driving device for driving the liquid crystal display panel, wherein the liquid crystal display panel comprises:

a common electrode;

a plurality of pixel electrodes arranged in a matrix; and source lines provided on a left side of pixel electrodes in each column of pixel electrodes and on a right side of a rightmost column of pixel electrodes, wherein when every row or every two or more consecutive rows of pixel electrodes are set as one group, a pixel electrode in each row of an odd-numbered group is connected to a source line on a predetermined side among source lines existing on both sides of the pixel electrode, and a pixel electrode in each row of an even-numbered group is connected to a source line on a side opposite to the predetermined side among the source lines existing on both sides of the pixel electrode;

the driving device comprises:

a DA converter for inputting each data corresponding to each of pixel values for one row, converting the input data to an analog voltage, and outputting a potential after subjected to conversion, wherein depending on whether a first control signal input to the DA converter is at high level or low level, the DA converter switches between whether a potential higher than a common electrode potential is output from an odd-numbered potential output terminal from the left and a potential lower than the common electrode potential is output from an even-numbered potential output terminal from the left, and whether a potential lower than the common electrode potential is output from the odd-numbered potential output terminal from the left and a potential higher than the common electrode potential is output from the even-numbered potential output terminal from the left; and switch means for switching between whether a potential of a pixel electrode is set using the source line on the left side of the pixel electrode and whether the potential of the pixel electrode is set using the source line on the right side of the pixel electrode, wherein if the number of pixel columns to be driven is denoted as m, the switch means has m input terminals and m+1 switch output terminals, and if a k-th input terminal from the left is denoted as $I_k$, k-th and k+1-th switch output terminals from the left are denoted as $O_k$ and $O_{k+1}$, respectively, and k takes each value from 1 to m, the switch means switches, depending on whether a second control signal input to the switch means is at high level or low level, between whether the input terminal $I_k$ is connected to the switch output terminal $O_k$ and whether the input terminal $I_k$ is connected to the switch output terminal $O_{k+1}$;

the liquid crystal display device further comprising:

first latch means having m+1 input terminals for a data reading instruction signal to give an instruction to read a pixel value, and configured such that, when the data reading instruction signal is input, the first latch means reads and holds a pixel value for one pixel corresponding to an input terminal to which the data reading instruction signal is input;

a shift register having m signal output terminals for the data reading instruction signal and configured to output the data reading instruction signal sequentially from each signal output terminal;

second latch means for reading pixel values of m pixels for one row collectively from the first latch means, and outputting data corresponding to each pixel value;

level shifting means having m+1 data input terminals and m+1data output terminals and configured to shift levels of data input from the data input terminals and outputting the data from the data output terminals; and a voltage follower having m+1 potential input terminals and m+1 potential output terminals and configured to output, from the potential output terminals, potentials equal to potentials input from the potential input terminals, wherein the first latch means has m+1 pixel value output terminals for causing the second latch means to read pixel values, the second latch means has m+1 data reading terminals for reading pixel values from the first latch means and m+1 data output terminals for outputting data corresponding to pixel values of pixels for one row, the DA converter has m+1 data input terminals and m+1 potential output terminals, the signal output terminals of the shift register are connected to the input terminals of the switch means in a one-to-one relationship, the switch output terminals of the switch means are connected to the input terminals of the first latch means in a one-to-one relationship, the pixel value output terminals of the first latch means are connected to the data reading terminals of the second latch means in a one-to-one relationship, the data output terminals of the second latch means are connected to the data input terminals of the level shifting means in a one-to-one relationship, the data output terminals of the level shifting means are connected to the data input terminals of the DA converter in a one-to-one relationship, the potential output terminals of the DA converter are connected to the potential input terminals of the voltage follower in a one-to-one relationship, the potential output terminals of the voltage follower are connected to the source lines of the liquid crystal display panel, the level of the first control signal is switched alternately on a frame-by-frame basis, the level of the second control signal is switched alternately each time all rows belonging to a group are selected after the second control signal is set to high level upon starting a frame, and the switch means maintains a state equal to that when the second control signal is at high level until the second control signal is generated in a first frame after power-on.

7. A driving device for a liquid crystal display panel including a common electrode, a plurality of pixel electrodes arranged in a matrix, and source lines provided on a left side of pixel electrodes in each column of pixel electrodes and on a right side of a rightmost column of pixel electrodes, wherein when every row or every two or more consecutive rows of pixel electrodes are set as one group, a pixel electrode in each row of an odd-numbered group is connected to a source line on a predetermined side among source lines existing on both sides of the pixel electrode, and a pixel electrode in each row of an even-numbered group is connected to a source line on a side opposite to the predetermined side among the source lines existing on both sides of the pixel electrode, the driving device comprising:

a DA converter for inputting each data corresponding to each of pixel values for one row, converting the input data to an analog voltage, and outputting a potential after subjected to conversion, wherein depending on whether a first control signal input to the DA converter is at high level or low level, the DA converter switches between whether a potential higher than a common electrode potential is output from an odd-numbered potential output terminal from the left and a potential lower than the common electrode potential is output from an even-numbered potential output terminal from the left, and whether a potential lower than the common electrode potential is output from the odd-numbered potential output terminal from the left and a potential higher than the common electrode potential is output from the even-numbered potential output terminal from the left; and switch means for switching between whether a potential of a pixel electrode is set using the source line on the left side of the pixel electrode and whether the potential of the pixel electrode is set using the source line on the right side of the pixel electrode, wherein if the number of pixel columns to be driven is denoted as m, the switch means has m input terminals and m+1 switch output terminals, and if a k-th input terminal from the left is denoted as $I_k$, k-th and k+1-th switch output terminals from the left are denoted as $O_k$ and $O_{k+1}$, respectively, and k takes each value from 1 to m, the switch means switches, depending on whether a second control signal input to the switch means is at high level or low level, between whether the input terminal $I_k$ is connected to the switch output terminal $O_k$ and whether the input terminal $I_k$ is connected to the switch output terminal Ok+1;

the driving device further comprising a voltage follower, wherein depending on whether the second control signal is at high level or low level, output from a leftmost potential output terminal of the voltage follower is put into a high impedance state or output from a rightmost potential output terminal of the voltage follower is put into the high impedance state.

* * * * *